US008048010B2

(12) United States Patent
Ohashi et al.

(10) Patent No.: US 8,048,010 B2
(45) Date of Patent: Nov. 1, 2011

(54) MASSAGE NOZZLE AND MASSAGE DEVICE

(75) Inventors: Takahiro Ohashi, Fukuoka-ken (JP); Nobuhiro Shono, Fukuoka-ken (JP); Koichi Toyoda, Fukuoka-ken (JP); Tomoko Negishi, Fukuoka-ken (JP)

(73) Assignee: Toto, Ltd., Fukuoka (JP)

( * ) Notice: Subject to any disclaimer, the term of this patent is extended or adjusted under 35 U.S.C. 154(b) by 1107 days.

(21) Appl. No.: 10/588,230

(22) PCT Filed: Jan. 14, 2005

(86) PCT No.: PCT/JP2005/000330

§ 371 (c)(1),
(2), (4) Date: Mar. 28, 2007

(87) PCT Pub. No.: WO2005/074856

PCT Pub. Date: Aug. 18, 2005

(65) Prior Publication Data

US 2007/0173751 A1 Jul. 26, 2007

(30) Foreign Application Priority Data

| | | |
|---|---|---|
| Feb. 3, 2004 | (JP) | 2004-027070 |
| Feb. 3, 2004 | (JP) | 2004-027071 |
| Mar. 25, 2004 | (JP) | 2004-090622 |
| Mar. 25, 2004 | (JP) | 2004-090623 |

(51) Int. Cl.

| | |
|---|---|
| ***A61H 9/00*** | (2006.01) |
| ***A61H 7/00*** | (2006.01) |
| ***A61H 19/00*** | (2006.01) |
| ***A47K 3/00*** | (2006.01) |
| ***B05B 1/34*** | (2006.01) |
| ***A62C 2/08*** | (2006.01) |
| ***A62C 37/08*** | (2006.01) |
| ***B05B 1/14*** | (2006.01) |
| ***E21F 5/04*** | (2006.01) |
| ***F23D 11/38*** | (2006.01) |
| ***F23D 14/48*** | (2006.01) |

(52) U.S. Cl. ..... 601/155; 601/160; 601/169; 4/615; 239/468; 239/548

(58) Field of Classification Search ..... 601/9, 10, 601/154–160, 167, 169; 15/302, 322; 604/289, 604/313, 315; 239/468, 548, 552; 607/80–87; 4/541.6, 615

See application file for complete search history.

(56) References Cited

U.S. PATENT DOCUMENTS 1,038,656 A * 9/1912 Rueter ..... 601/75

(Continued)

FOREIGN PATENT DOCUMENTS

CN 2492318 5/2002

(Continued)

OTHER PUBLICATIONS

Notification of Reason for Refusal dispatched Feb. 6, 2008 in Japanese Application No. 2004-090623 and English translation thereof.

(Continued)

*Primary Examiner* — Justine Yu
*Assistant Examiner* — Kristen C Matter
(74) *Attorney, Agent, or Firm* — Banner & Witcoff, Ltd.

(57) ABSTRACT

A massage nozzle is disclosed including a vortex chamber having a water intake section provided to form a vortical flow therein, a spouting port provided to spout the vortical flow to form a negative pressure region, a water-spray plate provided at a distal end of the spouting port, the water-spray plate having an opening at a center thereof and a plurality of water-spray holes around the opening. The water-spray plate allows a large area suction and smooth movement while moving in contact with the skin. Further a movable member having an opening may be provided with at least a part inserted into the vortex chamber. Some part of a first portion of the movable member has a larger outside dimension than the spouting port, allowing physical vibration of the movable member in addition to the suction massage effect.

19 Claims, 114 Drawing Sheets

U.S. PATENT DOCUMENTS

| | | | | | |
|---|---|---|---|---|---|
| 4,422,191 | A | * | 12/1983 | Jaworski | 4/496 |
| 5,054,474 | A | * | 10/1991 | Jacob et al. | 601/160 |
| 5,070,864 | A | * | 12/1991 | Lemons | 601/160 |
| 5,143,295 | A | * | 9/1992 | Okayama et al. | 239/403 |
| 5,187,827 | A | * | 2/1993 | Wei | 15/22.1 |
| 5,230,106 | A | * | 7/1993 | Henkin et al. | 4/541.4 |
| 7,578,808 | B2 | * | 8/2009 | Fujisato | 604/289 |

FOREIGN PATENT DOCUMENTS

| | | | | |
|---|---|---|---|---|
| JP | 4-55337 | | | 5/1992 |
| JP | 04-104833 | U | | 9/1992 |
| JP | 8-196596 | | | 8/1996 |
| JP | 08-196596 | A | | 8/1996 |
| JP | 09084713 | | * | 3/1997 |
| JP | 2003-38382 | | | 2/2003 |
| JP | 2004-351067 | | | 12/2004 |
| JP | 2004-351067 | A | | 12/2004 |

OTHER PUBLICATIONS

Notification of Reason for Refusal dispatched Feb. 6, 2008 in Japanese Application No. 2004-090622 and English translation thereof.

Office Action received for corresponding Chinese Application No. 2005800078289 dated Sep. 4, 2009.

* cited by examiner (a)

(b)

(c)

(a)

(b)

MASSAGE NOZZLE AND MASSAGE DEVICE

RELATED APPLICATION INFORMATION

This application is a National Stage application of co-pending PCT application PCT/JP2005/000330 filed Jan. 14, 2005, which was published in Japanese under PCT Article 21(2) on Aug. 18, 2005, which claims priority from Japanese patent applications 2004-027070 filed Feb. 3, 2004, 2004-027071 filed Feb. 3, 2004, 2004-090622 filed Mar. 25, 2004 and 2004-090623 filed Mar. 25, 2004. These applications are incorporated herein by reference in their entirety.

TECHNICAL FIELD

Aspects of the present invention relate to a massage nozzle and a massage device and, more particularly, the massage nozzle and massage device to produce negative pressure due to a water vortical flow and enable suction pressure as applied to a human body.

BACKGROUND ART

Massage devices to massage a skin surface of a human body and promote a blood circulation for the purpose of beautification and health enhancement have been widely used. As these conventional massage devices, for example, an electrically-operated shoulder tapping machine, a lumbar kneading machine, a device to let a depressurized suction hole suck a portion of a person's skin and the like are known.

As a massage device using water, one example proposes a massage device provided with an opening to introduce pressurized fluid into a cylindrical body whose one end is closed and the other end is opened in the inner-circumference tangential direction, an opening to introduce outside air into the above-mentioned closed end in the center of the cylindrical body and further, a guide cylinder outside the cylindrical body to suck in the vicinity of a spouting port. Here, a person's skin can be sucked with the negative-pressure region in the vicinity of the spouting port expanded by letting the spouted water flow reversely through the guide cylinder.

In addition, another example discloses a suction washing machine provided with an opened flow-out in a front side of an expanded guide section to let spouted water flow out.

Furthermore, yet another example of a washing machine using the suction effect by the vortical flow discloses a massage washing machine provided with an air-flow separation plate which enable a user to use in the air.

The massage device by using water vortical flow has a problem in that water splashes in all directions from the spouting port. For example, one massage device has a problem in that if using the massage device in the air, the spouted water does not splash so much as long as the guide cylinder is pressed against the skin. However, if the guide cylinder is released from the skin, the spouted water splashes conically in all directions and wets the user, persons around the user, and/or a bathroom's wall in an undesirable manner, causing the user or persons to feel uncomfortable.

Meanwhile, a massage washing machine is provided with an air-water separation plate to prevent water from splashing by separating a spouting section and suction section of vortical flow and applying the vortical flow passed through a passage hole of a one-through plate to a splash-prevention bent section. However, in this massage washing machine, since the spouting section and the suction section are separated, the whole length of the machine has to be designed to be longer, reducing the suction force and preventing a depression or vibration effect due to vortical flow from affecting a skin. In addition, the suction section is smaller than the spouting port so that the area receiving the suction force is smaller. Furthermore, since the suction port is closely stuck to the skin, this brings about a problem in that it is hard to move the main unit of the massage machine.

Meanwhile, as a message method to add to a human body various types of bioeffects such as blood circulation and removal of metabolic decomposition product, and psychological effects such as relaxation and the like, a massage method with physical vibration such as "tapping" or "kneading" is effective as well as the suction massage method to suck and deform a site on the person's skin subject to treatment.

However, the conventional massage devices as described above have emphasized only the suction effect but have not considered the enhancement of massage effect by intentionally generating physical vibration.

SUMMARY

One or more aspects of the present invention proposed to solve the above problems. One example of an aspect of the present invention may provide a massage nozzle and a massage device using its massage nozzle, in which even if releasing in the atmosphere, water does not splash in all directions, suction can be performed in a large area. Even if moving while coming in contact with the skin, smooth movement can be performed.

Another example may provide a massage nozzle and a massage device using its massage nozzle to enable a significant massage effect due to physical vibration in addition to a suction massage effect based on a novel concept.

A first massage nozzle of an illustrative example of the present invention may include a vortex chamber equipped with a water intake section to produce a vortical flow in a chamber and a spouting port to spout the above-mentioned vortical flow to form a negative-pressure region and a water-spray plate. The water-spray plate, which may be provided at the end of the above-mentioned spouting port, has an opening in the center and has also a plurality of water-spray holes around the above-mentioned opening.

The above-mentioned configuration enables suction massage by providing an opening to serve as a suction port and enables water to be spouted in a shower-like manner by adjusting the vortical flow by a water-spray hole, which can prevent spouted water from spraying even if releasing in the atmosphere. In addition, since the water-spray hole having a water-adjustment effect is provided at the end of the spouting port, the vortical flow can be moved closer to a site on the person's skin subject to treatment and a massage effect due to vortical flow can be obtained. Furthermore, since water can be spouted in a shower-like manner from the water-spray hole in an opened condition, this massage device can be used also as a showerhead.

In addition, a second massage nozzle of another illustrative example of the present invention may include a vortex chamber equipped with a water intake section to produce a vortical flow in a chamber and a spouting port to spout the above-mentioned vortical flow to form a negative-pressure region, a semi-cylindrical guide section provided as protruding from the above-mentioned spouting port and a water-spray plate. The water-spray plate, which is provided at the end of the above-mentioned guide section, has an opening in the center and has also a plurality of water-spray holes around the above-mentioned opening.

Also in the above-mentioned configuration, the same effect as the massage nozzle as described above can be obtained by providing the water-spray plate. Furthermore, according to the above-mentioned configuration, providing the guide section can prevent effectively the vortical flow spouted from the spouting port from splashing. Moreover, if the guide section is designed to be detachable, a user-desired suction force, feeling of stimulation, suction area and the like can be arbitrarily selected.

In this case, if the above-mentioned opening is designed to be larger than the above-mentioned spouting port, a suction region can be sufficiently obtained to enhance a massage effect and bioeffect. In addition, the massage nozzle main body can be designed in a compact size to enable a user to handle more easily.

In addition, if the configuration further includes a baffle plate provided at the opposed face to the above-mentioned spouting port of the above-mentioned water-spray plate or the inner-circumference wall of the above-mentioned guide section, the baffle plate will serve as a stator to enhance a flow-adjustment effect much more.

In addition, in the above-mentioned guide section, when half of the difference between the diameter of the above-mentioned spouting port and the diameter of the above-mentioned opening of the above-mentioned water-spray plate is determined as L1, the angle of the water flow to be spouted from the above-mentioned spouting port with the face including the above-mentioned spouting port is determined as θ, if designed to protrude as the length to the above-mentioned water-spray plate viewing from the above-mentioned spouting port is (L1×tan θ) or more, the vortical flow to be spouted from the spouting port will readily collide with the inner-circumference wall or the water-spray plate to maintain a flow-adjustment effect.

In addition, in the above-mentioned second massage nozzle, if a movable member equipped with a semi-discoid-shaped stopper having an opening in the center, a semi-cylindrical ring section substantially perpendicularly protruding from the circumference of the above-mentioned opening of the above-mentioned stopper to the above-mentioned stopper, is movably provided in the above-mentioned guide section, it is possible to enhance both the splash-prevention effect and the suction massage effect according to the position of the movable member.

In addition, in the above-mentioned guide section, when half of the difference between the diameter of the above-mentioned spouting port and the diameter of the above-mentioned opening of the above-mentioned stopper is determined as L2, the angle of the water flow to be spouted from the above-mentioned spouting port to the face including the above-mentioned spouting port is determined as θ, if designed to protrude as the length to the above-mentioned water-spray plate viewing from the above-mentioned spouting port in an opened spouting condition is (L2×tan θ) or more, the vortical flow to be spouted from the spouting port will readily collide with the inner-circumference wall, the water-spray plate or the movable member to maintain a flow-adjustment effect.

Meanwhile, in the above-mentioned first massage nozzle, if a movable member equipped with a semi-discoid-shaped stopper having an opening in the center, a semi-cylindrical ring section semi-perpendicularly protruding from the circumference of the above-mentioned opening of the above-mentioned stopper to the above-mentioned stopper, is movably provided in the above-mentioned vortex chamber, it is possible to enhance both the splash-prevention effect and the suction massage effect according to the position of the movable member.

In this case, if the maximum outside dimension of the above-mentioned stopper is designed to be larger than the above-mentioned opening of the above-mentioned guide section, it is unlikely that the movable member will pass through the water-spray plate to enable a user to more easily handle.

In addition, if the above-mentioned ring section is provided as possible to protrude from the above-mentioned opening of the above-mentioned water-spray plate, the protruding height of the ring section can be changed easily by applying the ring section to the site on the person's skin subject to treatment, conditions suitable for splash-prevention or suction massage can be arbitrarily changed to use.

In addition, the above-mentioned water-spray plate further includes a circumferential protrusion section protruding from the circumference of the above-mentioned opening of the above-mentioned water-spray plate to the above-mentioned spouting port, when the water-spray plate does not come in contact with the site on the person's skin subject to treatment, a vortical flow can be prevented from overflowing from the opening of the water-spray plate to enhance a flow-adjustment. Meanwhile, when the water-spray plate comes in contact with the site on the person's skin subject to treatment, a vortical flow can overflow beyond this circumferential protrusion section, a massage effect due to "twisting" or "vibration" by the vortical flow can be obtained.

In addition, a third massage nozzle of a third illustrative example of the present invention may include a vortex chamber having a water intake section provided to form vortical flow therein and a spouting port provided to spout the above-mentioned vortical flow to form a negative pressure region; and a movable member having an opening, at least some part of which is inserted into the vortex chamber, the opening being provided to effect the above-mentioned negative region externally, the above-mentioned some part including a first portion which has a larger outside dimension than the above-mentioned spouting port.

The negative-pressure region formed by the vortical flow can readily affect a site on the person's skin subject to treatment of a human body by providing a movable member with a through-hole. In addition, physical vibration can be added to the site on the person's skin subject to treatment by rotating of the movable member in an eccentric or inclined condition by effect due to the vortical flow. That is, collisional stimulation is provided by collision of the movable member with the site on the person's skin subject to treatment and vibration-like stimulation is provided by rotation of the movable member. Particularly, a "kneading relax effect" remarkably increases by rotation of the movable member around the circumference while providing collisional stimulation to the site on the person's skin subject to treatment which is sucked into the massage nozzle. This effect is the same as many subjects actually felt in the sensory evaluation conducted by the inventor of the present invention. As a result, the suction effect due to the vortical flow and the massage effect due to vibration synergistically generate a highly-effective beautification effect and various bioeffects. In addition, designing the movable member with at least some part having an outside dimension which is larger than that of the spouting port can prevent the movable member from passing through the vortex chamber and provide an easy-to-handle and an operational-highly-reliable massage nozzle.

If the above-mentioned movable member has a section externally protruding from the above-mentioned spouting port in a condition that the above-mentioned first portion abuts the vortex chamber inner wall in the vicinity of the above-mentioned spouting port, applying the movable member to the site on the person's skin subject to treatment causes the movable member to become unbalanced so as to bring about precession movement and similar movement easily. At this time, since the movable member is pressed against the site on the person's skin subject to treatment due to a spouted water flow, a vibration massage effect due to shaking can be much more readily obtained. In addition, protruding the movable member enables the vibration stroke to become larger at the section abutting the site.

If the above-mentioned section externally protruding has a second portion, which has a larger outside dimension than the above-mentioned spouting port, this can prevent the movable member from sinking into the vortex chamber and can readily provide a highly-effective vibration effect.

A fourth massage nozzle of a fourth illustrative example of the present invention includes a vortex chamber having a water intake section provided to form a vortical flow therein and a spouting port provided to spout the above-mentioned vortical flow to form a negative pressure region; a guide section in a semi-cylindrical shape protruding further with respect to the above-mentioned spouting port and having an inside diameter larger than that of the above-mentioned spouting port; a protrusion section protruding from an inner wall of the above-mentioned guide section toward a rotation axis of the above-mentioned vortical flow; and a movable member having an opening, at least some of the moveable member being inserted into the above-mentioned guide section, the opening being provided to effect the above-mentioned negative region externally, the above-mentioned some part having a stopper capable of abutting the above-mentioned protrusion section.

According to the present massage nozzle, providing a movable member having a through-hole enables a negative region formed by a vortical flow affect a site on the person's skin subject to treatment of a human body. In addition, the precession movement and the similar movements of the movable member due to the effect of vortical flow can provide physical vibration to the site on the person's skin subject to treatment of the human body. As a result, the suction effect due to vortical flow and massage effect synergistically generate a highly-effective beautification effect and various bioeffects.

In addition, providing a guide section having an inside diameter which is larger than that of the spouting port expands a suction area to a site on the person's skin subject to treatment of a human body, enabling more effective suction vibration massage. At the same time, the massage nozzle main body can be designed in a compact size so easy to be handled. In addition, setting an amplitude of movable member operation to be larger can enhance the "kneading relax effect" and the like. Furthermore, it is possible to set a movable member's inclination angle, moving range, motion cycle and the like to the predetermined range and to obtain a favorable vibration effect without preventing a vortical flow from being formed. In addition, letting the stopper of the movable member abut on the protrusion section of the guide section can prevent the movable member from passing through the guide section and can provide an easy-to-handle and operational highly reliable massage nozzle.

In this case, the above-mentioned protrusion section is provided in a substantially annular fashion and has a plurality of water-spray holes and the central axis of the above-mentioned movable member can be designed to be inclinable to the central axis of the above-mentioned vortex chamber. Providing the protrusion section in a semi-circular manner enables the movable member to rotate more smoothly. In addition, providing water-spray holes enables water to be spouted in a shower-like manner in an opened spouting condition due to the flow-adjustment effect with the water-spray hole, and prevents spouted water from splashing. The movable member provides a vibration-like feeling of stimulation due to the "procession movement" of the movable member and the similar movements.

If the above-mentioned movable member has a section externally protruding from the above-mentioned guide section in a condition that the above-mentioned stopper abuts the above-mentioned protrusion section, applying the movable member to the site on the person's skin subject to treatment causes the movable member to be unbalanced to bring about precession movement and similar movements easily. At this time, since the movable member is pressed against the site on the person's skin subject to treatment due to a spouted water flow, a vibration massage effect due to shaking can be readily obtained. In addition, protruding the movable member enables the vibration stroke to become larger at the section abutting the site.

Meanwhile, a fifth massage nozzle of a fifth illustrative example the present invention includes a vortex chamber having a water intake section provided to form a vortical flow therein and a spouting port provided to spout the above-mentioned vortical flow to form a negative pressure region; a plurality of protrusions provided around the above-mentioned spouting port and protruding from the above-mentioned spouting port; a protrusion section protruding from each of the above-mentioned protrusions toward a rotation axis of the above-mentioned vortical flow; and a movable member having an opening, at least some part of which is inserted into between the above-mentioned plurality of protrusions and the above-mentioned spouting port, the opening being provided to effect the above-mentioned negative region externally, the above-mentioned some part having a stopper capable of abutting the above-mentioned protrusion section.

According to this massage nozzle, the negative-pressure region formed by the vortical flow can readily affect a site on the person's skin subject to treatment of a human body by providing a movable member with a through-hole. In addition, the precession movement and the similar movements of the movable member due to the effect of the vortical flow can provide physical vibration to the site on the person's skin subject to treatment of the human body. As a result, the suction effect due to vortical flow and massage effect synergistically generate a highly-effective beautification effect and various bioeffects. In addition, a plurality of protrusions comes in contact with the site on the person's skin subject to treatment of the human body to provide a depressing massage effect. Furthermore, letting the stopper of the movable member abut on the protrusion section can prevent the movable member from passing the protrusion and provide an easy-to-handle and operational highly reliable massage nozzle.

If the above-mentioned movable member has a part externally protruding from a plurality of protrusions in a condition that the above-mentioned stopper abuts the above-mentioned protrusion section, applying the movable member to the site on the person's skin subject to treatment causes the movable member to be unbalanced to bring about precession movement and similar movements easily. At this time, since the movable member is pressed against the site on the person's skin subject to treatment by the spouted water flow, a vibration massage effect due to shaking can be readily obtained. In addition, protruding the movable member enables the vibration stroke to become larger at the section abutting the site.

In addition, if the above-mentioned movable member includes a semi-cylindrical ring section having the above-mentioned opening inside and a stopper protruding from an outer circumferential wall of the above-mentioned ring section, this can provide a reliable vibration effect to the ring section and maintain the reliability of the operation by the stopper.

Meanwhile, a massage device includes a water supply means and a massage nozzle according to any one of above massage nozzles, wherein water is supplied from the above-mentioned water supply means to the above-mentioned vortex chamber through the above-mentioned water intake section so that a suction massage can be practiced by a user utilizing a negative pressure region formed in the above-mentioned spouting port of the above-mentioned massage nozzle.

According to the above-mentioned configuration, when the water-spray plate does not come in contact with the site on the person's skin subject to treatment, spouted water is prevented from splashing and the nozzle can be used as a shower. In addition, one or more aspects of the present invention may provide a massage device which can be moved smoothly widely through multiple sites of a human body during suction massage.

In addition, according to the above-mentioned configuration, a massage effect due to physical vibration can be generated synergistically in addition to the suction effect. Therefore, one or more aspects of the present invention can provide also a massage device enabling very highly effective massage.

BRIEF DESCRIPTION OF THE DRAWINGS

FIG. 80 is a perspective view showing the movable member according to an embodiment of the present invention, which the massage nozzle is provided with.

DESCRIPTION OF THE NUMERALS

| | |
|---|---|
| 1 | massage nozzle |
| 1A | massage nozzle |
| 1B | massage nozzle |
| 2 | vortex section |
| 2c | slip stopper |
| 4 | connection |
| 5 | introduction route |
| 6 | water intake section |
| 6A | water intake route |
| 6B | water intake opening |
| 7 | spouting port |
| 8 | vortex chamber |
| 8W | circumferential wall |
| 9 | flange |
| 10 | guide section |
| 10W | inner-circumference wall |
| 12 | water-spray plate |
| 12a, 12L | water-spray holes |
| 12b | opening |
| 13 | protrusion section |
| 14 | baffle plate |
| 16 | claw section |
| 18 | spring |
| 20 | movable member |
| 20a | ring section |
| 20b | opening |
| 20c | stopper |
| 20d | rib |
| 20e | stopper |
| 20f | side face opening |
| 20g | support shaft |
| 20h | protrusion |
| 20i | impeller |
| 20j | notch |
| 20k | water-discharging hole |
| 20m | supplemental opening |
| 20z | central axis |
| 30 | flexible hose |
| 50 | water-supply means |
| 60 | water piping |
| 70 | housing |
| 72 | power switch |
| 74 | flow rate adjustment valve |
| 76 | water-intake port |
| 78 | Pick-up hole |
| 80 | power cord |
| 100 | bathtub |
| 110 | hot water |
| 120 | nozzle storage section |
| 130 | blow flow exhaust port |
| 140 | change-over valve |
| 152 | water-intake piping |
| 154 | nozzle piping |
| 156 | blow flow exhaust piping |
| 170 | air-intake opening/closing cock |
| 200 | user |
| 210 | site on the person's skin subject to treatment |
| 300 | pressure-reception plate |
| 300a | small hole |
| 400 | supply section |
| CF | vortical flow |
| F | vortical suction force |
| Z | rotation axis |

DESCRIPTION OF THE PREFERRED EMBODIMENTS

The details of various aspects of the present invention are hereinafter described with reference to the accompanying drawings.

First Embodiment

First, as a first embodiment of the present invention, a massage nozzle having a water-spray plate equipped with a plurality of water-spray holes is hereinafter described.

Figure 1:
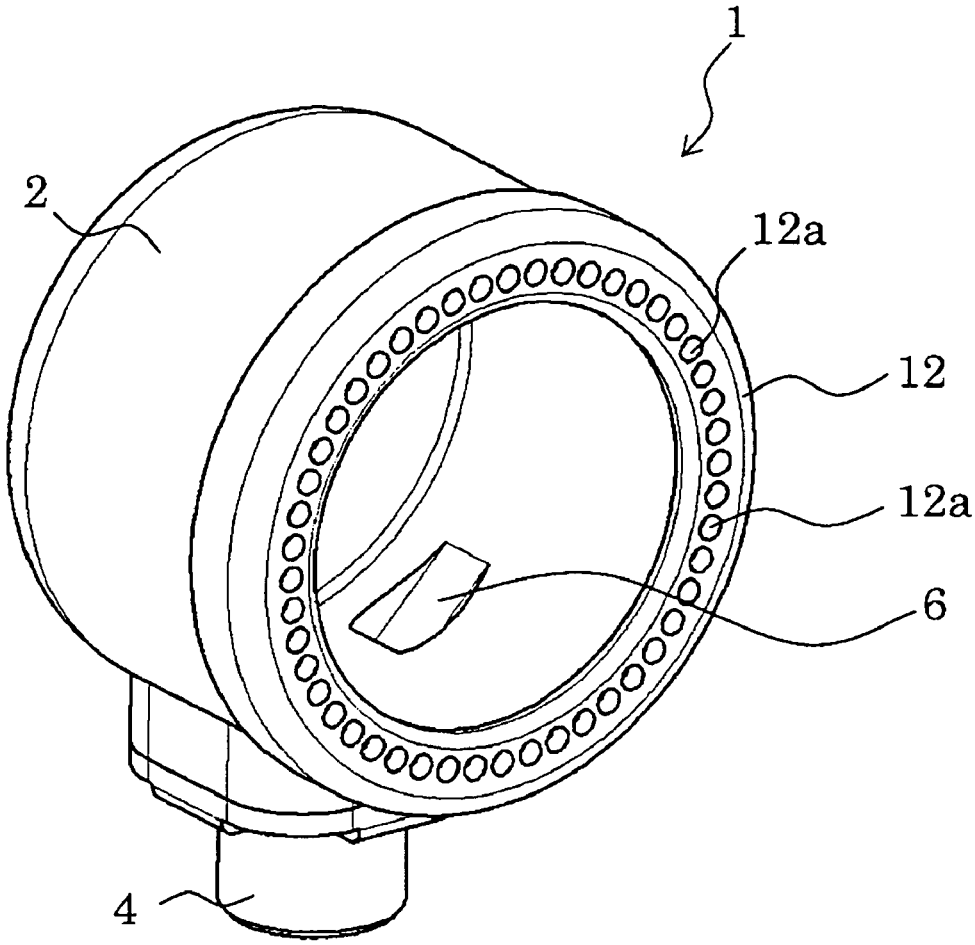
FIG. 1 is a perspective view showing a massage nozzle 1 according to an embodiment of the present invention.
Figure 2:
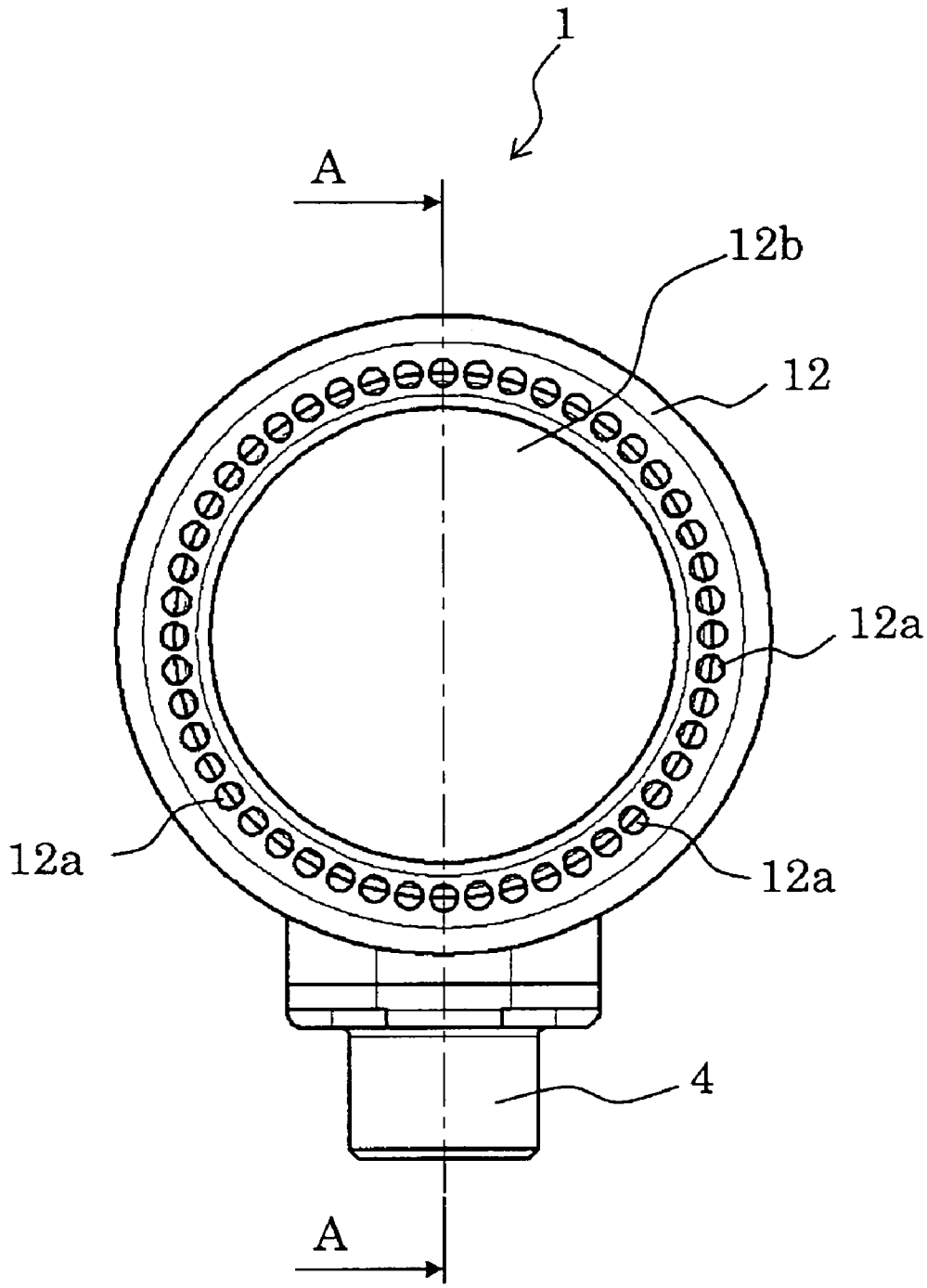
FIG. 2 is a front view showing a massage nozzle 1 according to an embodiment of the present invention.
Figure 3:
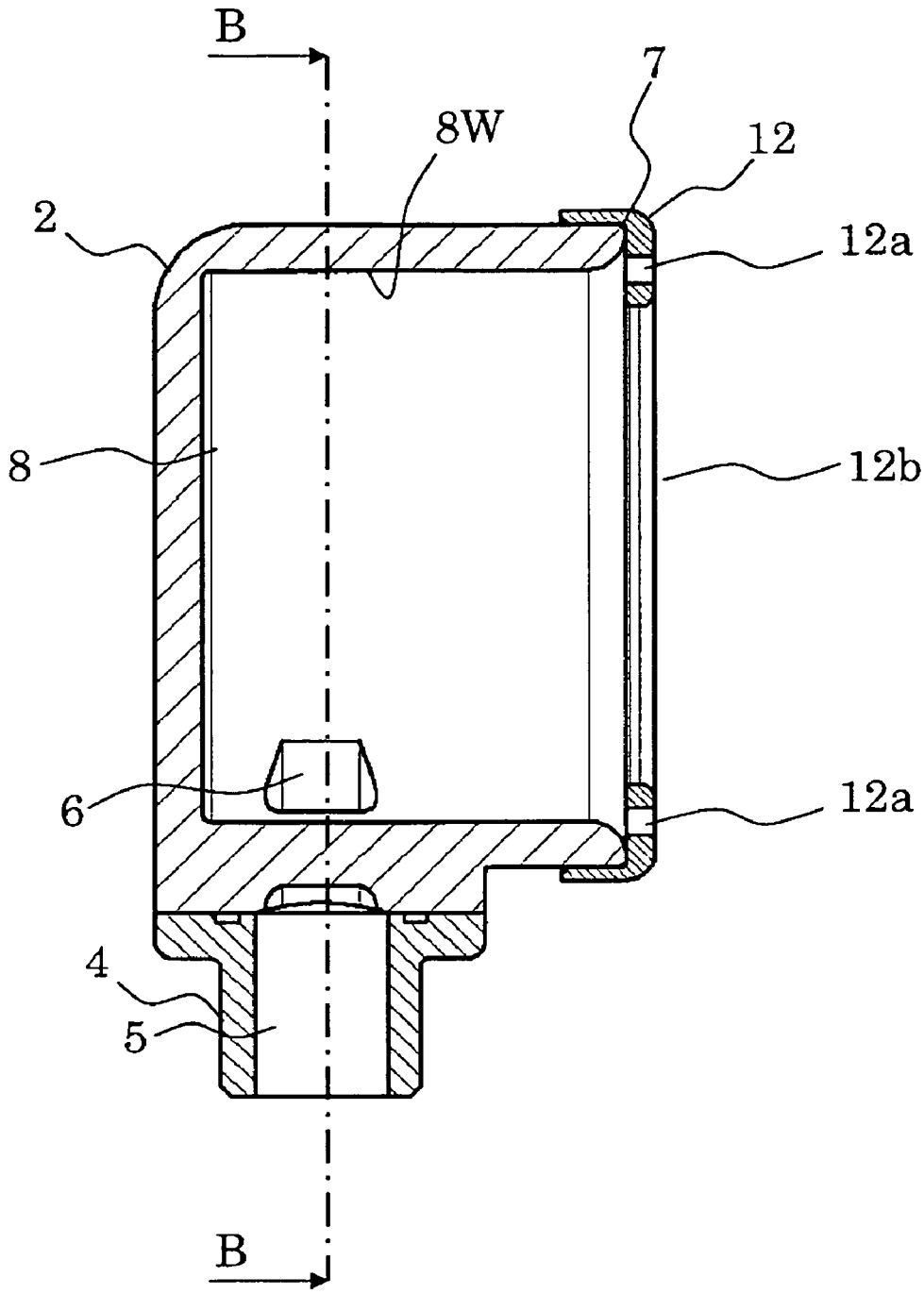
FIG. 3 is an A-A line sectional view of FIG. 2.
Figure 4:
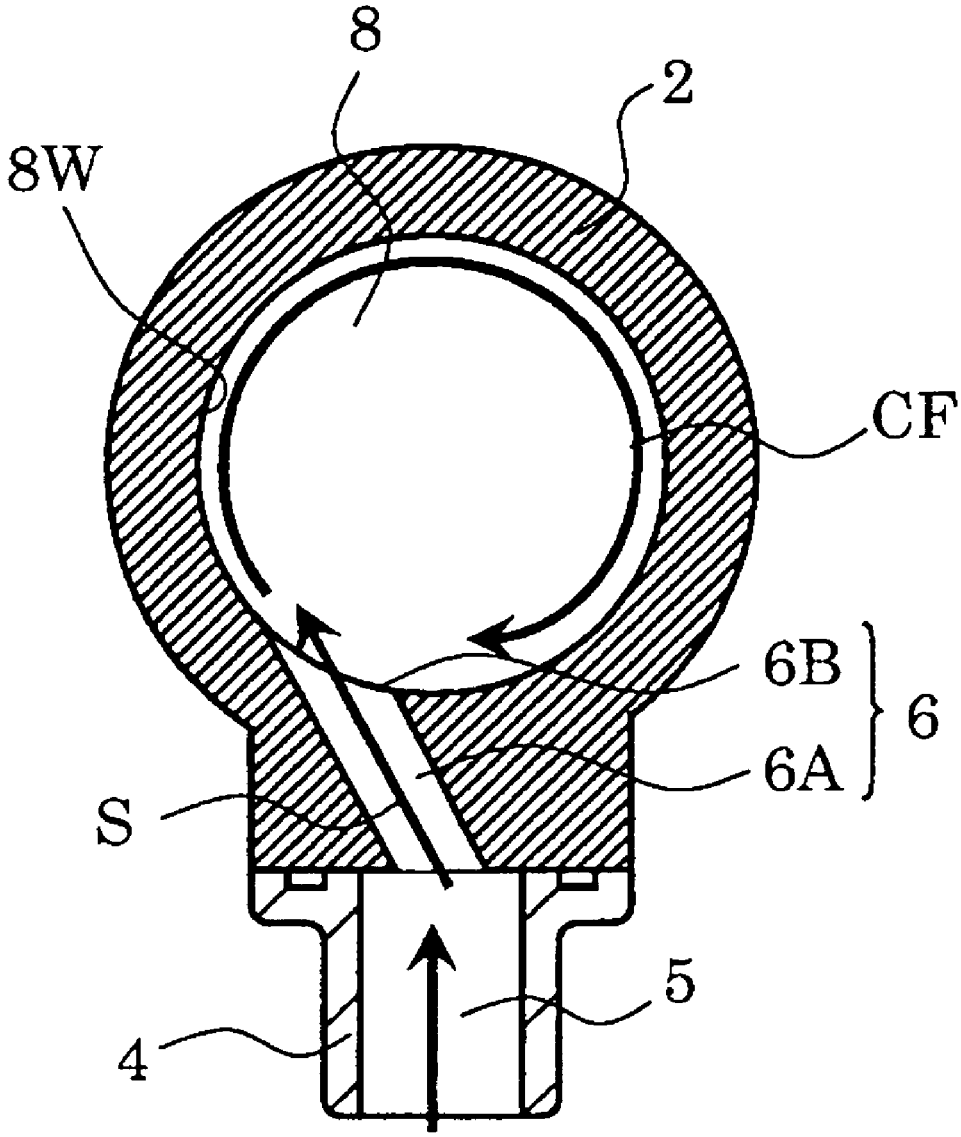
FIG. 4 is a B-B line end view of FIG. 3.

FIG. 1 to FIG. 4 are schematic views showing the massage nozzle according to an embodiment of the present invention. That is, FIG. 1 is a perspective view of the massage nozzle 1. FIG. 2 is a front view, FIG. 3 is an A-A line sectional view of FIG. 2 and FIG. 4 is a B-B line end view of FIG. 3.

The massage nozzle 1 according the present embodiment has a vortex section 2 and a connection 4. The vortex section 2 has a vortex chamber 8 which is surrounded by a circumferential wall 8W and whose section is semi-circular. One end of the vortex chamber 8 is opened and forms a spouting port 7.

The circumferential wall 8W is provided with a water intake section 6. In a substantially tangential direction from the water intake section 6 to the circumferential wall 8W of the vortex chamber 8, water is introduced and a vortical flow CF along the circumferential wall 8W is formed. A connection 4 is provided with an introduction route 5 opened as connecting to the water intake section 6.

Meanwhile, an end of a spouting port 7 is provided with a water-spray plate 12. The water-spray plate 12 is provided with an opening 12*b* in the center and a plurality of water-spray holes 12*a* are provided around the opening 12*b*.

In order to form the vortical flow CF efficiently in the vortex chamber 8, it is preferable that the water intake section 6 is opened in the tangential direction to the circumferential wall 8W of the vortex chamber. However, even when the water intake section 6 is not opened accurately in the tangential direction and there is some misalignment in the opening direction and position with the tangential direction, the vortical flow CF has only to be formed.

In this case, the "water intake section 6" as shown in FIG. 4, includes a water intake route 6A to virtually determine the introduction direction of water flow to be introduced into the vortex chamber 8 and a water intake opening 6B as an opened end in the vortex chamber 8 of the water intake route 6A. In case of the massage nozzle 1 of the present specific example, the introduction direction of the water flow to be introduced into the vortex chamber 8 is an arrow mark S direction. Accordingly, the water intake route 6A corresponds to a way provided in the arrow mark S direction. In addition, a water intake opening 6B corresponds to the boundary between this waterway and the vortex chamber 8.

If the connection 4 is threaded like a general showerhead, it is convenient to connect to water piping such as a hose and the like.

Meanwhile the section between the vortex section 2 and the water-spray plate 12 may be designed to be detachable. If the section between the vortex section 2 and the water-spray plate 12 is designed to be detachable, it is possible to replace the water-spray plate 12 arbitrarily as desired by a user and select a desired suction area and feel of stimulation such as a twisting vibration as described below in detail. In addition, it becomes easier to attach/detach and replace a movable member 20 (not illustrated) described below in detail.

As a mechanism for attachment/detachment of the water-spray plate 12, for example, various types of mechanism such as a screw fitting, fitting mechanism between L-shaped groove and protrusion and the like can be arbitrarily used. However, in order to prevent detachment and/or looseness due to the vortical flow, it is preferable that a mechanism fixes (tightens) the water-spray plate in the same direction of that of the vortical flow.

Since it is only natural that a general user turns clockwise to tighten, the water intake section 6 is preferably provided so that the vortical flow is turned clockwise. Thus, it is easy to attach/detach and can prevent inadvertent detachment due to the vortical flow.

Figure 5:
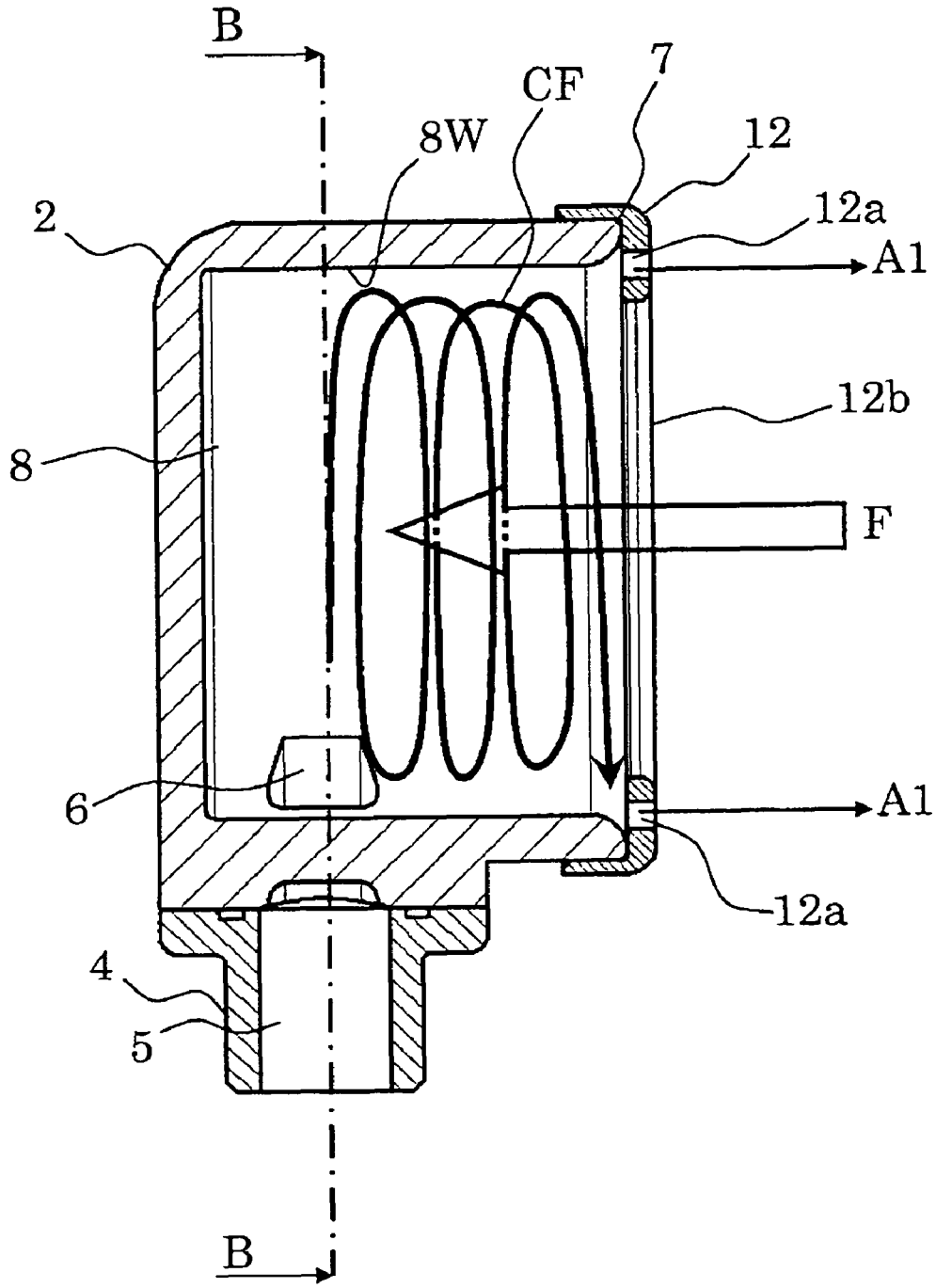
FIG. 5 is a schematic sectional view showing a condition in which water is supplied to the massage nozzle 1 according to an embodiment of the present invention.
Figure 6:
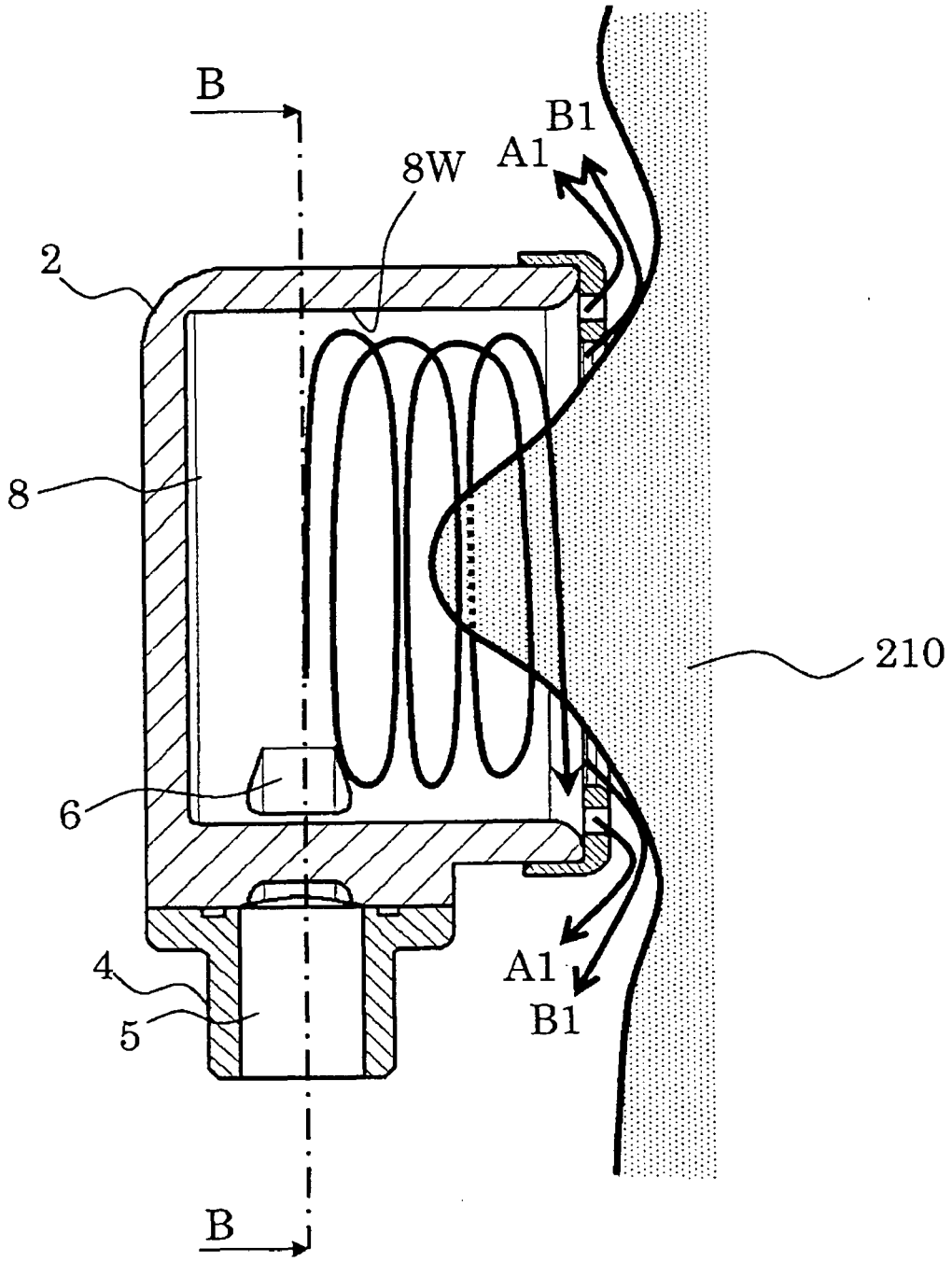
FIG. 6 is a schematic sectional view showing a condition in which massage is performed by the massage nozzle 1 according to an embodiment of the present invention.

FIG. 5 is a schematic sectional view showing a condition in which water is supplied to the massage nozzle 1 according to an embodiment of the present invention. In addition, FIG. 6 is a schematic sectional view showing a condition in which massage is performed by the massage nozzle 1 according to an embodiment of the present invention.

The water fed by a water-supply means which is not illustrated, passes through an introduction route 5 in the connection 4 and is introduced into the vortex chamber 8 from the water intake section 6 in the vortex section 2. At this time, as the water intake section 6 is opened in the tangential direction to the vortex chamber 8, the water introduced into the vortex chamber 8 forms the vortical flow CF. This vortical flow CF reaches a spouting port 7 while rotating along the circumferential wall 8W and finally reaches the water-spray plate 12.

At this time, a centrifugal force with the vortical flow CF produces a negative-pressure region around the center of the vortex chamber 8, therefore, a force to pull into the vortex chamber 8 from the outside of the massage nozzle 1 along the central axis of the opening 12*b* of the water-spray plate 12 (hereinafter referred to as "vortical suction force") is generated.

Meanwhile, the vortical flow reaching the water-spray plate 12 is spouted forward from the water-spray holes 12*a* as indicated by the arrow mark A1 in FIG. 5. That is, a vortical component included in the vortical flow CF is suppressed and a bundled spouted water flow can be obtained as a general shower. Accordingly, for example, when the massage nozzle 1 is used in water of a bathtub, even if the massage nozzle 1 is released inadvertently in the atmosphere, the problem in which vortical spouted water splashes in all directions can be solved. In addition, this massage nozzle 1 can be used as a general showerhead when suction massage is not performed, providing users with a convenient use style.

Next, the massage conditions are described hereinafter. As shown in FIG. 6, slightly applying the massage nozzle 1 provides a site on the person's skin subject to treatment 210 of a user with the vortical suction force F generated from the vortical flow CF. As a result, it lets a suction force efficiently affect the site on the person's skin subject to treatment 210 to obtain a highly-effective suction massage effect.

Meanwhile, a uniform water flow A1 spouted from the water-spray holes 12*a* is formed between the site on the person's skin subject to treatment 210 and the water-spray plate 12. In addition, if the water amount of the vortical flow CF exceeds the water amount spouted from the water-spray holes 12*a*, a water flow B1 overflowed from the opening 12*b* forms a water film.

The site on the person's skin subject to treatment 210 is depressed in a doughnut-shaped manner due to the water film formed by these water flows A1 and B1; the central section is sucked into the opening 12*b* by intensive vortical suction force F and is deformed three-dimensionally to undergo effective suction massage. That is, the site on the person's skin subject to treatment 210 undergoes depression force at the periphery and intensive suction force in the center at the same time. In addition, the water flow A1 and water flow B1 provides the site on the person's skin subject to treatment 210 with vibration. The site on the person's skin subject to treatment 210 is deformed three-dimensionally by the above-mentioned actions and undergoes "kneading relax effect" due to vibration.

In addition, since the water film formed by the water flow A1 and B1 always exist between the water-spray plate 12 and the site on the person's skin subject to treatment 210, the massage nozzle 1 can be smoothly moved while applying the massage nozzle 1 to the site on the person's skin subject to treatment 210 undergoing suction massage, enabling the site on the person's skin subject to treatment 210 to undergo suction massage widely.

In this case, if the ratio of the area of the opening 12*b* to the spouting port 7 is designed to be smaller, it becomes easier to relatively increase the spouting amount from the water-spray holes 12*a* provided around the opening 12*b*. That is, it enables the ratio of water to be spouted in a shower-like manner from the water-spray holes 12*a* to increase and the ratio of water overflowed from the opening 12*b* to decrease. As a result, it becomes easier to increase the bundling degree of water to be spouted from the massage nozzle 1.

Figure 7:
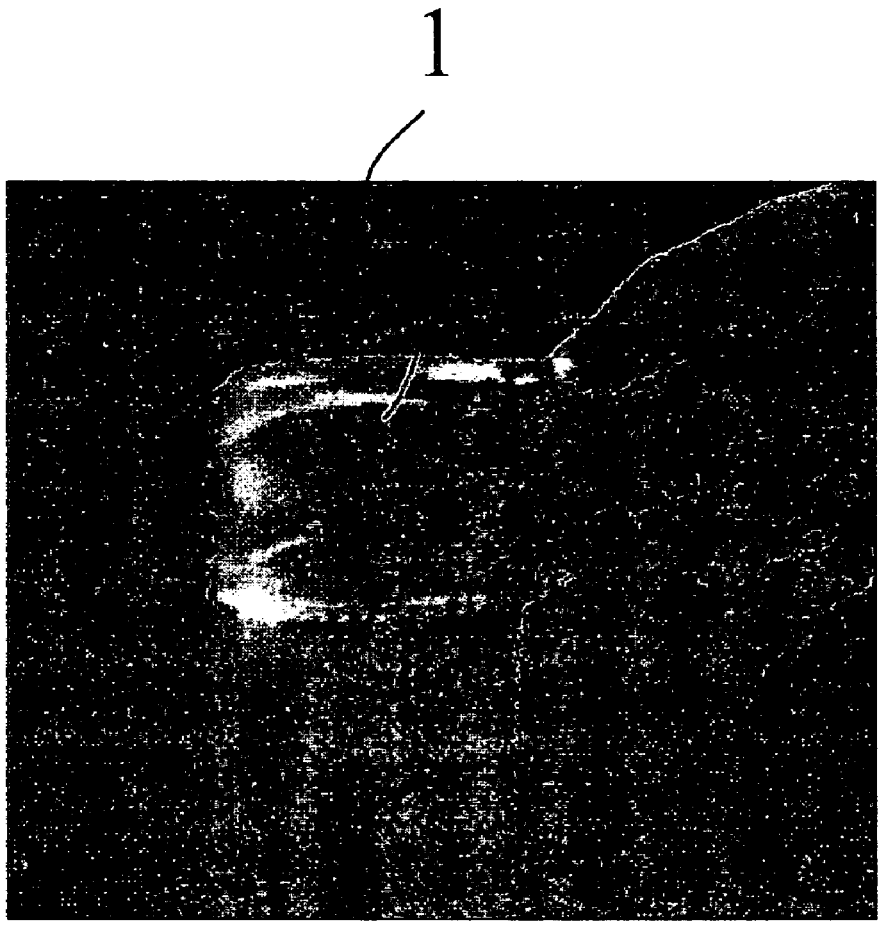
FIG. 7 is a photo showing the results of a water-spray test using a massage nozzle prototyped by the inventor of the present invention.

FIG. 7 is a photo showing the results of a water-spray test using a massage nozzle prototyped by the inventor of the present invention. The configuration parameters and operation conditions of the massage nozzle 1 described above are as follows:

| | |
|---|---|
| Inside diameter of vortex chamber 8: | 60 mmϕ |
| Length of vortex chamber 8: | 45 mm |
| Size of water intake section 6 | 42 $mm^2$ |
| Diameter of spouting port 7: | 60 mmϕ |
| Thickness of water-spray plate 12 : | 3 mm |
| Diameter of water-spray hole 12a: | 3 mmϕ |
| Number of water-spray holes 12a: | 48 pcs. |
| Diameter of opening 12b: | 52 mmϕ |
| Supply water amount: | 30 liters/minute |

FIG. 7 shows that the vortical component included in the vortical flow is suppressed and water is forward spouted in a shower-like manner from the water-spray plate 12. In addition, in this condition, slightly applying the massage nozzle 1 to the site on the person's skin subject to treatment of a human body generates the vortical suction force due to the vortical flow CF, enabling the user to perform a highly-effective suction massage in addition to depressing and vibration effects due to spouted water.

In addition, since a uniform water film is formed by the water flow spouted from the water-spray holes 12*a* and the opening 12*b*, the massage nozzle 1 could be smoothly moved to freely perform suction massage in the predetermined range while applying the massage nozzle 1 to the site on the person's skin subject to treatment 210.

As described above, according to one or more aspects of the present invention, when discharging water in the atmosphere in an opened condition, bundled spouted water flow in a shower-like manner can be formed. As a result, the aspects of present invention were made to solve the above-mentioned problems in which spouted water splashes in all directions, furthermore, to let the massage nozzle serve as a general showerhead. That is, according to one or more aspects of the present invention, one massage nozzle can be used arbitrarily as a shower or a suction massage, providing users with a convenient use style.

Figure 8:
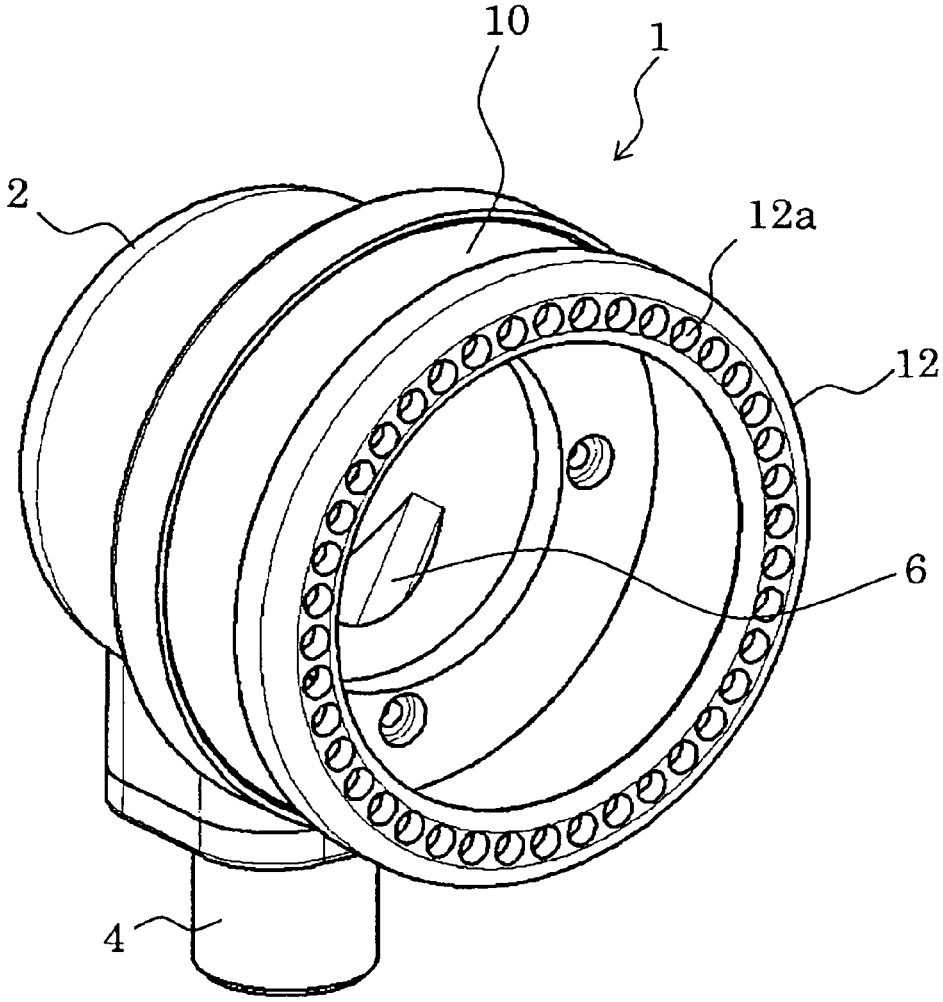
FIG. 8 is a perspective view showing the massage nozzle 1 according to an embodiment of the present invention.
Figure 9:
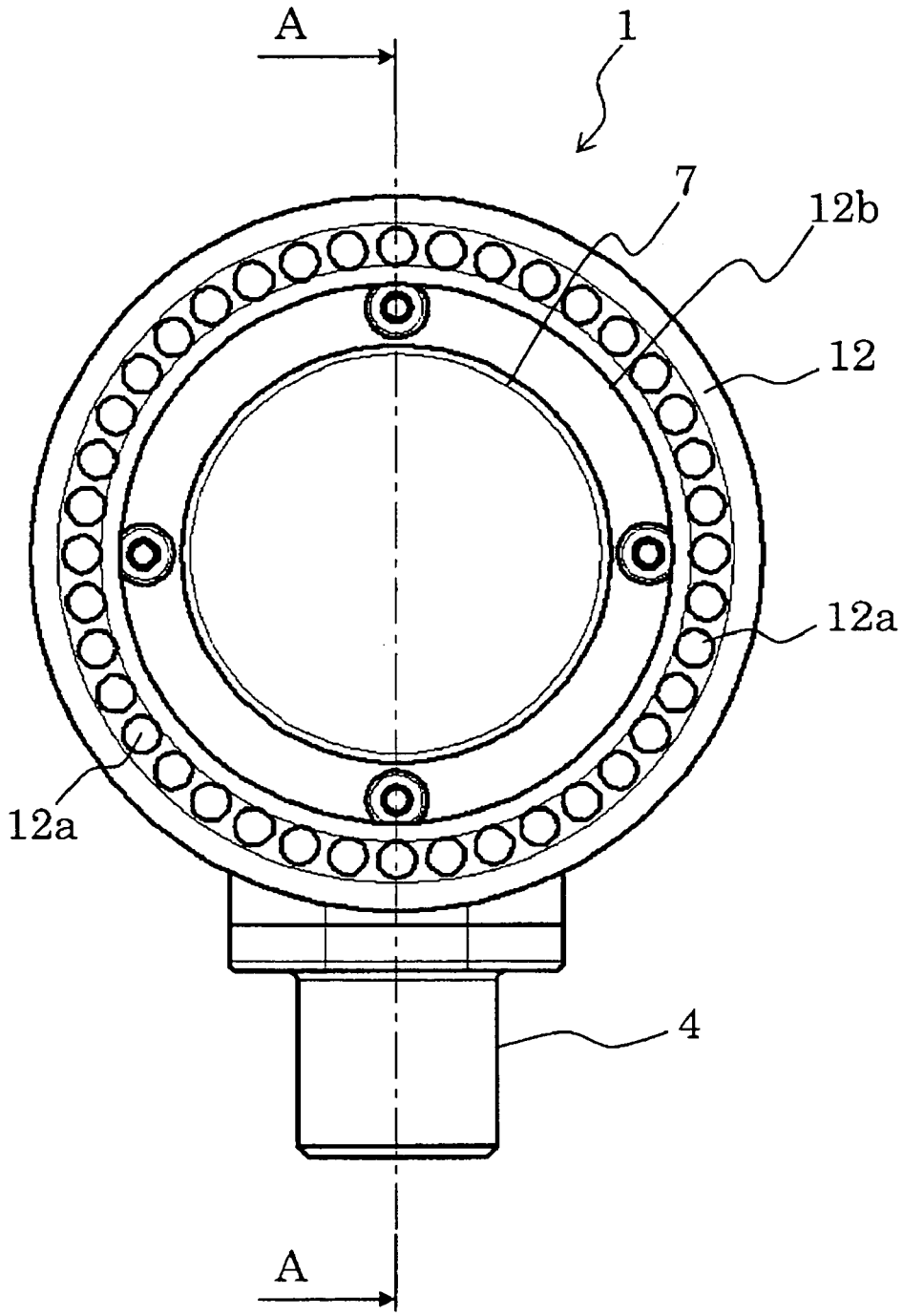
FIG. 9 is a front view showing a massage nozzle according to an embodiment of the present invention.
Figure 10:
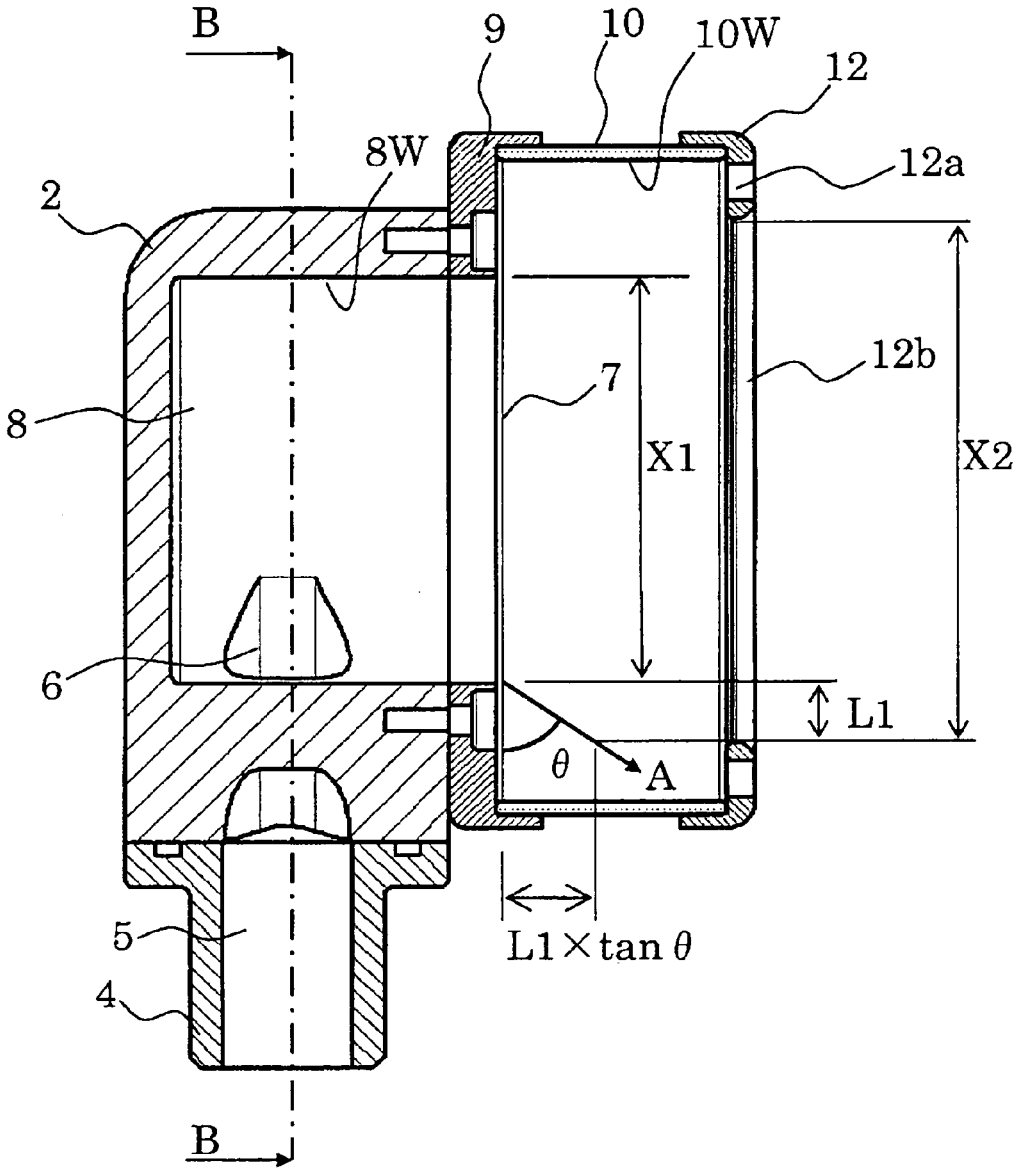
FIG. 10 is an A-A line sectional view of FIG. 9.

Next, a massage nozzle equipped with a guide section is described hereinafter. FIGS. 8 to 10 are schematic views showing a massage nozzle according to a second embodiment of the present invention. That is, FIG. 8 is a perspective view showing the massage nozzle 1. FIG. 9 is a front view. FIG. 10 is an A-A line sectional view of FIG. 9. In addition, a B-B line sectional view of FIG. 10 is the same as FIG. 4.

The massage nozzle 1 of the present embodiment is provided with a ring-shaped guide section 10 outside of a spouting port 7 through a flange 9. The end of the guide section 10 is provided with a water-spray plate 12. The water-spray plate 12 is provided with an opening 12*b* in the center and a plurality of water-spray holes 12*a* are provided around the opening 12*b*.

In this case, as shown in FIG. 10, if the diameter X2 of the opening 12*b* of the water-spray plate 12 is designed to be larger than the diameter X1 of a spouting port 7, a suction region can be sufficiently maintained to enhance the massage effect and bioeffect. In addition, the massage nozzle main body can be designed in a compact size to enable a user to more easily handle.

At least, either one of sections between the vortex section 2 and the flange 9, between the flange 9 and the guide section 10, and between the guide section 10 and the water-spray plate 12 may be designed detachably. For example, if the section between the vortex section 2 and the flange 9 is designed to be detachable, the flange 9 (including the guide section 10 and the water-spray plate 12) can be replaced arbitrarily by a user and desired suction force and feel of simulation due to twisting and vibration can be selected as described below. In addition, it becomes easier to attach/detach and replace a movable member 20 (not illustrated) hereinafter described in the detail.

As a mechanism for attachment/detachment of the flange 9, guide section 10 and water-spray plate 12, for example, various types of mechanism such as a screw fitting, fitting mechanism between L-shaped groove and protrusion and the like can be used. However, in order to prevent detachment and/or looseness due to the vortical flow, it is preferable that a mechanism fixes (tightens) the water-spray plate in the same direction of that of the vortical flow.

In addition, as described above in FIG. 1 to FIG. 4, since it is only natural that a general user turns clockwise to tighten, the water intake section 6 is preferably provided so that the vortical flow is turned clockwise. Thus, it is easy to attach/detach and can prevent inadvertent detachment due to the vortical flow.

Figure 11:
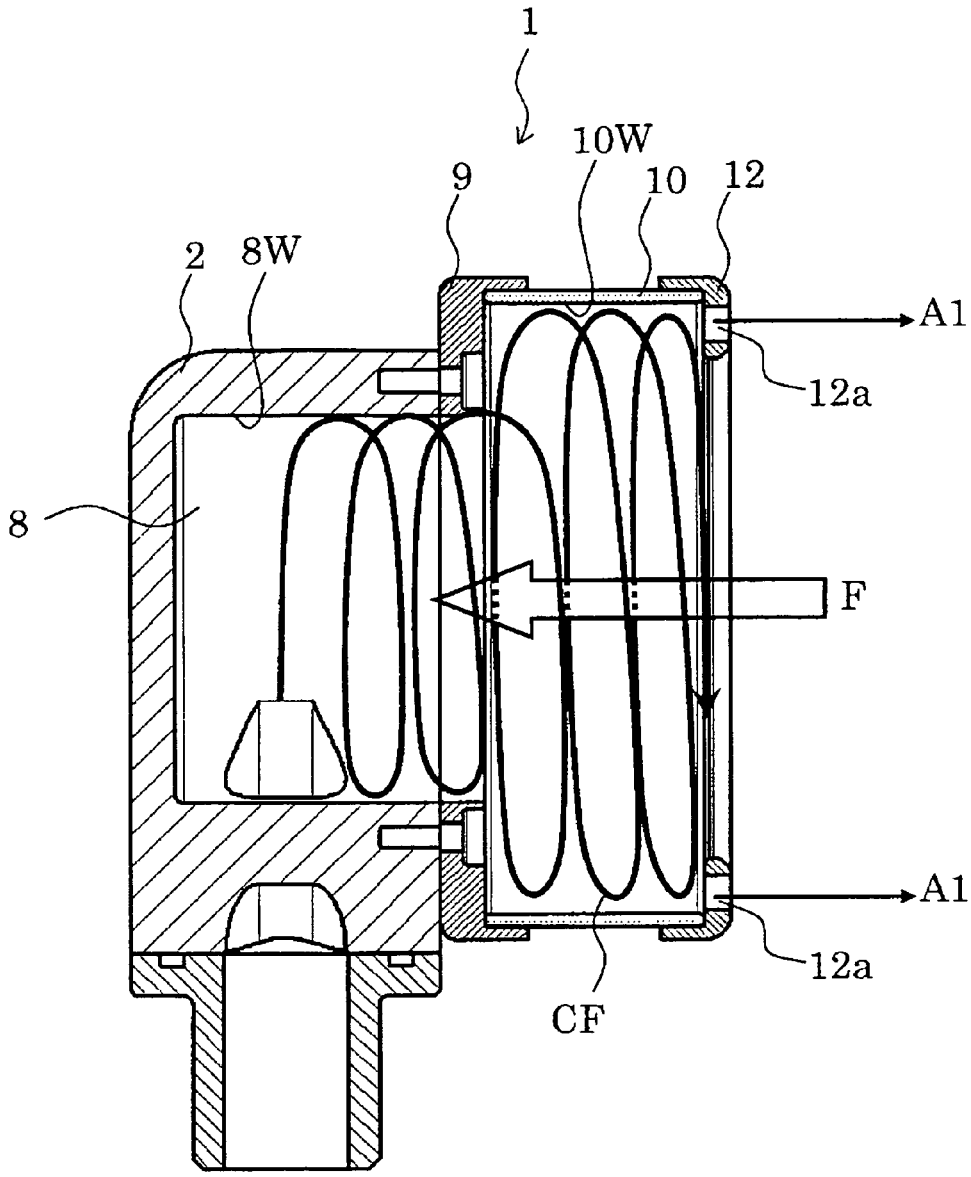
FIG. 11 is a schematic sectional view showing a condition in which water is supplied to the massage nozzle 1 according to an embodiment of the present invention.
Figure 12:
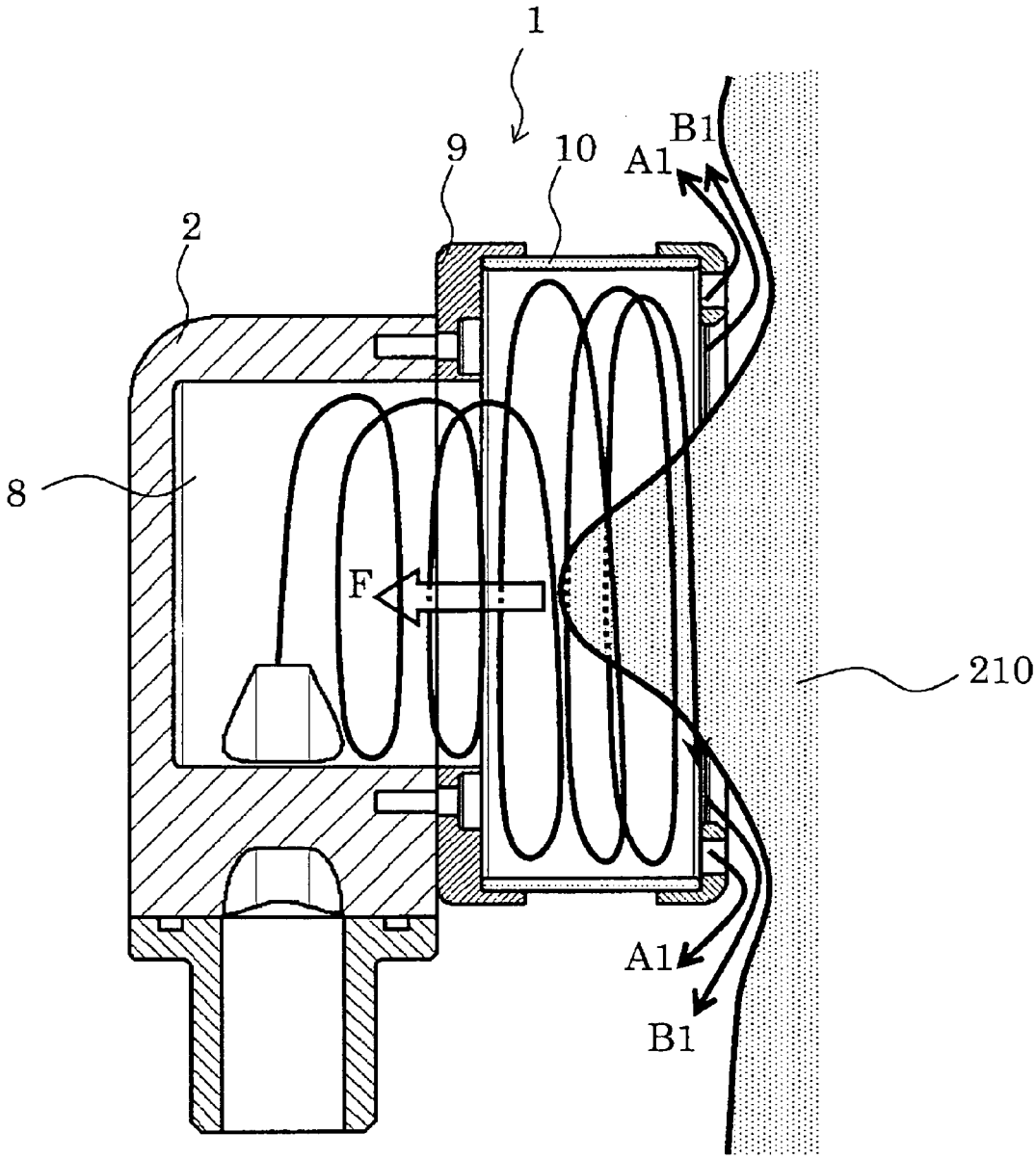
FIG. 12 is a schematic sectional view showing a condition in which massage is performed by the massage nozzle 1 according to an embodiment of the present invention.

FIG. 11 is a schematic sectional view showing a condition in which water is supplied to the massage nozzle 1 of the present embodiment. FIG. 12 is a schematic sectional view showing a condition in which massage is performed by the massage nozzle 1.

That is, the introduced water from the water intake section 6 to the vortex chamber 8 forms the vortical flow CF. This vortical flow CF reaches the spouting port 7 while rotating along the circumferential wall 8W and finally reaches the water-spray plate 12 while rotating along the inner-circumference wall 10W of the guide section 10 provided further outside.

At this time, a centrifugal force with the vortical flow CF produces a negative-pressure region around the center of the vortex chamber 8, therefore, the vortical suction force F to pull into the vortex chamber 8 from the outside of the massage nozzle 1 along the central axis of the opening 12*b* of the water-spray plate 12 is generated.

Meanwhile, the vortical flow reaching the water-spray plate 12 is spouted forward from the water-spray holes 12*a* as indicated by the arrow mark A1 in FIG. 11. That is, a vortical component included in the vortical flow CF is suppressed and a bundled spouted water flow can be obtained as a general shower.

In addition, according to one or more aspects of the present invention, in order to prevent the vortical flow CF from splashing, first it is necessary that the vortical flow CF spouted from the spouting port 7 collides with the inner-circumference wall 10W or the water-spray plate 12 of the guide section 10 before reaching the opening 12*b*. For this purpose, as shown in FIG. 10, when half of the difference between the diameter of the spouting port 7 and the diameter of the opening 12 is determined as L1, the angle of the water flow A to be spouted from the spouting port 7 to the face including the spouting port 7 is determined as θ, it is preferable that the guide section 10 is designed to protrude as the length to the above-mentioned water-spray plate viewing from the above-mentioned spouting port is (L1×tan θ) or more.

Next, for the conditions during massage, as shown in FIG. 12, slightly applying the massage nozzle 1 lets the vortical suction force F generated from the vortical flow CF effect the site on the person's skin subject to treatment 210 of the user. As a result, it lets a suction force efficiently affect the site on the person's skin subject to treatment 210 to obtain a highly-effective suction massage effect.

Also in the present embodiment, a uniform water flow A1 spouted from the water-spray holes 12*a* is formed between the site on the person's skin subject to treatment 210 and the water-spray plate 12. In addition, if the water amount of the vortical flow CF exceeds the water amount spouted from the water-spray holes 12*a*, a water flow B1 overflowed from the opening 12*b* forms a water film.

The site on the person's skin subject to treatment 210 is depressed in a doughnut-shaped manner due to the water film formed by these water flows A1 and B1; the central section is sucked into the opening 12*b* by intensive vortical suction force F and is deformed three-dimensionally to undergo effective suction massage. That is, the site on the person's skin subject to treatment 210 undergoes depression force at the periphery and intensive suction force in the center at the same time. In addition, the water flow A1 and water flow B1 provides the site on the person's skin subject to treatment 210 with vibration. The site on the person's skin subject to treatment 210 is deformed three-dimensionally by the above-mentioned actions and undergoes "kneading relax effect" due to vibration.

In addition, since the water film formed by the water flow A1 and B1 always exist between the water-spray plate 12 and the site on the person's skin subject to treatment 210, the massage nozzle 1 can be smoothly moved while applying the massage nozzle 1 to the site on the person's skin subject to treatment 210 undergoing suction massage, enabling the site on the person's skin subject to treatment 210 to undergo suction massage widely.

According to the present embodiment, if the area of the opening 12*b* is designed to be larger than that of the spouting port 7, a region to undergo vortical suction force F can be sufficiently maintained to obtain a highly-effective massage effect by providing effective deformation to the site on the person's skin subject to treatment 210. In addition, if the opening 12*b* is designed to be larger than the spouting port 7, the massage nozzle main body (a housing section forming a vortex chamber 8) can be designed in a compact size to be easier to be handled while maintaining the suction region determined by the opening 12*b*.

However, the present embodiment is not limited to these specific examples. That is, the area of the spouting port 7 may be almost the same as that of opening 12*b* or the area of the opening 12*b* may be smaller than that of the spouting port 7. If the ratio of the opening 12*b* to the spouting port 7 is designed to be smaller, it becomes easier to increase the spouted amount from the water-spray holes 12*a* provided in the circumference of the opening 12*b*. That is, it can increase the ratio of water to be spouted in a shower-like manner from the water-spray holes 12*a* and reduce the water amount overflowed from the opening 12*b*. As a result, it becomes easier to increase the bundling degree of water to be spouted from the massage nozzle 1.

Figure 13:
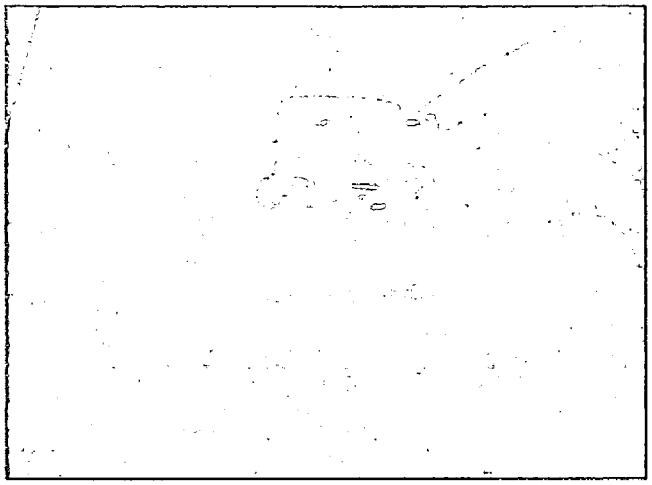
FIG. 13 is a photo showing the results of a water-spray test using a massage nozzle prototyped by the inventor of the present invention.
Figure 13:
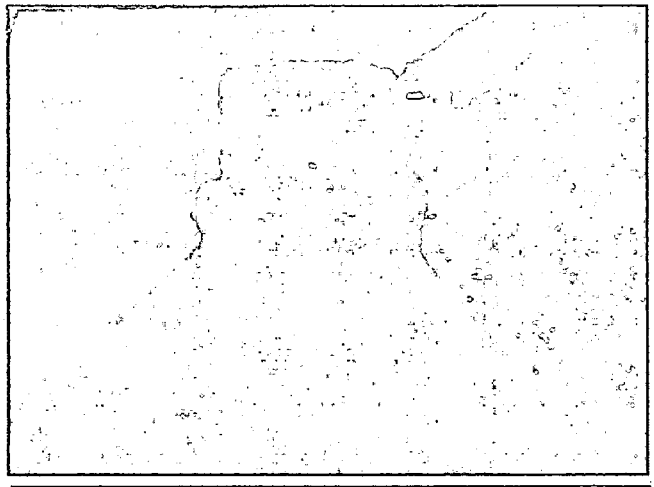
Figure 13:
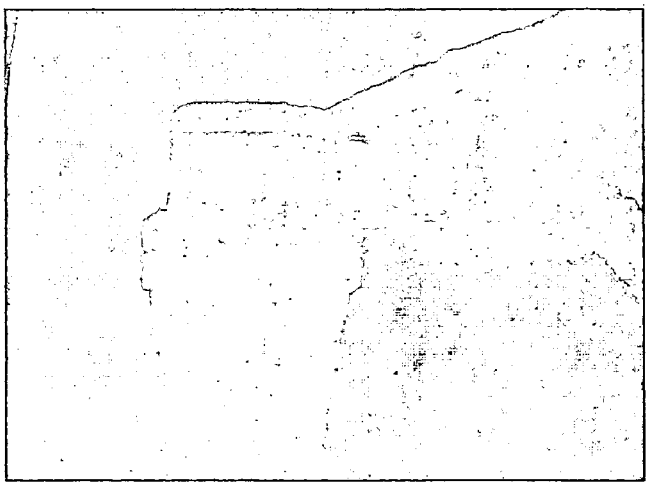

FIG. 13 is a photo showing the results of a water-spray test using a massage nozzle prototyped by the inventor of the present invention. The configuration parameters and operation conditions of the massage nozzle 1 described above are as follows:

| | |
|---|---|
| Inside diameter of vortex chamber 8: | 45 mmϕ |
| Length of vortex chamber 8: | 45 mm |
| Size of water intake section 6 | 42 $mm^2$ |
| Diameter of spouting port 7: | 45 mmϕ |
| Inside diameter of guide section 10: | 71 mmϕ |
| Length of guide section 10: | 15 mm |
| Thickness of water-spray plate 12 : | 3 mm |
| Diameter of water-spray hole 12a: | 4 mmϕ |
| Number of water-spray holes 12a: | 40 pcs. |
| Diameter of opening 12b: | 50 mmϕ |
| Supply water amount: | 28.6 liters/minute |

First, FIG. 13(*a*) shows the condition where the guide section 10 is removed and water is spouted from the spouting port 7. It shows also that the vortical flow CF splashes in a wide range and spouted in all directions.

Next, FIG. 13(*b*) shows the condition where water is spouted with the ring-shaped guide section 10 attached. It also shows that the vortical flow CF spouted from the spouting port 7 collides with the guide section 10, slightly be bundled and splashes while rotating with the expansion angle slightly decreased.

Next, FIG. 13(*c*) shows the condition where water is spouted with the water-spray plate 12 attached. It also shows that attaching the water-spray plate 12 suppresses the vortical component included in the vortical flow and water is forward spouted in a shower-like manner from the water-spray plate 12. In addition, in this condition, slightly applying the massage nozzle 1 to the site on the person's skin subject to treatment of a human body generates the rotation suction force due to the vortical flow CF, enabling the user to perform a highly-effective suction massage in addition to depressing and vibration effects due to spouted water.

As described above, according to one or more aspects of the present invention, when discharging water in the atmosphere in an opened condition, bundled spouted water flow in a shower-like manner can be formed. As a result, the present embodiment was made to solve the above-mentioned problems in which spouted water is sprayed in all directions, furthermore, to let the massage nozzle serve as a general showerhead. That is, according to the prevent embodiment, one massage nozzle can be used arbitrarily as a shower or a suction massage, providing users with a convenient use style.

Next, a flow-adjustment effect of the water-spray holes 12*a* provided in the massage nozzle 1 of the present embodiment.

Figure 14:
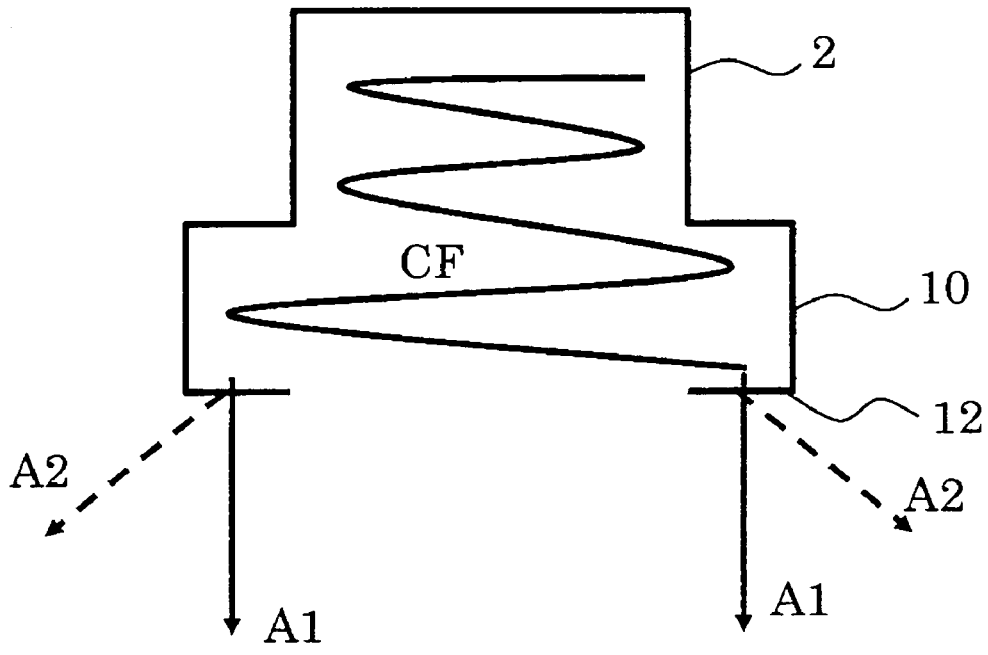
FIG. 14 is a concept view showing a water flow to be formed by the massage nozzle 1 of the present invention.

FIG. 14 is a concept view showing a water flow to be formed by the massage nozzle 1 of one or more aspects of the present invention. The water introduced into the vortex chamber 8 forms the vortical flow CF, reaches the water-spray plate 12 while rotating along the circumferential wall 10W, and is finally spouted from the water-spray holes 12*a*. The water spouted from the water-spray holes 12*a* forms a water flow bundled in the semi-perpendicular direction to the opening 12*b* as shown by the arrow mark A1.

In this case, in order that the water to be spouted from the water-spray holes 12*a* is spouted in the arrow mark A1 direction without splashing in a rotation direction as shown by the arrow mark A2 in the same drawing, it is necessary that the water-spray holes 12*a* have a flow-adjustment effect.

Figure 15:
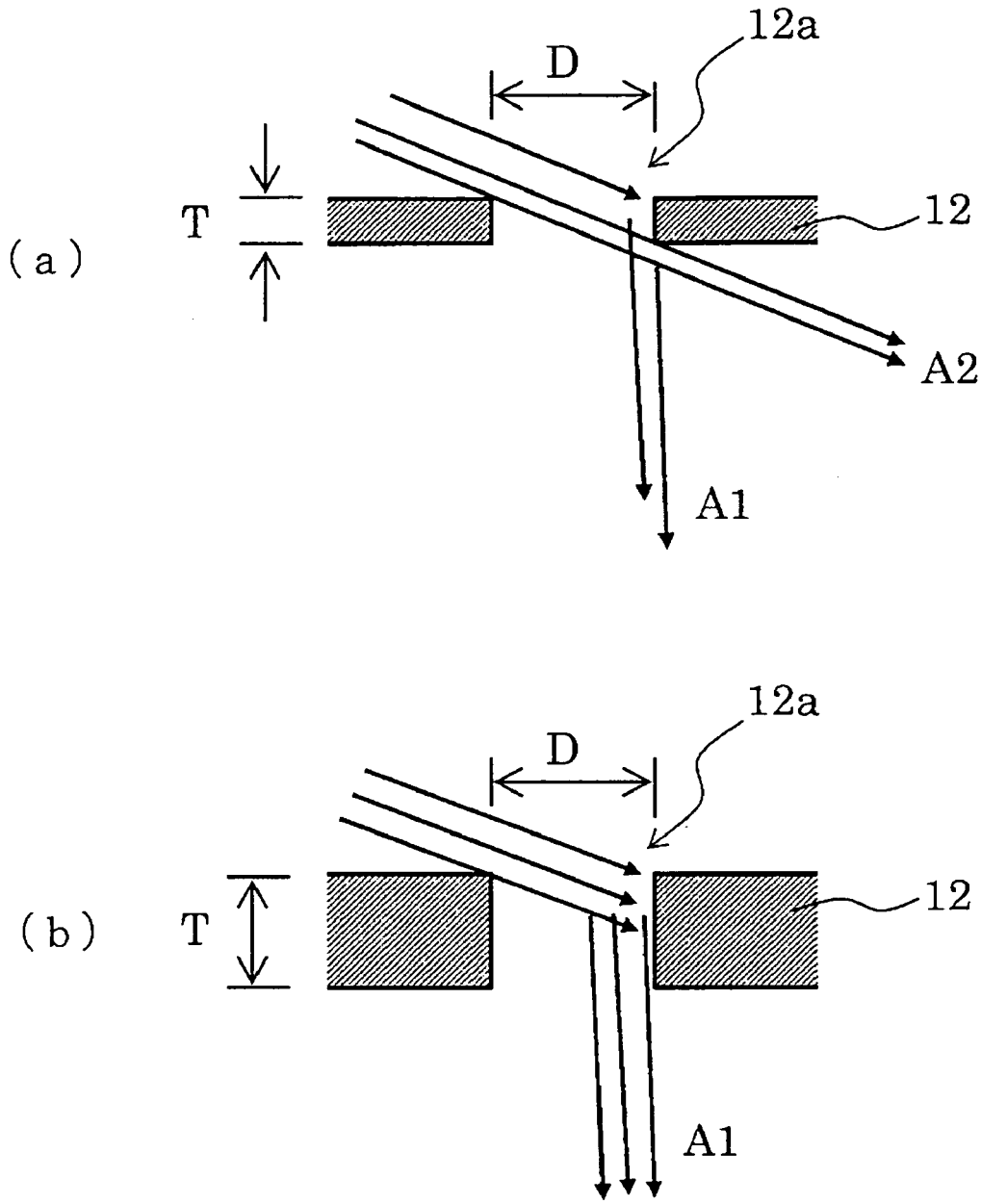
FIG. 15 is a partially expanded sectional view showing a part of a water-spray hole 12*a*.

FIG. 15 is a partially expanded sectional view showing a part of a water-spray hole 12*a*. The vortical flow CF rotating along the circumferential wall enters the water-spray holes 12*a* at a slant while maintaining the vortical component.

Provisionally as shown in FIG. 15(*a*) if the thickness T of the water-spray plate 12 is designed to be relatively smaller with respect to the diameter D of the water-spray holes 12*a*, some part of the vortical flow CF entered at a slant the water-spray holes 12*a* passes through without colliding with the side wall of the water-spray holes 12*a*. That is, the flow-adjustment effect becomes smaller and the vortical flow CF and the spouted water from the water-spray holes 12*a* tends to splash in all directions.

Meanwhile, as shown in FIG. 15(*b*), if the thickness T is designed to be relatively larger with respect to the diameter D of the water-spray holes 12*a*, all the vortical flow CF entered the water-spray holes 12*a* at a slant may collide with the side wall of the water-spray holes 12*a* and the vortical component may be absorbed and spouted forward in the semi-perpendicular direction as shown by the arrow mark A1.

That is, the water-spray holes 12*a* increases a flow-adjustment effect, enabling the vortical component included in the vortical flow CF to be suppressed and the water to be spouted as water flow bundled in the arrow mark A1 direction.

Figure 16:
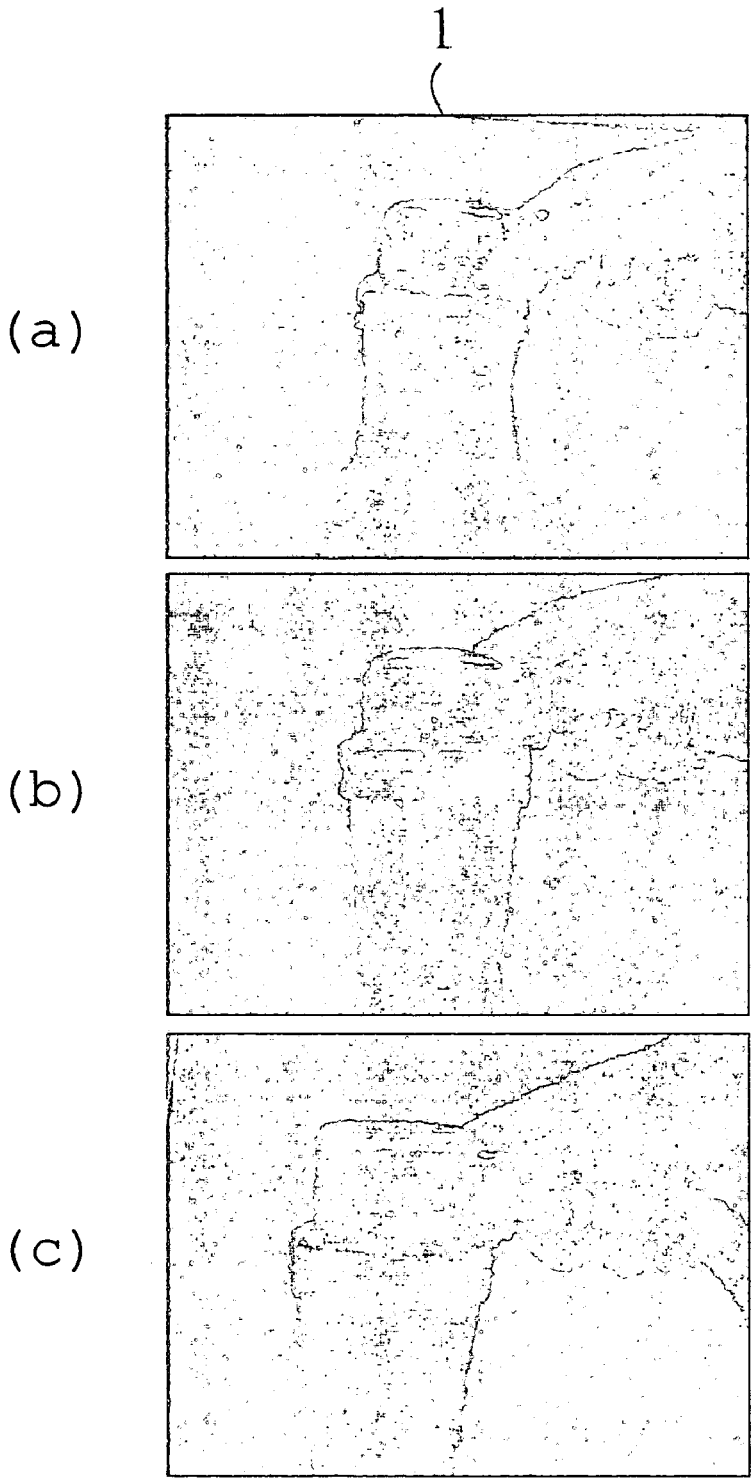
FIG. 16 is a photo showing partially results of the investigated flow-adjustment effect by the water-spray hole.

FIG. 16 is a photo showing partially results of the investigated flow-adjustment effect by the water-spray hole. The massage nozzle 1 has the same configuration parameter as described above in FIG. 13. However, the thickness of the water-spray plate 12 was arbitrarily changed.

FIG. 16(*a*) shows a spouted water flow when the thickness of the water-spray plate 12 is determined as 1 mm. Since the water flow spouted from the water-spray holes 12*a* is inclined in the rotation direction of the vortical flow, it is found that the spouted water flow splashes. That is, it is found that the vortical component is not suppressed.

FIG. 16(*b*) shows a spouted water flow when the thickness of the water-spray plate 12 is determined as 2 mm. Since the water flow spouted from the water-spray holes 12*a* faces the opening 12*b* in the semi-perpendicular direction, the spouted water is bundled. That is, it is found that the vortical component included in the vortical flow is suppressed.

FIG. 16(*c*) shows a spouted water flow when the thickness of the water-spray plate 12 is determine as 3 mm. The water flow spouted from the water-spray holes 12*a* faces the opening 12*b* in the perpendicular direction and the spouted water is sufficiently bundled. That is, it is found that the water-spray holes 12*a* produce a sufficient flow-adjustment effect to suppress the vortical component.

Figure 17:
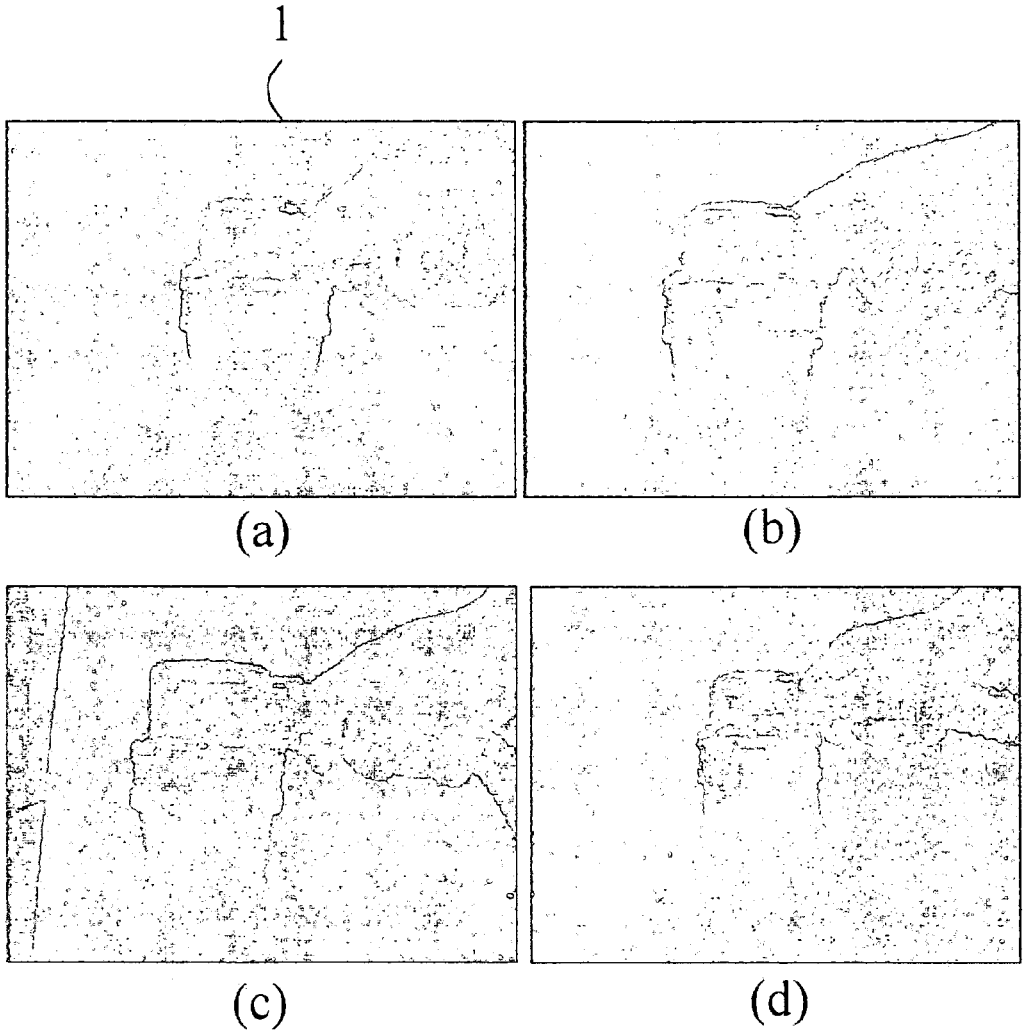
FIG. 17 is a photo showing partially results of the investigated flow-adjustment effect by the water-spray hole of another massage nozzle.

FIG. 17 is a photo showing partially results of the investigated flow-adjustment effect by the water-spray hole of another massage nozzle. The massage nozzle 1 described here has the same configuration parameter as described above in FIG. 13 except for the following points.

| | |
|---|---|
| Length of guide section 10: | 25 mm |
| Thickness of water-spray plate 12: | 1 mm, 2 mm 3 mm |
| Diameter of opening 12b: | 60 mmϕ |

FIG. 17(*a*) shows a spouted water flow when the thickness of the water-spray plate 12 is determined as 1 mm. As described above in FIG. 16(*a*), since the water flow spouted from the water-spray holes 12*a* is inclined in the rotation direction of the vortical flow, it is found that the spouted water flow splashes and the vortical component is not suppressed. FIG. 17(*b*) shows a spouted water flow when the thickness of the water-spray plate 12 is determined as 2 mm. The water flow spouted from the water-spray holes 12*a* is bundled in the semi-perpendicular direction to the opening 12*b*, it is found that the vortical component included in the vortical flow is suppressed.

FIG. 17(*c*) shows a spouted water flow when the thickness of the water-spray plate 12 is determined as 3 mm. The water flow spouted from the water-spray holes 12*a* is further bundled forward, it is found that the flow-adjustment effect due to the water-spray holes 12*a* increases. The spouted water flow shown in FIG. 17(*b*) and FIG. 17(*c*) has a water flow element splashing in a slightly wider manner than that in shown in FIG. 16(*b*) and FIG. 16(*c*). It is assumed that this reason is caused by the difference of the size of the opening 12*b*. These points are described hereinafter in detail with reference to FIG. 21 and FIG. 22.

Figure 18:
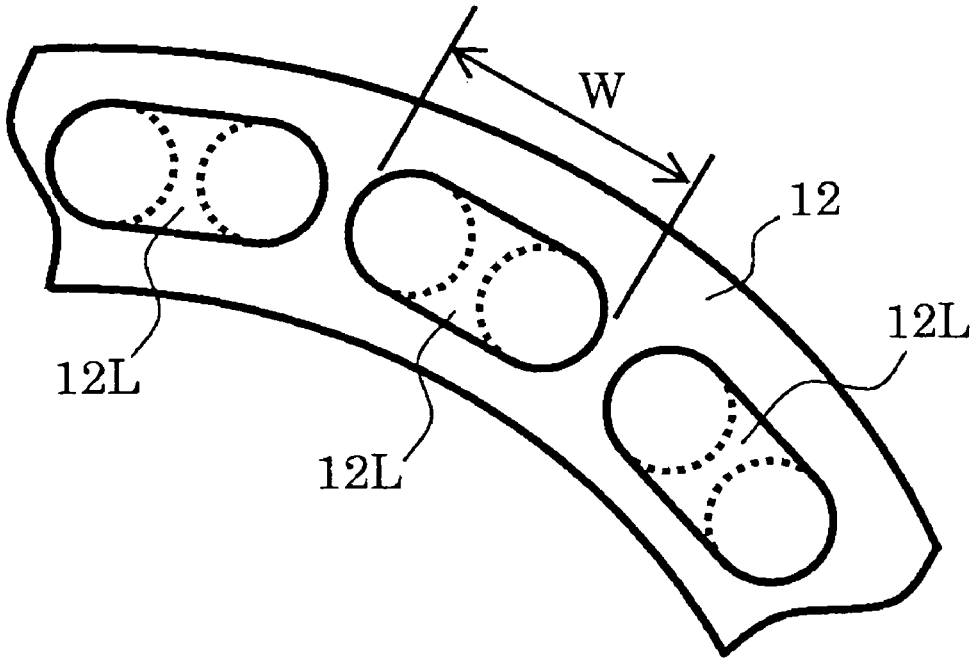
FIG. 18 is a schematic sectional view showing an example of a water-spray plate prototyped by the inventor of the present invention.

Next, FIG. 17(*d*) shows as shown in FIG. 18 that the water flow spouted from a massage nozzle in which two adjacent water-spray holes 12*a* are connected to form one water-spray hole 12L. In this case, since the opening length W of the water-spray hole 12L viewing in the rotation direction of the vortical flow is larger, a flow-adjustment effect to the vortical flow decreases. As a result, it is found that the water flow spouted from the water-spray hole 12L is greatly inclined in the rotation direction as shown in FIG. 17(*d*).

In addition, the inventor of the present invention conducted the same test after the length of the guide section 10 was changed to 15 mm. However, the results were almost the same as those shown in FIGS. 17(*a*) to (*d*).

As described above, in order to bundle the water flow spouted from the massage nozzle 1, it is found that the flow-adjustment effect due to the water-spray holes 12*a* is important. That is, as shown in FIG. 15, if the ratio of the thickness T of the water-spray plate 12 to the diameter D (taken along the rotation direction of the vortex flow) of the opening of the water-spray hole 12*a* is larger, a more highly-effective flow-adjustment effect can be obtained to suppress the vortical component included in the vortical flow.

In order to suppress the vortical component included in the vortical flow, a baffle plate may be provided.

Figure 19:
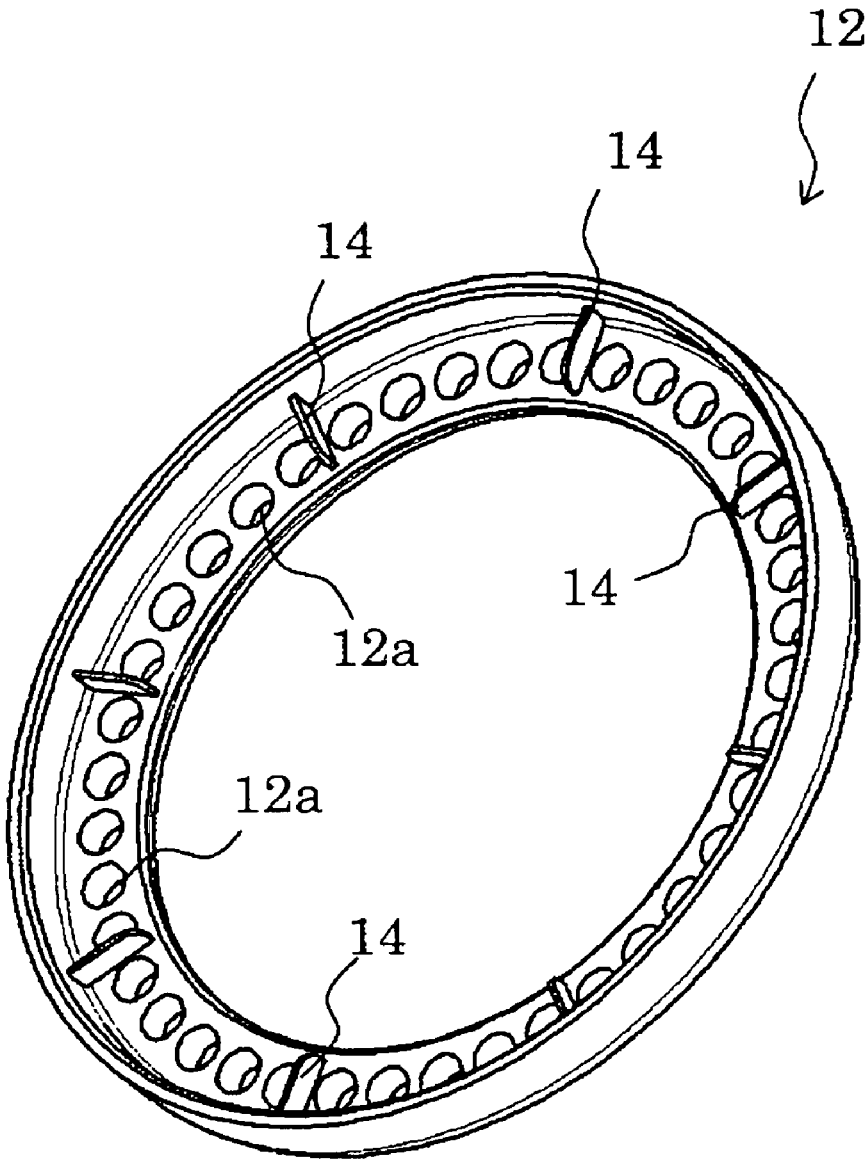
FIG. 19 is a schematic sectional view showing an example of a baffle plate.

FIG. 19 is a schematic sectional view showing an example of a baffle plate.

That is, providing the back side (near side to a spouting port 7) of the water-spray plate 12 with a protruding baffle plate 14 enables the vortical component included in the vortical flow CF to be suppressed and bundled water flow to be spouted perpendicularly from the water-spray holes 12*a*. In addition, such a baffle plate may be provided in the circumferential wall of the guide section 10. Furthermore, if the height of the baffle plate 14 is designed to be lower and placed on a position closer to the water-spray plate 12, the vortical flow can be maintained up to the position closer the water-spray plate 12, the effect due to the vortical flow can be added more strongly to the site on the person's skin subject to treatment 210 to be sucked from the opening 12*b* of the water-spray plate 12.

Next, the water flow to be overflowed from the opening 12*b* of the massage nozzle 1 is hereinafter described.

Figure 20:
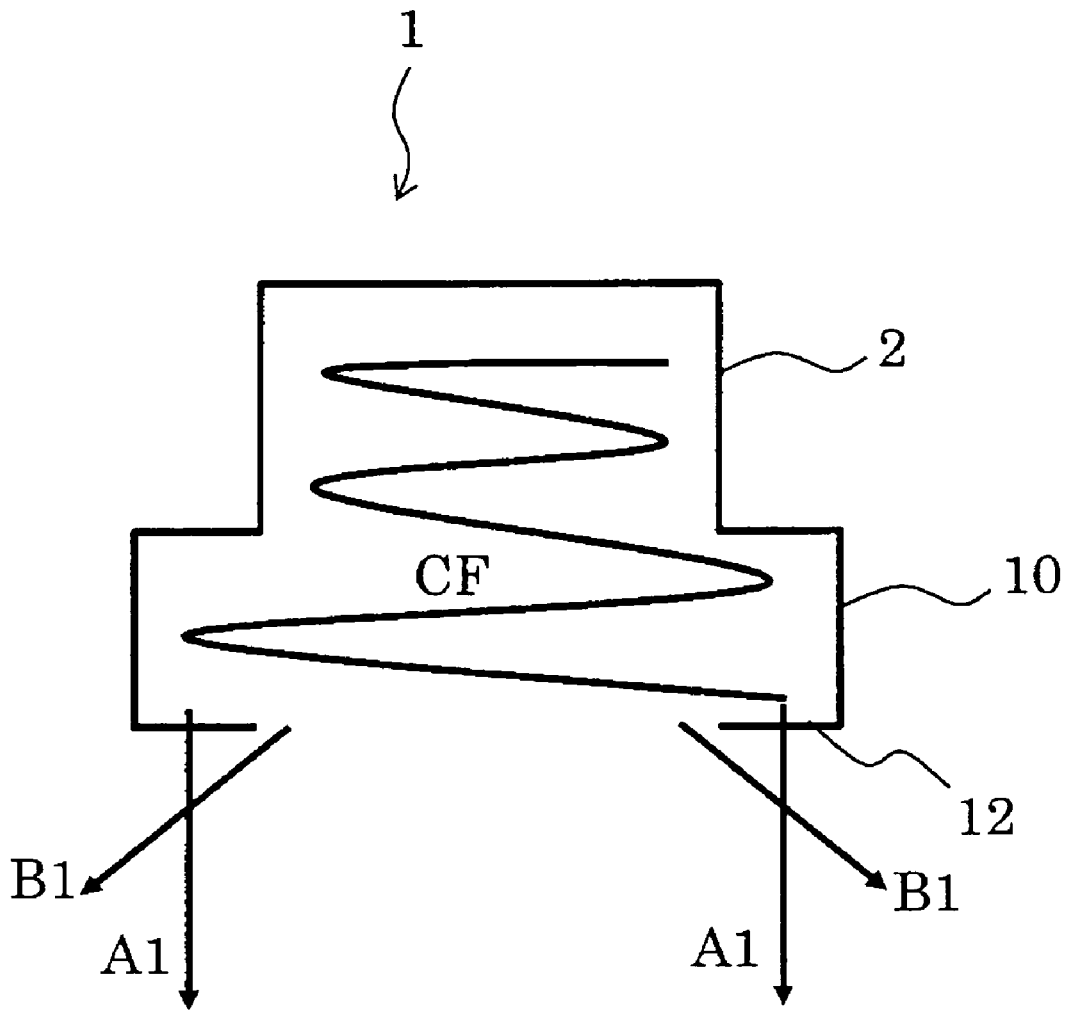
FIG. 20 is a concept view showing a water flow to be formed by the massage nozzle 1 of the present invention.

FIG. 20 is a concept view showing a water flow to be formed by the massage nozzle 1. That is, the vortical flow CF reached the water-spray plate 12, whose vortical component is suppressed due to the flow-adjustment effect with the water-spray holes 12*a*, is spouted in a semi-perpendicular direction to the opening 12*b* as shown by the arrow mark A1. However, if the water amount supplied to the nozzle exceeds the water amount spouted from the water-spray holes 12*a*, water is overflowed from the opening 12*b* as a spouted water flow B1. This spouted water flow B1 has a vortical component and therefore, splashes in all directions.

The water mount of water flow B1 to be spouted from the opening 12*b* depends on the size of the opening 12*b*. That is, if the opening 12*b* is larger, the amount of the water flow B1 tends to be larger.

Figure 21:
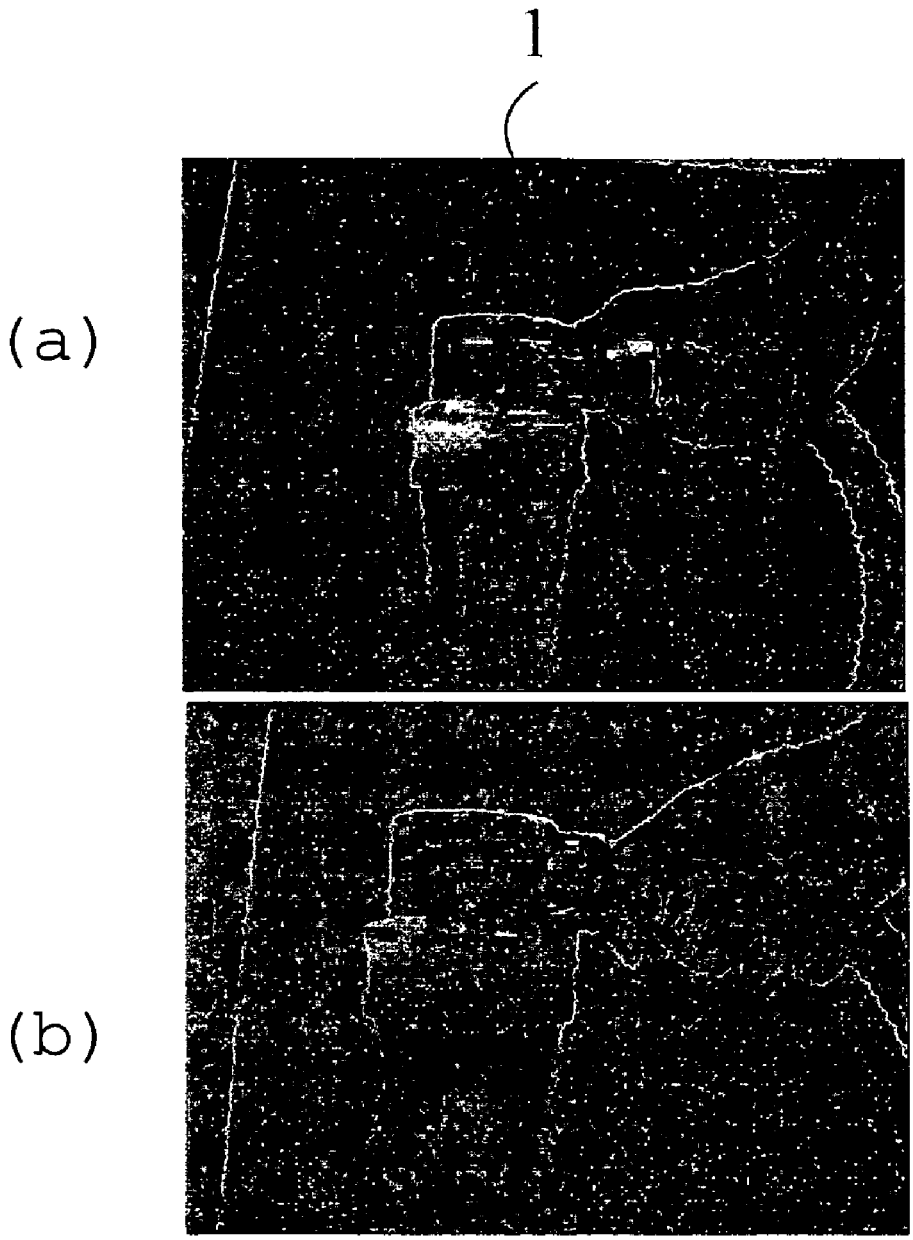
FIG. 21 is a photo showing the change of spouting flow according to size of an opening 12*b*.

FIG. 21 is a photo showing the change of spouting flow according to size of an opening 12*b*.

FIG. 21(*a*) shows a spouted water flow from the massage nozzle 1 having the opening 12*b* with 50 mmϕ diameter. Meanwhile, FIG. 21(*b*) shows a spouted water flow from the massage nozzle 1 having the opening 12*b* with 60 mmϕ diameter.

If the diameter is larger, the ratio of the vortical flow B1 spouted from the opening 12*b* becomes larger. For this reason, it is found that the splashing element included in the spouted water increases. According to the massage nozzle 1, as the curtain of the water flow A1 to be spouted in a shower-like manner from the water-spray holes 12*a* is formed, the water flow B1 having the splashing element tends to be blocked by the curtain of this water flow A1. In addition, if the water flow B1 becomes stronger, it shoots through the curtain of the water flow A1 to form an expanded spouted water flow.

According to one or more aspects of the present invention, however, it is unnecessary to suppress the vortical flow B1 completely, it can be arbitrarily determined according to the characteristics and application required by the massage nozzle. That is, as described above in FIG. 12, the water flow B1 spouted from the opening 12*b* provides the site on the person's skin subject to treatment 210 with a physical stimulation such as "twisting" and "vibration" due to the vortical component. As a result, the massage effect can be enhanced much more. In addition, that is, the water flow B1 forms a uniform water film on the surface of the water-spray plate 12 to protect the surface of the site on the person's skin subject to treatment 210. As a result, it also enable a user to move the massage nozzle 1 while applying the massage nozzle 1 and sucking and perform suction massage arbitrarily in a wide range.

That is, if maintaining the water flow B1 spouted from the opening 12*b* as preventing the spouted water from splashing in a wide range, further high-effective massage can be obtained in some cases.

As a means to suppress the water flow B1 spouted from the opening 12*b*, there is a method in which the back side of the water-spray plate 12 is provided with a circumferential protrusion section.

Figure 22:
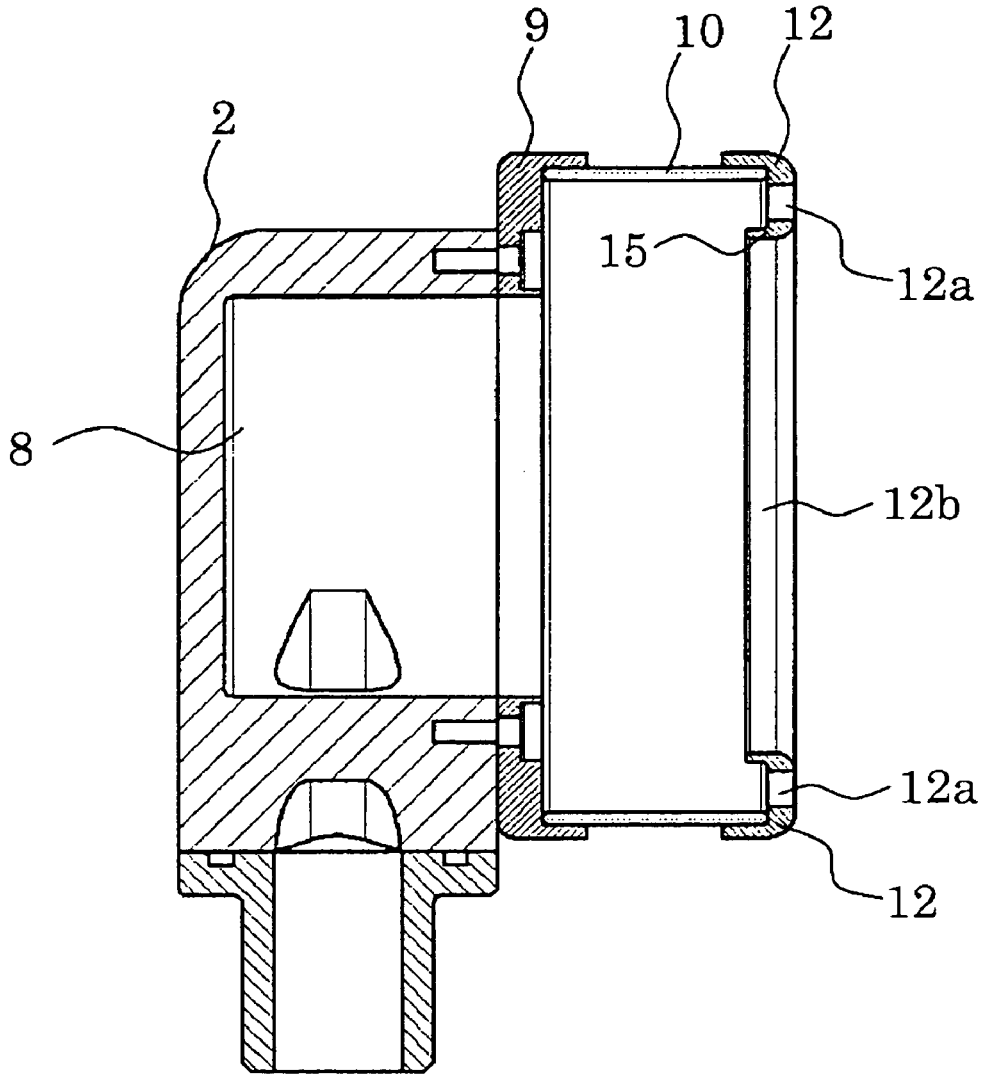
FIG. 22 is a schematic sectional view showing a massage nozzle in which a circumferential protrusion section is provided in a water-spray plate 12.
Figure 23:
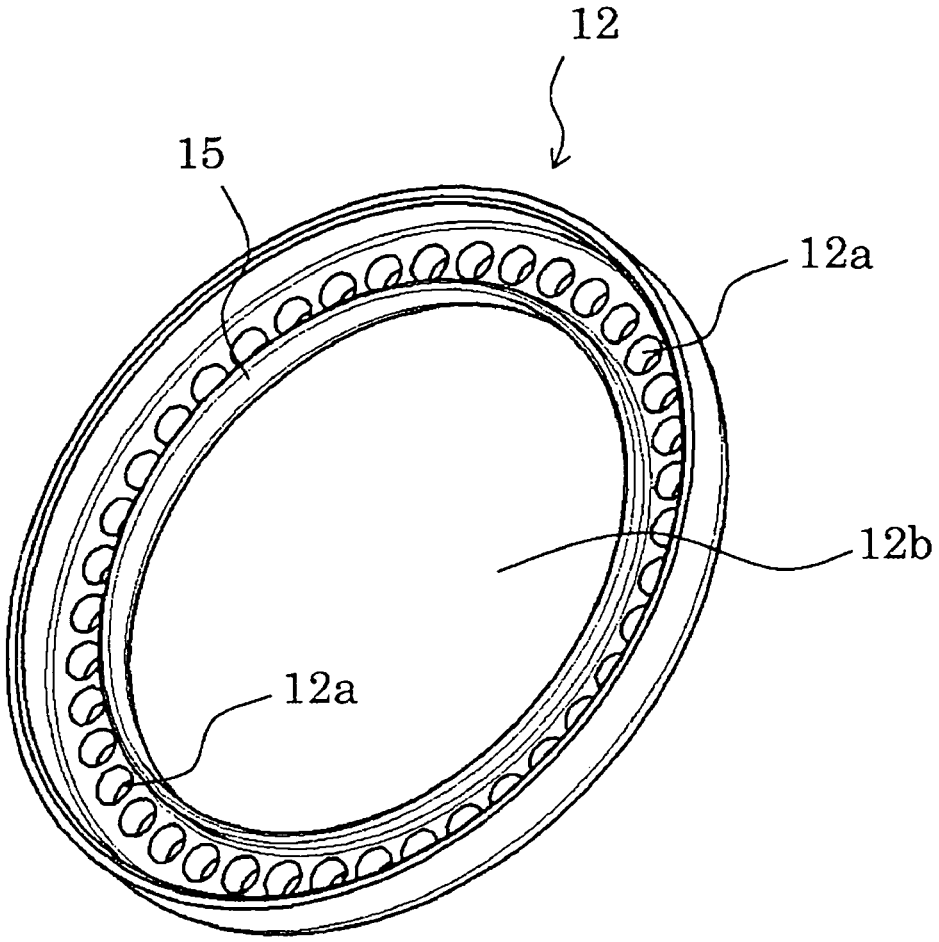
FIG. 23 is a perspective view showing the water-spray plate 12 of the massage nozzle 1 from the back side.

FIG. 22 is a schematic sectional view showing a massage nozzle in which a circumferential protrusion section is provided in the water-spray plate 12. In addition, FIG. 23 is a perspective view showing the water-spray plate 12 of the massage nozzle 1 viewing from the back side.

According to the present specific example, a circumferential protrusion section 15 which is protruding in the direction from the circumference of the opening 12*b* to the spouting port 7 is provided. Providing such a circumferential protrusion section 15 suppresses the vortical flow which reached the water-spray plate 12 from overflowing from the opening 12*b*. That is, the circumferential protrusion section 15 serves as a dam, which can prevent the vortical flow from overflowing from the opening 12*b*.

Figure 24:
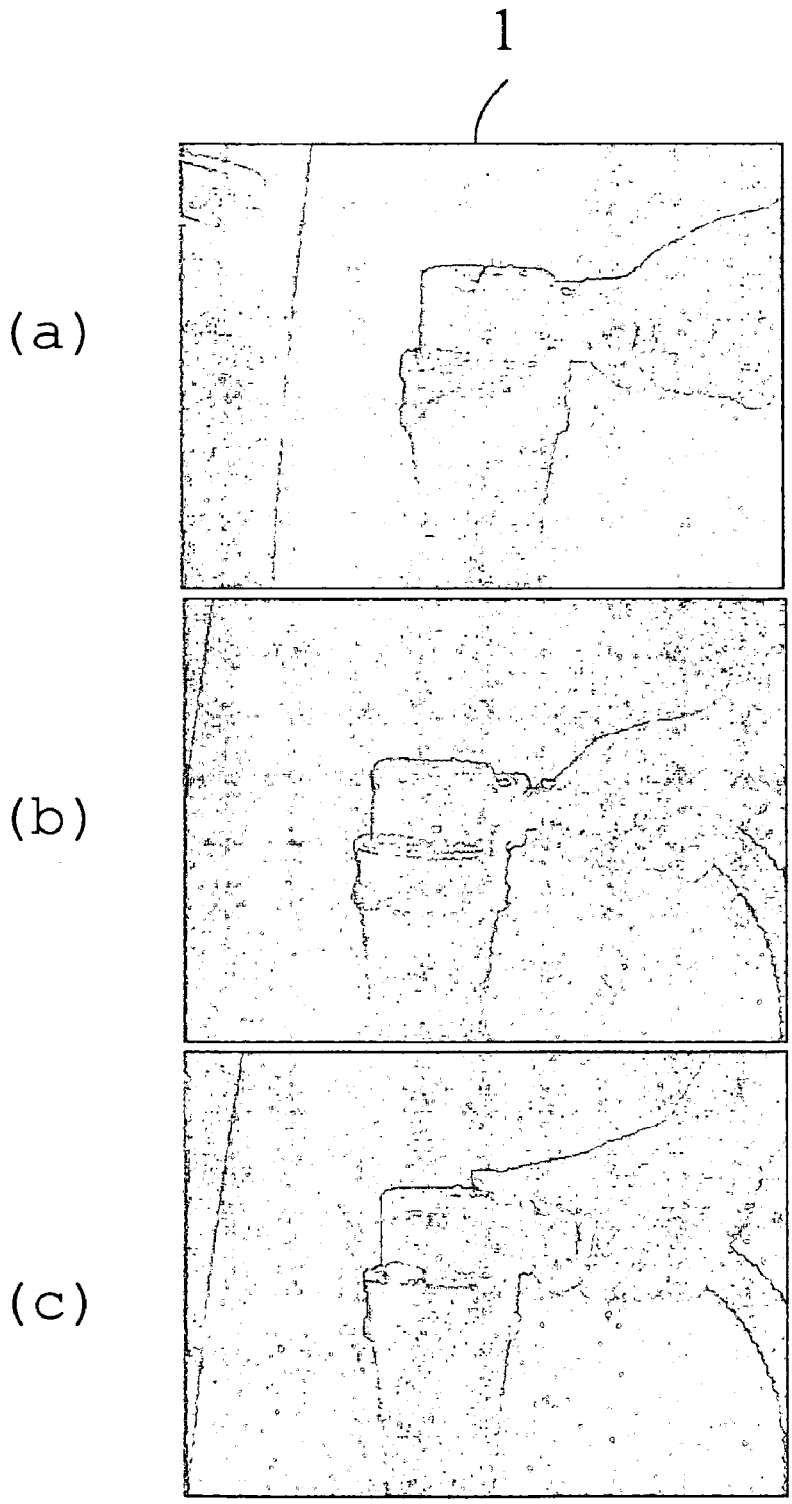
FIG. 24 is a photo showing an effect of a circumferential protrusion section 15.

FIG. 24 is a photo showing an effect of a circumferential protrusion section 15.

The massage nozzle 1 used here has the same configuration parameter as described above in FIG. 13 except for the following points, in which the length of guide section is 25 mm and the diameter of the opening 12*b* is 58 mmϕ.

FIG. 24(*a*) shows a spouted water flow in the case where the circumferential protrusion section 15 is not provided. A slightly-splashing water flow element is observed in addition to the water flow spouted in a shower-like manner from the water-spray holes 12*a*. It is assumed that this is an element of the water flow B1 which shoots through the curtain of the water flow A1 and expands.

FIG. 24(*b*) shows a spouted water flow in case that the circumferential protrusion section 15 having 2.5 mm of edge from the back side of the water-spray plate 12 is provided. It is found that providing the circumferential protrusion section 15 clearly reduces splashing element including the spouted water flow. That is, it is found that the vortical flow B1 spouted the opening 12*b* is suppressed.

FIG. 24(*c*) shows a spouted water flow in case that the circumferential protrusion section 15 having 5 mm of edge is provided. It is found that increasing the height of the circumferential protrusion section 15 further suppresses the splashing element included in the spouted water flow. That is, the vortical flow B1 to be spouted from the opening 12*b* is further suppressed.

As described above, providing the circumferential protrusion section 15 or not, and adjusting its height can adjust the balance between the water flow A1 to be spouted from water-spray holes 12*a* and the water flow B1 to be spouted from the opening 12*b*. Accordingly, for example, when the spouting flow is desired to be suppressed in an opened condition as much as possible, the water flow B1 to be spouted from the opening 12*b* has only to be suppressed by increasing the height of the circumferential protrusion section 15. On the contrary, when the kneading relax effect such as "twisting" and "vibration" due to the vortical flow is desired to increase in suction massage, the water flow B1 has only to increase by lowering the height of the circumferential protrusion section 15 or without providing the circumferential protrusion section 15.

As the first embodiment of the present invention, the massage nozzle having the water-spray plate equipped with a plurality of water-spray holes is described above.

Second Embodiment

Next, as a second embodiment, a massage nozzle providing a massage effect due to physical vibration of a movable member is hereinafter described.

Figure 25:
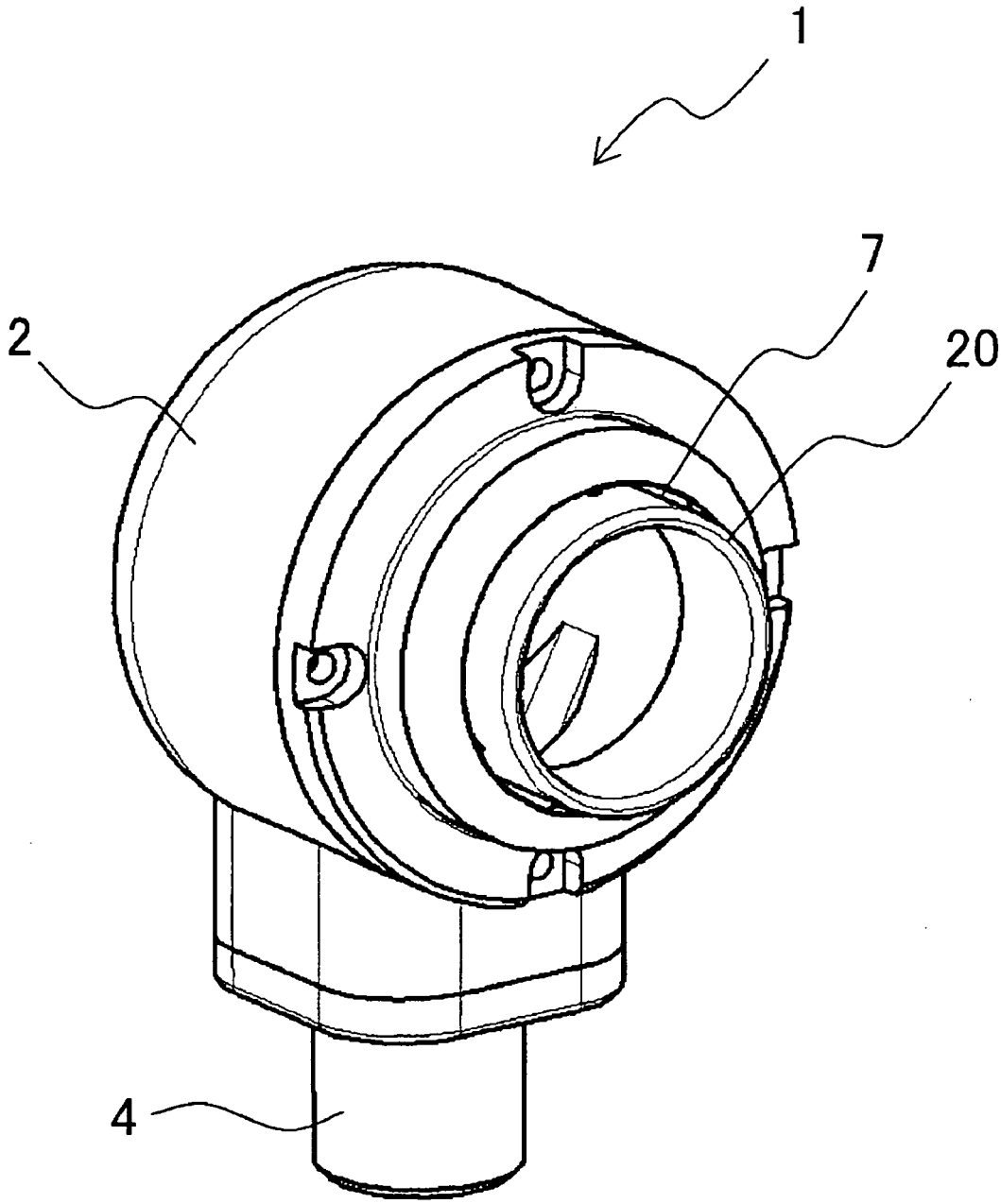
FIG. 25 is a perspective view showing a massage nozzle according to a second embodiment of the present invention.
Figure 26:
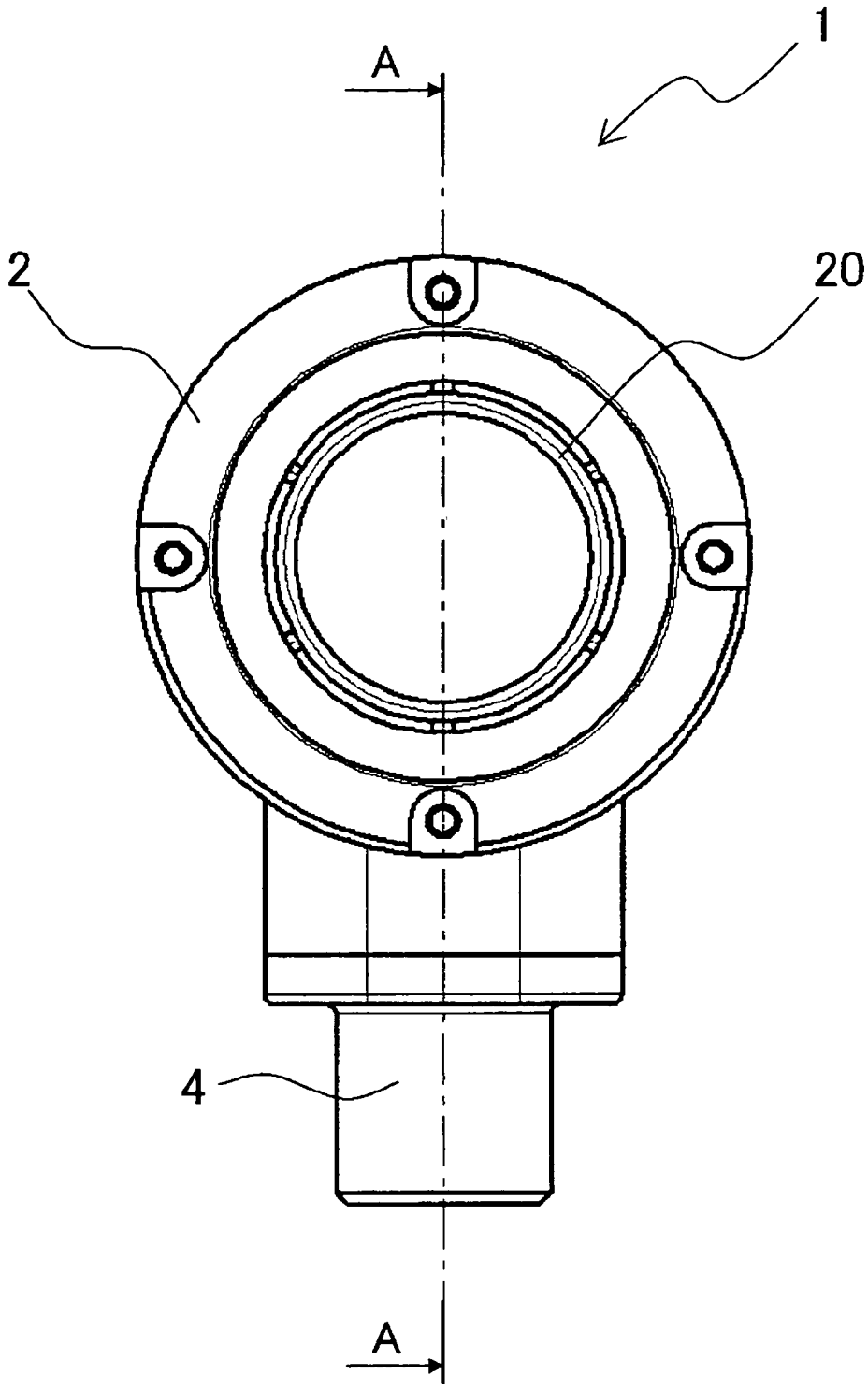
FIG. 26 is a front view showing the massage nozzle 1.
Figure 27:
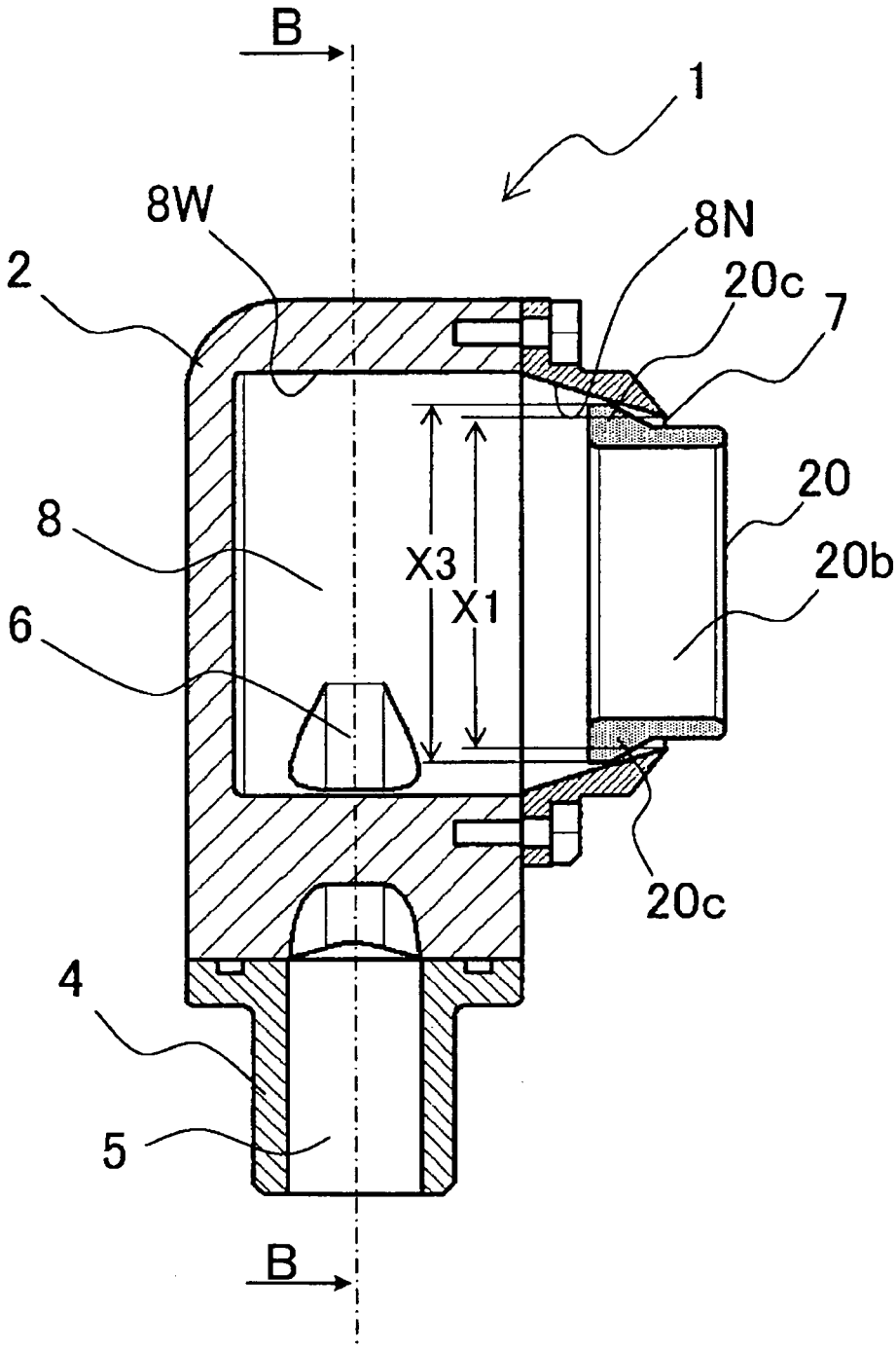
FIG. 27 is an A-A line sectional view of FIG. 26.
Figure 28:
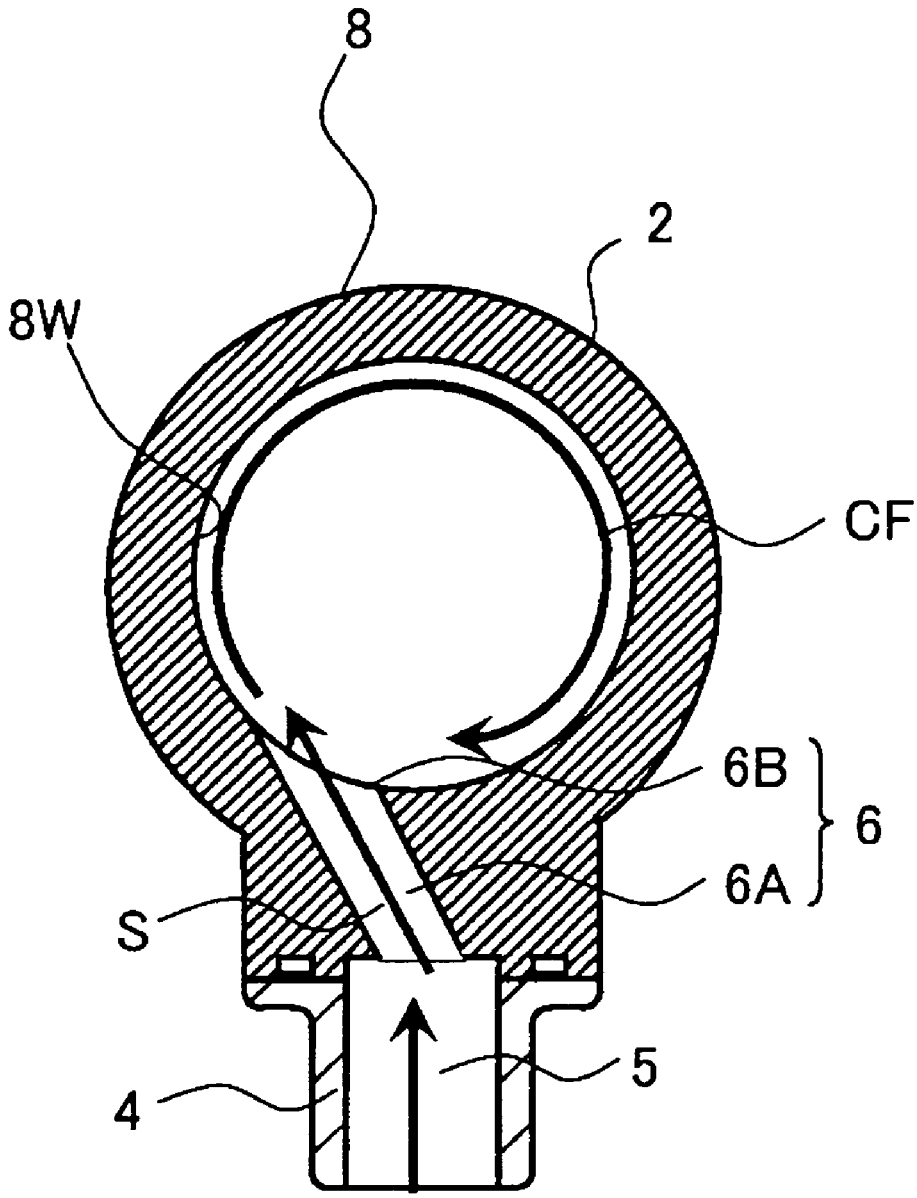
FIG. 28 is a B-B line sectional view of FIG. 27.

FIG. 25 to FIG. 28 are schematic views showing a massage nozzle according to the embodiment of the present invention. That is, FIG. 25 is a perspective view showing the massage nozzle 1, FIG. 26 is a front view, FIG. 27 is an A-A line sectional view of FIG. 26 and FIG. 28 is a B-B line sectional view of FIG. 27.

The massage nozzle 1 of the present embodiment has a vortex section 2 and a connection 4. The vortex section 2 is surrounded by the circumferential wall 8W and has the vortex chamber 8 whose section is semi-circular. The vortex chamber 8 has the narrowing section 8N whose inside diameter is gradually narrowed and forms the spouting port 7 whose end is opened.

The circumferential wall 8W is provided with the water intake section 6. As shown in FIG. 28, water is introduced in the semi-tangential direction of the circumferential wall 8W from the water intake section 6 to form a vortical flow CF along the circumferential wall 8W. The connection 4 is provided with the introduction route 5 which is opened to connect to the water intake section 6.

In order to efficiently form the vortical flow CF in the vortex chamber 8, it is preferable that the water intake section 6 is opened in the tangential direction of the circumferential wall 8W. However, even if the water intake section 6 is not opened correctly in the tangential direction of the circumferential wall 8W and the opening direction or opening position is misaligned with the tangential direction, the vortical flow CF has only to be formed.

In this case, the "water intake section 6" as shown in FIG. 28, includes a water intake route 6A to virtually determine the introduction direction of water flow to be introduced into the vortex chamber 8 and a water intake opening 6*b* as an opened end in the vortex chamber 8 of the water intake route 6A. In case of the massage nozzle 1 of the present specific example, the introduction direction of the water flow to be introduced into the vortex chamber 8 is an arrow mark S direction. Accordingly, the water intake route 6A corresponds to a way provided in the arrow mark S direction. In addition, a water intake opening 6*b* corresponds to the boundary between this waterway and the vortex chamber 8.

If the connection 4 is threaded like a general showerhead, it is convenient to connect to water piping such as a hose and the like.

In addition, according to the massage nozzle 1, the semi-cylindrical movable member 20 is inserted into the vortex chamber 8. As described below in detail, the movable member 20 performs the precession movement and the similar movements due to vortical flow CF to provide a highly-effective massage effect due to physical vibration.

Figure 29:
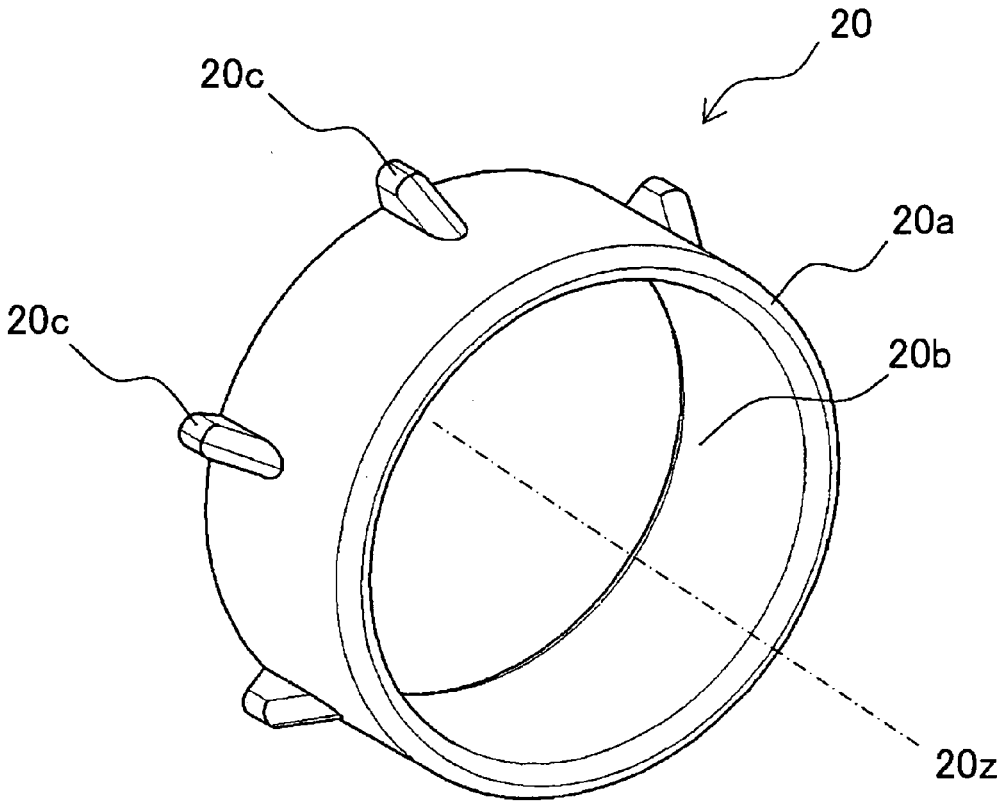
FIG. 29 is a perspective view of a movable member 20.

FIG. 29 is a perspective view of the movable member 20. That is, the movable member 20 of the present specific example has a cylindrical ring section 20*a* and a stopper 20*c* protruding from the outer circumference of the ring section 20*a*. The ring section 20*a* has an opening 20*b* inside. In addition, as shown in FIG. 27, the ring 20*a* is formed in a slightly smaller size than the diameter of the opening of the spouting port 7 as possible to protrude from the spouting port 7. Meanwhile, the circumference size of the movable member 20 including the end of the stopper 20*c* is designed to be larger than that of the spouting port 7 and the stopper 20*c* is designed to abut on the inside wall of the narrowing section 8N to prevent the movable member 20 from exiting the spouting port 7.

In addition, the movable member 20, as shown in FIG. 27, may have the ring section 20*a* whose end protrudes out of the spouting port 7 in a condition that the stopper 20*c* abuts the inside wall of the narrowing section 8N or in the same condition as described above, the end of the ring section 20*a* may not be designed to protrude from the spouting port 7. As described below, even if the movable member 20 does not protrude, various effects such as the vibration effect and the like can be obtained by applying the movable member 20 to the sucked site on the person's skin subject to treatment.

In addition, as shown in FIG. 27, if the outside dimension X3 of the stopper 20*c* is designed to be larger than the diameter X 1 of the spouting port 7, the movable member 20 can be prevented from detaching from the spouting port 7 and it enable a user to easily handle. In addition, as illustrated in FIG. 29, the stopper 20*c* may be designed to be placed in a semi-symmetrical manner to the central axis 20*z*. However, even if not placed in a semi-symmetrical manner, the movable member 20 has only not to pass through the spouting port 7.

Next, the massage nozzle 1 of the present embodiment is hereinafter described.

First, the suction effect with the massage nozzle 1 is described and the operation of the movable member 20 is described below.

Figure 30:
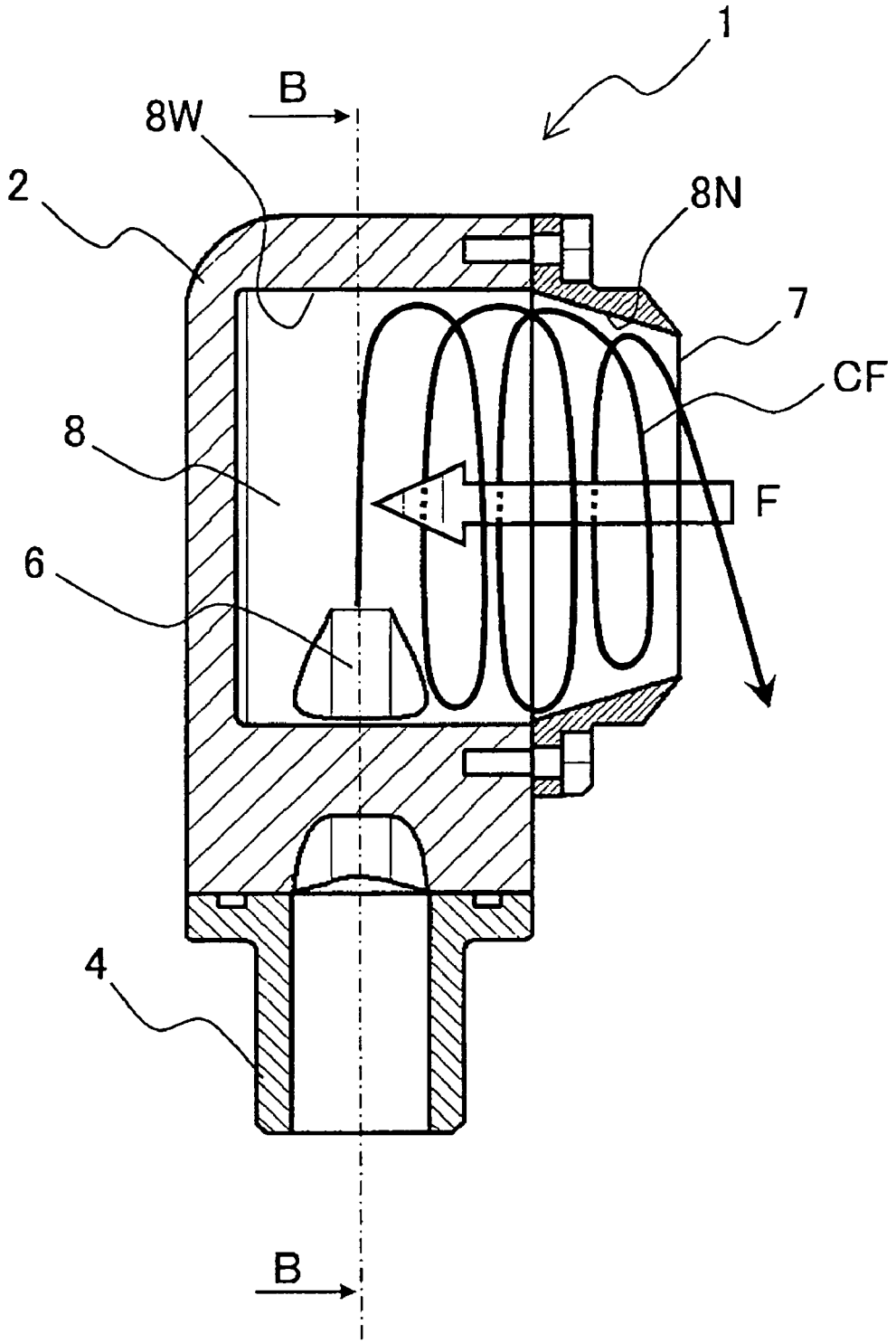
FIG. 30 is a schematic sectional view showing a condition in which water is supplied to the massage nozzle 1 according to an embodiment of the present invention.
Figure 31:
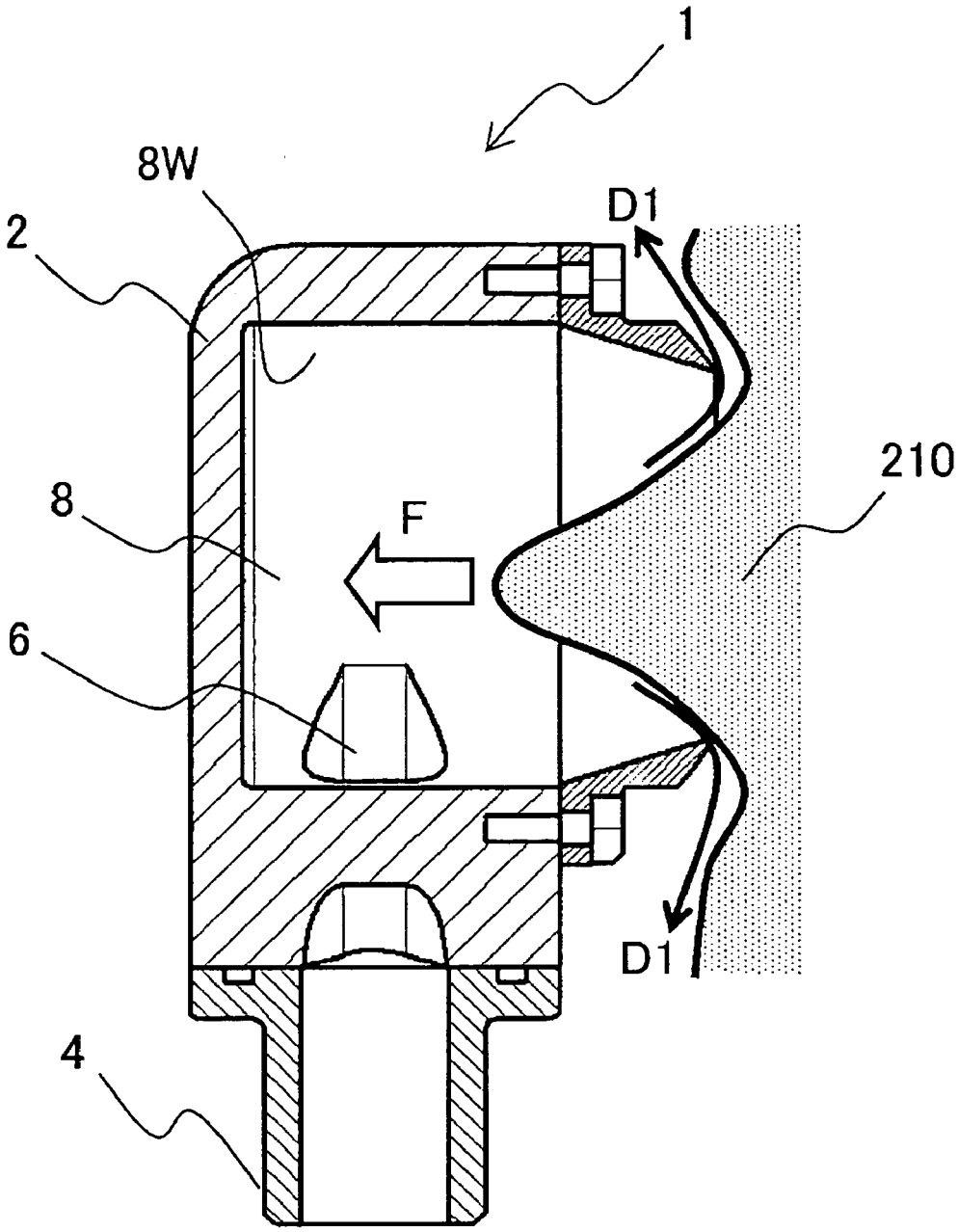
FIG. 31 is a schematic sectional view showing a condition in which massage is performed by the massage nozzle 1 according to an embodiment of the present invention.

FIG. 30 is a schematic sectional view showing a condition in which water is supplied to the massage nozzle 1 according to the present embodiment. In addition, FIG. 31 is a schematic sectional view showing a condition in which massage is performed by this massage nozzle 1. Furthermore, in order to simplify the illustration in these drawings, the movable member 20 was intentionally omitted.

The water fed by a water-supply means, which is not illustrated, passes through an introduction route 5 in the connection 4 and is introduced into the vortex chamber 8 from the water intake section 6 in the vortex section 2. At this time, as the water intake section 6 is opened in the tangential direction of the vortex chamber 8, the water introduced into the vortex chamber 8 forms the vortical flow CF. This vortical flow CF reaches a spouting port 7 while rotating along the circumferential wall 8W and increasing the flow rate at the narrowing section 8N, and finally is spouted outside.

At this time, a centrifugal force with the vortical flow CF produces a negative-pressure region around the center of the vortex chamber 8, therefore, a force to pull into the vortex chamber 8 from the outside of the massage nozzle 1 along the central axis of the spouting port 7 (hereinafter referred to as "vortical suction force") is generated.

If the above massage nozzle 1 is drawn close to a treatment site (210) on a person's body, as shown in FIG. 31, the vortical suction force F generated due to the effects of vortical flow CF. As a result, the site on the person's skin subject to treatment 210 is deformed by the suction force and a highly-effective suction massage effect can be obtained. In addition, at this time, a uniform water film due to the spouted water flow D1 is formed between the site on the person's skin subject to treatment 210 and the spouting port 7. The site on the person's skin subject to treatment 210 is depressed in a doughnut-shaped manner due to the water film formed by the water flow D1, the central section is sucked into the spouting port 7 by intensive vortical suction force F and is deformed three-dimensionally to undergo effective suction massage. That is, the site on the person's skin subject to treatment 210 undergoes depression force at the periphery and intensive suction force in the center at the same time. In addition, the water flow D1 due to the spouted water of the vortical flow CF provides the site on the person's skin subject to treatment 210 with a "twisting" effect. The site on the person's skin subject to treatment 210 is three-dimensionally deformed by the above-mentioned actions and undergoes "kneading relax effect" due to vibration.

In addition, since the water film formed by the water flow D1 always exists between the spouting port 7 and the site on the person's skin subject to treatment 210, the massage nozzle 1 can be smoothly moved while applying the massage nozzle 1 to the site on the person's skin subject to treatment 210 undergoing suction massage, enabling the site on the person's skin subject to treatment 210 to undergo suction massage widely.

The suction massage effect with the massage nozzle 1 is described above.

Next, operations of the movable member 20 are hereinafter described.

The movable member 20 undergoes the effect of the vortical flow CF and performs the precession movement or the similar movements. First, the precession movement is hereinafter described.

Figure 32:
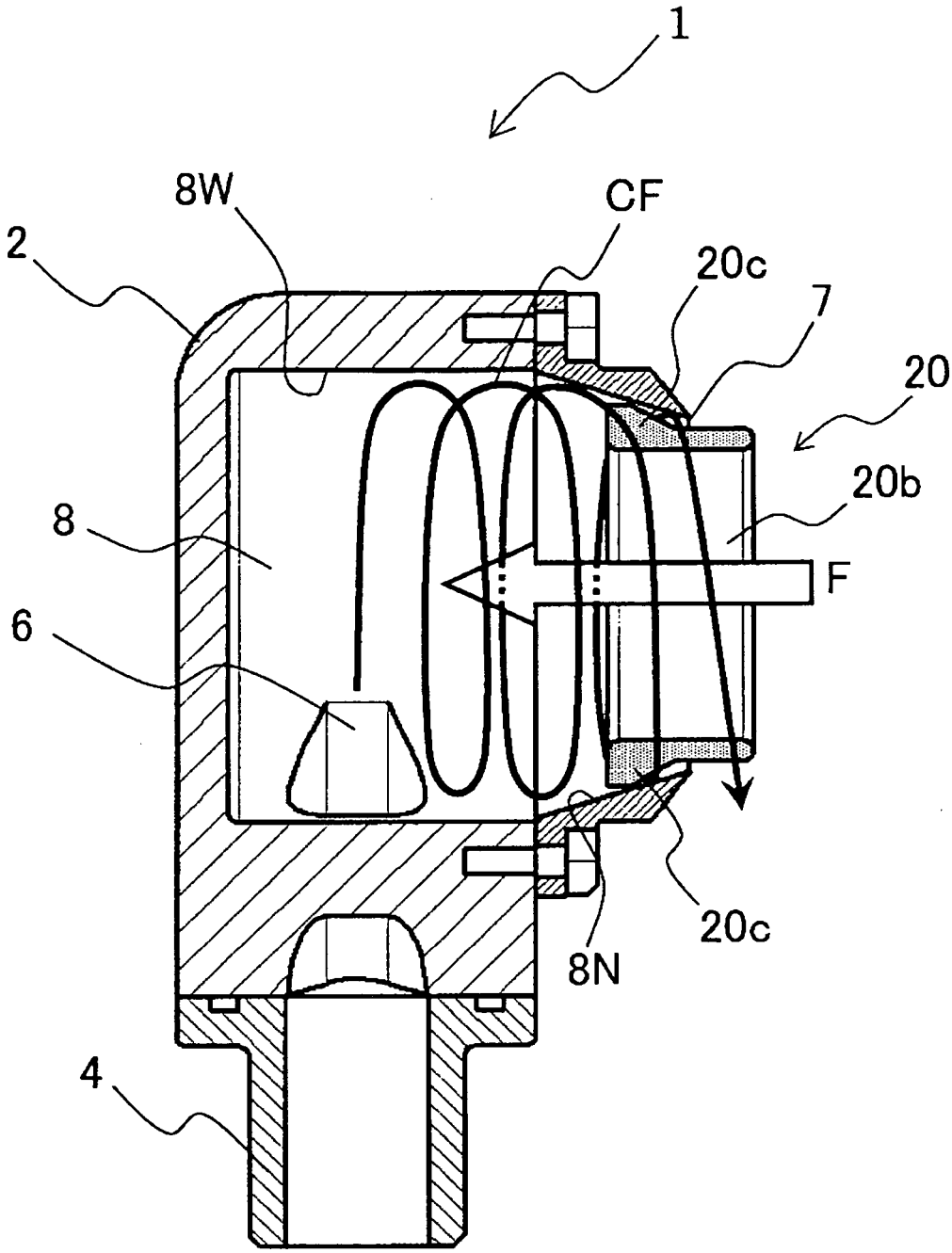
FIG. 32 is a sectional view describing the operation of the massage nozzle 1 of the present invention in which the movable member 20 is provided.

FIG. 32 is a sectional view describing the operation of the massage nozzle 1 in which the movable member 20 is provided. That is, in case that the movable member 20 is provided, if water is introduced into the vortex chamber 8, the pressure due to vortical flow CF pushes the movable member 20 in the direction of the spouting port 7 as illustrated and lets the stopper 20*c* abut on the narrowing section 8N. In addition, as described above in FIG. 30, the water introduced from the water intake section 6 forms the vortical flow CF in the vortex chamber 8. This vortical flow CF is spouted from the spouting port 7 via the clearance between the inside wall of the narrowing section 8N and the outside wall of the movable member 20. In addition, some part of the vortical flow CF is overflowed from the opening 20*b* of the movable member 20 via the narrowing section 8N. In addition, the negative region formed in the vortex chamber 8 generates the vortical suction force F via the opening 20*b* of the movable member 20.

Figure 33:
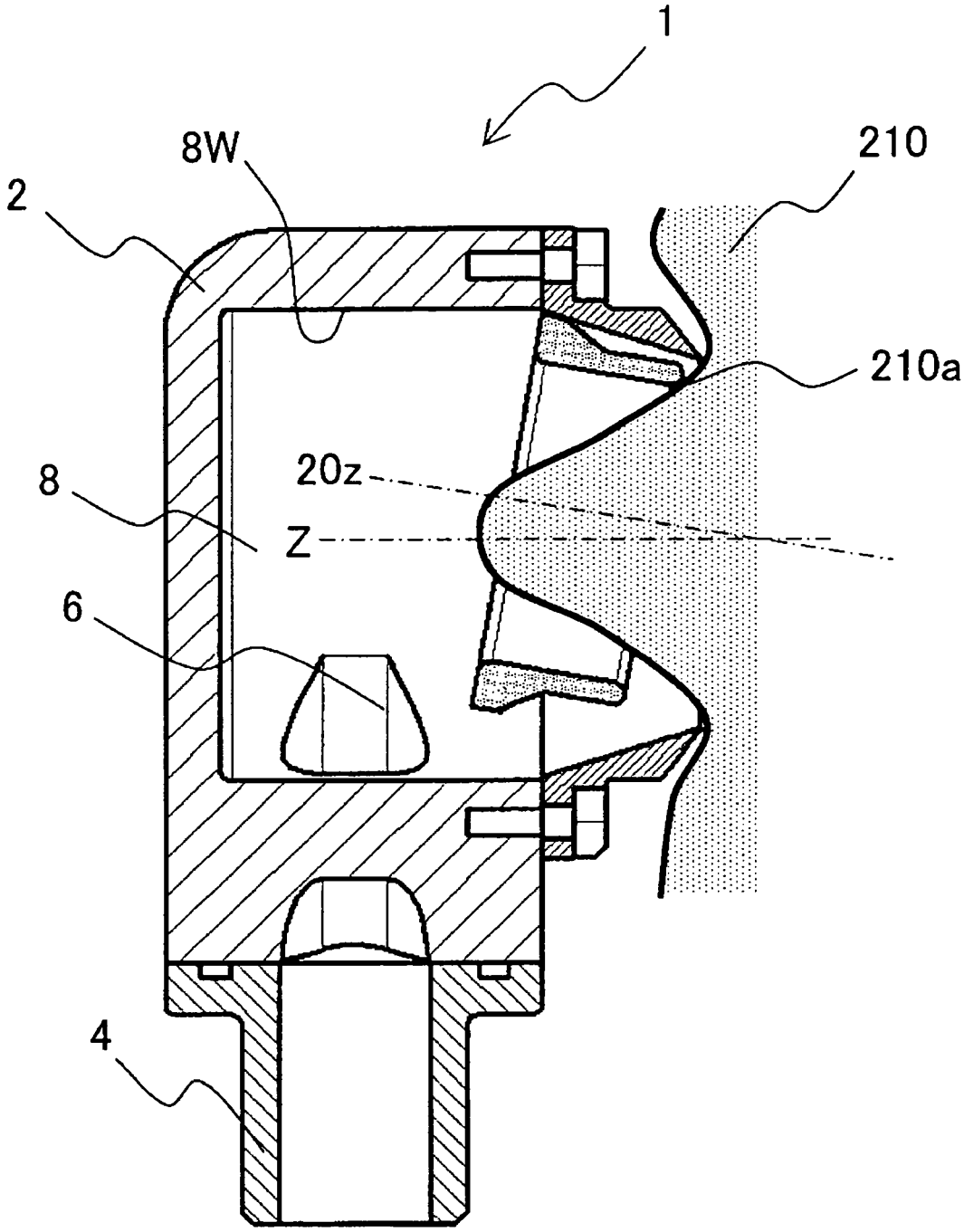
FIG. 33 is a schematic sectional view describing the operation of the movable member 20 in a condition where the massage nozzle 1 is applied to a site on the person's skin subject to treatment 210.
Figure 34:
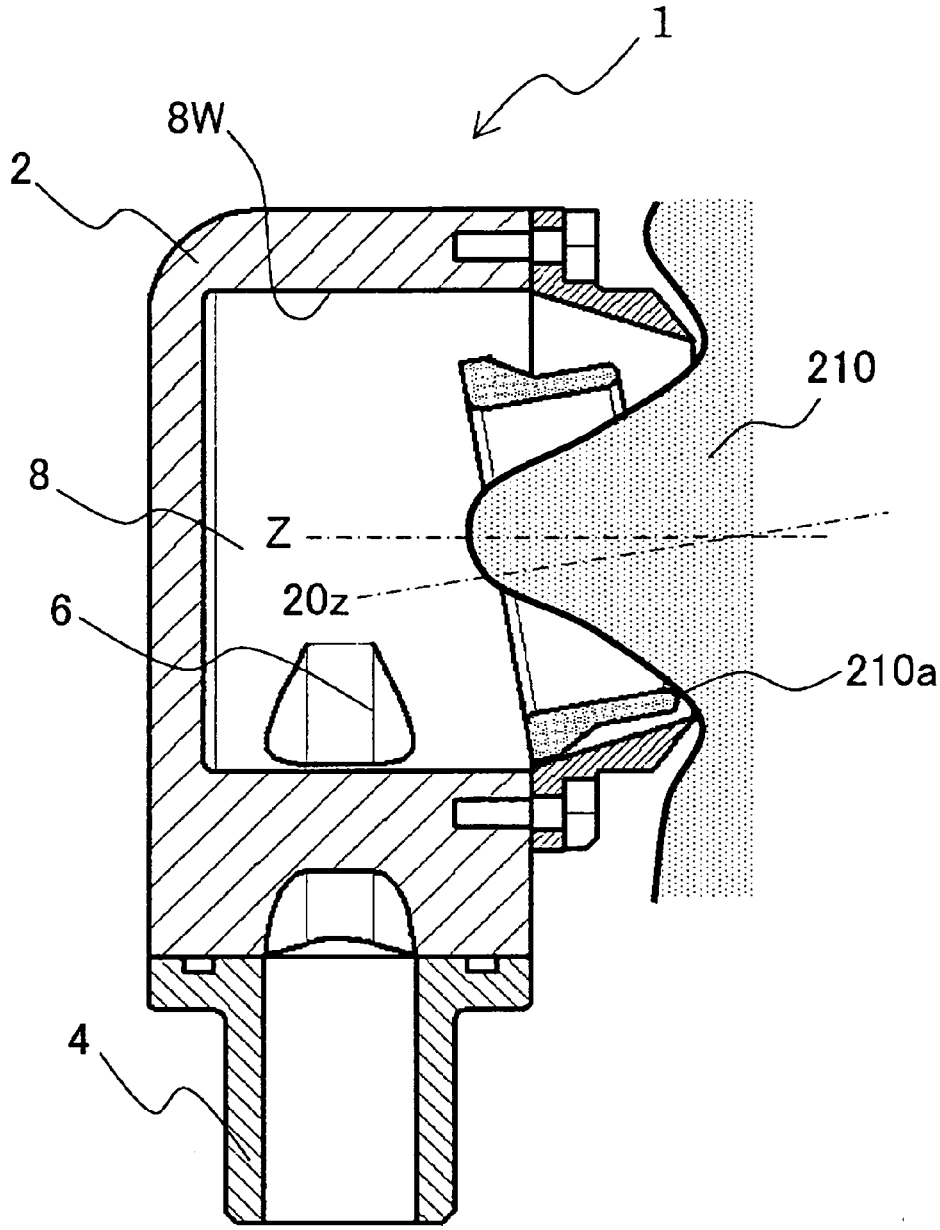
FIG. 34 is a schematic sectional view describing the operation of the movable member 20 in a condition where the massage nozzle 1 is applied to a site on the person's skin subject to treatment 210.

FIG. 33 and FIG. 34 are schematic sectional views describing the operation of the movable member 20 in a condition where the massage nozzle 1 is applied to a site on the person's skin subject to treatment. If letting the massage nozzle 1 get close to the site on the person's skin subject to treatment 210 of a human body, some part is pulled into the vortex chamber 8 due to the vortical suction force F. At this time, the site on the person's skin subject to treatment 210 pushes the movable member 20 into the vortex chamber 8. If the movable member 20 pushed into the vortex chamber 8 undergoes adjustment arbitrarily regarding the configuration parameters such as its shape, size and the like, the position relationship in parallel with the spouting port 7 is not maintained and the movable member rotates at a slant as illustrated. That is, the movable member 20 autorotates around the central axis 20*z*. In addition, the central axis 20*z* maintains the inclined position to the rotation axis Z of the vortical flow CF and rotates around the rotation axis Z. It may be that this movement is the similar movement to the precession movement of a top. This movement by the movable member 20 provides a highly-effective massage and bioeffect to the site on the person's skin subject to treatment 210. That is, as shown in FIG. 33 and FIG. 34, collisional stimulation can be provided by collision of the end of the movable member 20 at a slant with some part 210*a* of the site on the person's skin subject to treatment. In addition, a vibration-like stimulation is provided to the site on the person's skin subject to treatment 210 by rotation at a slant of the movable member 20. As a result, the "kneading relax effect" to the site on the person's skin subject to treatment 210 can be remarkably strengthened.

Figure 35:
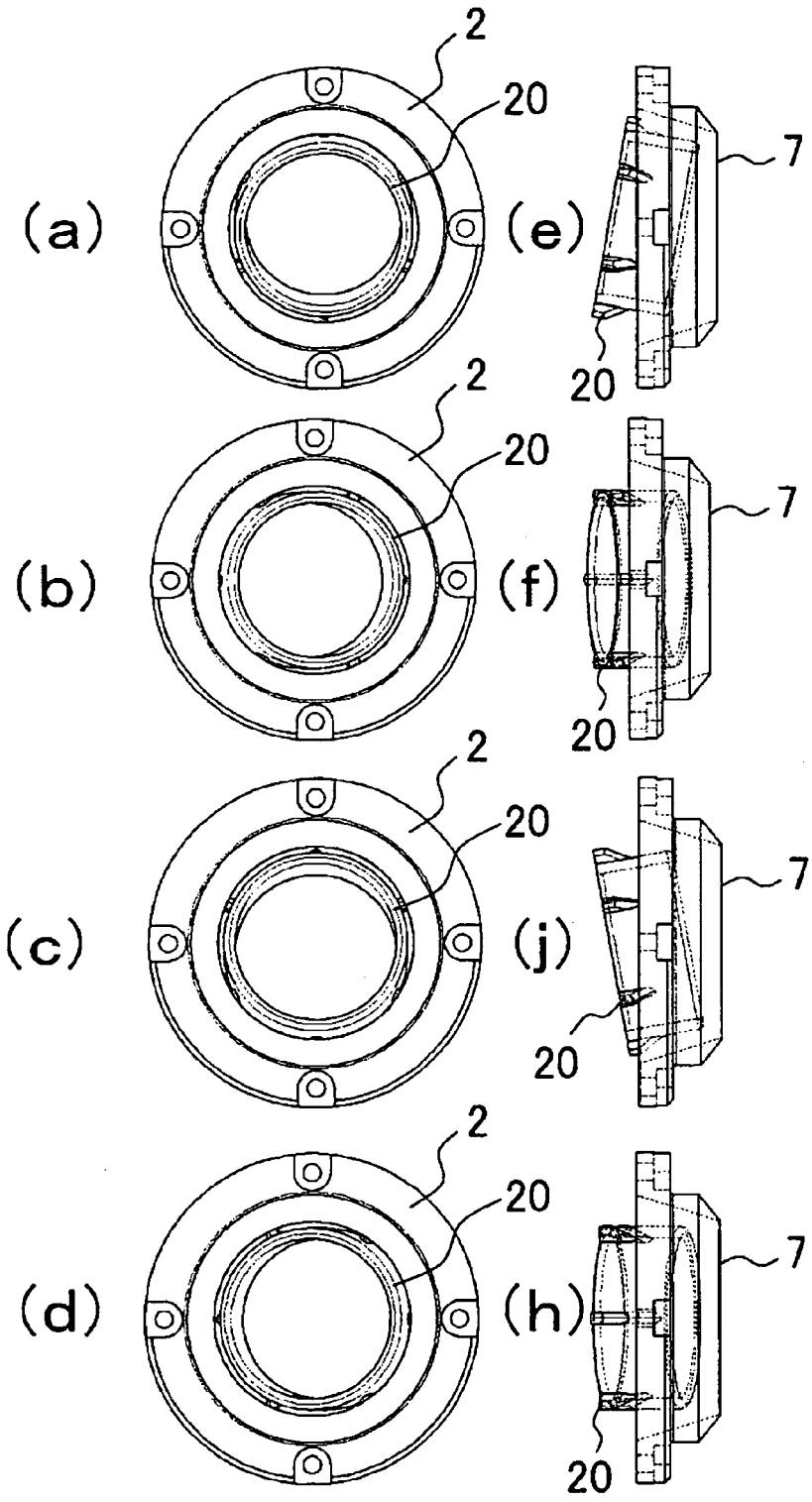
FIG. 35 is a schematic view showing the operation of the movable member during suction massage.
Figure 36:
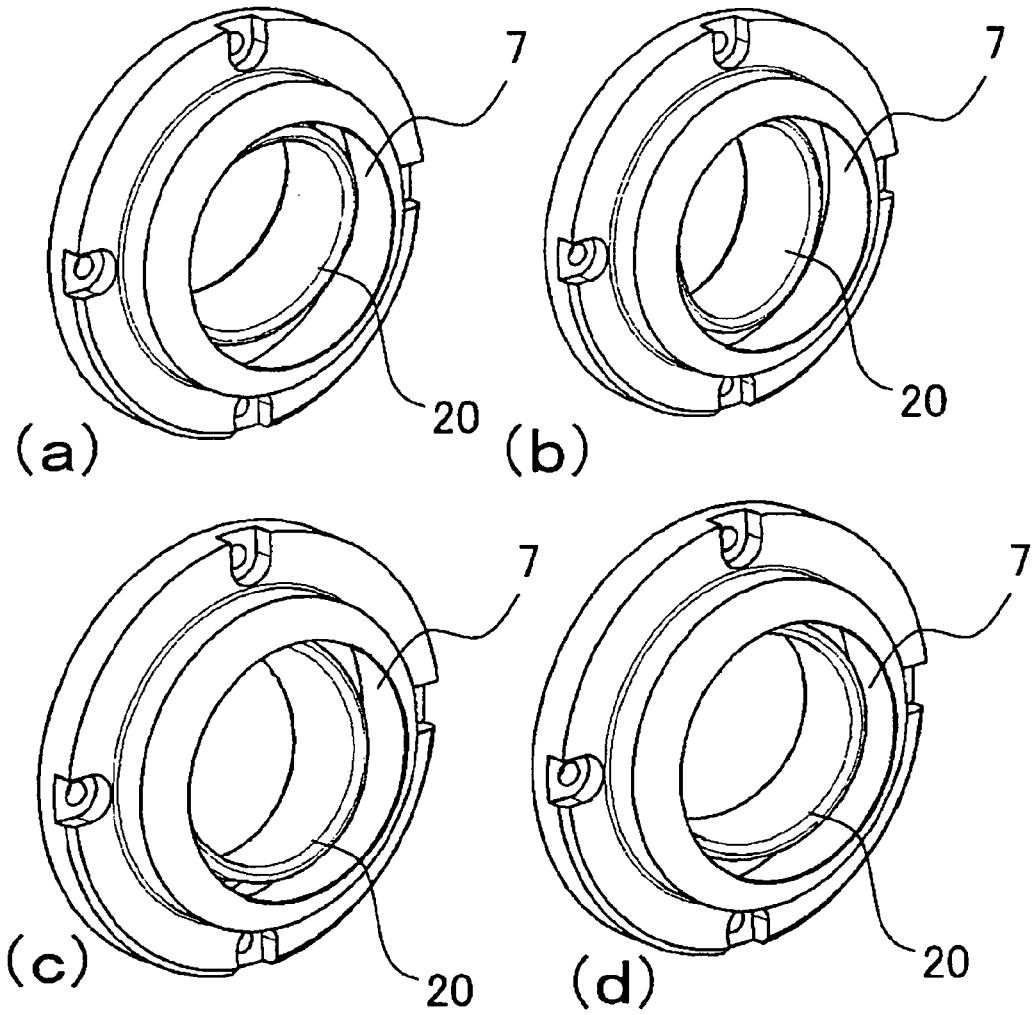
FIG. 36 is a schematic view showing the operation of the movable member during suction massage.
Figure 37:
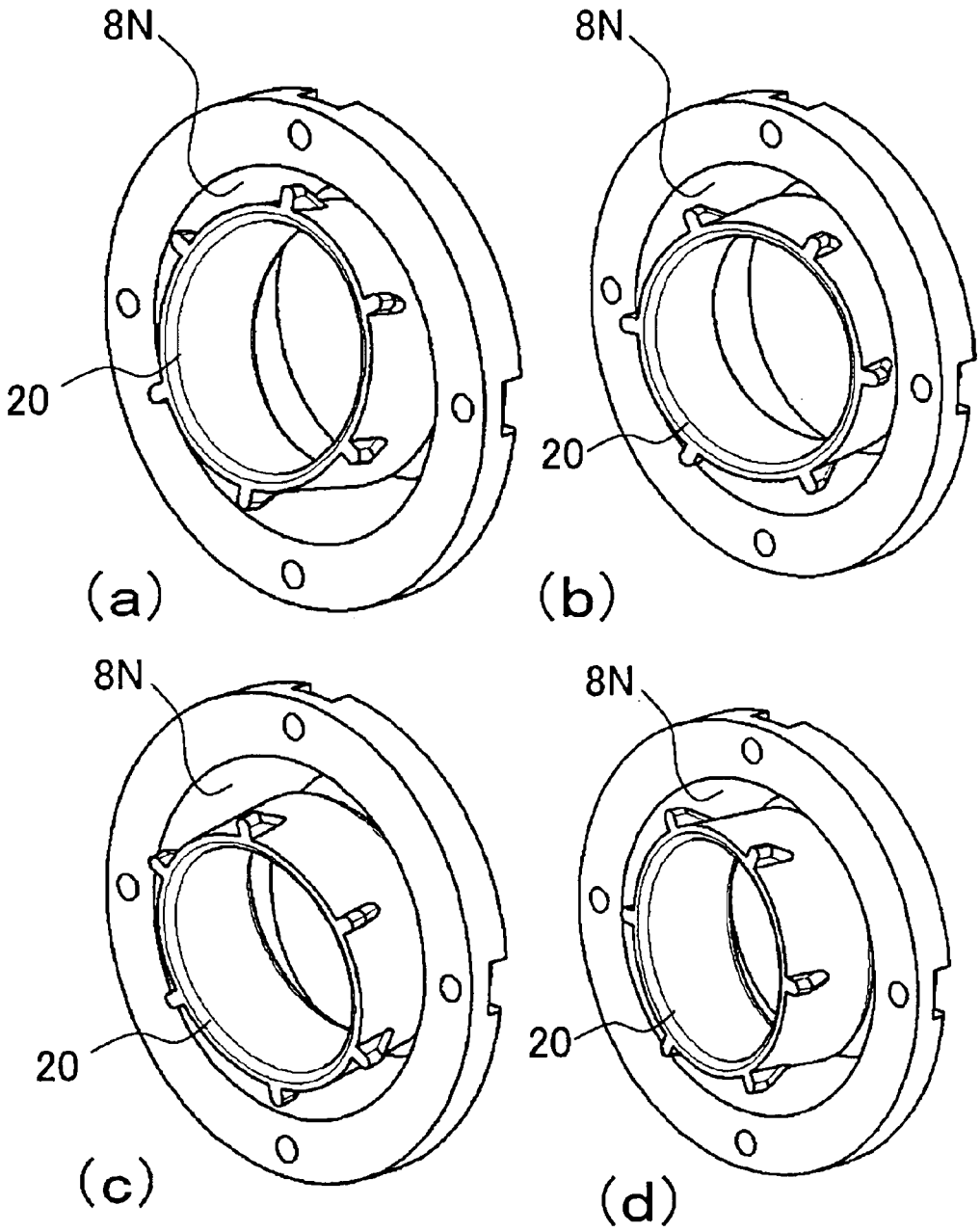
FIG. 37 is a schematic view showing the operation of the movable member during suction massage.

FIG. 35 to FIG. 37 are schematic views showing the operation of the movable member during suction massage.

That is, FIGS. 35(*a*) to (*d*) are front views of the spouting port 7 and the FIGS. 35(*e*) to (*h*) are perspective views of the spouting port 7 viewing from the side.

In addition, FIG. 36 is a perspective view of the spouting port 7 viewing from above of slope.

In addition, FIG. 37 is a disassembly perspective view of the spouting port 7 from the back side.

As shown in these drawings, the movable member 20 performs the "precession movement" at a slant due to the vortical flow CF. That is, the movable member 20 is changed as it autorotates around the central axis 20z (shown in FIG. 29. FIG. 33 and FIG. 34) and the rotation axis, i.e. the central axis 20z rotates around the rotation axis Z.

The reason why the movable member 20 moves as above shown is hereinafter described.

Figure 38:
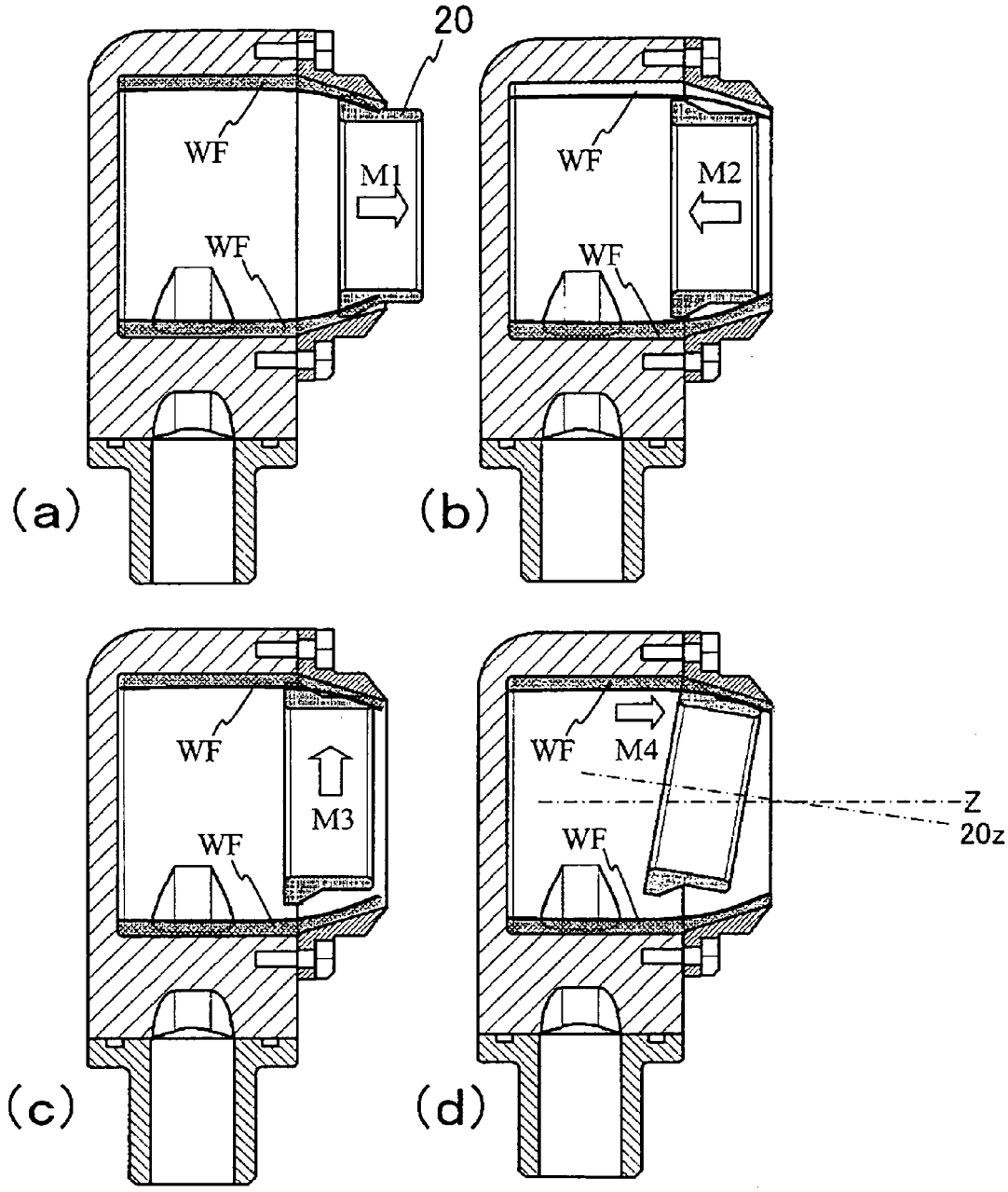
FIG. 38 is a schematic view describing the movement of the movable member 20 during suction massage.

FIG. 38 is a schematic sectional view describing the movement of the movable member 20.

That is, FIG. 38(*a*) shows an opened water-spouting condition in the same manner as FIG. 32. That is, it shows the condition where the water is introduced from water intake section 6 into the vortex chamber 8 to form a vortical flow. In this condition, the movable member 20 is pushed in the arrow mark M1 direction due to the exhaust pressure of the spouting flow. In addition, it lets the stopper 20c of the movable member 20 abut on the narrowing section 8N of the vortex chamber. At this time, the water film WF of the vortex chamber is formed along the circumferential wall 8W of the vortex chamber.

Next, FIG. 38(*b*) shows the moment when the massage nozzle is pushed against the site on the person's skin subject to treatment (not shown). If the massage nozzle is pushed against the site on the person's skin subject to treatment while standing against the exhaust force of the spouting flow, the movable member 20 is moved in the direction shown by the arrow mark M2 and pushed into the vortex chamber 8. With the movable member 20 pushed into the vortex chamber 8 as described above, if the movable member 20 exists on the central axis ideally, it is assumed that it is well-balanced and maintains the existing style.

However, the movable member 20 is located eccentrically in the radial direction (for example, in the arrow mark M3 direction) from the center of the vortex chamber due to various factors as shown FIG. 38(*c*). As a factor to cause the movable member 20 to be located eccentrically as described above, the eccentricity due to deformation of the site on the person's skin subject to treatment 210 (not illustrated), the relative movement between the site on the person's skin subject to treatment 210 and the massage nozzle and the effect of the gravity of the movable member 20 are given. For example, if the movable member 20 is made of plastic and the like with lighter gravity than that of water, buoyancy is given to the movable member 20 (this massage nozzle can be for example, used with it immersed in water and hot water of a bathtub). As a result, as shown by the arrow mark M3 in FIG. 38(*c*), the movable member 20 is moved perpendicularly and eccentrically located.

If the movable member 20 is eccentrically located in the vortex chamber 8 as described above, the exhaust force of the vortical flow affecting the movable member 20 does not become isotropic. That is, as shown in FIG. 38(*d*), the one side of the movable member 20 is caused to be deeply immersed in the water film WF of the vortical flow. As a result, the exhaust force of the vortical flow affects the one side of the movable member 20 more strongly and the movable member 20 is caused to be inclined as shown by the arrow mark M4.

The movable member 20 rotates due to the rotational force of the vortical flow at a slant as described above. That is, the movable member 20 autorotates around the central axis 20z. In addition, the central axis 20z rotates around the rotation axis Z while the central axis 20z maintains the inclined position to the central axis Z of the vortex chamber 8.

As described above, "precession movement" is given as a specific example of various movements of the movable member 20 of the massage nozzle 1. Thus, the "precession movement" of the movable member 20 while being located eccentrically from the vortical flow CF can provide physical vibration to the site on the person's skin subject to treatment 210. That is, the movable member 20 alternately affects the pressure force on the site on the person's skin subject to treatment pulled into the vortex chamber 8 due to the vortical suction force F from the circumference while rotating. In the sensory evaluation through sensory evaluation conducted by the inventor of the present invention, the movable member 20 performing the precession movement is applied to the site on the person's skin subject to treatment from the circumference, which causes vibration as shaking in the rotation direction of the vortical flow CF and in combination with the suction effect synergistically generates a highly-effective massage feeling. That is, providing the movable member 20 can provide a comfortable and effective vibration effect and in addition, enables more effective suction massage.

For the vibration effect with which the movable member 20 provides the site on the person's skin subject to treatment, the inventor of the present invention measured using a high-speed video camera and a vibration pickup. As a result, the frequency of the vibration due to the movable member 20 was found to be about 10 to 40 Hz and the frequency of vibration tended to increase as water flow rate increases. According to the research thus far by the inventor of the present invention, the vibration frequency at which a person using the massage nozzle feels the most comfortable is several dozen hertz. According to the present embodiment, it was found that the vibration with this band range of frequency is obtained. In addition, these facts are the same as those of a massage nozzle with a guide section 10 as described below.

As described below in detail, the movable member 20 performs various movements in addition to the "precession movement" is some cases. The inclination conditions of the movable member 20 and the mode of autorotation or orbital rotation vary depending on the size of the movable member 20 and the vortex chamber 8 and the configuration parameter such as size, shape and the like. Depending on combination of configuration parameters, the movable member 20 almost is not located eccentrically or inclined but only autorotates around the central axis 20z. In another case, the movable member 20 may orbit the central axis Z and may autorotate without being inclined and with being located eccentrically to the central axis Z. In addition, the movable member 20 does not autorotate but only orbits the central axis Z. Furthermore, the central axis 20z of the movable member 20 does not intersect with the central axis Z of the vortex chamber but maintains the inclined "twist" direction relationship and rotates and orbits. In the specification of one or more aspects of the present invention, these movements are referred as the "similar movement" to the "precession movement".

Figure 39:
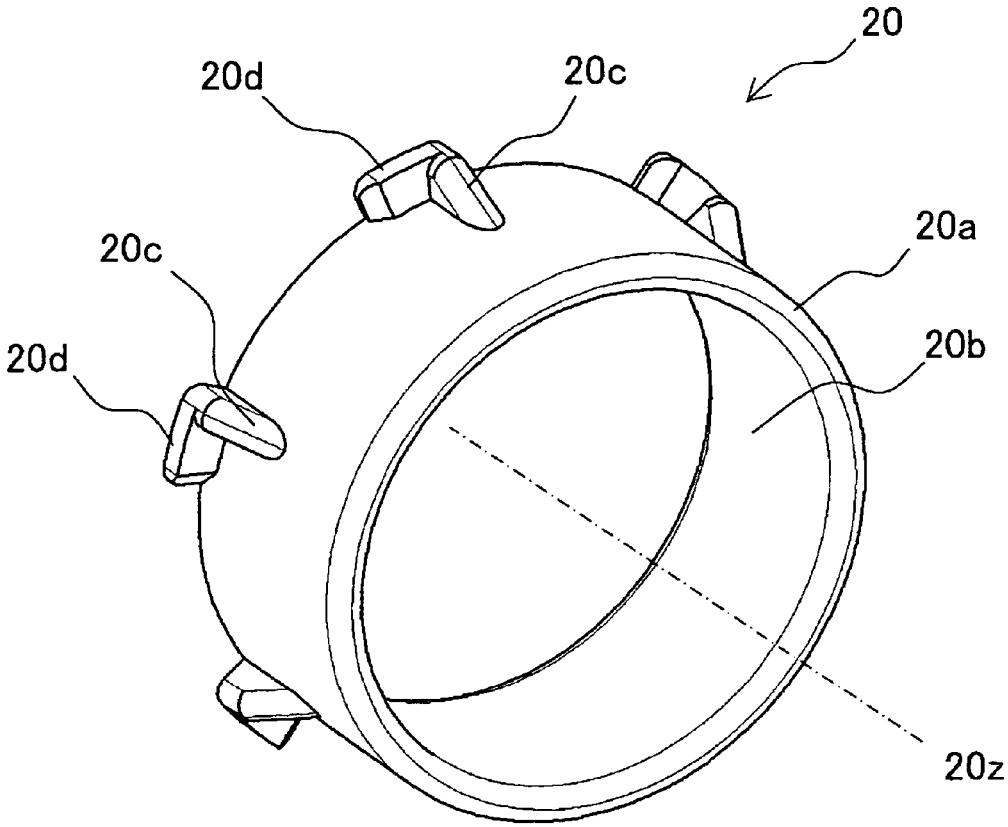
FIG. 39 is a schematic sectional view describing another specific example to a movable member with which the massage nozzle 1 can be provided according to an embodiment of the present invention.

FIG. 39 is a schematic sectional view describing another specific example to a movable member with which the massage nozzle 1 can be provided according to an embodiment of the present invention. That is, the movable member 20 of the present specific example has a rib 20d on a root of a stopper 20c protruding from the outer circumference of a cylindrical ring section 20a. The ribs 20d are provided in semi-parallel with the autorotation direction of the movable member 20.

These ribs 20d have the effects to firmly receive the exhaust force moving toward the spouting port 7 of the vortical flow CF and increase the pressure to press the movable member 20 against the spouting port 7. As a result, it contributes to enhance the collisional stimulation and vibration-like stimulation.

In addition, a movable member as described above may be designed to be detachable to/from the main body of the massage nozzle 1. For example, in case of the massage nozzle 1 illustrated in FIG. 25 to FIG. 28, some part of the narrowing section 8N can be detachable to/from the vortex section 2 and the movable member 20 may be replaced from there arbitrarily.

Thus, the movable members 20 based on user's desired shape or size arbitrarily can be selected and classified into each user, providing users with a convenient use style.

Figure 40:
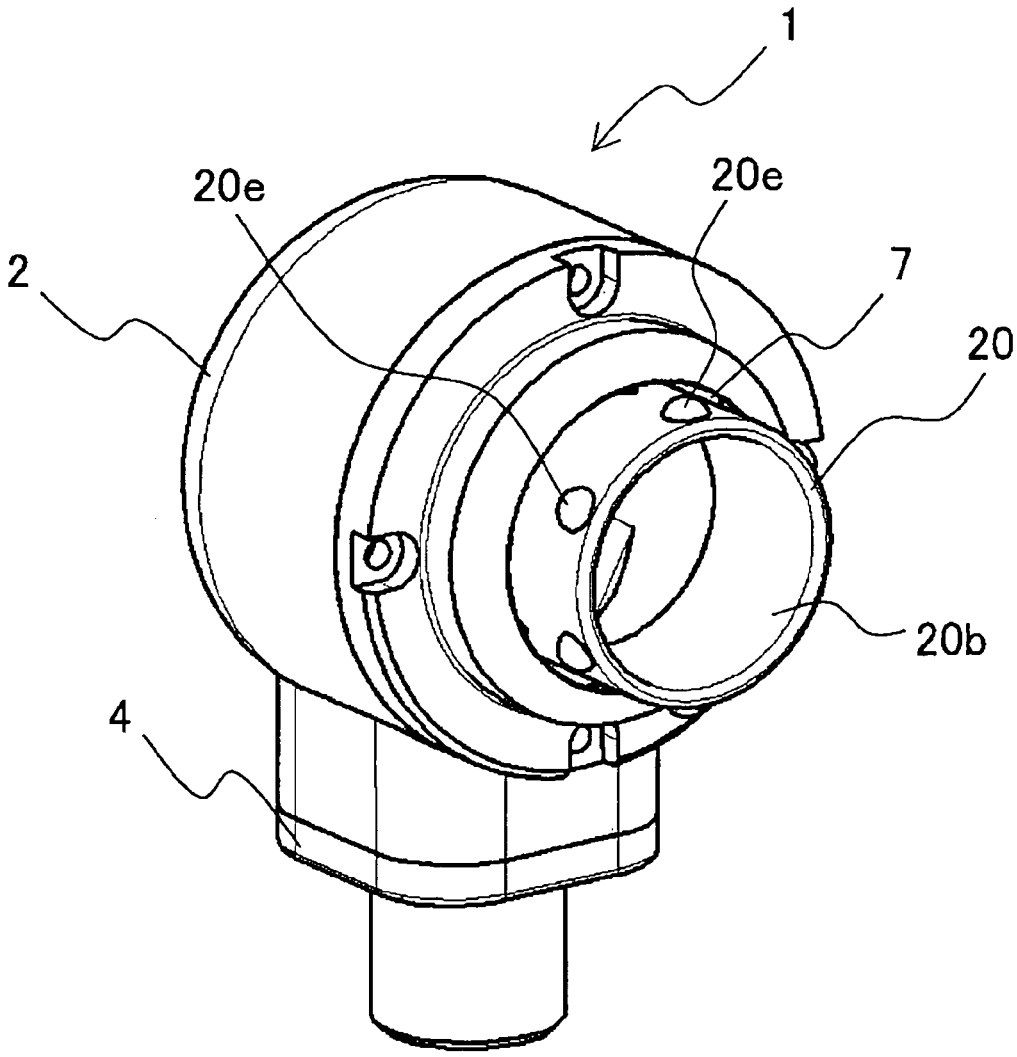
FIG. 40 is a perspective view showing the massage nozzle 1 as a second specific example of an embodiment of the present invention.
Figure 41:
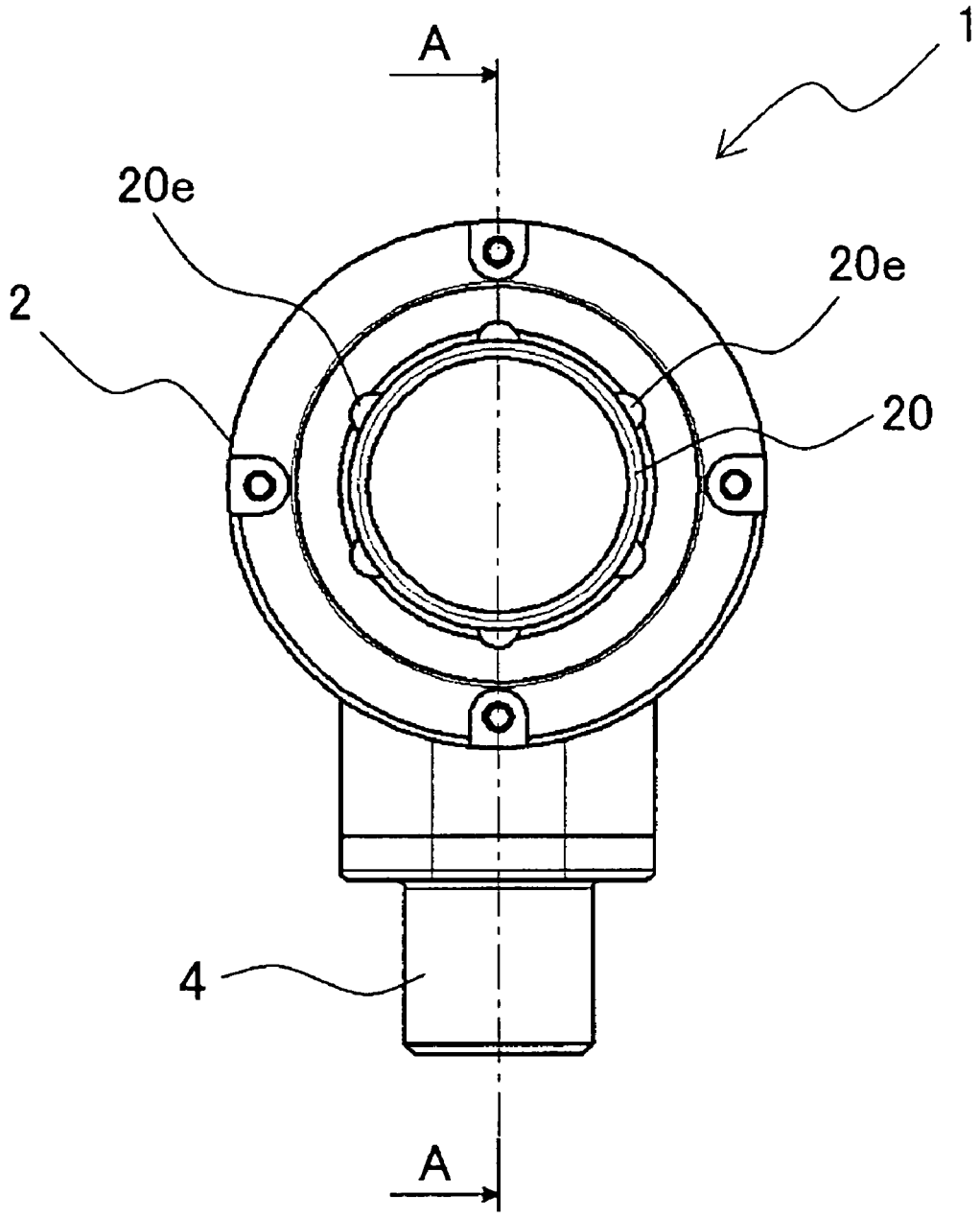
FIG. 41 is a front view showing the massage nozzle 1.
Figure 42:
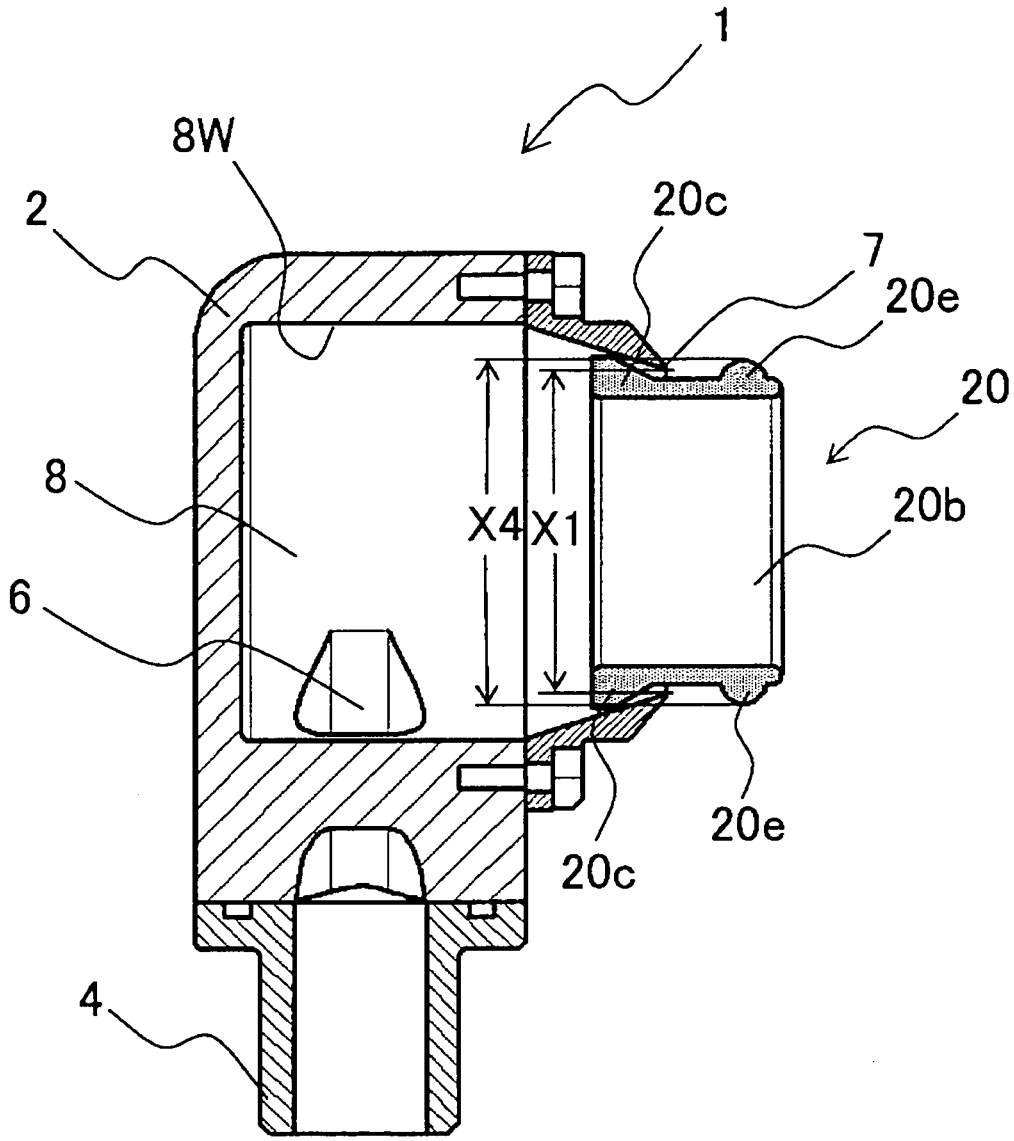
FIG. 42 is an A-A line sectional view of FIG. 41.
Figure 43:
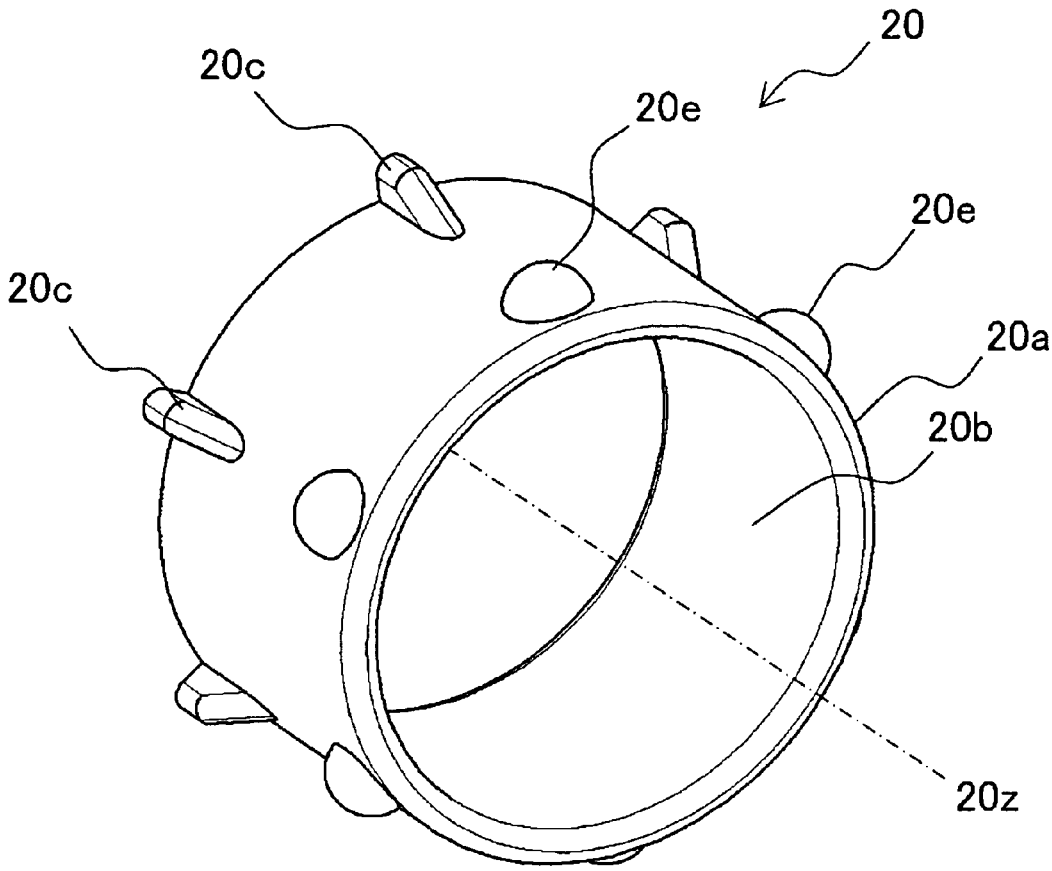
FIG. 43 is a perspective view showing the movable member 20 as a specific example of the present invention.

FIG. 40 to FIG. 42 are perspective views showing the massage nozzle as a second specific example of the present embodiment. FIG. 40 is a perspective view of the massage nozzle 1. FIG. 41 is a front view and FIG. 42 is an A-A line sectional view of FIG. 41. FIG. 43 is a perspective view showing the movable member 20 as the present specific example of invention. In these drawings, as to the same elements as described above in FIGS. 25 to 39, detailed description by attaching the same numerals is omitted.

The massage nozzle 1 of the present specific example is provided with the movable member 20 having a slightly longer whole length. As shown in FIG. 43, the movable member 20 has the cylindrical ring section 20*a*, the stopper 20*c* protruding from the outer circumference at the back side and the second stopper 20*e* protruding from the outer circumference around the end of the ring section 20*a*. The second stopper 20*e* plays a role to prevent the movable member 20 from sinking into the vortex chamber 8. That is, as shown in FIG. 42, the outer circumference size X4 including the end of the second stopper 20*e* is designed to be formed in a larger size than that of the opening diameter X1 of the spouting port 7. In addition, as shown in FIGS. 41 and 43, the stopper 20*e* may be designed to be placed in a semi-symmetrical manner to the central axis 20*z*. However, even if not placed in a semi-symmetrical manner, the movable member 20 has only to be provided so that it is not sunk into the vortex chamber 8 from the spouting port 7.

Thus, the movable member 20 is not pressed into the vortex chamber 8 and the suction condition with the opening 20*b* of the movable member 20 in contact with the site on the person's skin subject to treatment is maintained even if the massage nozzle 1 is applied to the site on the person's skin subject to treatment.

Figure 44:
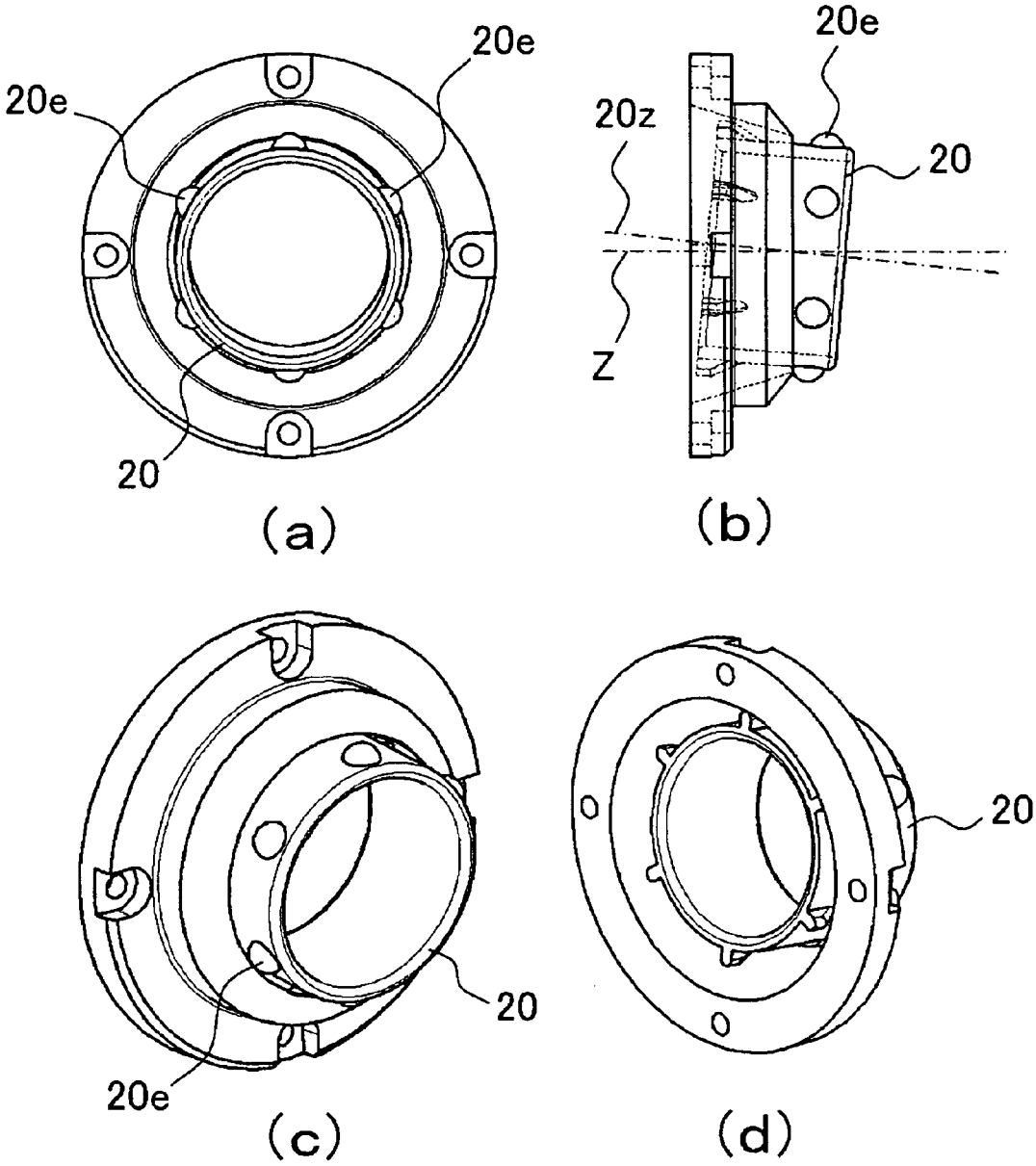
FIG. 44 is a schematic view showing a part of the operation of the movable member 20 of the massage nozzle as a specific example the present invention.

FIG. 44 is a schematic view showing some part of the operation of the movable member 20 of the massage nozzle 1 of the present specific example.

That is, FIG. 44(*a*) is a front view of the spouting port 7, FIG. 44(*b*) is a side view of the spouting port 7, FIG. 44(*c*) is a view of the spouting port 7 viewing from upper side and FIG. 44(*d*) is a view of the spouting port 7 viewing from back side.

As shown in these drawings, also according to the present specific example, the movable member 20 maintains the inclined position to the rotation axis Z of the vortical flow and performs "precession movement" and the similar movements. However, according to the present specific example, the movable member 20 maintains the protruding position from the spouting port 7. Accordingly, if the suction massage is performed, the site on the person's skin subject to treatment 210 can undergo a shaking massage in a circumferential direction according to the "precession movement" of the movable member 20 and the similar movements while being sucked by the opening 20*b* of the movable member 20.

That is, according to the present specific example, in addition to the suction effect due to the vortical flow, the "precession movement" and the similar movements of the opening 20*b* provides the whole suction section with a shaking-like vibration to greatly promote the massage effect.

Figure 45:
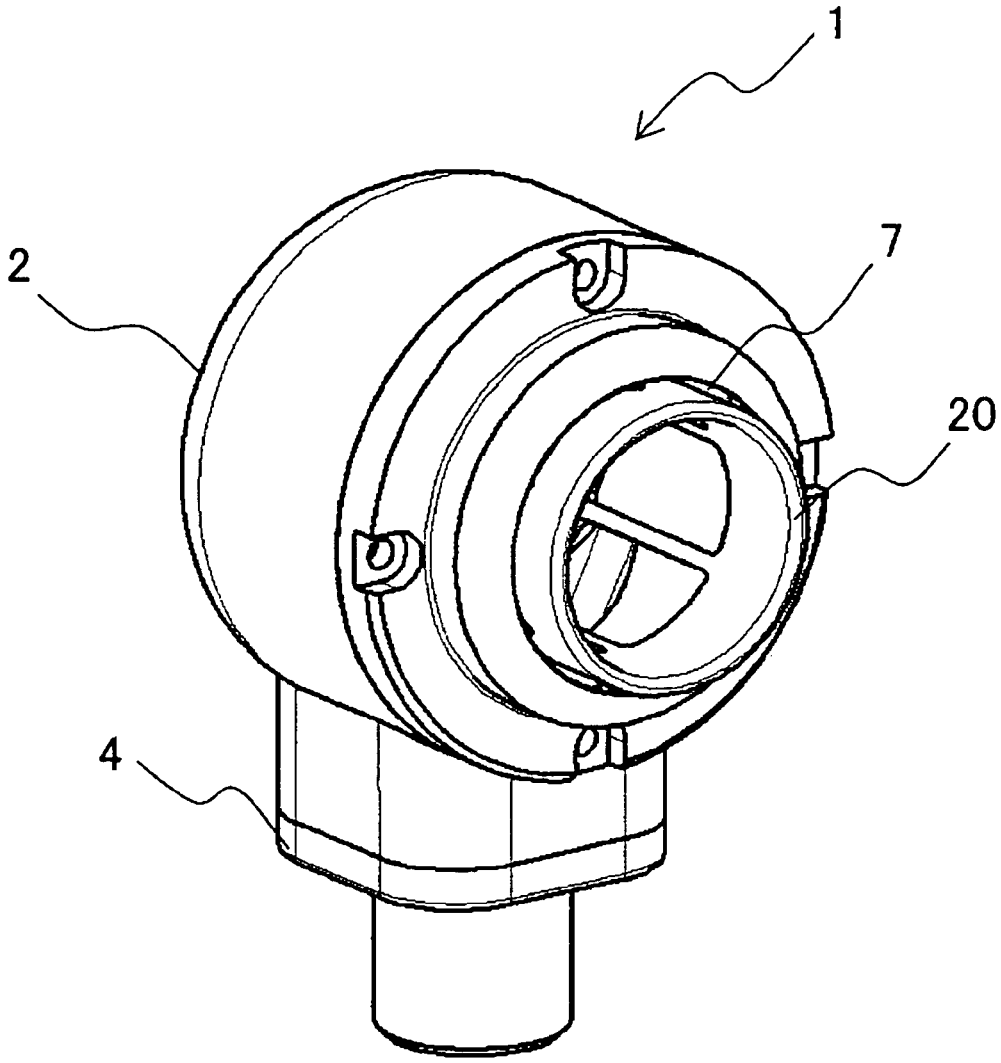
FIG. 45 is a schematic view showing the massage nozzle 1 as a third specific example of the present invention.
Figure 46:
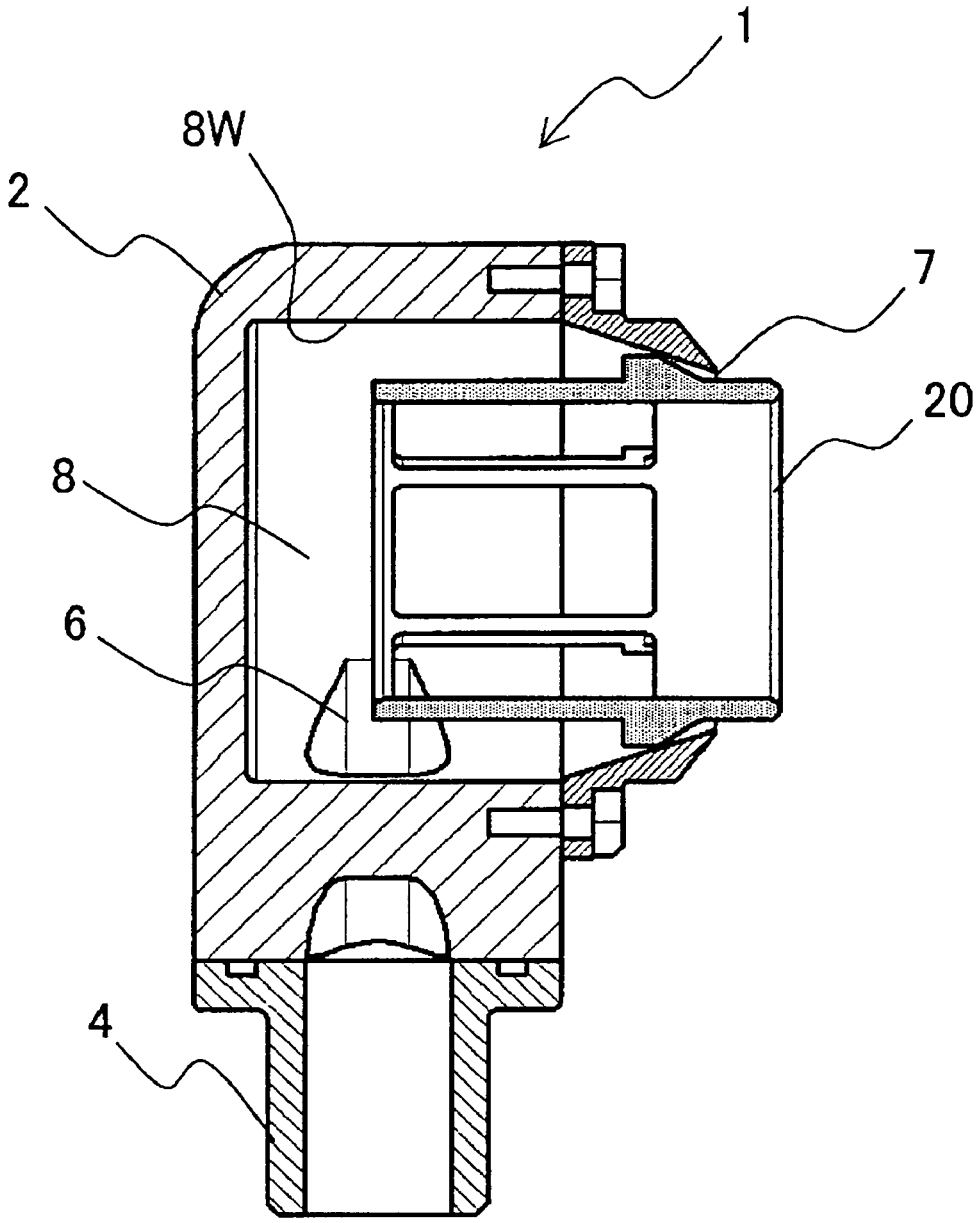
FIG. 46 is a vertical section showing the massage nozzle 1.
Figure 47:
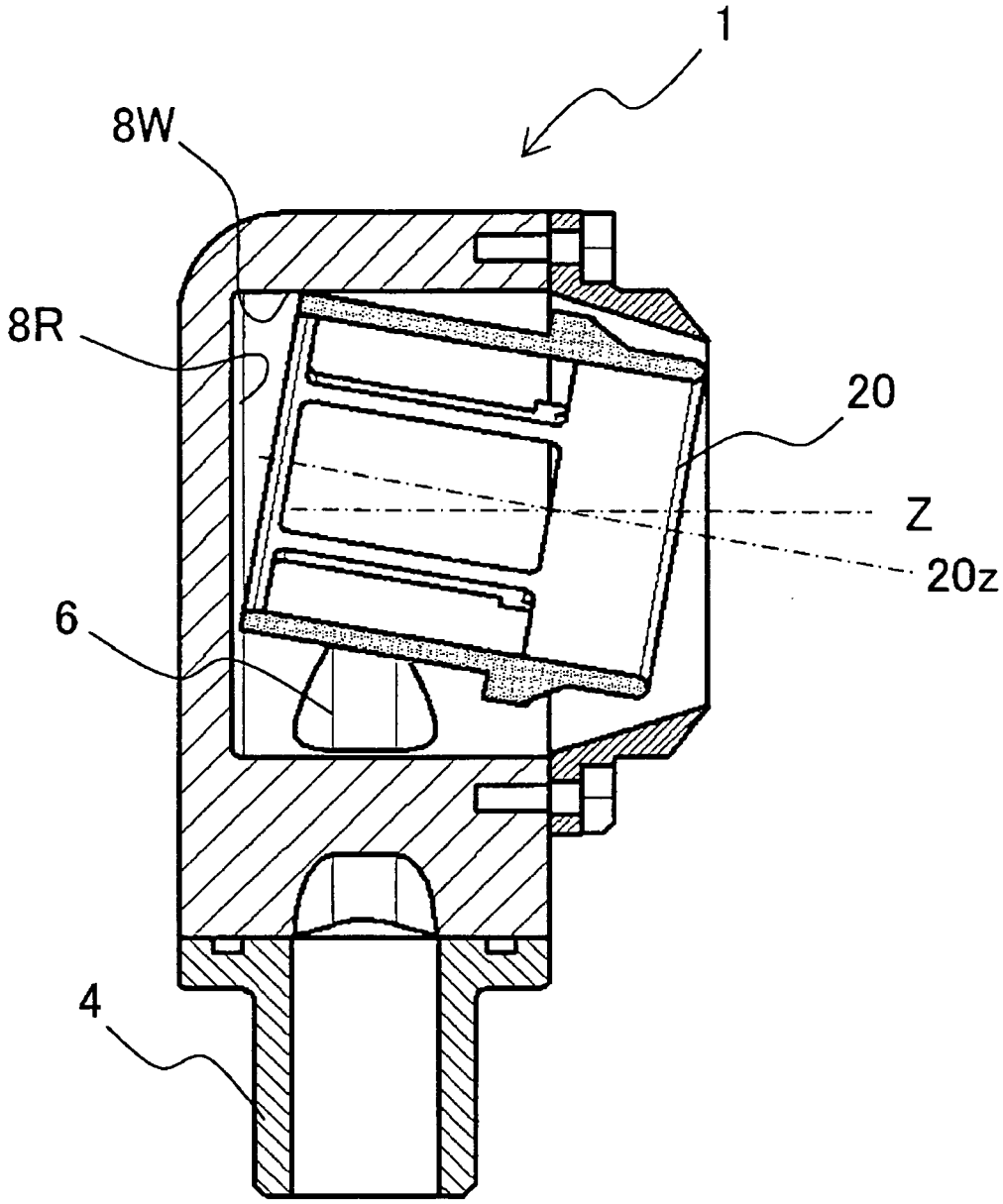
FIG. 47 is a vertical section showing the massage nozzle 1.
Figure 48:
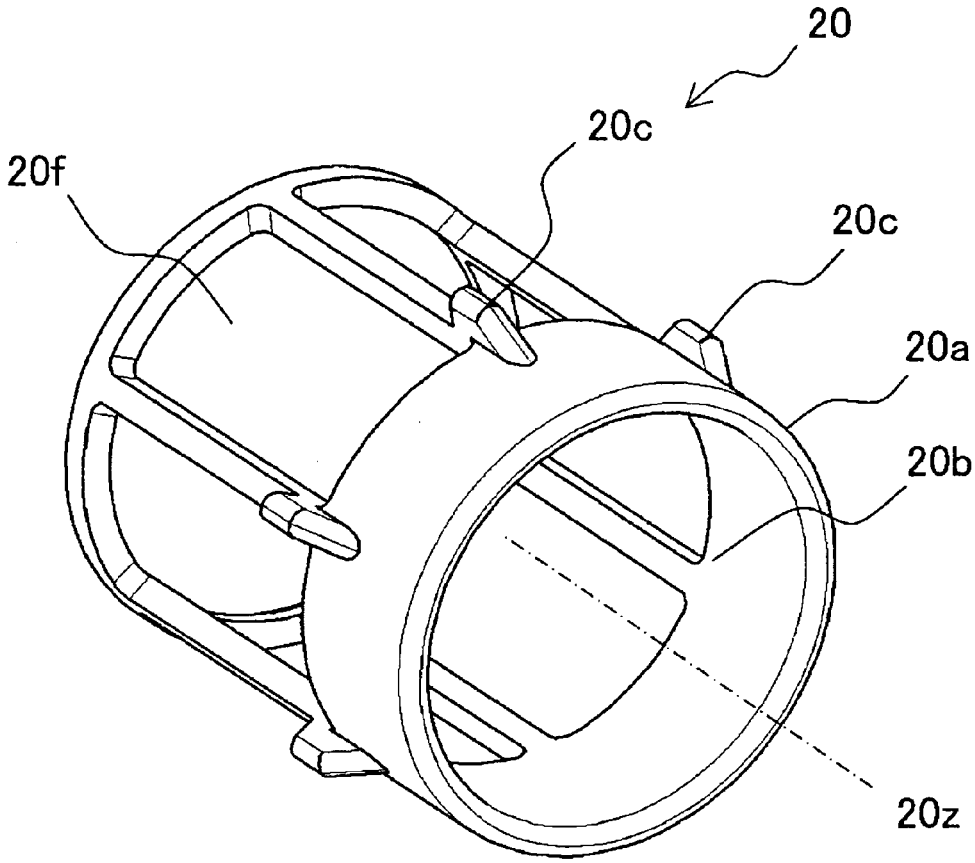
FIG. 48 is a perspective view showing the movable member 20.

FIGS. 45 to 47 are schematic views of the massage nozzle as a third example of the present embodiment. That is, FIG. 45 is a perspective view of the massage nozzle 1 and FIG. 46 and FIG. 47 are vertical sections of the massage nozzle 1. FIG. 48 is a perspective view showing the movable member 20. Also in these drawings, as to the same elements as described above in FIGS. 25 to 44, detailed description by attaching the same numerals is omitted.

According to the massage nozzle 1 of the present specific example, the movable member 20 having a longer whole length is provided to extend into the vortex chamber 8. As shown in FIG. 48, the movable member 20 has the cylindrical ring section 20*a* and the stopper 20*c* protruding from the outer circumference. In addition, the ring section 20*a* is extended further backward from the stopper 20*c* and the extended section is provided with a plurality of side openings 20*f*.

As shown in FIG. 47, this movable member 20 is pressed into the vortex chamber 8 by the site on the person's skin subject to treatment (not illustrated) during operation. However, since the ring section 20*a* is longer, the rear end section abuts the bottom surface 8R of the vortex chamber 8 and the circumferential wall 8W. At this time, the side opening 20*f* is formed at the ring section 20*a*, and the water to be introduced from the water intake section 6 will not be blocked. In addition, the "precession movement" around the rotation axis Z and the similar movements are performed while rotating around the central axis 20*z*. As a result, the site on the person's skin subject to treatment undergoes suction effect and the suction section undergoes a shaking-like in a circumference direction to obtain a highly-effective massage effect.

In addition, according to the present specific example, arbitrarily setting the length of the ring section 20*a* can adjust the relative position between the movable member 20 and the spouting port 7. That is, among the sites subject to treatment to be sucked into the inside from the spouting port 7, the ratio of a part which is sucked into the opening 20*b* of the movable member 20 and undergoes direct shaking-like vibration due to the "precession movement" and the similar movements can be arbitrarily set. If the length of the ring 20*a* is designed to be longer, since the movable member 20 more strongly comes in contact with the site on the person's skin subject to treatment, collisional stimulation and vibration-like stimulation can be provided more strongly.

Also according to the present specific example, the movable member 20 can be designed to be detachable to/from the main body of the massage nozzle 1. For example, some part of the narrowing section 8N can be detachable from the vortex section 2 and the movable member 20 may be replaced from there arbitrarily.

Thus, the length of the ring 20*a* movable member bases on user's desired shape or size arbitrarily can be selected and classified into each user, providing users with a convenient use style.

Figure 49:
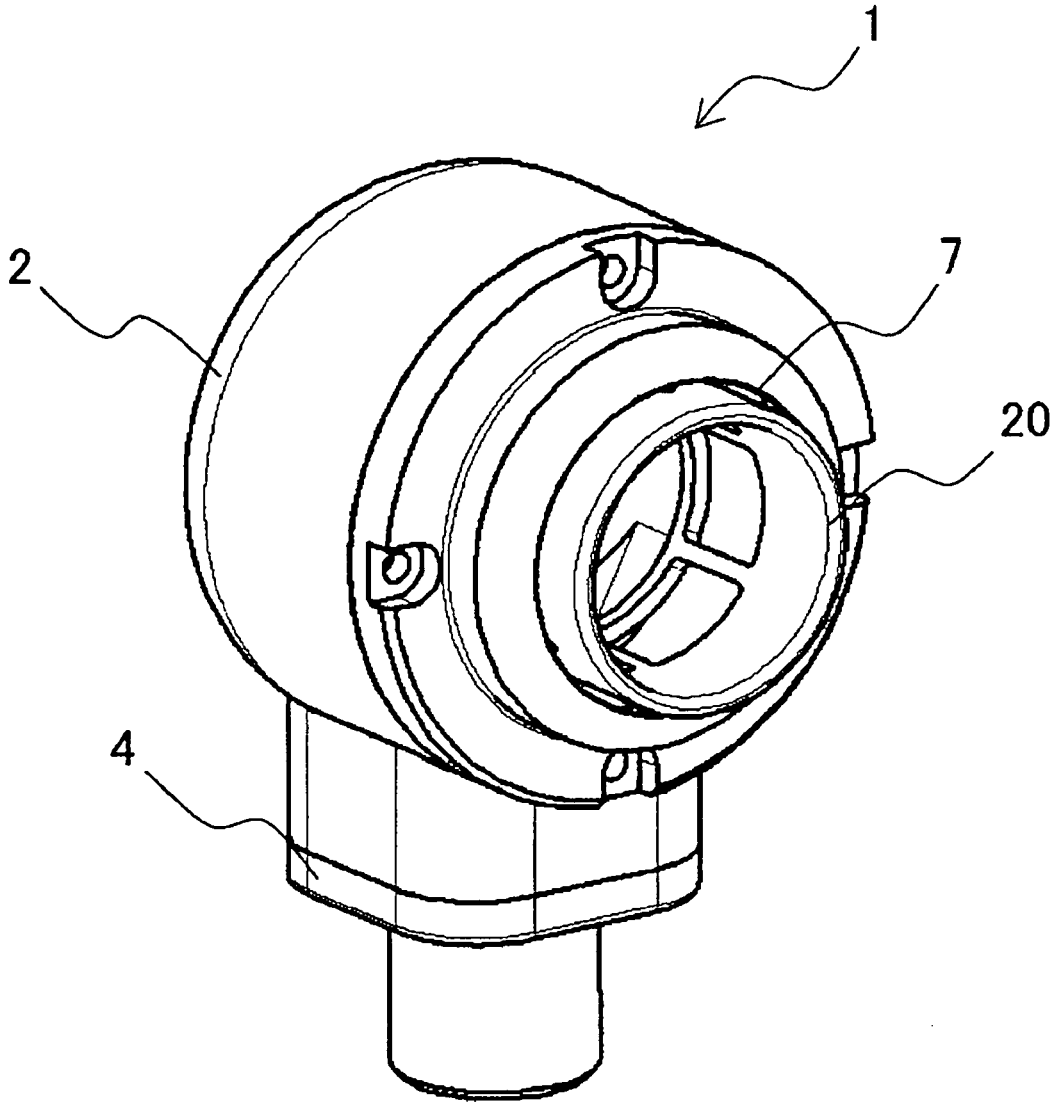
FIG. 49 is a schematic view showing the massage nozzle 1 as a forth specific example of the present invention.
Figure 50:
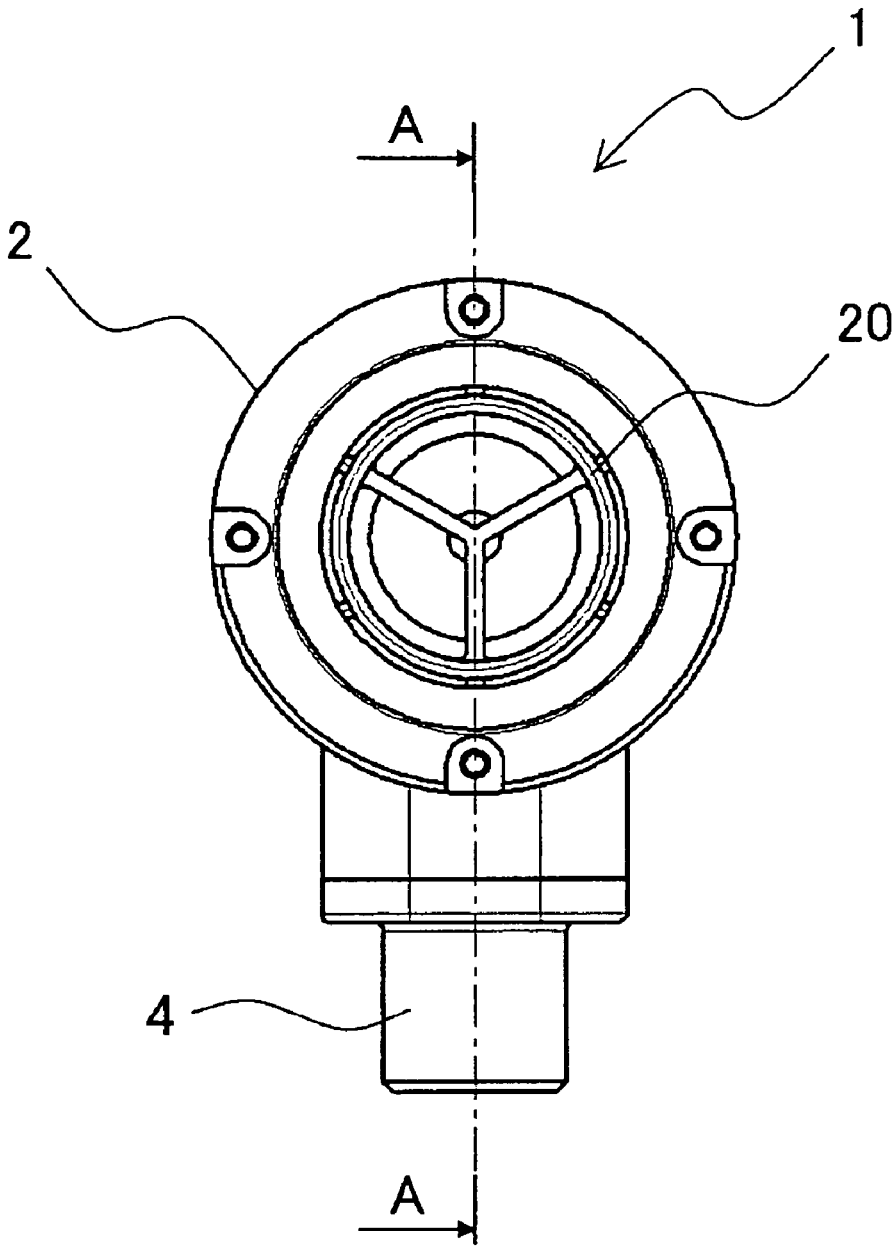
FIG. 50 is a front view showing the massage nozzle 1.
Figure 51:
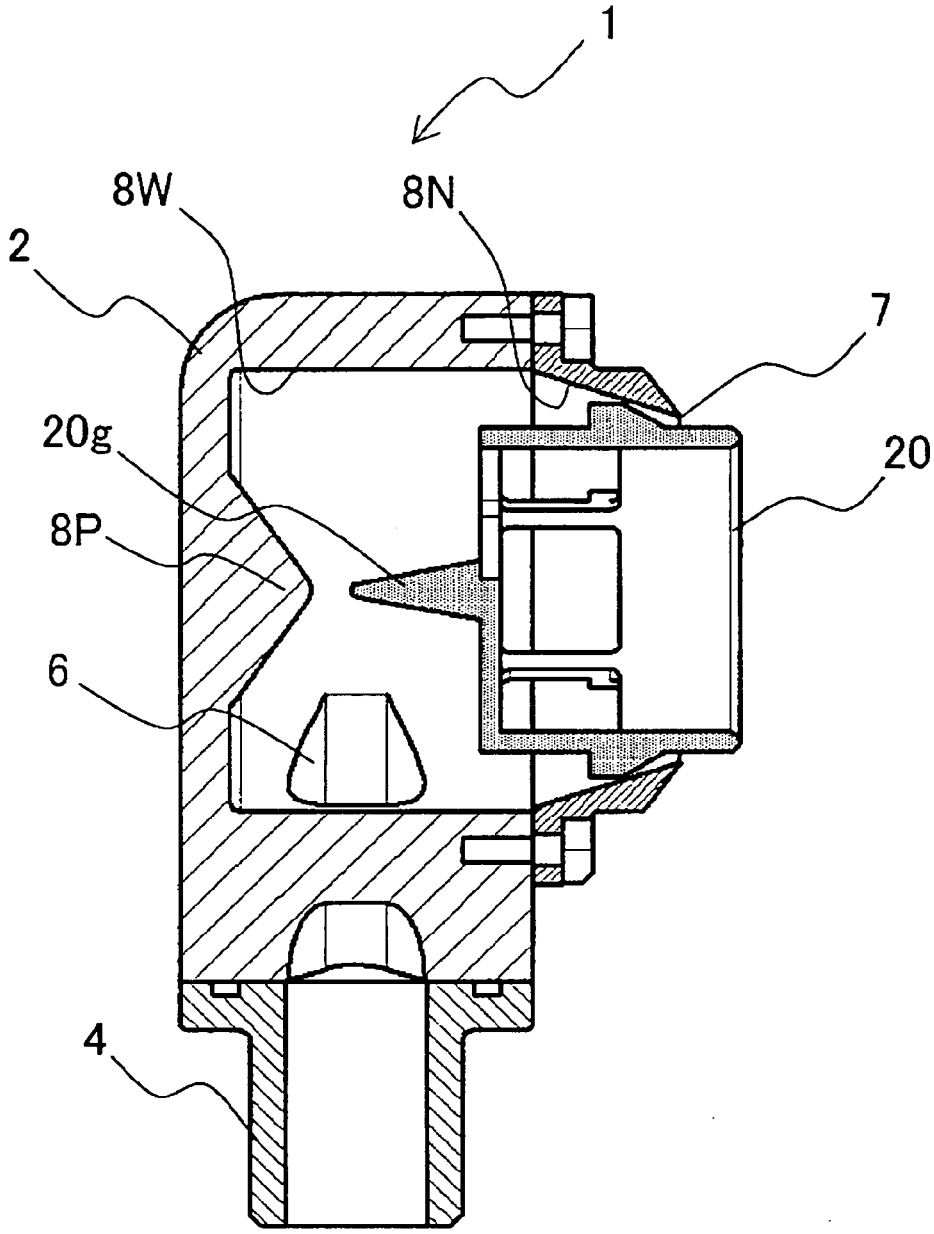
FIG. 51 is an A-A sectional view of FIG. 50.
Figure 52:
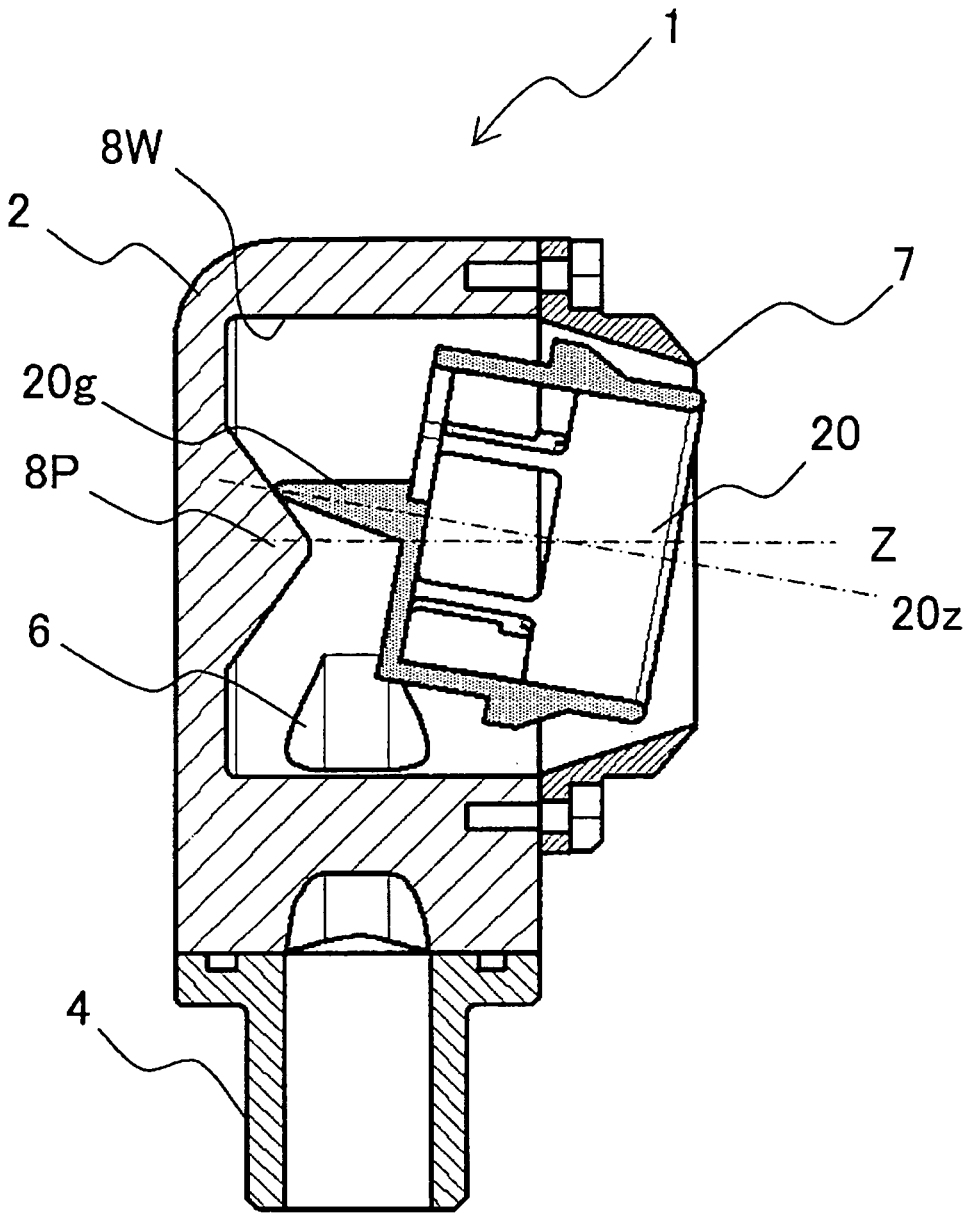
FIG. 52 is an A-A sectional view of FIG. 50.

FIG. 49 to FIG. 52 are schematic views showing the massage nozzle 1 as a fourth specific example of the present embodiment. That is, FIG. 49 is a perspective view of the massage nozzle 1, FIG. 50 a front view of FIG. 49 and FIGS. 51 and 52 are A-A sectional views of FIG. 50.

Figure 53:
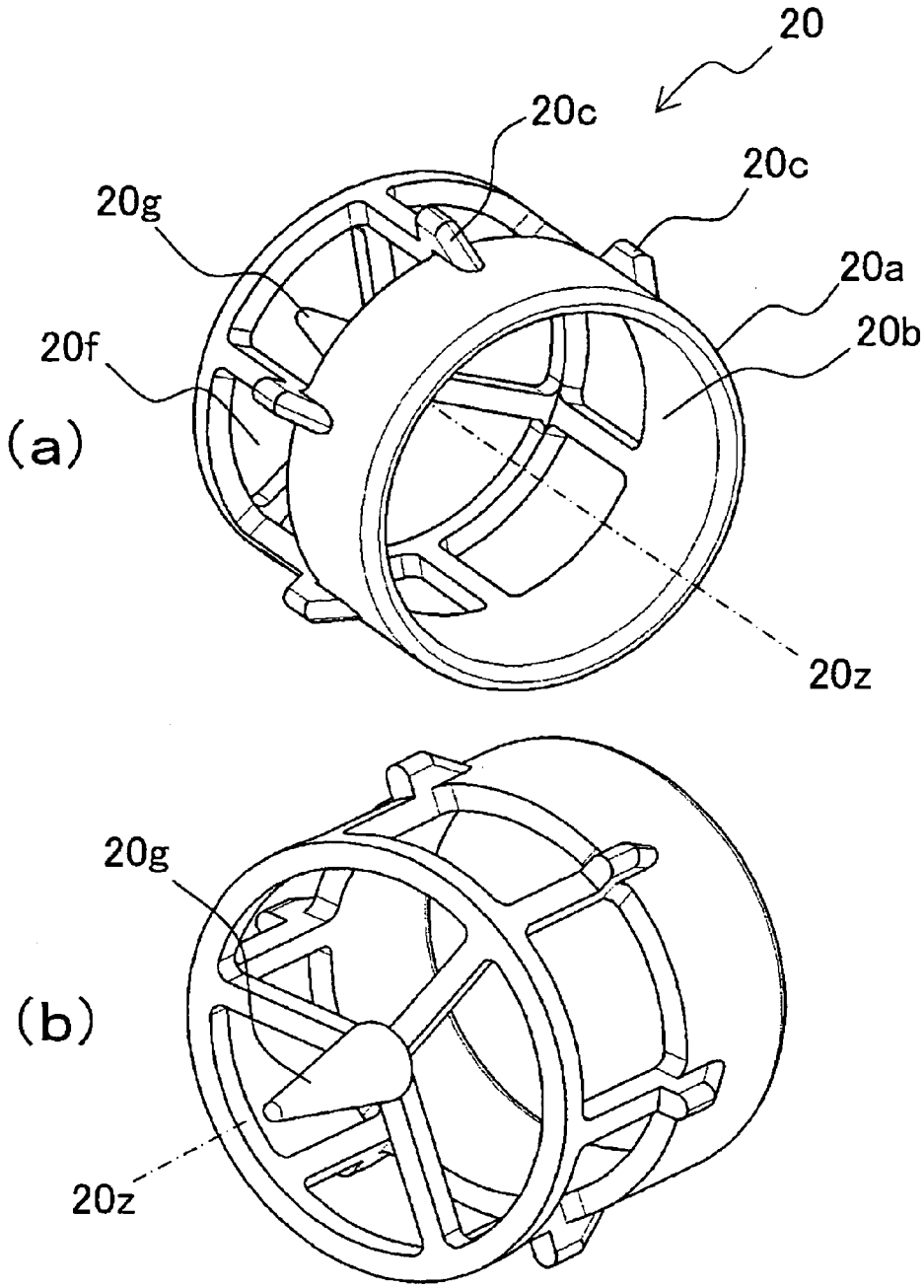
FIG. 53 is a perspective view of the movable member 20.

FIG. 53 is a perspective view of the movable member 20. That is, FIG. 53(*a*) is a front view of the movable member 20 of the present example viewing from the direction of the spouting port 7 and the FIG. 53(*b*) is a perspective view of the movable member 20 viewing from the back side (the direction of the vortex chamber 8). Also in these drawings, as to the same elements as described above in FIG. 25 to FIG. 48, detailed description by attaching the same numerals is omitted.

According to the massage nozzle 1 of the present specific example, the movable member 20 having the support shaft 20*g* protruding toward the vortex chamber 8 is provided. That is, as shown in FIG. 53, the movable member 20 has the cylindrical ring section 20*a*, the stopper 20*c* protruding from the outer circumference, a plurality of side openings 20*f* provided on the back side of the stopper 20*c* and the support shaft 20*g* protruding toward the bottom side of the vortex chamber 8.

Meanwhile, on the bottom side of the vortex chamber 8, the protrusion section 8P protruding conically around the rotation axis Z is provided.

If this massage nozzle 1 is provided with water in an opened condition, as shown in FIG. 51, the movable member 20 is pressed forward due to the spouting pressure of the vortical flow to let the stopper 20*c* abut on the narrowing section 8N.

Meanwhile, when performing the massage while applying the massage nozzle 1 to the site on the person's skin subject to treatment, as shown in FIG. 52, the movable member 20 is pressed into the vortex chamber 8. At this time, the support shaft 20*g* abuts the protrusion section 8P and the end of the support shaft 20*g* moves away from the rotation axis Z. That is, providing the protrusion section 8P and the support shaft 20*g* and letting them abut on each other enables the movable member 20 to be forcibly inclined. At this time, since the ring section 20*a* is provided with the side opening 20*f*, the water to be introduced from the water intake section 6 will not be blocked. In addition, while rotating around the support shaft 20*g* (central axis 20*z*) due to the vortical flow CF, the "precession movement" and the similar movements are performed. As a result, the site on the person's skin subject to treatment is sucked and the suction section undergoes shaking-like vibration in the circular direction at the same time to obtain a highly-effective massage effect.

According to the present specific example, providing the support 20*g* and the protrusion section 8P enables the movable member 20 to be forcibly inclined to generate the "precession movement" and the similar movements.

In addition, also according to the present specific example, arbitrarily setting the lengths of the ring section 20*a* and the support shaft 20*g* can adjust the relative position between the opening movable member 20*b* and the spouting port 7. That is, if the length of the ring 20*a* is designed to be longer, since the movable member 20 more strongly comes in contact with the site on the person's skin subject to treatment, collisional stimulation and vibration-like stimulation can be provided more strongly.

Figure 54:
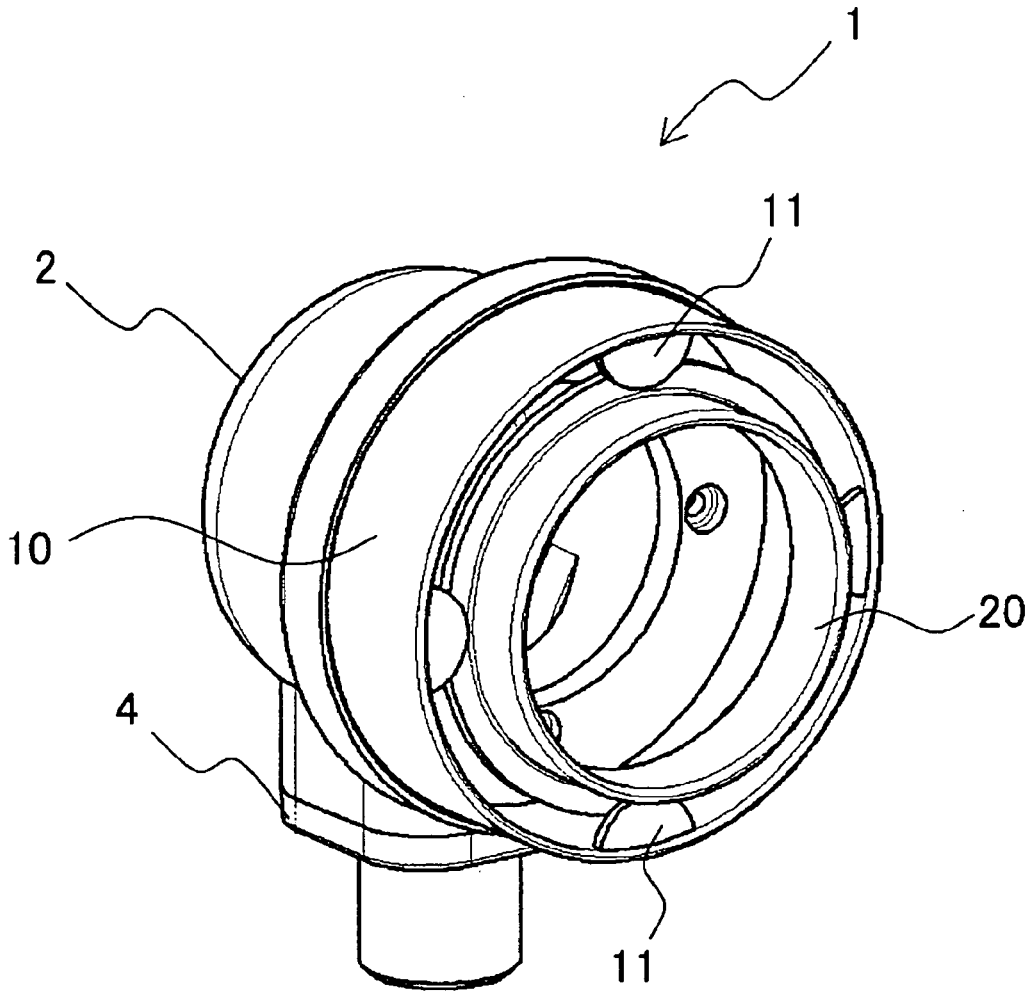
FIG. 54 is a schematic view showing the massage nozzle 1 as a fifth specific example of the present invention.
Figure 55:
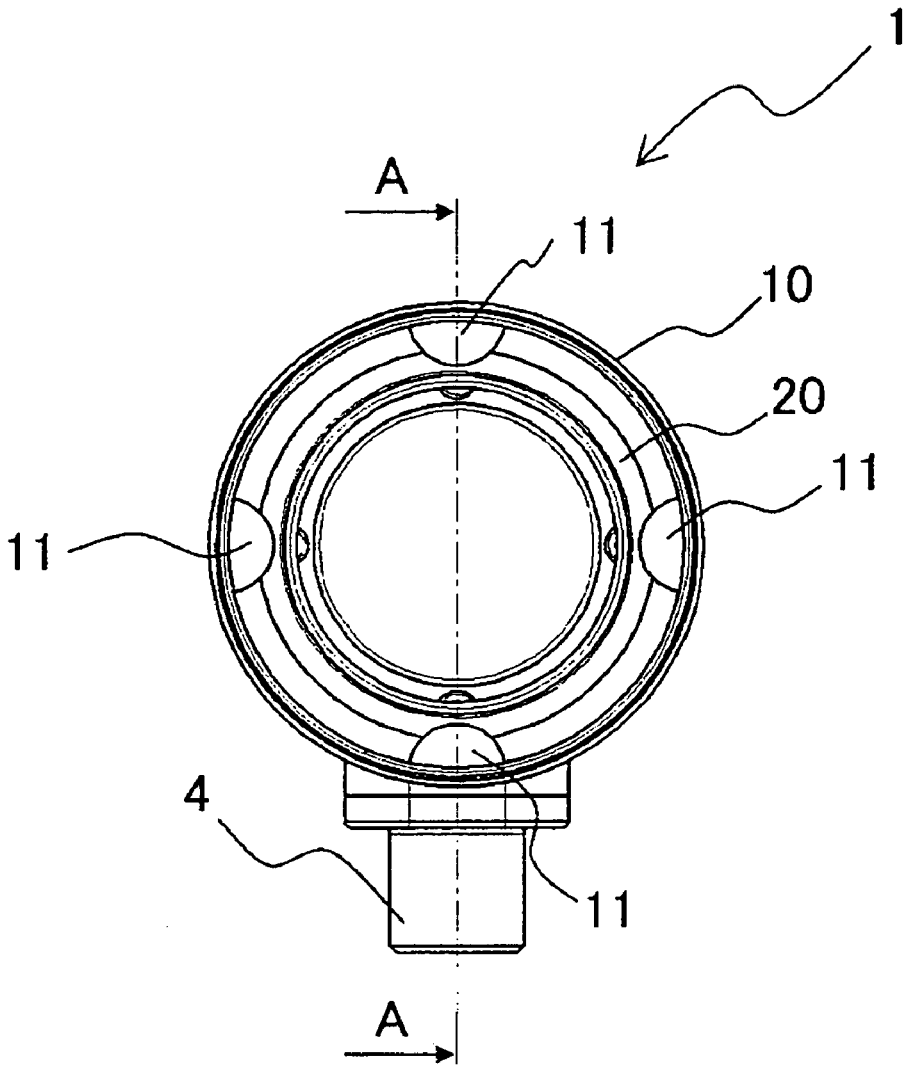
FIG. 55 is a front view showing the massage nozzle 1.
Figure 56:
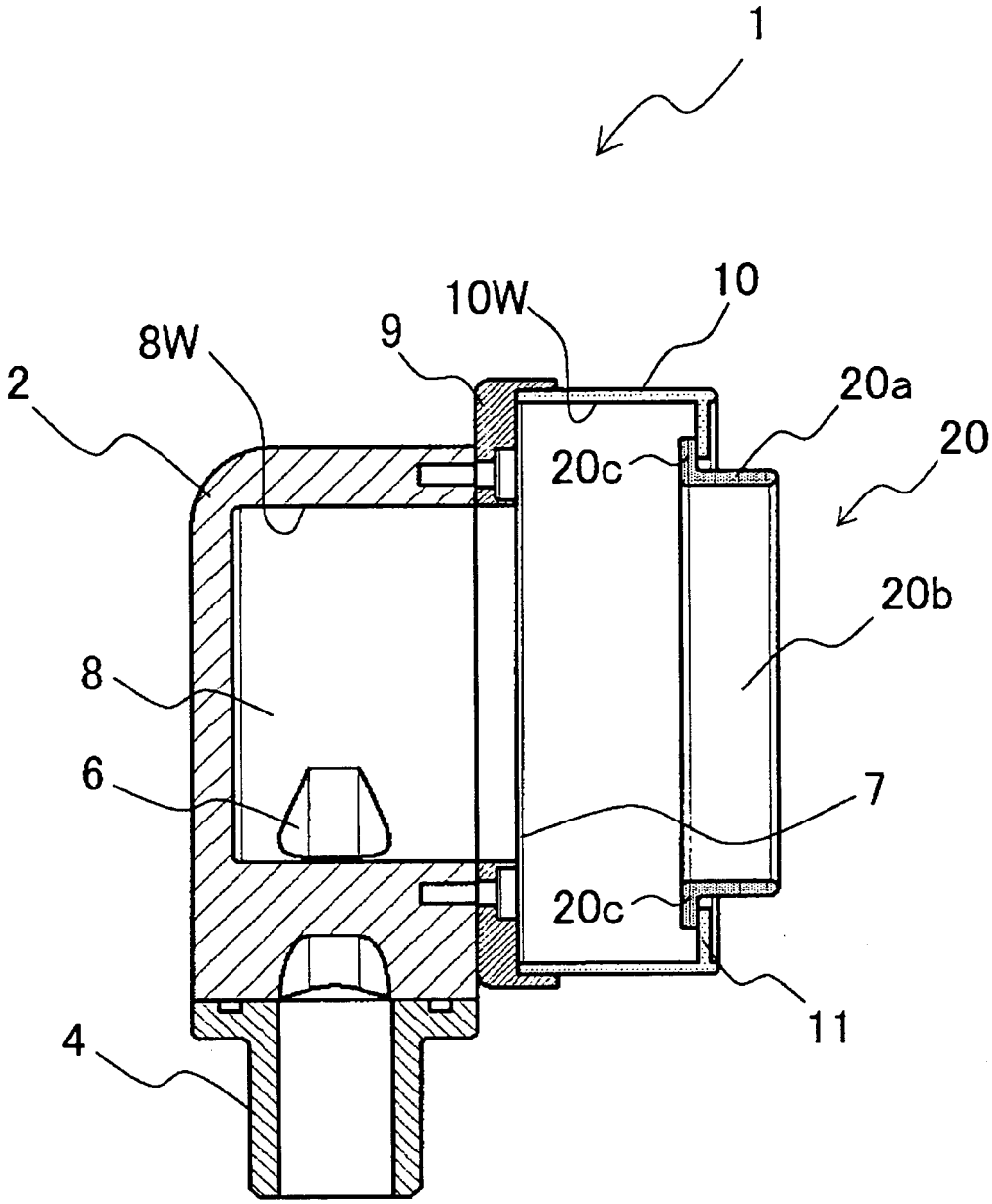
FIG. 56 is an A-A sectional view of FIG. 55.
Figure 57:
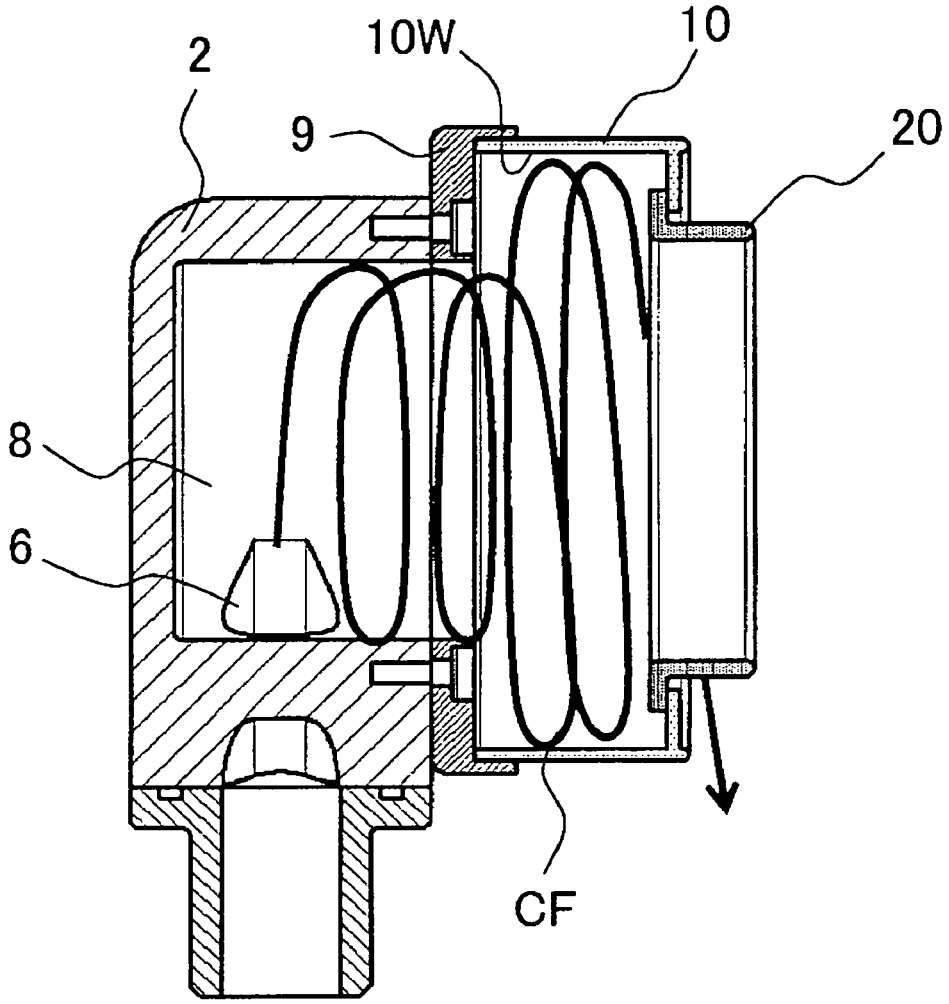
FIG. 57 is an A-A sectional view of FIG. 55.

FIG. 54 to FIG. 57 are schematic views showing the massage nozzle 1 as a fifth specific example of the present embodiment. That is, FIG. 54 is a perspective view of the massage nozzle 1, and FIG. 55 is a front view of the massage nozzle 1, and FIG. 56 and FIG. 57 are A-A sectional views of the massage nozzle 1.

Figure 58:
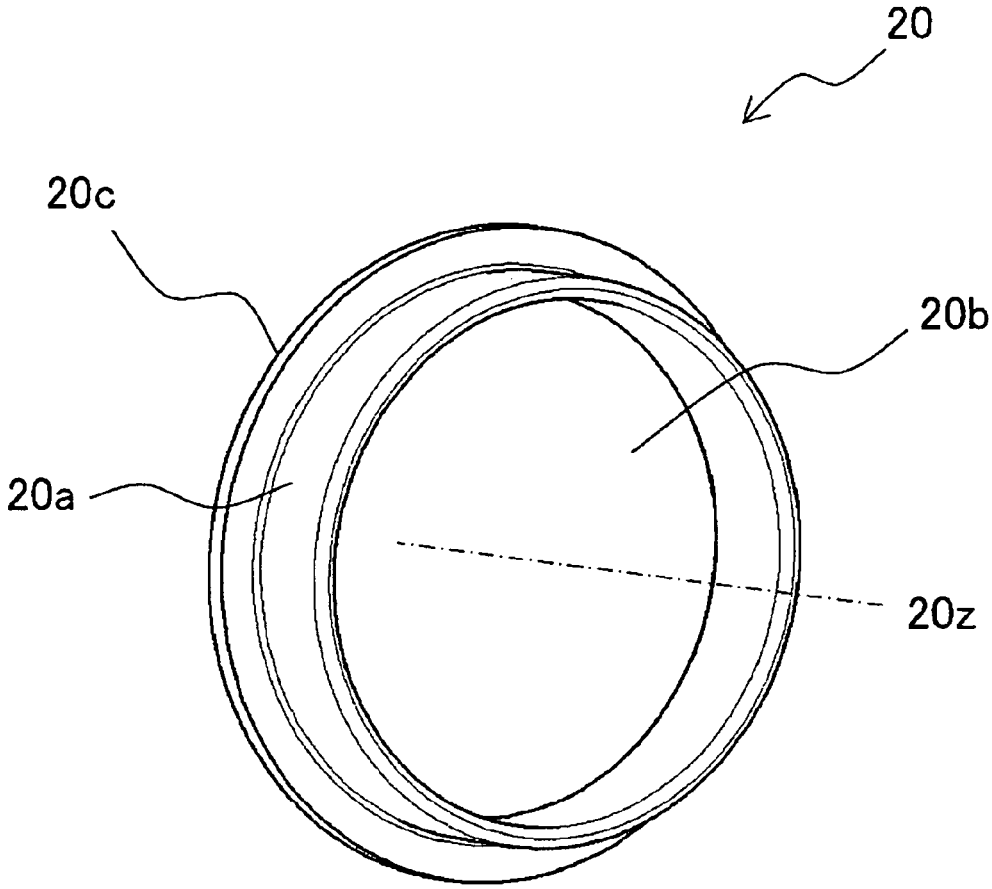
FIG. 58 is a perspective view showing the movable member 20.

In addition, FIG. 58 is a perspective view of the movable member 20. Also in these drawings, as to the same elements as described above in FIGS. 25 to 53, detailed description by attaching the same numerals is omitted.

According to the massage nozzle 1 of the present specific example, a ring-shaped guide section 10 is provided outside of the spouting port 7 via the flange 9. The protrusion section 11 is provided at the end of the inner-circumference wall of the guide section 10. The inside diameter of the guide section 10 is designed to be larger than that of the spouting port 7 and is provided so that the vortical flow spouted from the spouting port 7 collides with the inner-circumference wall 10W of the guide section 10. Providing the guide section 10 like this can prevent the vortical flow CF spouted from the spouting port 7 from splashing in all directions.

Meanwhile, as shown in FIG. 58, the movable member 20 has the cylindrical ring section 20*a* and the stopper 20*c* protruding in a discoid-shaped manner circumferentially from the bottom. As the protrusion section 11 provided in the guide 10 of the massage nozzle abuts the stopper 20*c* of the movable member 20, it is unlikely that this movable member 20 is detached from the guide section 10 during normal use.

In this case, as shown in FIG. 56, the movable member 20 may has some part of the end of the ring section 20*a* which is protruding from the end of the guide section 10 in a condition that the stopper 20*c* abuts the protrusion section 11 or in this condition, the end of the ring section 20*a* may not be designed to protrude from the end of the guide section 10. As described below, even if the movable member 20 is not protruding, various effects such as a vibration effect and the like by applying the movable member 20 to the site on the person's skin subject to treatment being sucked can be obtained.

As to the description of the above operation, as shown in FIG. 57, in an opened condition, the movable member 20 abuts the protrusion section 11 of the guide section 10 depending on the pressure due to the vortical flow CF. At this time, the vortical flow CF is spouted from the clearance between the movable member 20 and the guide 10. In addition, if the water amount is large, some part of the vortical flow CF is spouted from the movable member 20*b* of the movable member 20.

Meanwhile, in a condition where the site on the person's skin subject to treatment 210 undergoes suction massage, the movable member 20 is pressed into the guide section 10 and is greatly eccentrically located and performs the "precession movement" with a large amplitude and the similar movements as well as autorotation.

Figure 59:
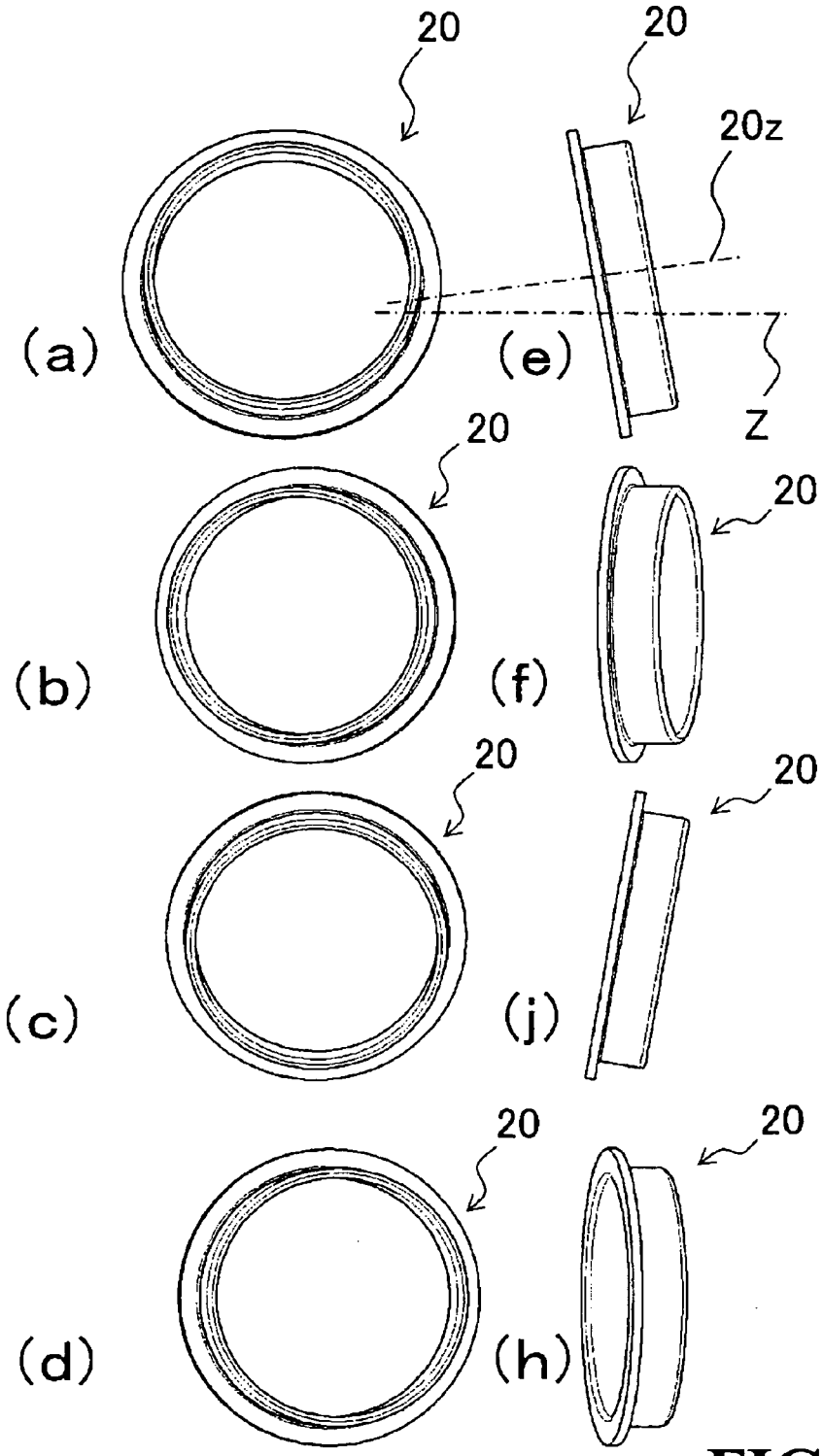
FIG. 59 is a schematic view describing the movement of the movable member 20.

FIG. 59 is a schematic view describing the movement of the movable member 20. That is, the same drawing shows the change in style of the movable member 20, FIGS. 59(*a*) to (*d*) are front views, FIGS. 59(*e*) to (*h*) are side views. As shown in these drawings, the movable member 20 performs the "precession movement" changing the inclination direction around the rotation axis Z of the vortical flow CF and the similar movements. However, according to the present embodiment, the eccentric amount of the movable member 20 can be designed to be larger by placing the movable member 20 in the guide section 10 having a larger inside diameter to obtain vibration with large amplitude.

Figure 60:
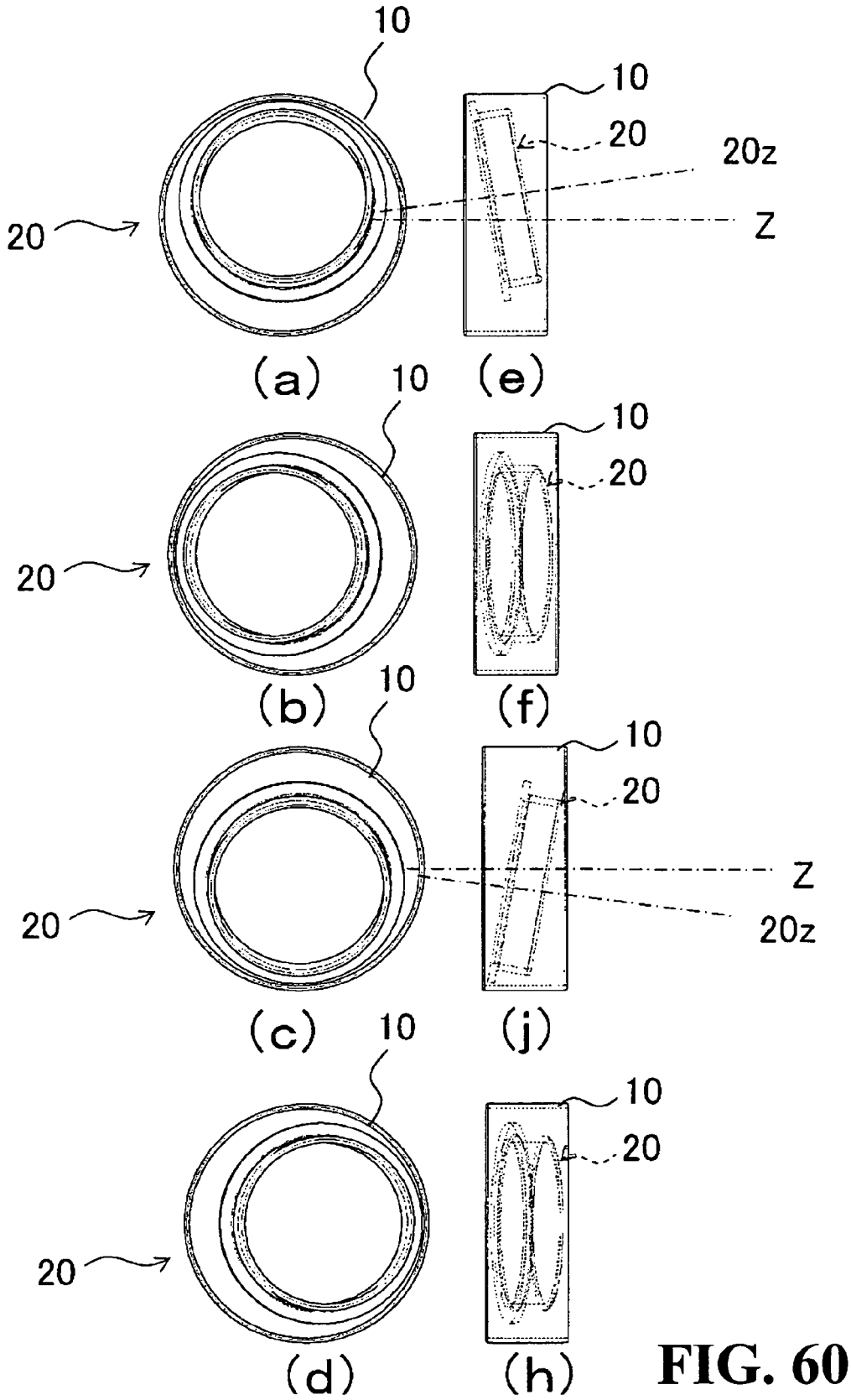
FIG. 60 is a schematic view showing the change in the position of the movable member 20 within a guide section 10.
Figure 61:
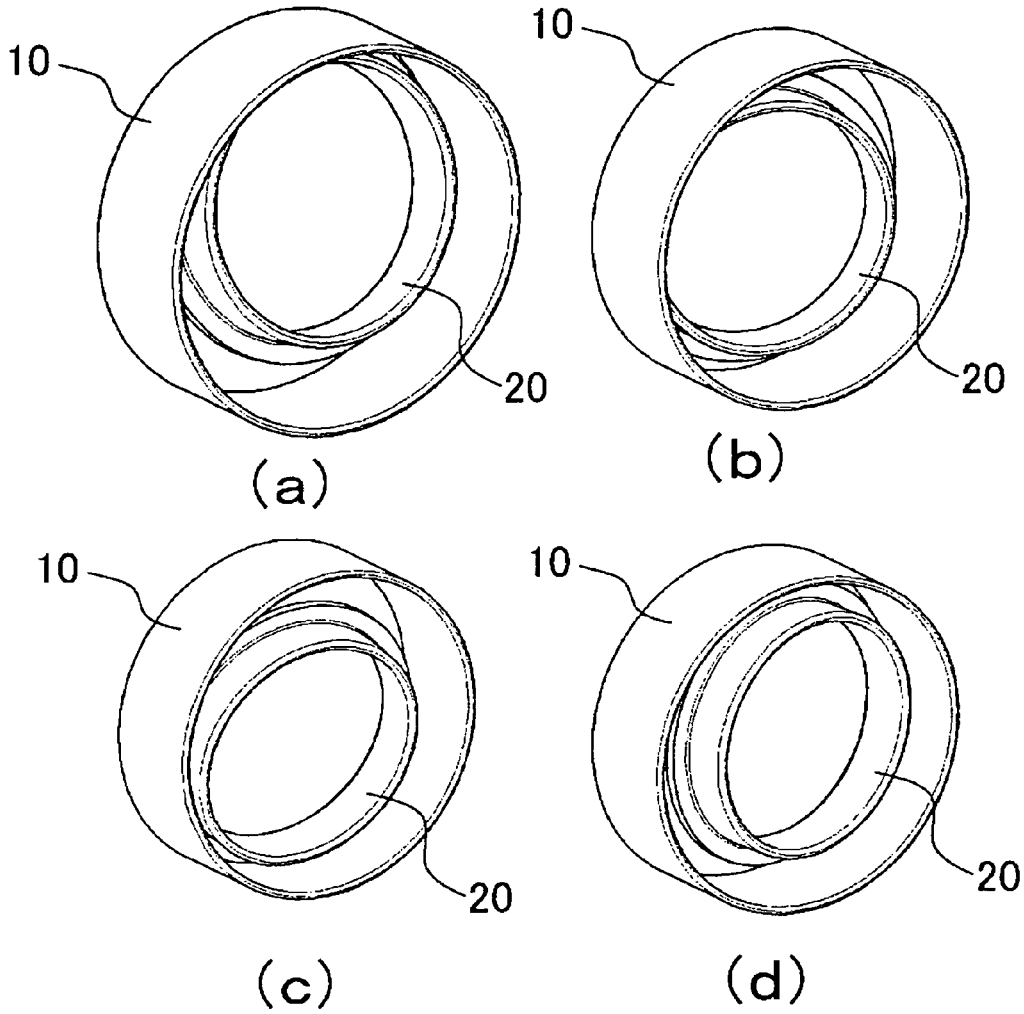
FIG. 61 is a schematic view showing the change in the position of the movable member 20 within a guide section 10.

FIGS. 60 and 61 are schematic views showing the change in the position of the movable member 20 within the guide section 10. That is, FIGS. 60(*a*) to (*d*) are schematic views showing the guide section and the movable member 20 viewing from the front. FIGS. 60(*e*) to (*h*) are schematic views showing the guide section 10 and the movable member 20 viewing from the side. FIG. 61 is a schematic view showing the guide section and the movable member 20 viewing from above of slope. In addition, in order to simplify the illustration in these drawings, the protrusion section 11 of the guide section 10 was intentionally omitted.

As shown in these drawings, according to the present embodiment, since the inside dimensions of the guide section 10 are slightly larger than the outside dimensions of the movable member 20, the eccentric amount of the movable member 20 becomes larger in the guide section 10 in association with the "precession movement" and the similar movements. For example, in the conditions shown in FIGS. 60(*a*) and (e), the movable member 20 is located eccentrically to the upper end facing the drawing in the guide section 10. Meanwhile, in the conditions shown in FIGS. 60(*c*) and (j), the movable member 20 is located eccentrically to the lower end facing the drawing in the guide section 10. As described above, the movable member 20 is located eccentrically in the guide section 10 and changes the position every moment, which brings about the "precession movement" with large vibration and the similar movements. At this time, since the stopper 20*c* is formed in a discoid-shaped manner, the movable member 20 can be smoothly moved in the guide section 10.

As a result, the amplitude with which the site on the person's skin subject to treatment is provided becomes larger. That is, the site on the person's skin subject to treatment is greatly shaken in the guide section 10 in association with the operation of the movable member 20, which can promote the massage effect due to vibration furthermore.

In addition, when a ring-shaped guide section 10 is provided as the present embodiment, if the length of the guide section 10 (the distance between the spouting port 7 and the protrusion section 11 in FIG. 56) is too short, since a space for the movable member 20 to be inclined toward the central axis of the vortex chamber 8 becomes narrower to prevent the contact in with the site on the person's skin subject to treatment, causing the stimulation due to vibration to be reduced in some cases. Meanwhile, if the length of the guide section 10 is too long, since the movable member 20 steps back in the direction of the spouting port 7 to decrease the collisional stimulation and cause the movable member 20 to be inclined greatly and the suction region to be reduced, resulting in lack of the stimulation due to vibration.

An example of the tests conducted by the inventor of the present invention is described. When 3 types of guide sections 10 having 15 mm, 25 mm and 35 mm length with the thickness of the stopper 20*c* of the movable member set to 2 mm, the length of ring 20*a* set to 10 mm (12 mm if including the stopper 20*c*) are used, the most favorable massage feeling was obtained in the massage nozzle with the guide section 10 having the 25 mm length.

Also according to the present embodiment, the sections between the vortex section 2 and the flange 9, and between the flange 9 and the guide section 10 may be designed detachably. For example, if the section between the vortex section 2 and the flange 9 is detachable, the flange 9 (including the guide section 10) can be arbitrarily replaced and desired suction force and feel of simulation due to vibration can be selected by a user. In addition, it becomes easier to attach/detach and replace a movable member 20 if the section between the flange 9 and the guide section 10 is designed detachably.

As a mechanism for attachment/detachment of these flange 9 and guide 10 and the like, for example, various types of mechanism such as a screw fitting, fitting mechanism between L-shaped groove and protrusion and the like can be used. However, in order to prevent detachment and looseness due to the vortical flow, it is preferable that a mechanism fixes (tightens) the water-spray plate in the same direction of that of the vortical flow.

Since it is only natural that a general user turns clockwise to tighten, the water intake section 6 is preferably provided so that the vortical flow is turned clockwise. Thus, it is easy to attach/detach and can prevent inadvertent detachment due to the vortical flow.

Next, variations of a movable member which can be used for the massage nozzle 1.

Figure 62:
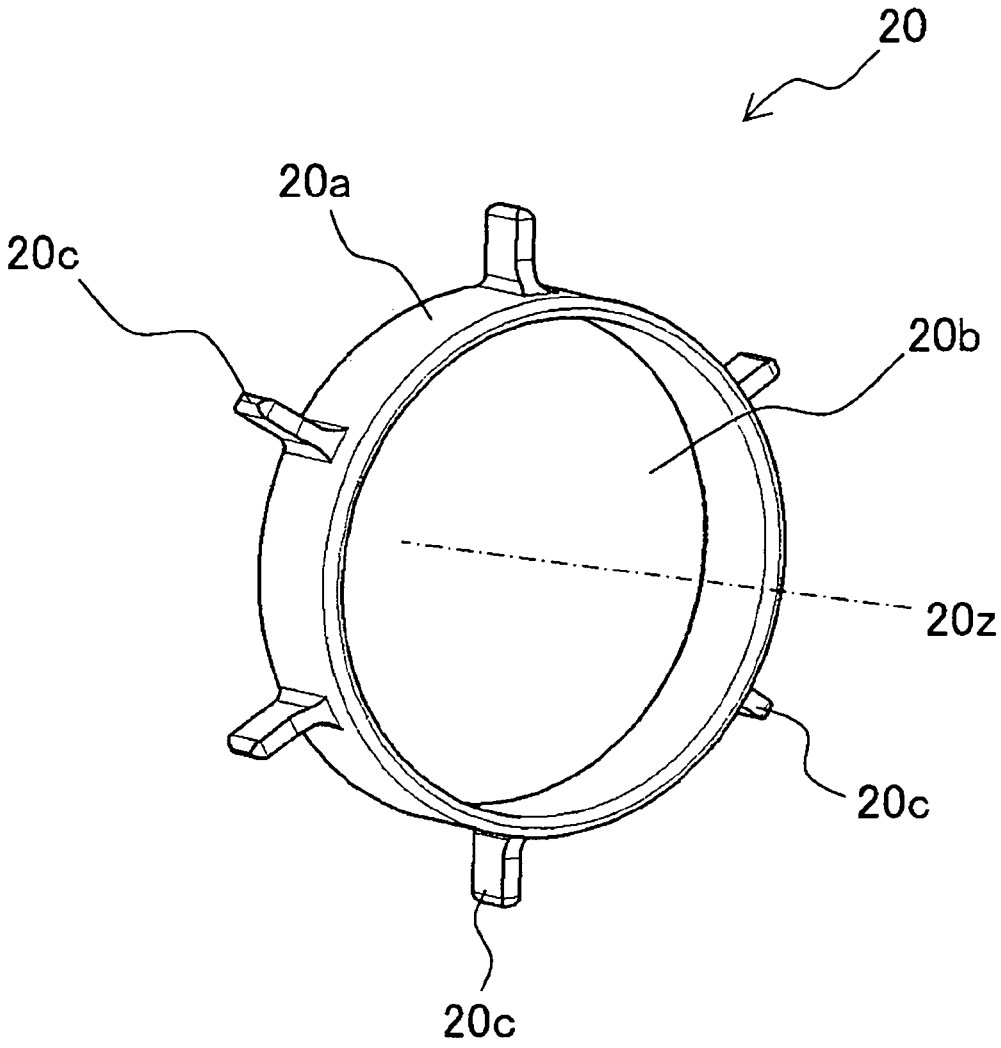
FIG. 62 is a schematic perspective view showing a first variation of a movable member which can be used for the massage nozzle having the guide section 10.

FIG. 62 is a schematic perspective view showing a first variation of a movable member which can be used for the massage nozzle 1 having the guide section 10.

That is, according to the present variation, the movable member 20 has the semi-cylindrical ring section 20*a* and the stopper 20*c* protruding from the outer circumference at the back side. In case of the present variation, the stopper 20*c* serves as an impeller. Therefore, it becomes easier to rotate due to the vortical force of the vortical flow. This movable member 20 is suitable for a massage nozzle described below in FIG. 77.

Figure 63:
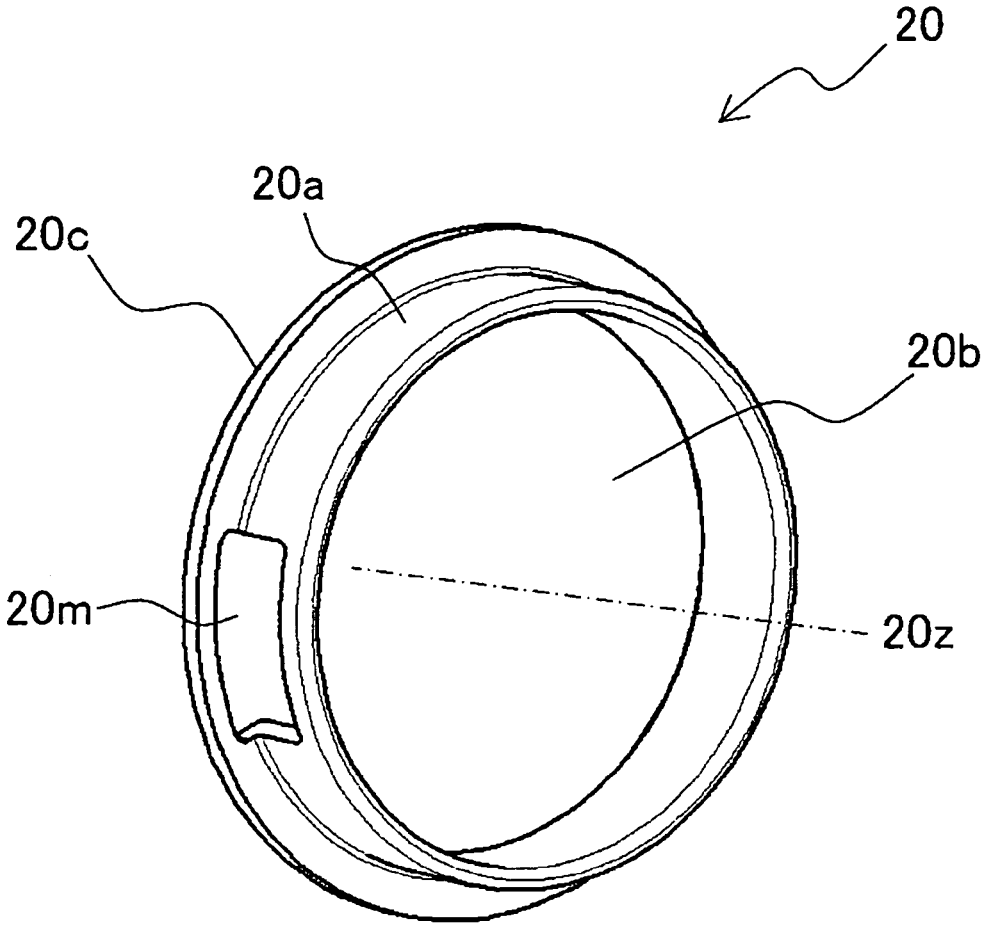
FIG. 63 is a schematic perspective view showing a second variation of a movable member which can be used for the massage nozzle having the guide section 10.

FIG. 63 is a schematic perspective view showing a second variation of a movable member which can be used for the massage nozzle having the guide section 10.

That is, according to the present variation, as shown in FIG. 58, the movable member 20 has the cylindrical ring section 20*a* and the stopper 20*c* protruding from the outer circumference thereof circumferentially in a discoid-shaped manner. In addition, according to the present variation, a supplemental opening 20*m* is provided in some part of the ring section 20*a*. Providing the supplemental opening 20*m* like this causes the force due to the vortical flow CF affecting the movable member 20 to be nonuniform facing the circumferential direction. As a result, slightly-random vibration can be generated to enable the massage effect due to vibration to increase.

Figure 64:
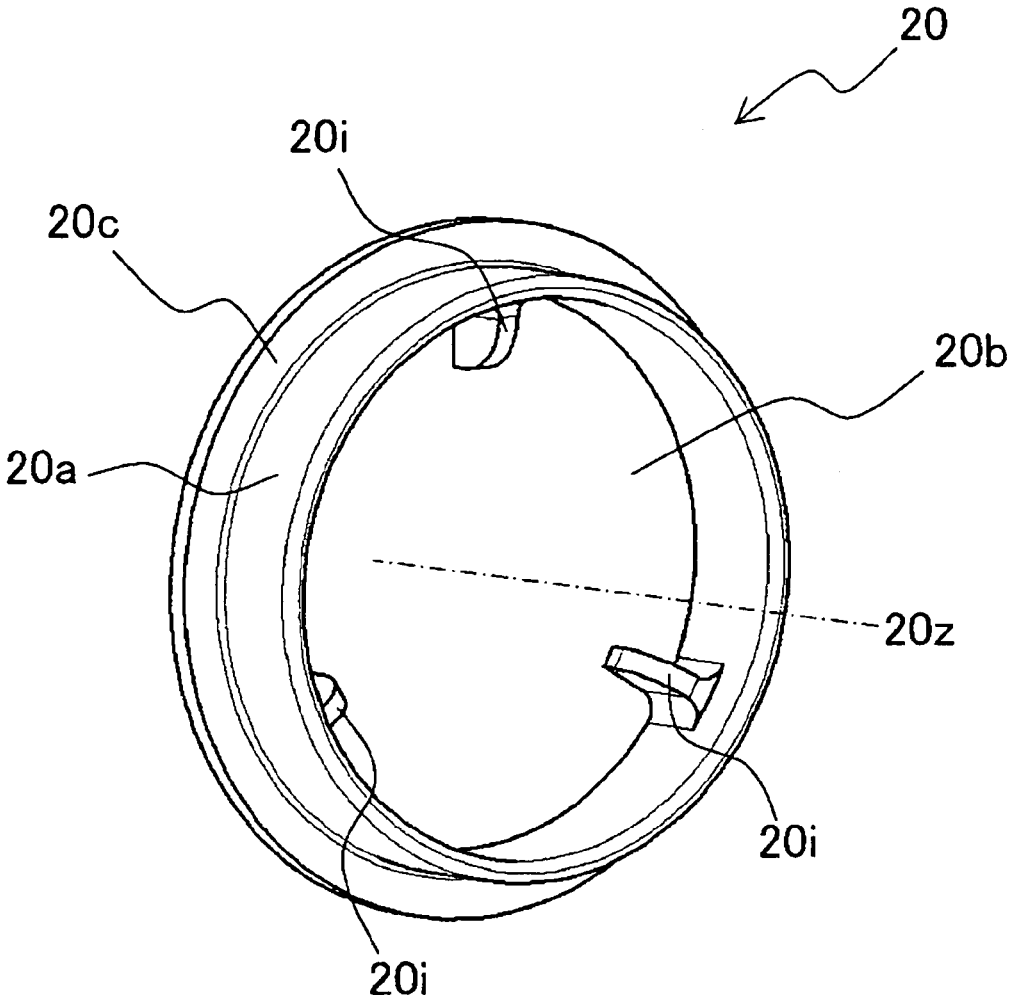
FIG. 64 is a schematic perspective view showing a third variation of a movable member which can be used for the massage nozzle having the guide section 10.

FIG. 64 is a schematic perspective view showing a third variation of a movable member which can be used for the massage nozzle 1 having the guide section 10.

Also according to the present variation, as shown in FIG. 58, the movable member 20 has the cylindrical ring section 20*a* and the stopper 20*c* protruding from the outer circumference thereof circumferentially in a discoid-shaped manner. In addition, according to the present variation, the impeller 20*i* protruding from the ring section 20*a* to the inside is provided. Providing the impeller 20*i* like this strengthens the vortical flow CF affecting the movable member 20 to promote the rotational movement. At the same time, providing the stimulation by contact of these impellers 20*i* to the site on the person's skin subject to treatment sucked from the opening 20*b* enables the vibration massage effect to further increase.

Figure 65:
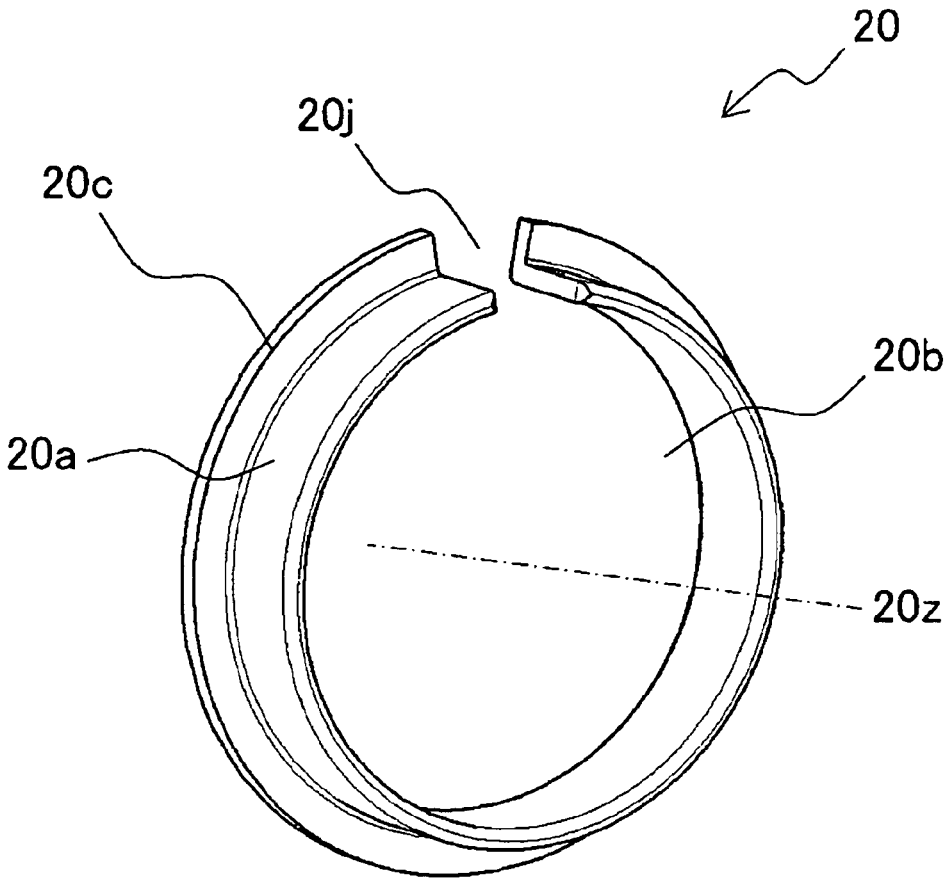
FIG. 65 is a schematic perspective view showing a fourth variation of a movable member which can be used for the massage nozzle having the guide section 10.

FIG. 65 is a schematic perspective view showing a fourth variation of a movable member which can be used for the massage nozzle 1 having the guide section 10. Also according to the present variation, as shown in FIG. 58, the movable member 20 has the cylindrical ring section 20*a* and the stopper 20*c* protruding from the outer circumference thereof circumferentially in a discoid-shaped manner. In addition, according to the present variation, the notch 20*j* whose some part is cut facing the circumferential direction is provided.

Providing the notch 20*j* like this causes the force due to the vortical flow CF affecting the movable member 20 to be nonuniform facing the circumferential direction. As a result, slightly-random vibration can be generated to enable the massage effect due to vibration to increase.

Figure 66:
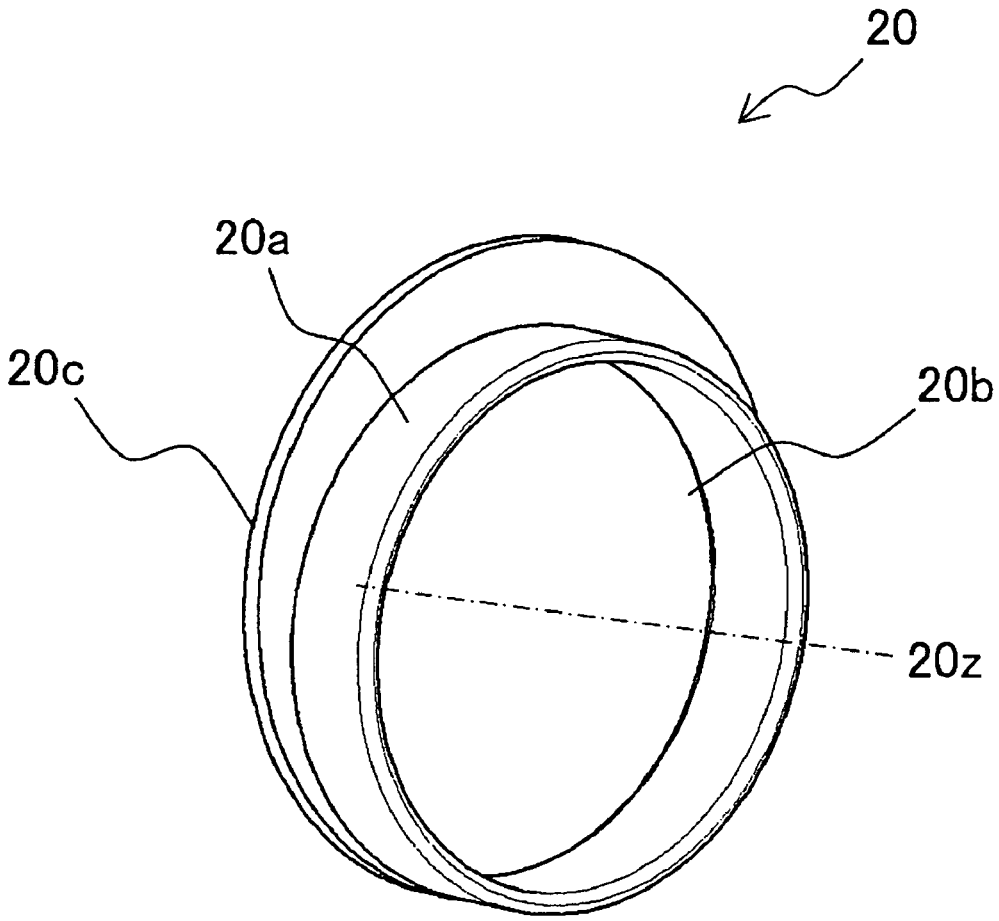
FIG. 66 is a schematic perspective view showing a fifth variation of a movable member which can be used for the massage nozzle having the guide section 10.

FIG. 66 is a schematic perspective view showing a fifth variation of a movable member which can be used for the massage nozzle 1 having the guide section 10. Also according to the present variation, as shown in FIG. 58, the movable member 20 has the cylindrical ring section 20*a* and the stopper 20*c* protruding from the outer circumference thereof circumferentially in a discoid-shaped manner. However, according to the present variation, the stopper does not protrude in a uniform width facing the circumferential direction and the protrusion amount is biased. That is, the ring section 20*a* is located eccentrically to the discoid-shaped stopper 20*c*.

According to the present movable member 20, since the ring section 20*a* is located eccentrically, the amplitude of the vibration with which the site on the person's skin subject to treatment is provided in accordance with rotation of the movable member 20. That is, the massage effect due to vibration can be further increased. According to the present specific example, even if rotating the movable member 20 with the central axis 20*z* almost in parallel with the central axis Z of the vortex chamber without letting the movable member perform the precession movement, a favorable massage effect can be obtained. That is, if the movable member 20 is rotated around the central axis Z of the vortex chamber, the ring section 20*a* located eccentrically provides a strong vibration-like stimulation to the site on the person's skin subject to treatment. As a result, a strong "kneading relax effect" can be obtained.

Figure 67:
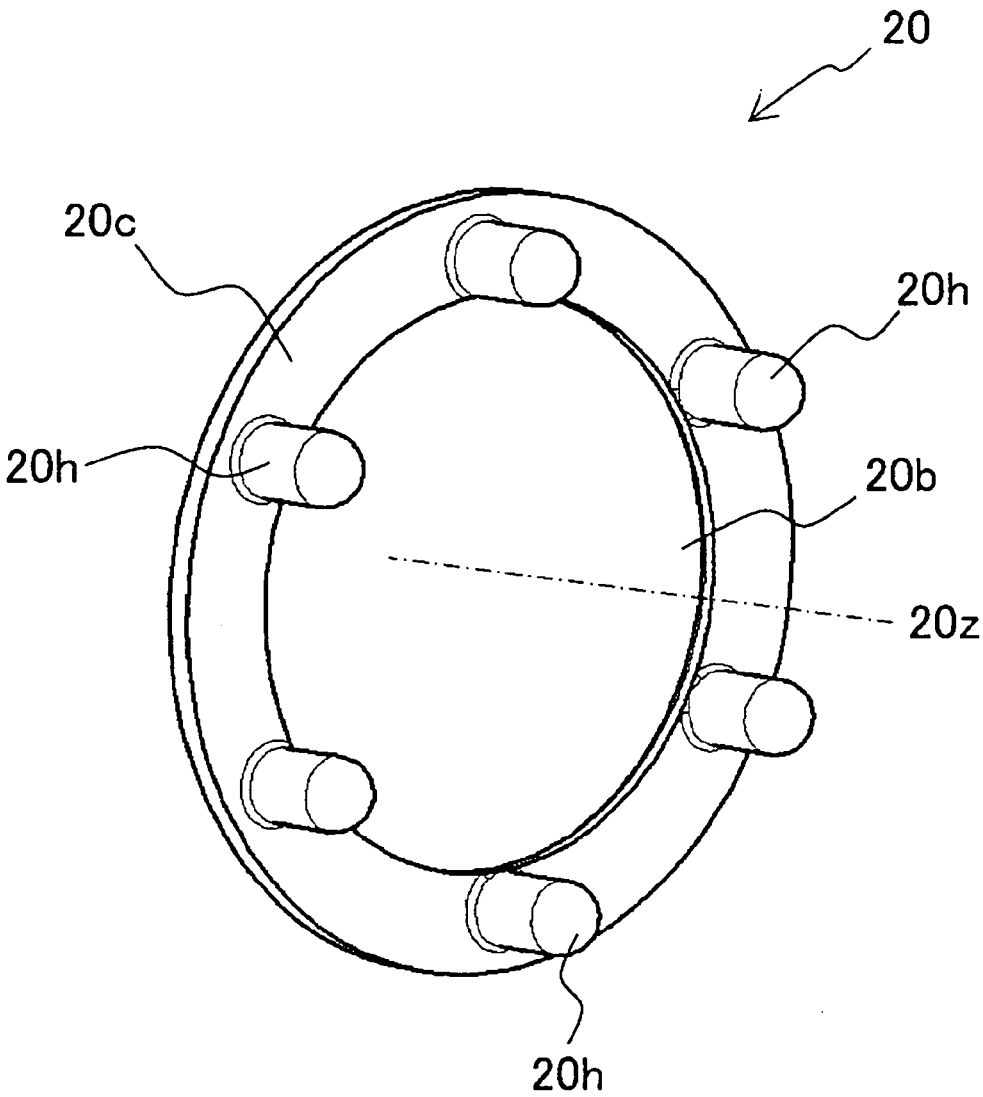
FIG. 67 is a schematic perspective view showing a sixth variation of a movable member which can be used for the massage nozzle having the guide section 10.

FIG. 67 is a schematic perspective view showing a sixth variation of a movable member which can be used for the massage nozzle 1 having the guide section 10.

According to the present variation, the movable member 20 has a discoid-shaped stopper 20*c* and a plurality of protrusions 20*h* protruding from its main surface. Providing the protrusions 20*h* like this can provide the site on the person's skin subject to treatment with a strong stimulation. That is, as described above in FIGS. 54 to 61, if the movable member 20 performs the "precession movement" or the similar movements in an eccentric manner, a plurality of protrusions 20*h* will provide the site on the person's skin subject to treatment with a strong vibration depression force to obtain a highly-effective massage effect.

Figure 68:
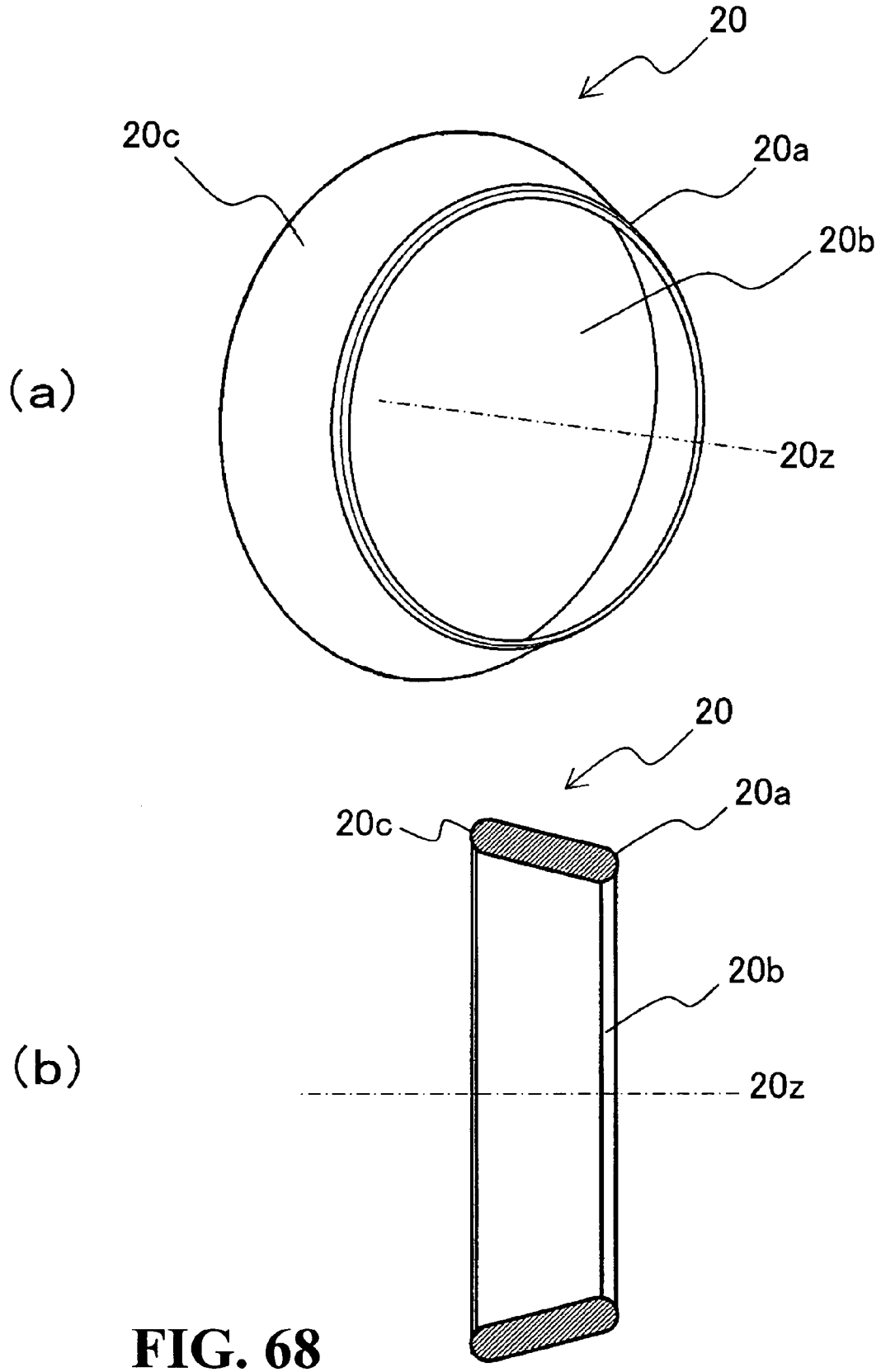
FIG. 68(*a*) is a schematic perspective view showing a seventh variation of a movable member which can be used for the massage nozzle having the guide section 10 and FIG. 68(*b*) is a vertical section of FIG. 68(*a*).

FIG. 68(*a*) is a schematic perspective view showing a seventh variation of a movable member which can be used for the massage nozzle 1 having the guide section 10 and FIG. 68(*b*) is a vertical section of FIG. 68(*a*).

According to the present variation, the movable member 20 has a semi-conical side. According to the present specific example, among the conical side, some part which abuts the protrusion section 11 of the guide section 10 serves as the stopper 20*c* and the downstream side (front) becomes the ring section 20*a*.

The movable member of the present specific example does not have to be equipped with a collar-shaped stopper, carrying the advantage that the structure is simple and easy to manufacture.

In addition to the movable members described above, various movable members can be used. For example, various types of movable members which are unaxisymmetric in weight can be used as well as the movable members illustrated in FIGS. 63, 65 and 66. If these movable members are used, as described above in FIG. 38, it becomes easier for the movable member to be located eccentrically to the central axis Z to readily obtain a vibration effect.

Furthermore, as a material for the movable member 20, in addition to plastic, ceramics and metal, for example, flexible materials such as a rubber and the like can be used. If a rubber is used, impact and vibration with which the site on the person's skin subject to treatment is provided becomes milder, complying with the demand of a user who does not like intensive stimulation.

In addition, if the movable member is made of a flexible material such as a rubber and the like, it becomes easier to deform, carrying the advantage that the movable member can be easily inserted into the guide section 10 of the massage nozzle or the vortex chamber 8. However, according to the prototype test by the inventor of the present invention, if the material for the movable member is too soft, this brought about a problem in that the rotation movement was not performed smoothly and the movable member 20 exited out of the spouting port 7 and guide section 10 in some cases. Although it depends on the shape and size of the movable member 20, for example, when using the materials having the 50 or 60 hardness, favorable results were not obtained, when using the materials having the 70 hardness, almost favorable results were obtained and when using the materials having the 80 or 90 hardness, favorable results were obtained.

In addition, some part of the stopper 20*c* may be made of hard materials such as plastic and the like and the end part of the ring section 20*a* (which comes in contact with a human body) may be made of flexible materials such as a rubber and the like. Thus, this ensures not only rotation movement but also provides mild stimulation.

Meanwhile, various movable members described above can be detachable to/from the main body of the massage nozzle 1. For example, in case of the massage nozzle 1 illustrated in FIGS. 54 to 57, the guide section 10 can be detachable out of the flange 9 and the movable member 20 may be replaced from there arbitrarily.

Thus, the movable members 20 bases on user's desired shape or size arbitrarily can be selected and classified into each user, providing users with a convenient use style.

Figure 69:
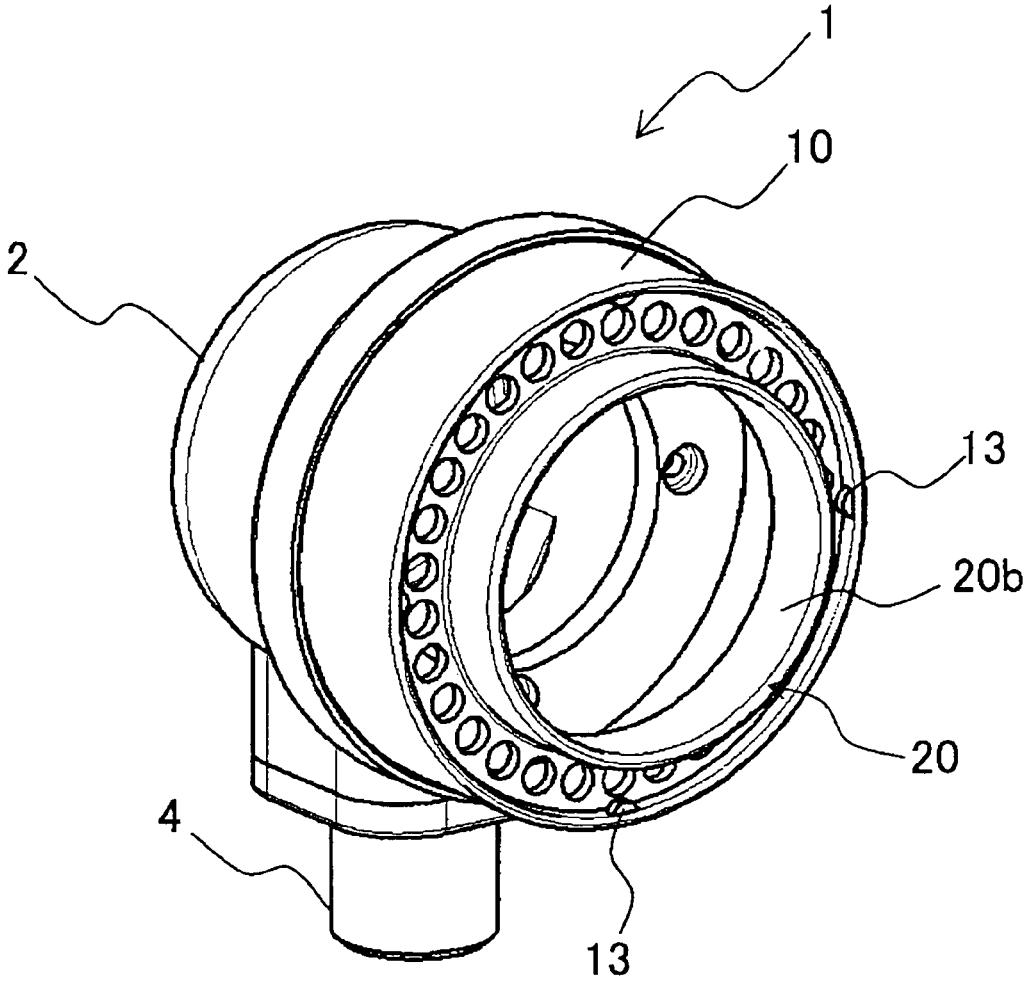
FIG. 69 is a schematic view showing the massage nozzle 1 as a seventh specific example of the present invention.
Figure 70:
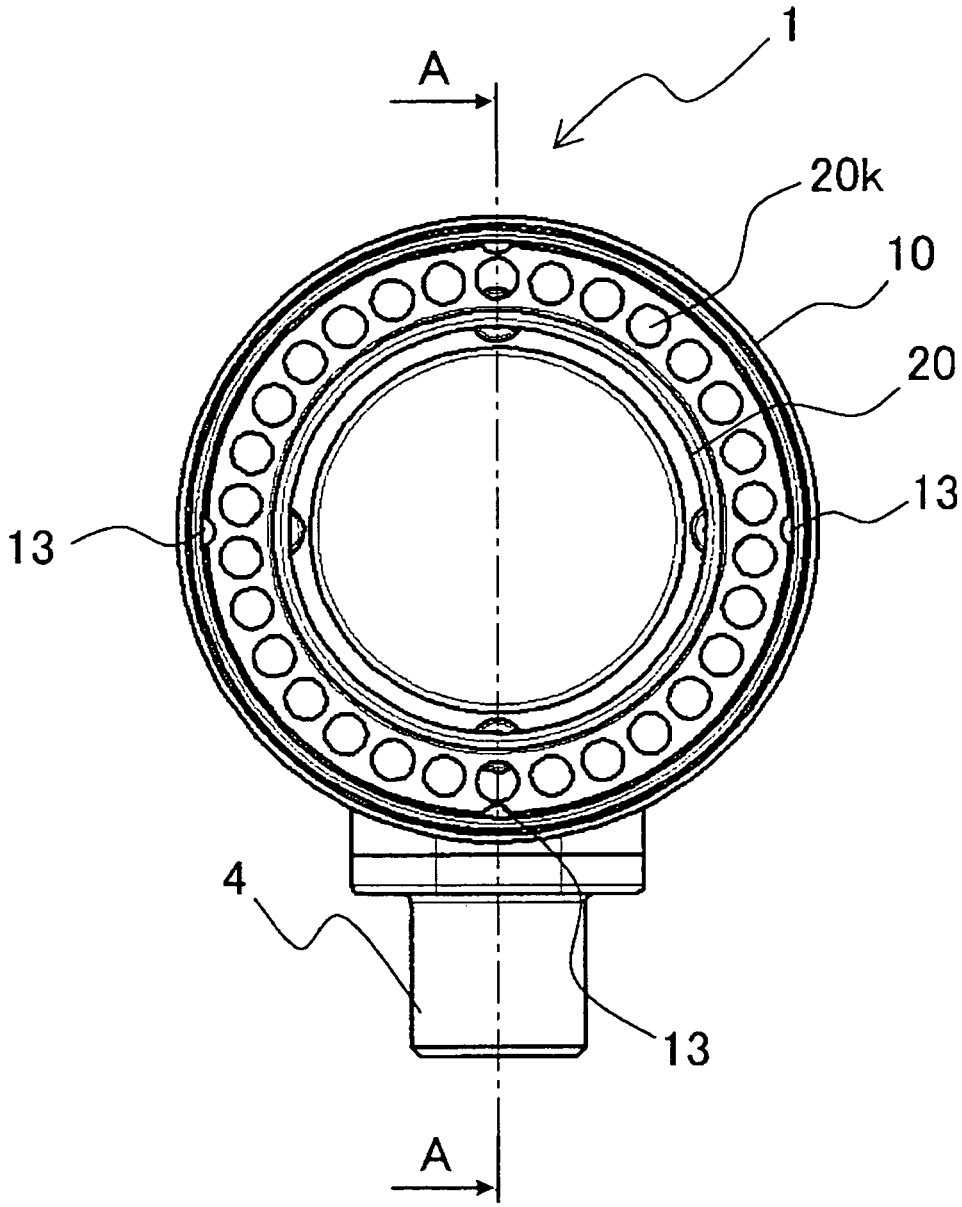
FIG. 70 is a front view showing the massage nozzle 1.
Figure 71:
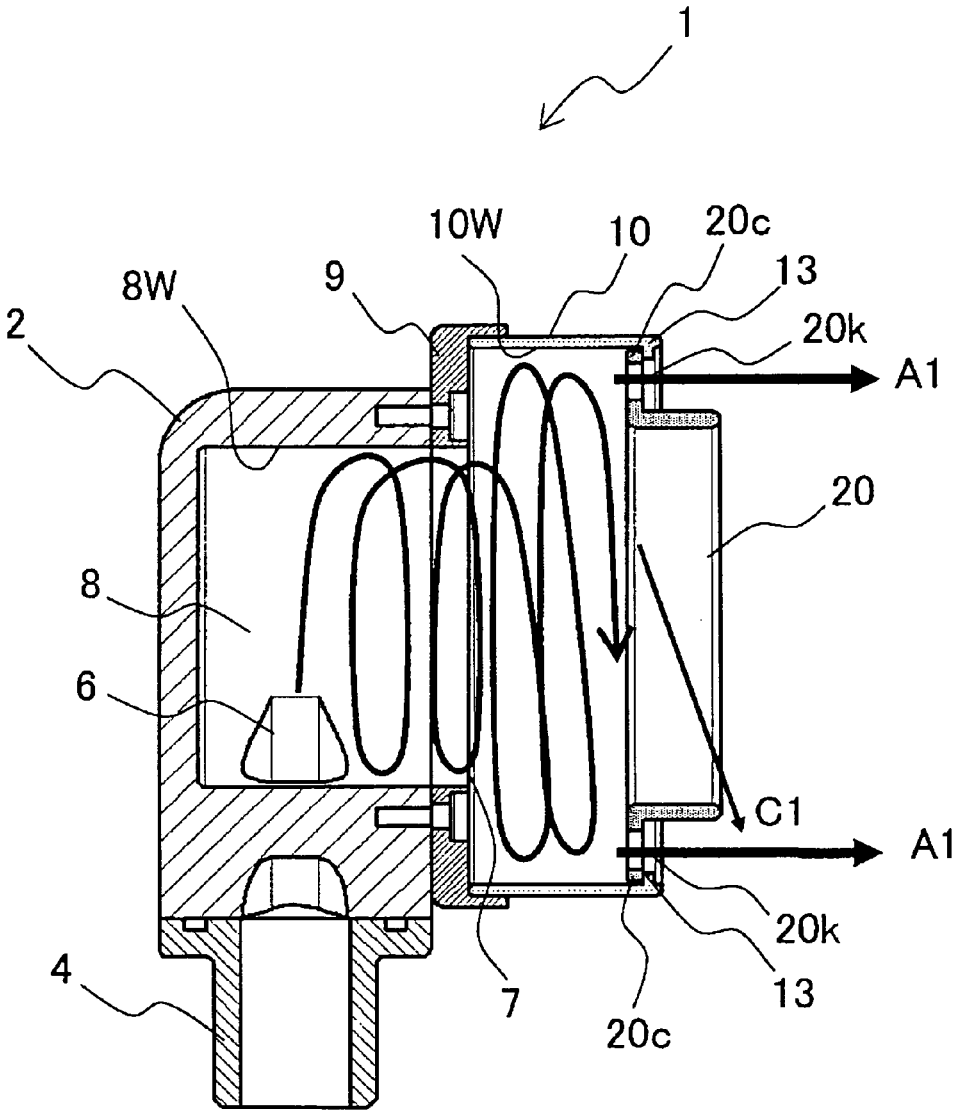
FIG. 71 is an A-A sectional view of FIG. 70.

FIGS. 69 to 71 are schematic views showing the massage nozzle as a sixth specific example of the present embodiment. That is, FIG. 69 is a perspective view showing the massage nozzle 1.

FIG. 70 is a front view showing the massage nozzle 1 and FIG. 71 is an A-A sectional view of FIG. 70.

Figure 72:
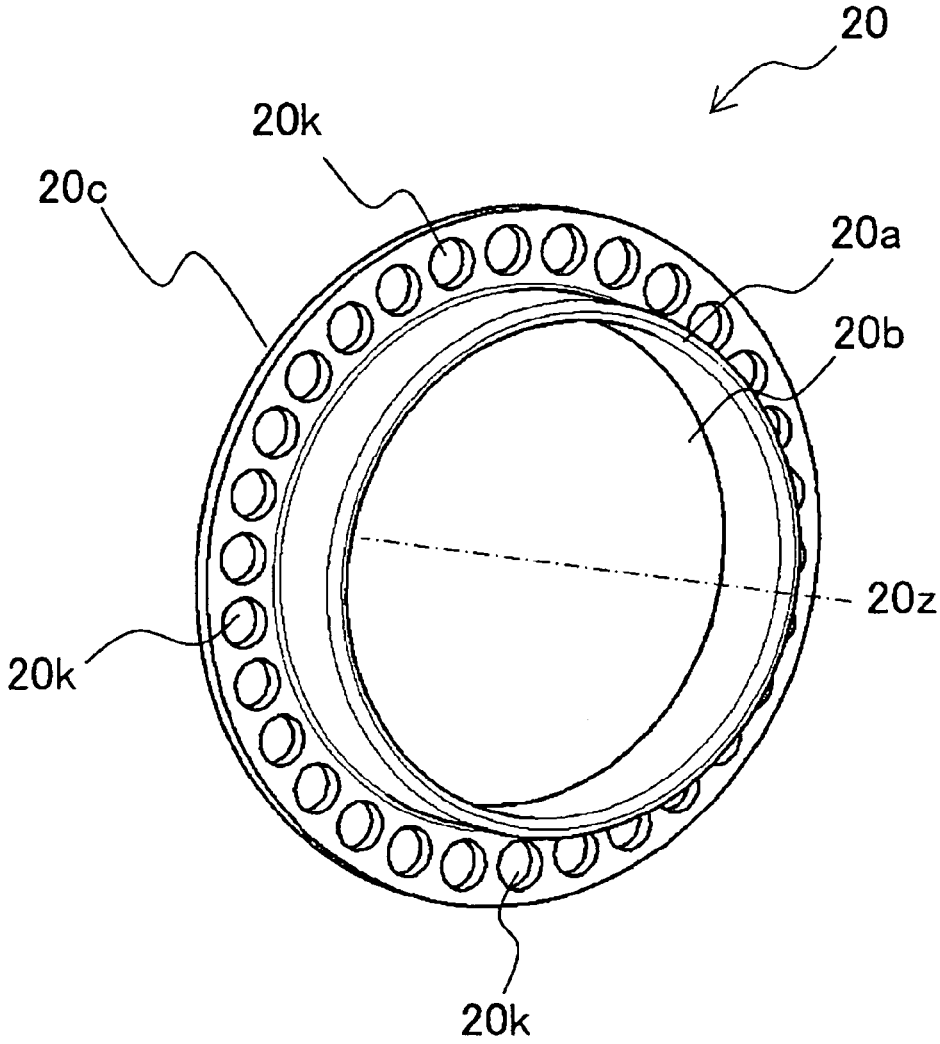
FIG. 72 is a perspective view showing the movable member 20.

In addition, FIG. 72 is a perspective view showing the movable member 20. Also in these drawings, as to the same elements as described above in FIGS. 25 to 68, detailed description by attaching the same numerals is omitted.

Also in the massage nozzle 1 of the present specific example, the guide section 10 is provided outside of the spouting port 7 via the flange 9. The circumferentially slightly-protrusion section 13 is provided around the end of the inner-circumference wall of the guide section 10.

Meanwhile, as shown in FIG. 72, the movable member 20 has the cylindrical ring section 20*a* and the stopper 20*c* protruding in a discoid-shaped manner circumferentially from the bottom. As the stopper 20*c* abuts the protrusion section 13 provided at the end of the guide section 10, this prevents the movable member 20 from detaching from the guide section 10. A plurality of water-discharging holes 20*k* are provided in the stopper 20*c* of the movable member 20.

According to the massage nozzle 1 of the present specific example, the vortical flow CF can be prevented from splashing in an opened condition (not letting the massage nozzle touch on the site on the person's skin subject to treatment) by providing the movable member 20 with a plurality of water-discharging holes 20*k*. That is, as shown in FIG. 71, in an opened condition, the pressure due to the vortical flow CF causes the movable member 20 to abut on the protrusion section 13 provided in the end of the guide section. In addition, the vortical flow CF rotating around the inner-circumference wall 10W of the guide section 10 collides with the stopper 20*c* of the movable member 20 and is spouted forward in a shower-like manner from a plurality of water-discharging holes 20*k*. That is, the water-discharging holes 20*k* provided in the movable member 20 take the flow-adjustment effect to suppress the vortical component included in the vortical flow CF. As a result, this massage nozzle 1 can be used as a general showerhead.

In addition, if the spouting amount from the water-discharging holes 20*k* is insufficient, as shown by the arrow mark C2, the vortical flow CF is to be overflowed from the opening 20*b* of the movable member 20. However, also in this case, if the water flow shown by the arrow mark C2 is not too strong, since the vortical flow CF will be blocked by a shower-like water film shown by the water flow A1, spouted water will not splash in all directions.

Meanwhile, in a condition where massage is performed while applying to the site on the person's skin subject to treatment, as described in FIGS. 25 to 67, the movable member 20 performs the precession movement and the similar movements with located eccentrically in the guide section 10.

As a result, the site on the person's skin subject to treatment undergoes the vibration effect with a shaking, enabling a highly-effective massage in combination with the suction massage and vibration effect.

Figure 73:
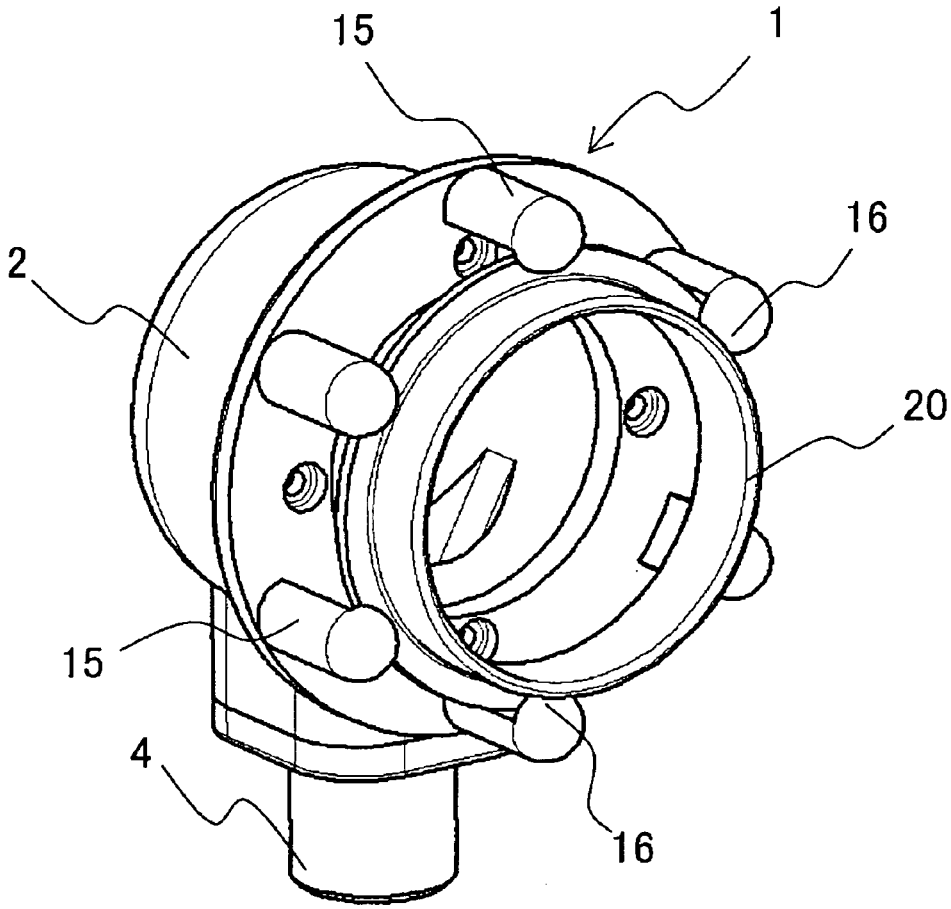
FIG. 73 is a schematic view showing the massage nozzle 1 as a eighth specific example of the present invention.
Figure 74:
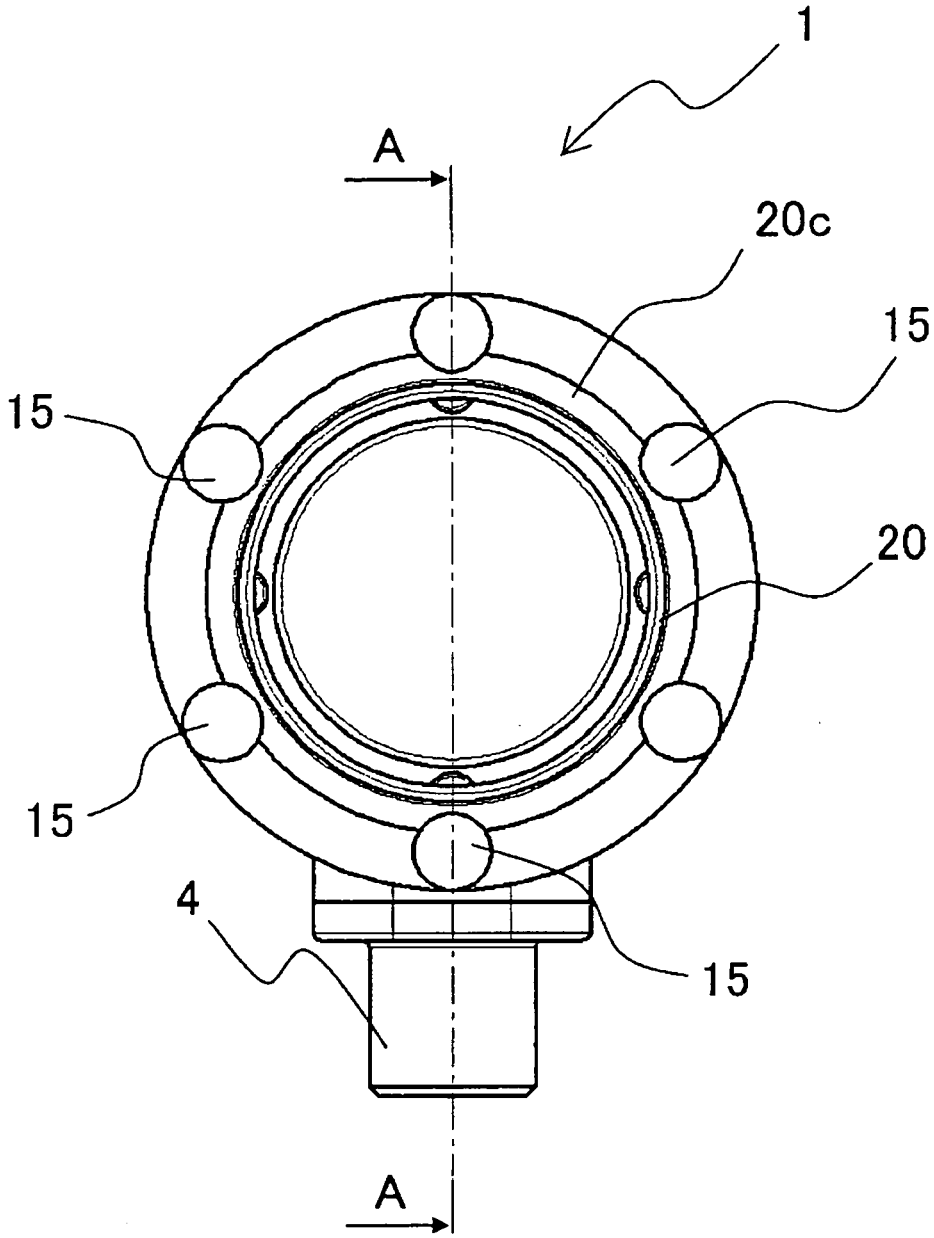
FIG. 74 is a front view showing the massage nozzle 1.
Figure 75:
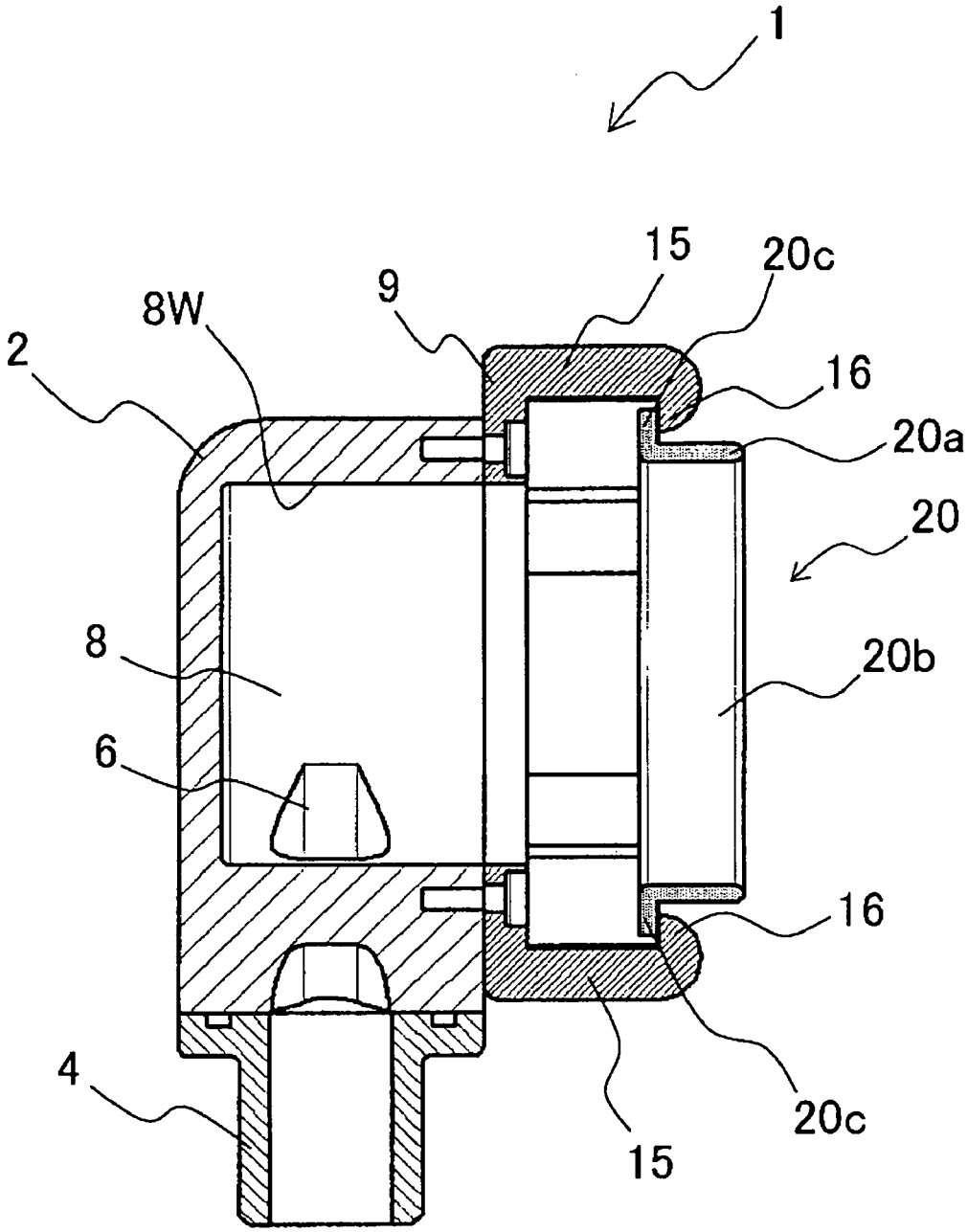
FIG. 75 is an A-A sectional view of FIG. 74.
Figure 76:
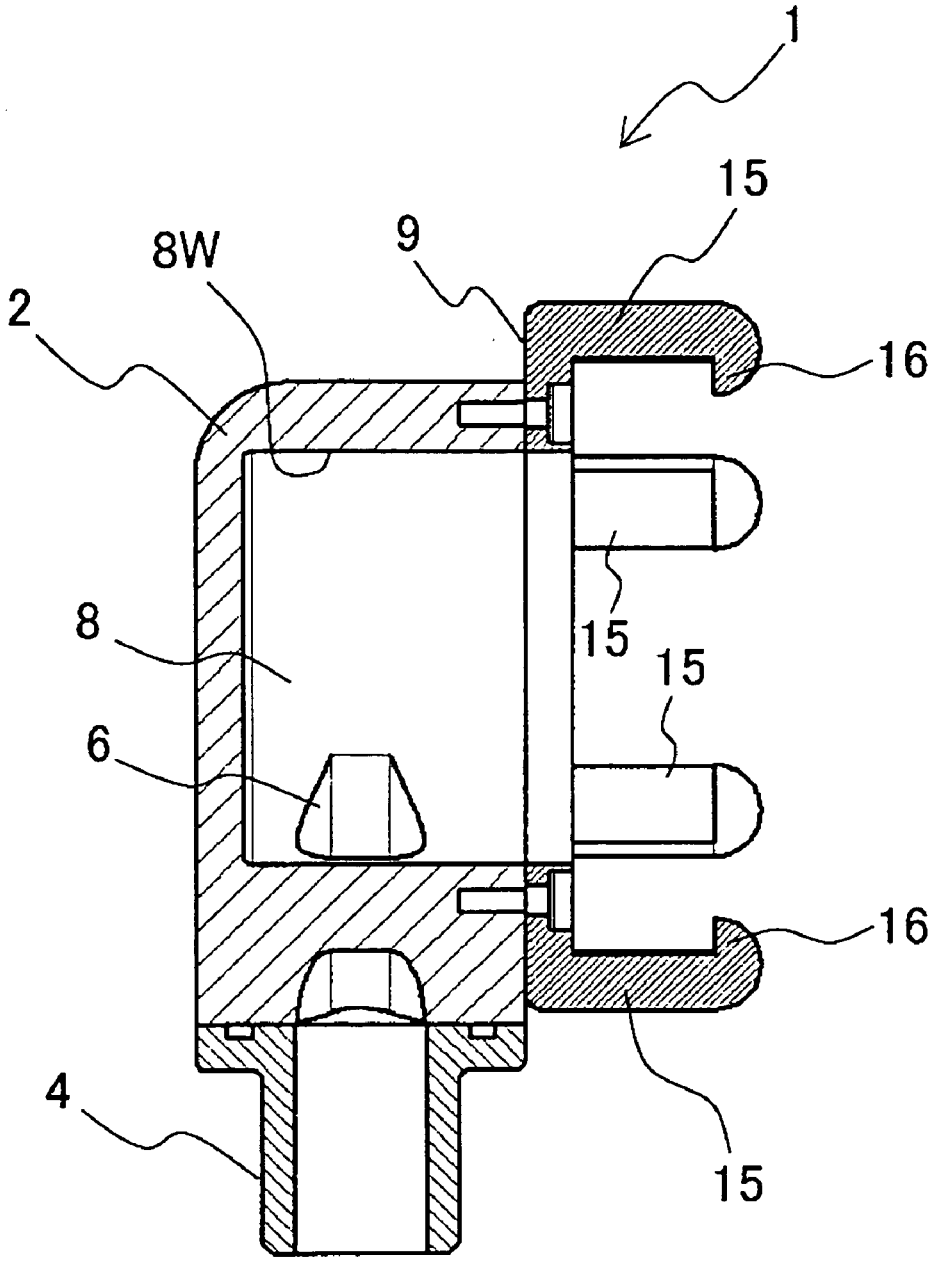
FIG. 76 is an A-A line sectional view showing the condition where the movable member 20 is removed.

FIGS. 73 to 76 are schematic views showing the massage nozzle as a seventh specific example of the present embodiment. That is, FIG. 73 is a perspective view of the massage nozzle 1, FIG. 74 is a front view showing the massage nozzle 1, FIG. 75 is an A-A sectional view of FIG. 74 and FIG. 76 is an A-A line sectional view showing the condition where the movable member 20 is removed. Also in these drawings, as to the same elements as described above in FIGS. 25 to 72, detailed description by attaching the same numerals is omitted.

According to the massage nozzle 1 of the present specific example, holding claws 15 protrude out of the spouting port 7 as a plurality of protrusions via the flange 9. The holding claws 15 have the claw section 16 at the end as a protrusion protruding inward.

Meanwhile, the movable member 20 has the same shape as shown in FIG. 58, the cylindrical ring section 20*a* and the stopper 20*c* protruding in a discoid-shaped manner circumferentially from the bottom. As the stopper 20*c* abuts the claw 16 provided at the end of the holding claw 15, this prevents the movable member 20 from detaching from the massage nozzle 1. Since the stopper 20*c* is formed in a discoid-shaped, the movable member 20 can be moved smoothly inside of the holding claw 15.

In addition, the movable member 20, as shown in FIG. 75, may have the ring section 20*a* whose end protrudes out of the end of the holding claw 15 in a condition that the stopper 20*c* abuts the claw section 16, or in the same condition as described above, the end of the ring section 20*a* may not be designed to protrude from the holding claw 15. As described below, even if the movable member 20 does not protrude, various effects such as the vibration effect and the like by applying the movable member 20 to the sucked site on the person's skin subject to treatment can be obtained.

Also in the massage nozzle of the present specific example, in an opened condition, as shown in FIG. 75, the movable member 20 is affected by the pressure of the vortical flow CF, causing the stopper 20*c* to abut on the claw section 16 of the holding claw 15. In addition, when the massage nozzle 1 is applied to the site on the person's skin subject to treatment, the movable member 20 is pressed backward to start to rotate due to the vortical force of the vortical flow CF. At this time, letting the movable member 20 perform eccentric or inclined "precession movement" and the similar movements in a space surrounded by holding claws 15 can provide a physical vibration to the site on the person's skin subject to treatment.

Also according to the present specific example, a depressing effect by applying a plurality of holding claws 15 to the site on the person's skin subject to treatment can be obtained at the same time.

In addition, although the cases where the movable member 20 having the shape illustrated in FIG. 58 is provided are shown in FIGS. 73 to 76, one or more aspects of the present invention are not limited to this specific example and various shaped movable members can be used as well as the movable members illustrated in FIGS. 63 and 64.

Third Embodiment

Next, as a third embodiment of the present invention, a massage nozzle in combination with the above-described first and second embodiments described above.

Figure 77:
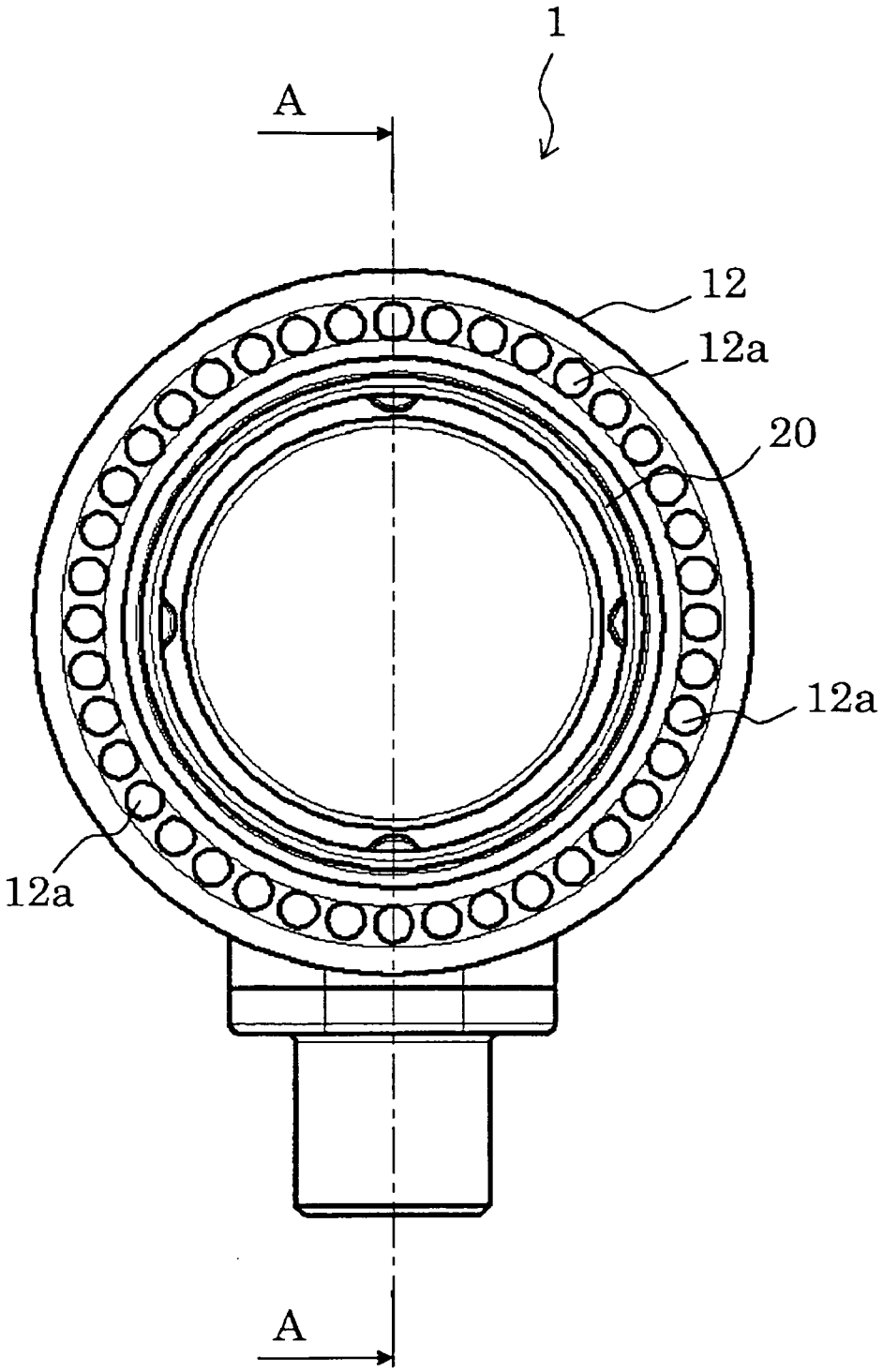
FIG. 77 is a front view showing a massage nozzle according to an embodiment of the present invention.

FIG. 77 is a front view showing a massage nozzle according to an embodiment of the present invention.

Figure 78:
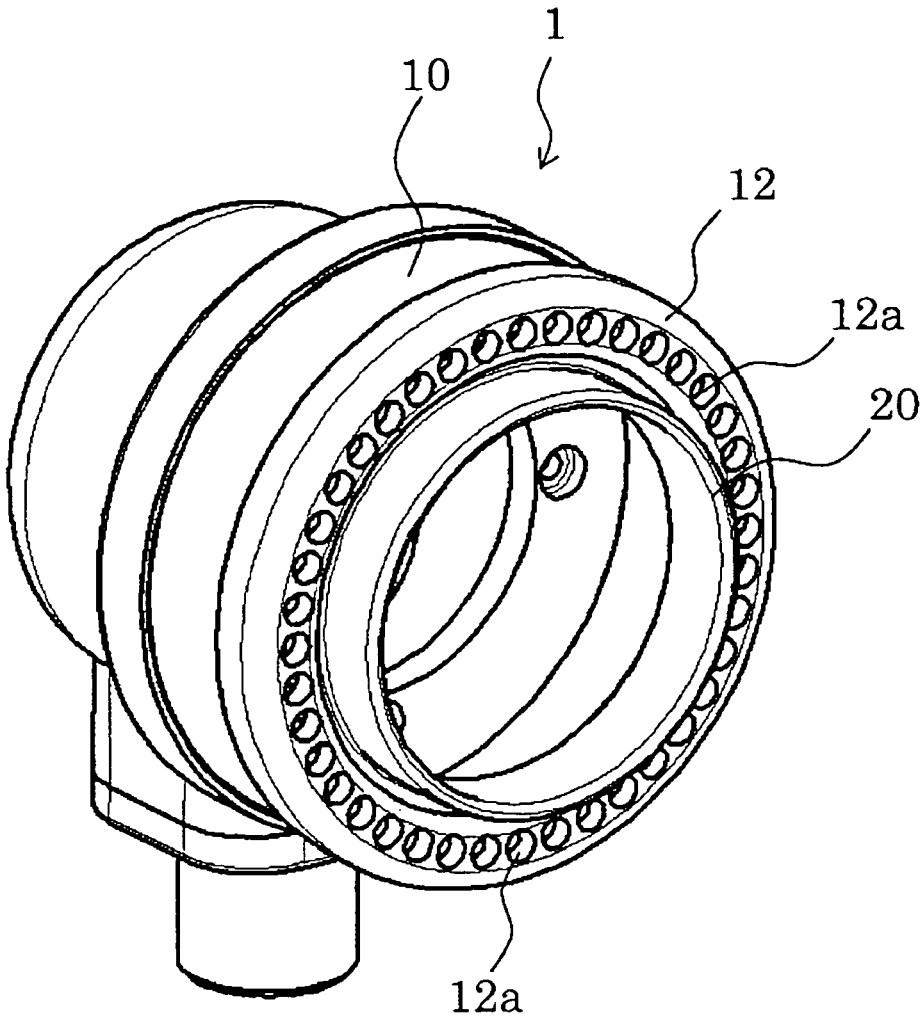
FIG. 78 is a perspective view showing the massage nozzle according to an embodiment of the present invention.
Figure 79:
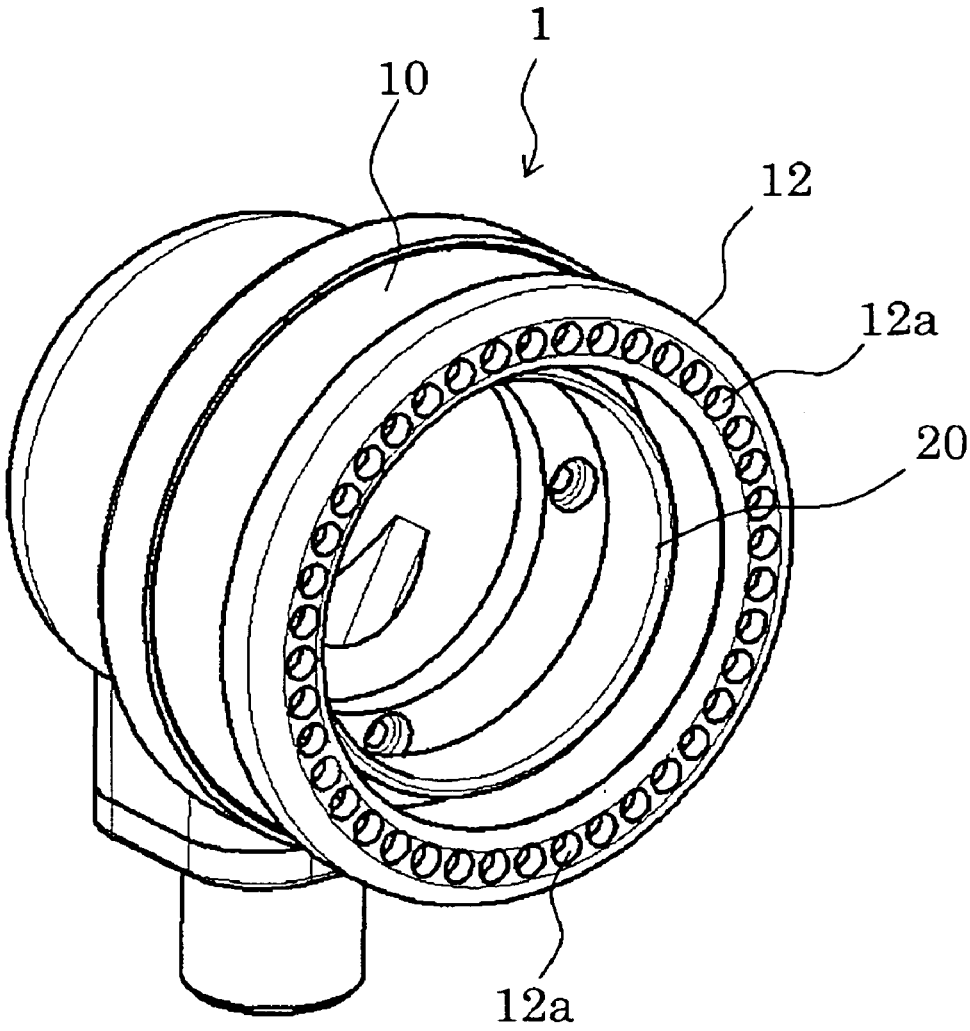
FIG. 79 is a perspective view showing the massage nozzle according to an embodiment of the present invention.

In addition, FIG. 78 and FIG. 79 are perspective views showing the massage nozzle of the embodiment of the present invention.

Figure 80:
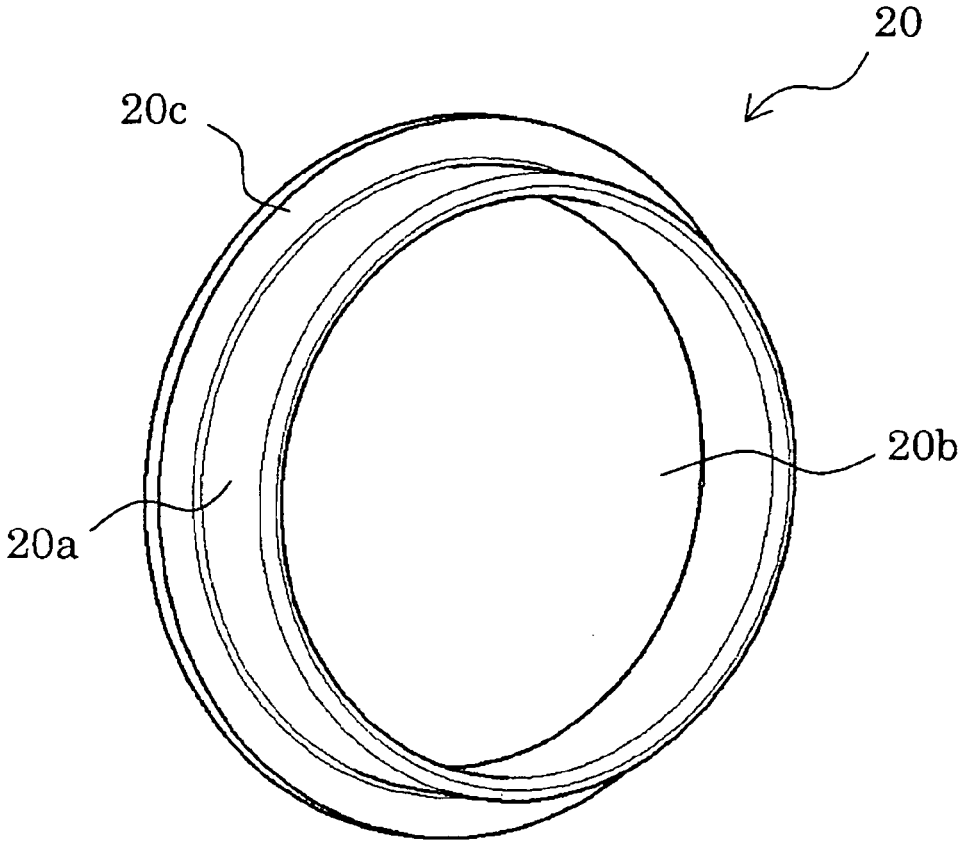
Figure 81:
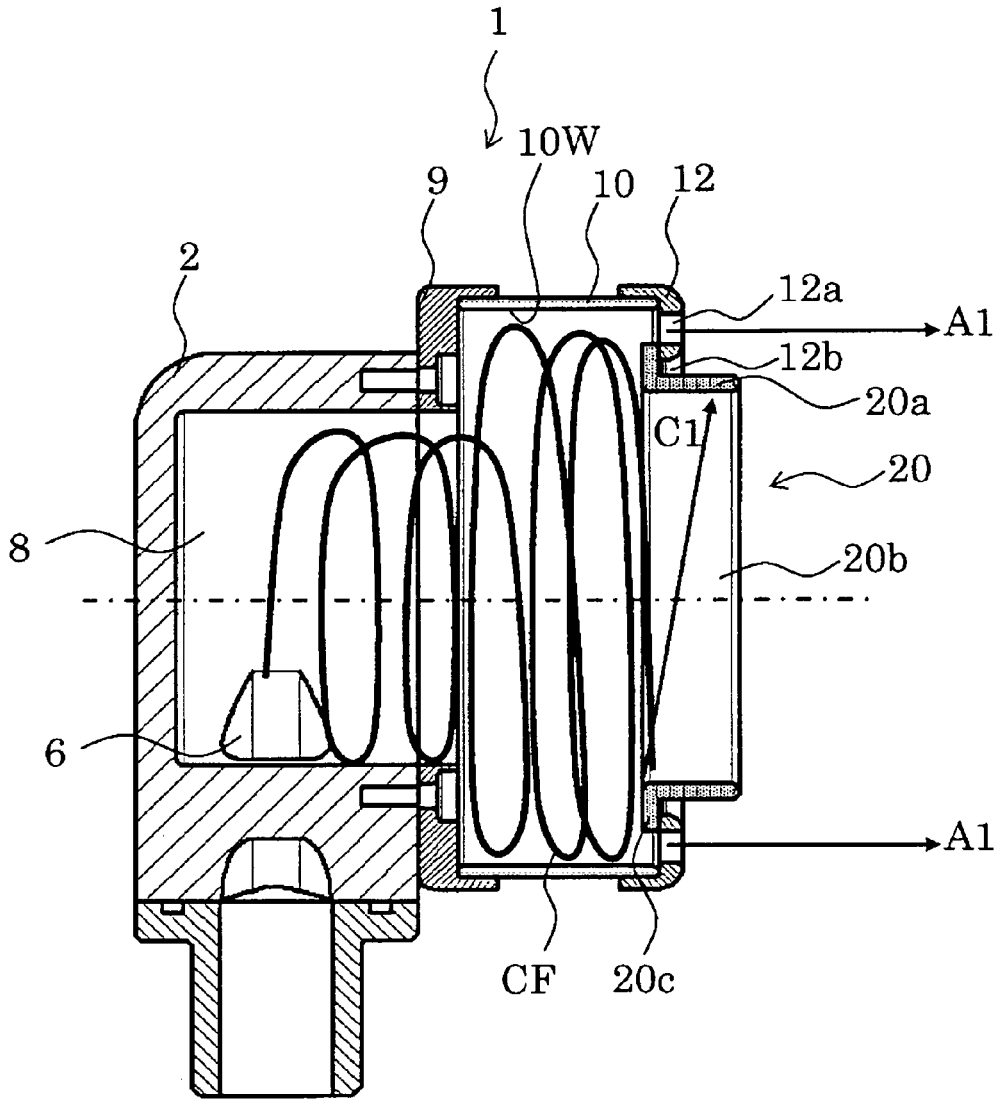
FIG. 81 is an A-A line sectional view of FIG. 77.
Figure 82:
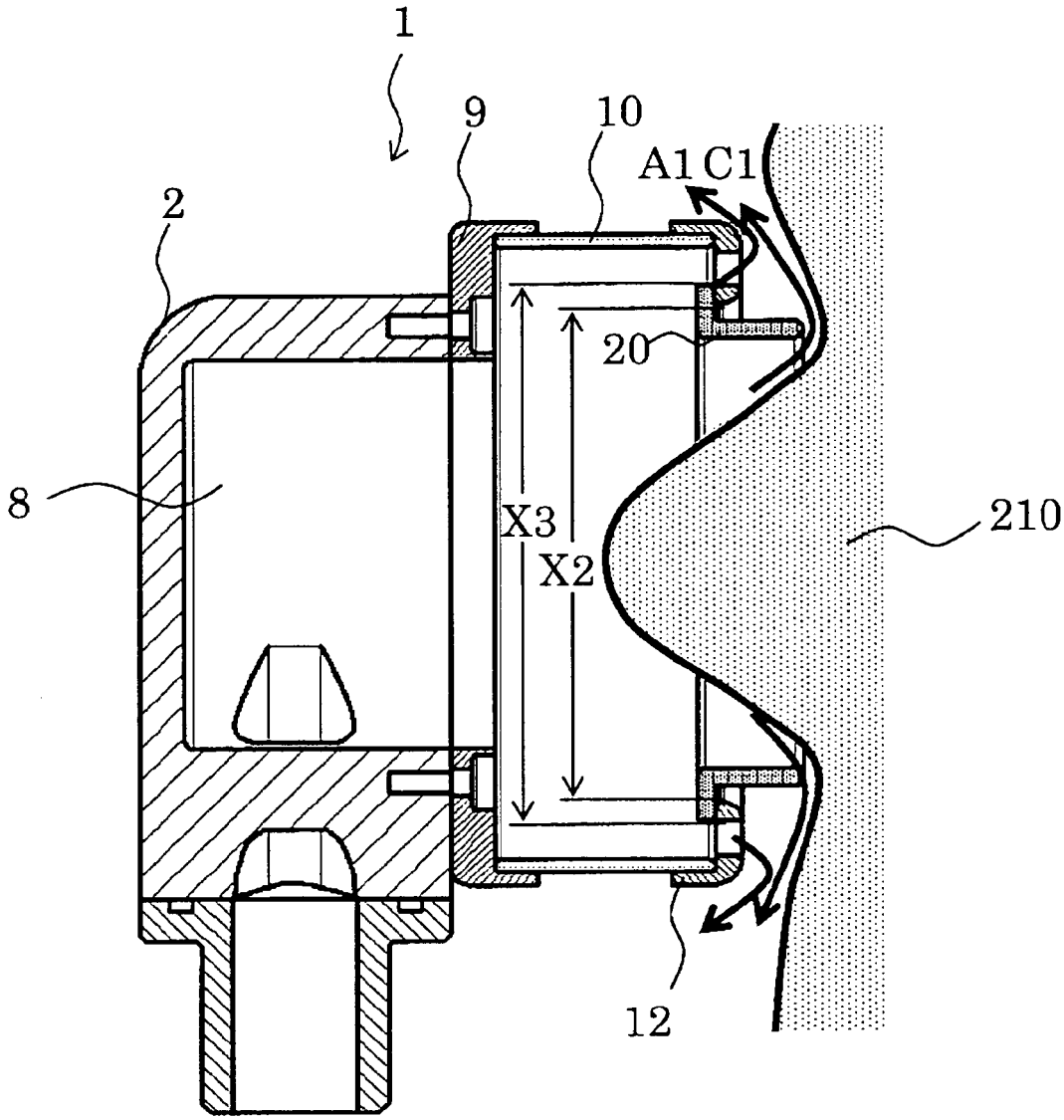
FIG. 82 is an A-A line sectional view of FIG. 77.
Figure 83:
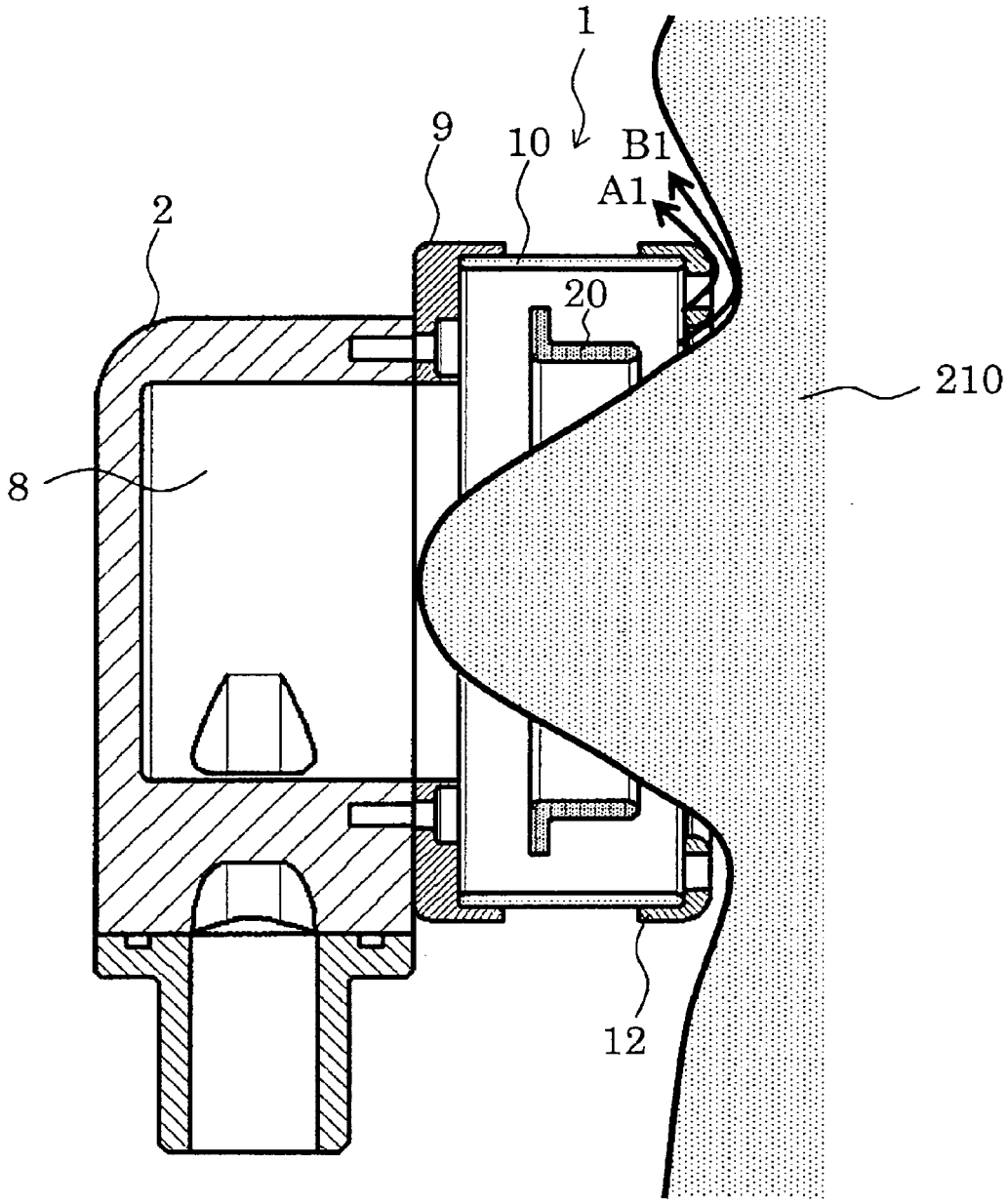
FIG. 83 is an A-A line sectional view of FIG. 77.

FIG. 80 is a perspective view showing the movable member which the massage nozzle of the present embodiment is provided with and FIGS. 81 to 83 are A-A line sectional views of FIG. 77. In these drawings, as to the same elements as described above in FIGS. 1 to 76, detailed description by attaching the same numerals is omitted.

According to the present specific example, the movable member 20 is provided in the guide section 10. Since the movable member 20 is not fixed, it can freely move in a space regulated by the flange 9, guide 10 and water-spray plate 12.

In addition, one or more aspects of the present invention are not limited to this specific example, as described above in FIGS. 1 to 7, the movable member 20 can be provided even in the massage nozzle without the guide section 10. That is, as shown in FIG. 1 to FIG. 7, in case that the water-spray plate 12 is provided at the end of the spouting port 7, providing the movable member 20 in the vortex chamber 8 can obtain each type of effects as described below in the same manner.

As shown in FIG. 80, the movable member 20 has the semi-discoid-shaped stopper 20*c* which has an opening in the center, the cylindrical 20*a* rinsing from the opening end. That is, the same movable member 20 as shown in the FIG. 58 is provided. Since the stopper 20*c* is designed to be larger than the opening 12*b* of the water-spray plate 12, it will not pass through the opening 12*b* during normal use. The outside dimensions of the stopper 20*c* are specified so that the water-spray holes 12*a* are not virtually blocked.

In addition, as shown in FIG. 82, if the maximum outside dimensions X3 of stopper 20*c* is designed to be larger than the radius X2 of the opening 12*b* of the water-spray plate, it is unlikely that the movable member 20 will pass through the guide section 10 to enable a user to more easily handle.

The use conditions of the massage nozzle 1 of the present embodiment are described while referring to FIG. 81. If water is fed to the massage nozzle 1 from the water-supply means (not illustrated), a vortical flow CF is formed in the vortex chamber 8. This vortical flow CF rotates from the spouting port 7 along the inner-circumference wall 10W of the guide section 10 and reaches the water-spray plate 12. At this time, the movable member 20 abuts the back side of the water-spray plate 12 due to the pressure of the vortical flow CF to let the cylindrical ring 20*a* protrude outside of the opening 12*b* of the water-spray plate 12. Also at this time, the movable member 20 undergoes semi-uniform depressing pressure moving from the inner-circumference wall 10W to the center and is placed semi-concentrically with the rotation axis Z of the vortical flow CF. That is, the movable member 20 abuts the back side of the water-spray plate 12 at almost the same distance viewing from the inner-circumference wall 10W of the guide section.

At this time, the stopper 20*c* virtually does not block the water-spray holes 12*a* provided in the water-spray plate 12 and the vortical flow CF which reached the water-spray plate 12 is spouted in a shower-like manner from the water-spray holes 12*a*. In addition, providing the movable member 20 enables the opening 12*b* of the water-spray plate to be designed to be virtually small and the splash of the vortical flow to be further efficiently suppressed. That is, in the conditions as shown in FIG. 81, the size of the opening of the water-spray plate is equal to the size of the opening of the stopper 20*c*. That is, the opening of the water-spray plate 12 can be designed to be smaller. As a result, this strengthens the "dam" effect to block the splash of the vortical flow and further can readily suppress water from splashing from the opening of the water-spray plate (opening of the ring section 20*a*) as described above in FIG. 21.

Furthermore, in a condition where the movable member 20 is placed as shown in FIG. 81, the thickness of the stopper 20*c* has the same effect as that of the circumferential protrusion section 15 as described above in FIG. 22 and FIG. 23.

Meanwhile, the vortical flow flowed in the opening 12*b* of the water-spray plate 12 is spouted in the arrow mark C1 direction in FIG. 81, however, since the vortical flow collides with the internal wall of the ring 20*a* to suppress the vortical component, splashing at a wider angle can be prevented.

As described above, providing the movable member 20 can suppress the vortical flow from splashing from the opening 12*b* of the water-spray plate 12 on an opened spouted condition furthermore.

In this condition, a negative region due to vortical flow CF is formed inside the ring section 20*a*. In addition, when letting the site on the person's skin subject to treatment 210 get close to it, as shown in FIG. 82, the site on the person's skin subject to treatment 210 is sucked into the ring section 20*a* to undergo massage. At this time, the water flow C1 flowed from the inside of the ring section 20*a* forms the water film between the site on the person's skin subject to treatment 210 and the end of the ring section 20*a* to protect the site on the person's skin subject to treatment 210. In addition, the site on the person's skin subject to treatment 210 undergoes depressing pressure due to the water flow A1 spouted from the water-spray holes 12*a* provided outside of that to promote the massage effect furthermore.

In addition, if a user strengthens the force to press the massage nozzle 1, the movable member 20 stands against the pressure of the vortical flow CF and goes backward to enable the site on the person's skin subject to treatment 210 to be sucked more widely by the opening 12*b* of the water-spray plate 12. At this time, as described above in FIG. 12, the site on the person's skin subject to treatment 210 undergoes depressing pressure due to the water flow A1 and B1 and in addition the film formed by the those water protects the site on the person's skin subject to treatment 210.

That is, in a condition where the movable member 20 is pressed into the guide section 10 (or the vortex chamber 8), the area of the opening to the water-spray plate can be expanded and the suction effect (bioeffect) can be enhanced. At the same time, since the water amount (B1) to be flowed from the opening of the water-spray plate increases, the effect to form the water film in front of the water-spray plate 12 increases to improve the movability of the nozzle.

As can be seen if comparing with the conditions shown in FIG. 81, providing the movable member 20 enables the opening of the water-spray plate to be smaller on an opened spouting condition and to be larger during suction massage. These conditions can be automatically changed depending on the use conditions.

Also at this time, the movable member 20 rotates and vibrates due to the vortical effect of the vortical flow CF to provide physical stimulation to the site on the person's skin subject to treatment 210. For this reason, the site on the person's skin subject to treatment 210 undergoes stimulation from the movable member 20 in addition to the "twisting" and "vibration" due to the vortical flow CF to promote the massage effect.

Figure 84:
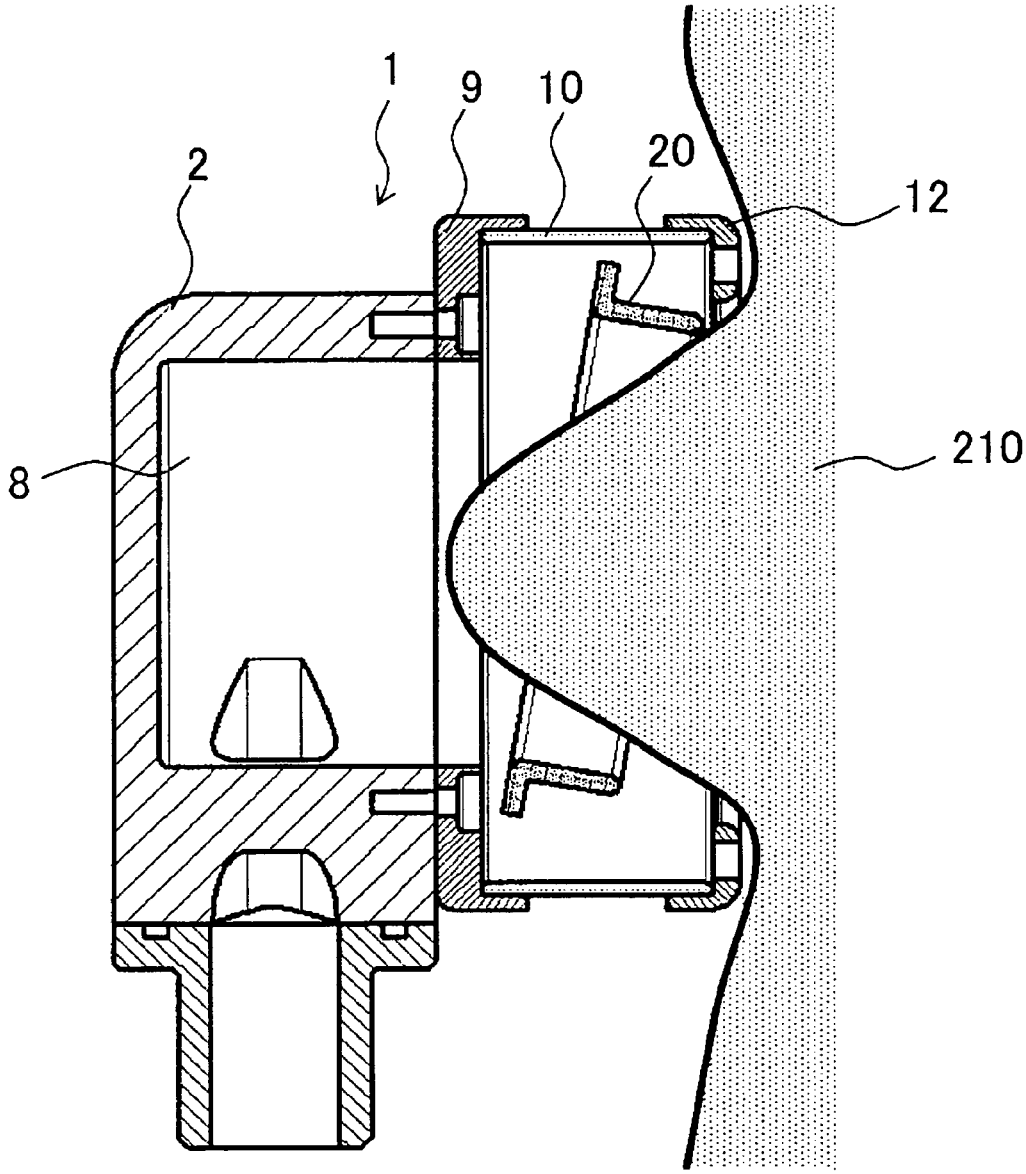
FIG. 84 is an A-A line sectional view of FIG. 77.

That is, as shown in FIG. 84, slightly pressing the massage nozzle 1 on the site on the person's skin subject to treatment causes the movable member 20 to press against the pressure of the vortical flow CF, go back, and perform the "precession movement" or similar movements while being located eccentrically. As a result, this provides vibration with shaking to the site on the person's skin subject to treatment 210 to enhance the massage effect.

Figure 85:
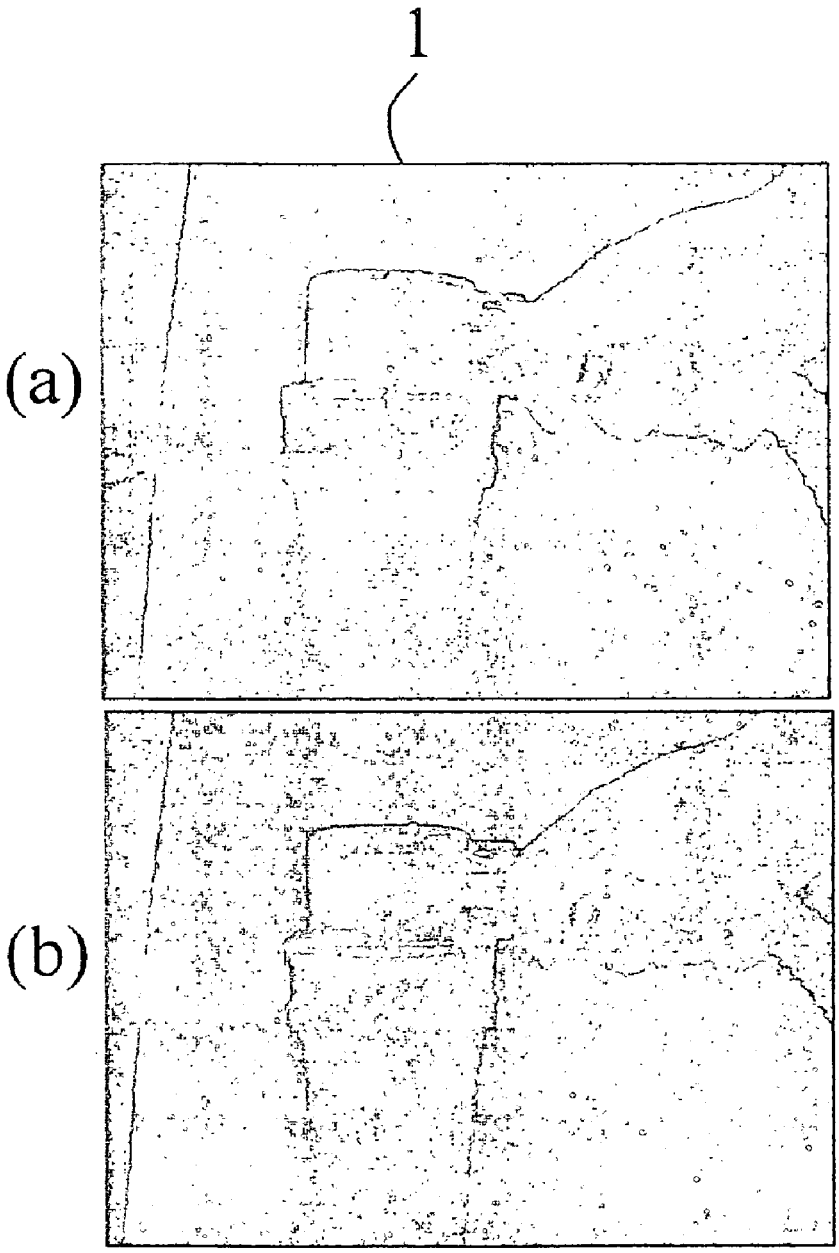
FIG. 85 is a photo showing a splash-prevention effect due to movable member 20.

FIG. 85 is a photo showing a splash-prevention effect due to movable member 20. In addition, the massage nozzle 1 used here has the same configuration parameter as described above in FIG. 13 except for the following points, in which the length of guide section 10 is 25 mm and the diameter of the opening 12*b* of the water-spray plate 12 is 60 mmϕ. At this time, the diameter of the stopper 20*c* of the movable member 20 is set to 62 mmϕ, the diameter of the opening is set to 44 mmϕ, the outer circumference of the ring section 20*a* is set to 48 mmϕ and the inner circumference is set to 44 mmϕ.

FIG. 85(*a*) shows a case where the movable member 20 is not provided. At this time, as described above in FIG. 21(*b*), from the vortical flow spouted from the opening 12*b* of the water-spray plate 12, it is found that there is a lot of the splashing element.

FIG. 85(*b*) shows a case where the movable member 20 is provided. Providing the movable member 20 suppresses the vortical component of the vortical flow to be spouted from the opening 12*b* of the water-spray plate 12 and shows that the bundled spouting flow less splashing is obtained. In this condition, letting the massage nozzle 1 get close to the site on the person's skin subject to treatment 210 can perform a highly-effective suction massage as described above in FIG. 82 or FIG. 83.

Figure 86:
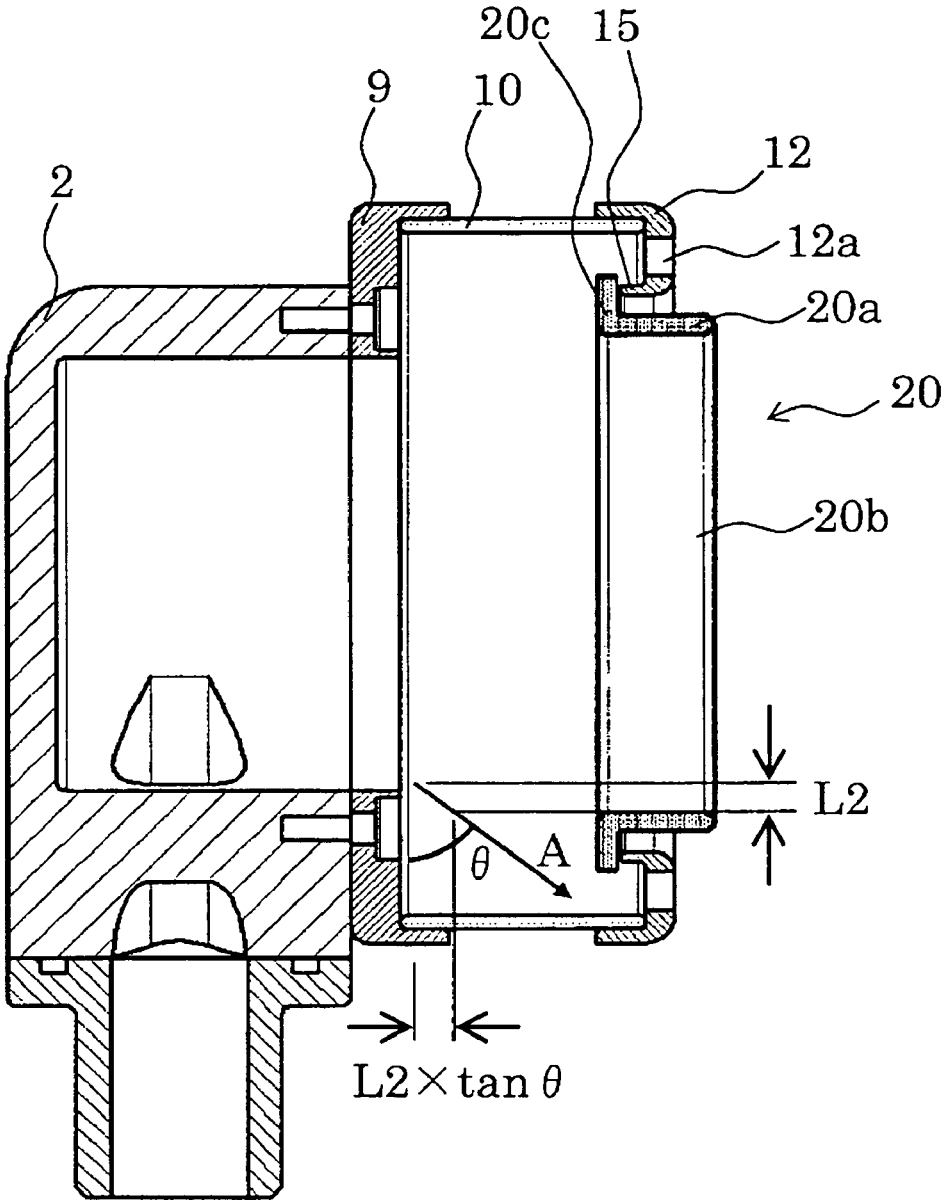
FIG. 86 is a schematic sectional view showing a variation of the massage nozzle having the movable member 20.

FIG. 86 is a schematic sectional view showing the variation of the massage nozzle having the water-spray plate 12 and the movable member 20. That is, in this variation, the circumferential protrusion section 15 is provided on the back side of the water-spray plate 12 as well as the movable member 20 provided. As described in FIGS. 22 to 24, providing the circumferential protrusion section 15 can adjust The balance between the water flow A1 to be spouted from the water-spray holes 12*a* and the water flow B1 to be spouted from the opening 12*b* of the water-spray plate 12. That is, this can prevent splashing in an opened spouting condition while adjusting the effect of vortical flow due to suction massage in a well-balanced manner.

In addition, providing the movable member 20 furthermore can satisfy both of splash prevention and promotion of the massage effect due to suction massage at a higher level.

In addition, if the movable member 20 is provided, in order to suppress the vortical flow CF from splashing, it is necessary to let the vortical flow CF to be spouted from the spouting port 7 collide with the stopper 20*c*. For this purpose, as shown in FIG. 86, when half of the difference between the diameter of the spouting port 7 and the diameter of the opening of the stopper 20*c* is determined as L2, the angle of the water flow A to be spouted from the spouting port 7 to the face including the spouting port 7 is determined as θ, it is preferable that the guide section 10 is formed as protruding as the length to the above-mentioned stopper 20*c* viewing from the above-mentioned spouting port in an opened spouting condition is (L2 □ tan θ) or more). The above-mentioned "opened spouting condition" shows conditions where the vortical flow is spouted without the massage nozzle 1 applied to the site on the person's skin subject to treatment. At this time, the stopper 20*c* of the movable member 20 is located almost on the vortex chamber 8 and is in a condition as abutting the back side of the water-spray plate 12 and the circumferential protrusion section 15.

In addition, in FIGS. 77 to 86, the example where the ring section 20*a* of the movable member 20 is semi-cylindrical is given, however, the present invention is not limited to this example. That is, the ring section 20*a* may be formed as "expanding toward the end", on the contrary, may be formed as "narrowing toward the end". If the ring section 20*a* is formed as expanding, the opening of the stopper 20*c* is smaller than the opening at the end of ring section 20*a*. Meanwhile, if the ring section 20*c* is formed as narrowing, the opening of the stopper 20*c* is larger than the opening of the end of the ring section 20*a*. In both cases, it is preferable that the above related equation is judged based on the opening of the stopper 20*c*.

In addition, except for the above examples, various types of movable members 20 according the 2nd embodiment can be used.

Figure 87:
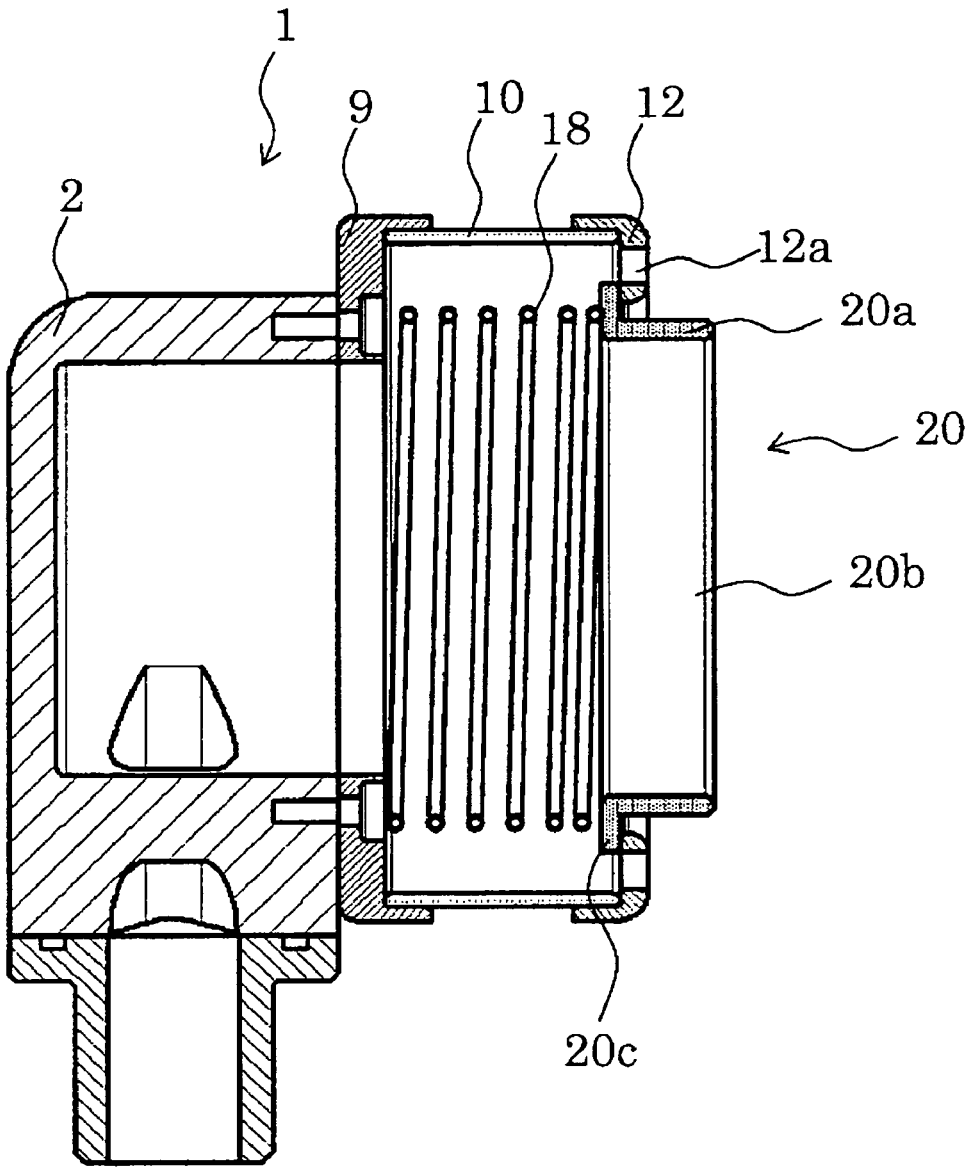
FIG. 87 is a schematic sectional view showing a second variation of the massage nozzle in which the movable member 20 is provided.

FIG. 87 is a schematic sectional view showing a second variation of the massage nozzle where the water-spray plate 12 and movable member 20 are provided. That is, according to the present variation, the movable member 20 is located eccentrically to the water-spray plate 12 by a spring 18. Thus, the movable member 20 is positioned in the center not to block the water-spray holes 12*a* without loads and maintained while abutting the back side of the water-spray plate 12. That is, providing the spring 18 enables the movable member 20 to firmly abut the water-spray plate 12 when being spouted in an opened condition to obtain the flow-adjustment effect with the movable member 20.

In addition, when performing suction massage, slightly pressing on the site on the person's skin subject to treatment 210 enables the suction massage via the ring section 20*a* as shown in FIG. 82. Further slightly pressing on causes the movable member 20 to stand against the pressure of the spring 18 and vortical flow CF and go backward and enables the wide-ranged suction massage via the opening 12*b* of the water-spray plate 12 as shown in 83.

In addition, according to one or more aspects of the present invention, the position of the movable member 20 may be adjustable using a mechanical vertical adjustment mechanism instead of letting the movable member 20 be located eccentrically by the spring 18. That is, proving the movable member 20 in the guide section 10 enables the position to be adjusted arbitrarily by a lever or a button, the condition shown in FIGS. 81 and 82 and the condition shown in FIG. 83 or the half between the above-mentioned conditions to be maintained. In addition, it is recommended to provide a mechanism to be positioned in the center as not letting the stopper 20*c* block the water-spray holes 12*a* in a condition where the movable member 20 abuts the water-spray plate 12.

Next, the results of measured suction pressure of the massage nozzle 1 are hereinafter described.

FIGS. 88 to 92, FIGS. 93 and 94 are schematic views showing two types of massage nozzles 1 prototyped and evaluated by the inventor of the present invention.

Figure 88:
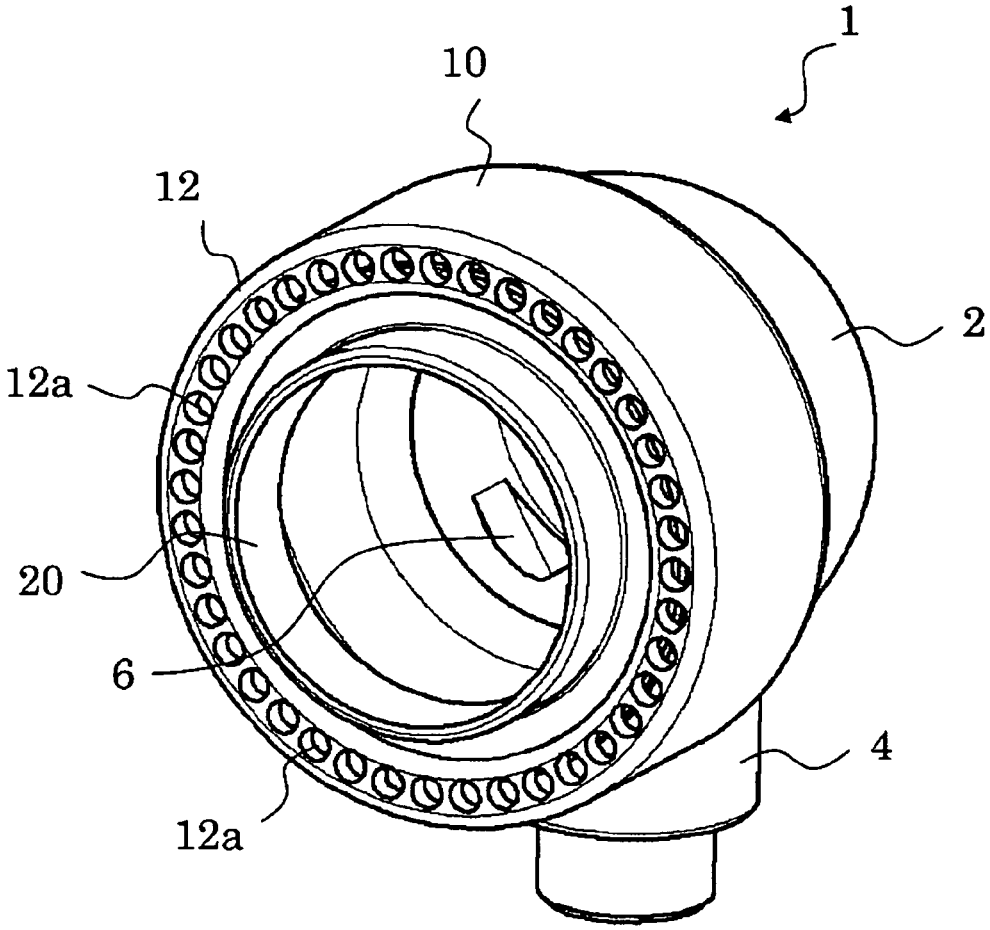
FIG. 88 is a perspective view showing the massage nozzle (sample 1).
Figure 89:
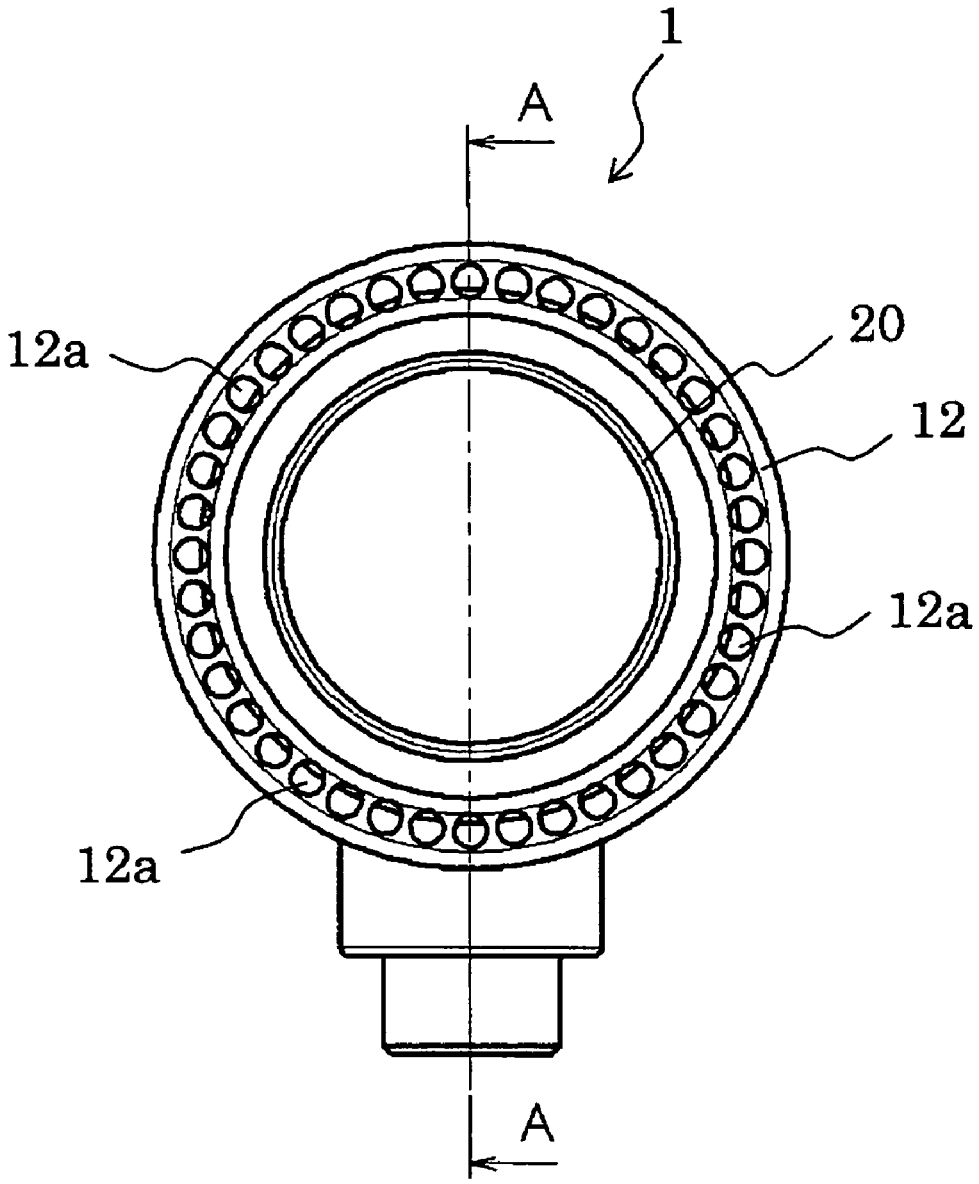
FIG. 89 is a front view showing the massage nozzle of the sample 1.
Figure 90:
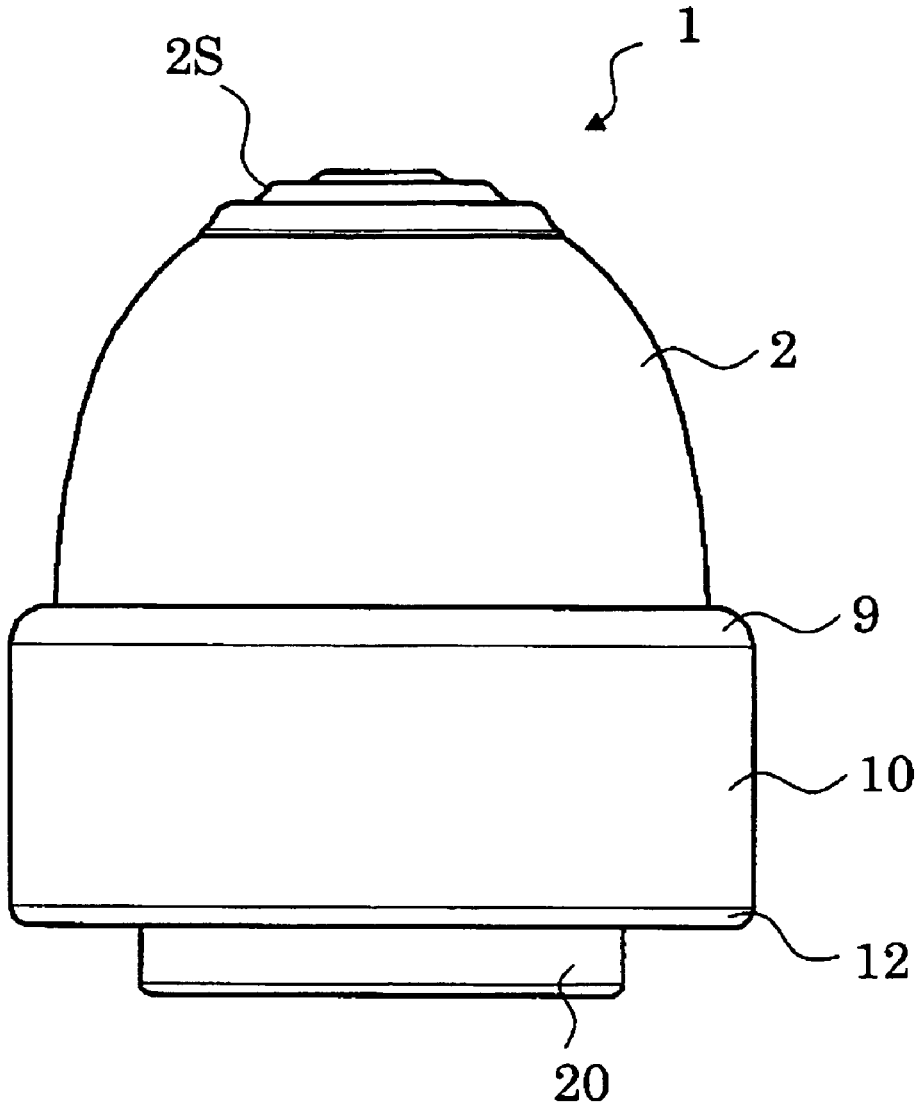
FIG. 90 is a top view showing the massage nozzle of the sample 1.
Figure 91:
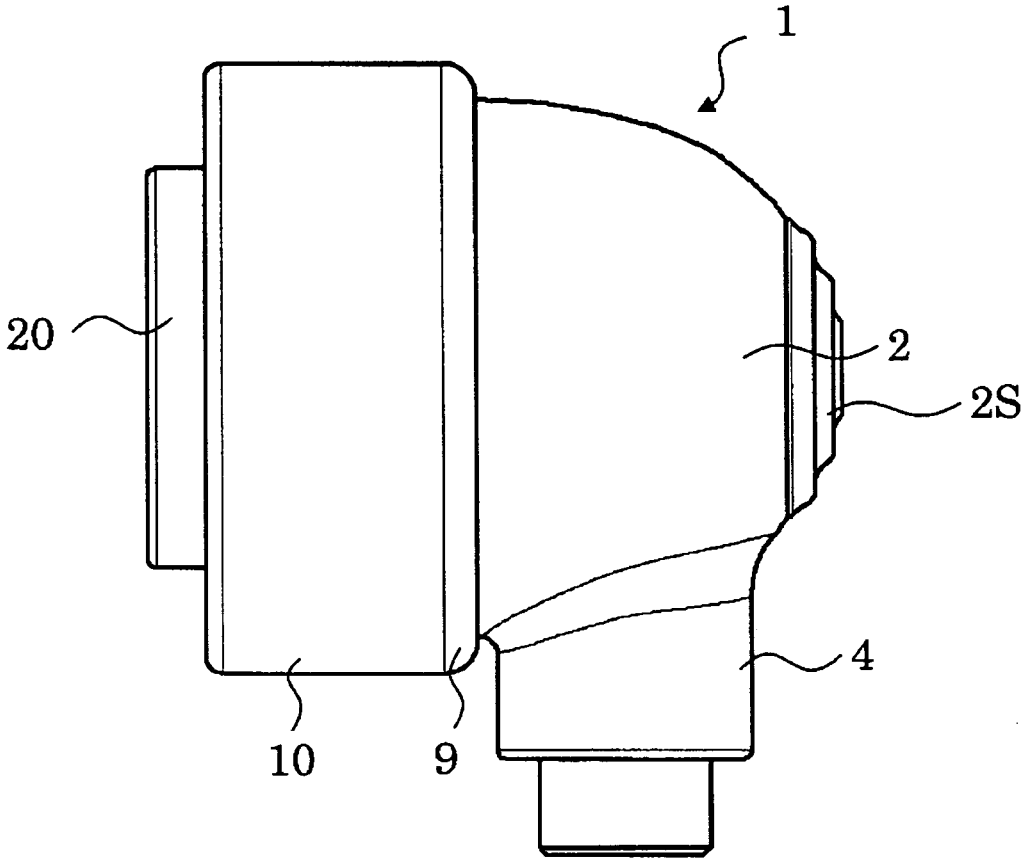
FIG. 91 is a side view showing massage nozzle of the sample 1.
Figure 92:
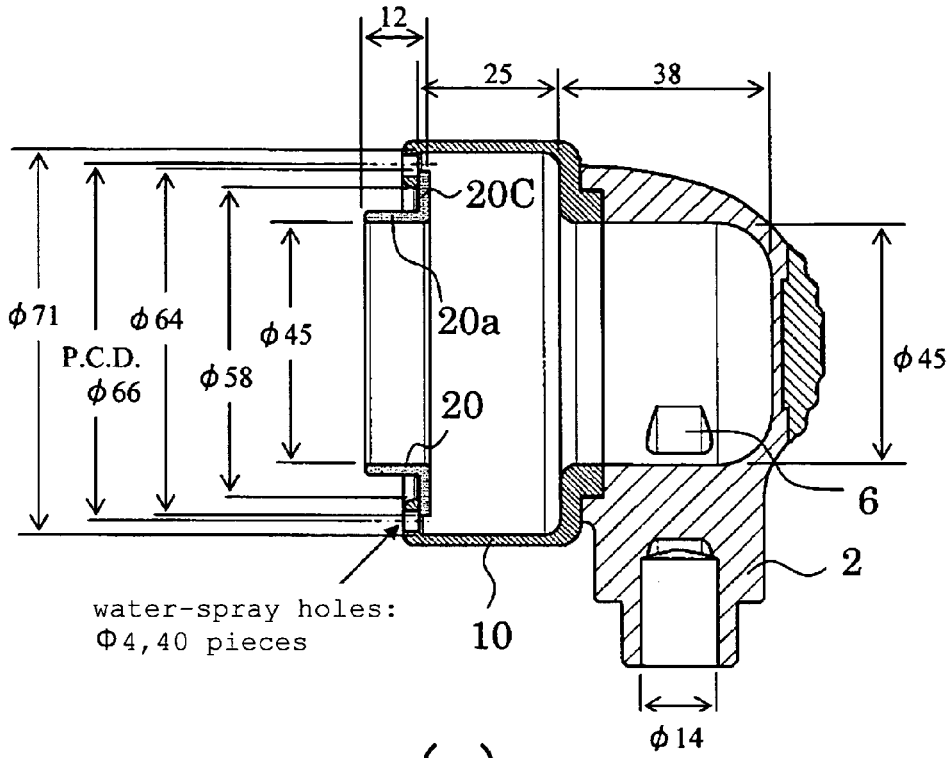
FIG. 92(*a*) is an A-A line sectional view of FIG. 89 and FIG. 92(*b*) is a schematic view showing a shape of a water intake section 6.
Figure 92:
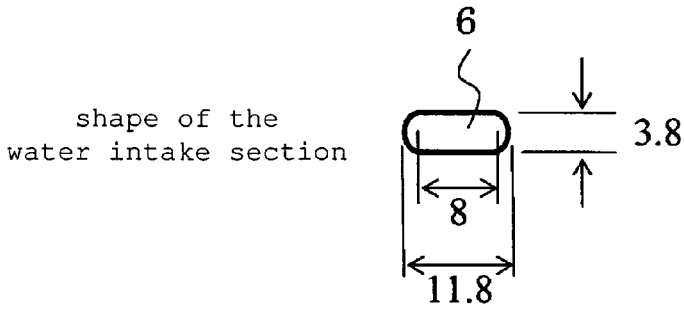

That is, FIG. 88 is a perspective view of the massage nozzle 1 (sample 1), FIG. 89 is a front view, FIG. 91 is a side view, FIG. 92(*a*) is an A-A line sectional view of FIG. 89 and FIG. 92(*b*) is a schematic view showing the shape of the water intake section 6.

Figure 93:
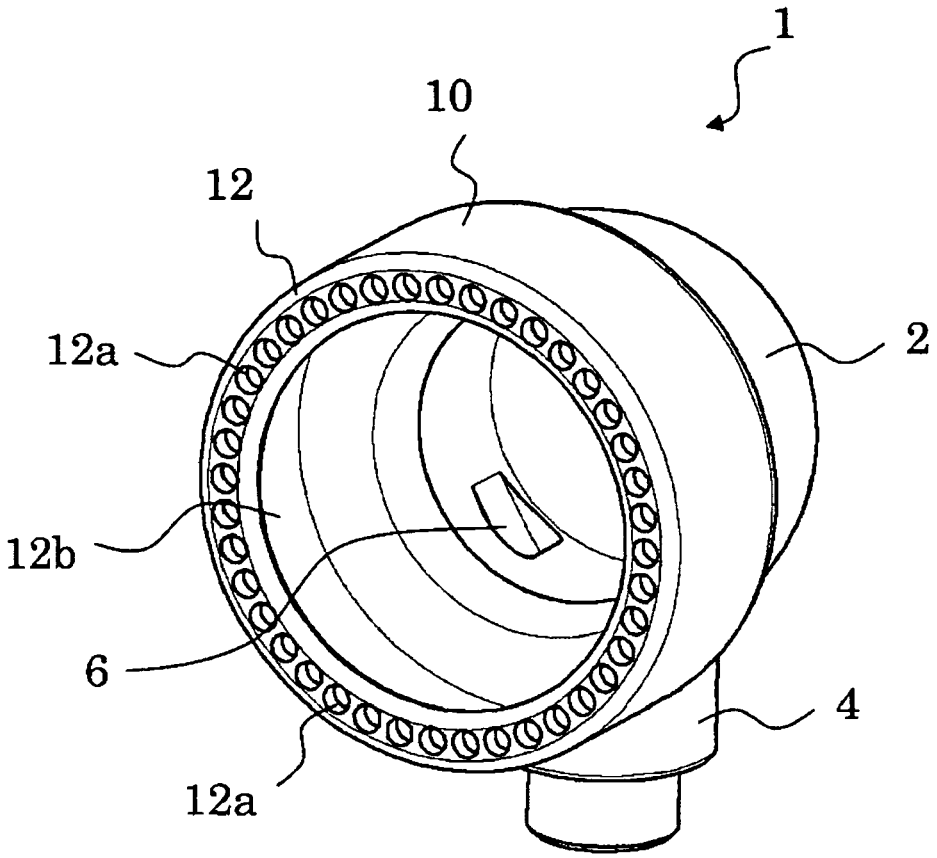
FIG. 93 is a perspective view showing the massage nozzle of the sample 2.
Figure 94:
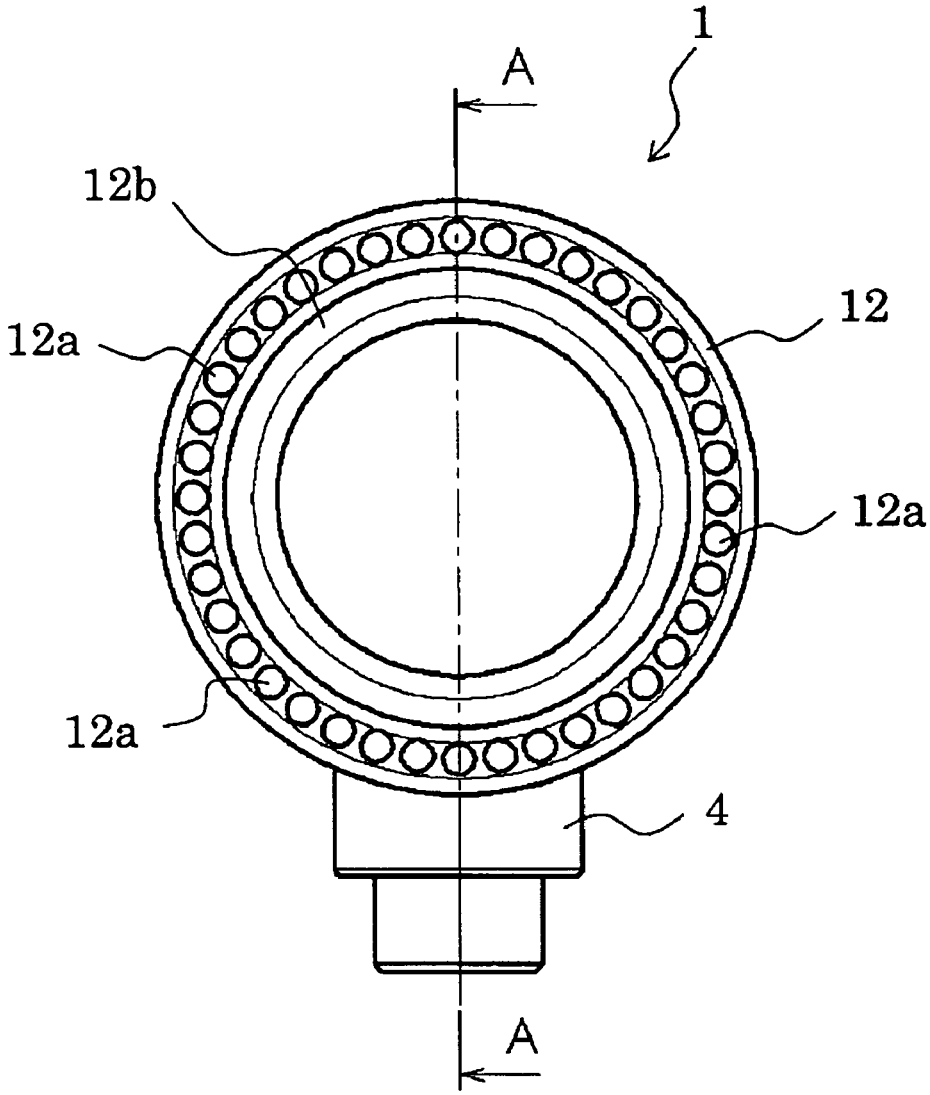
FIG. 94 is a front view showing the massage nozzle of the sample 2.
Figure 95:
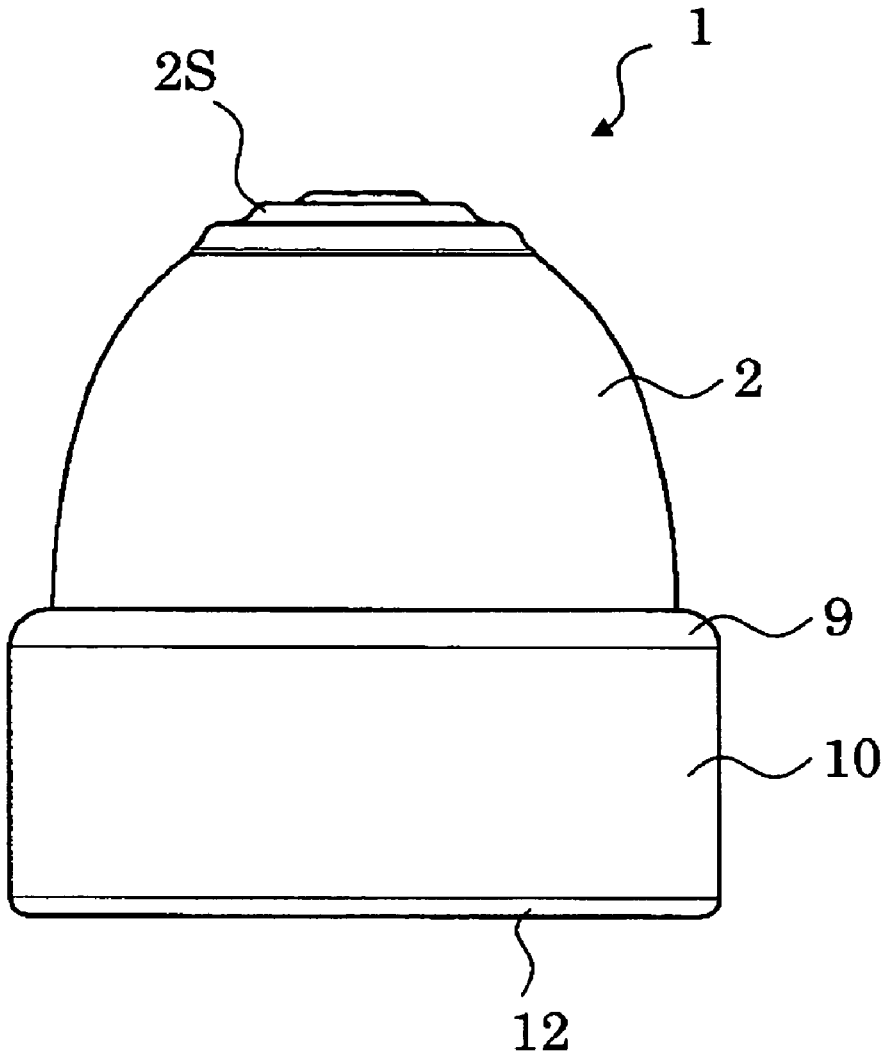
FIG. 95 is a top view showing the massage nozzle of the sample 2.
Figure 96:
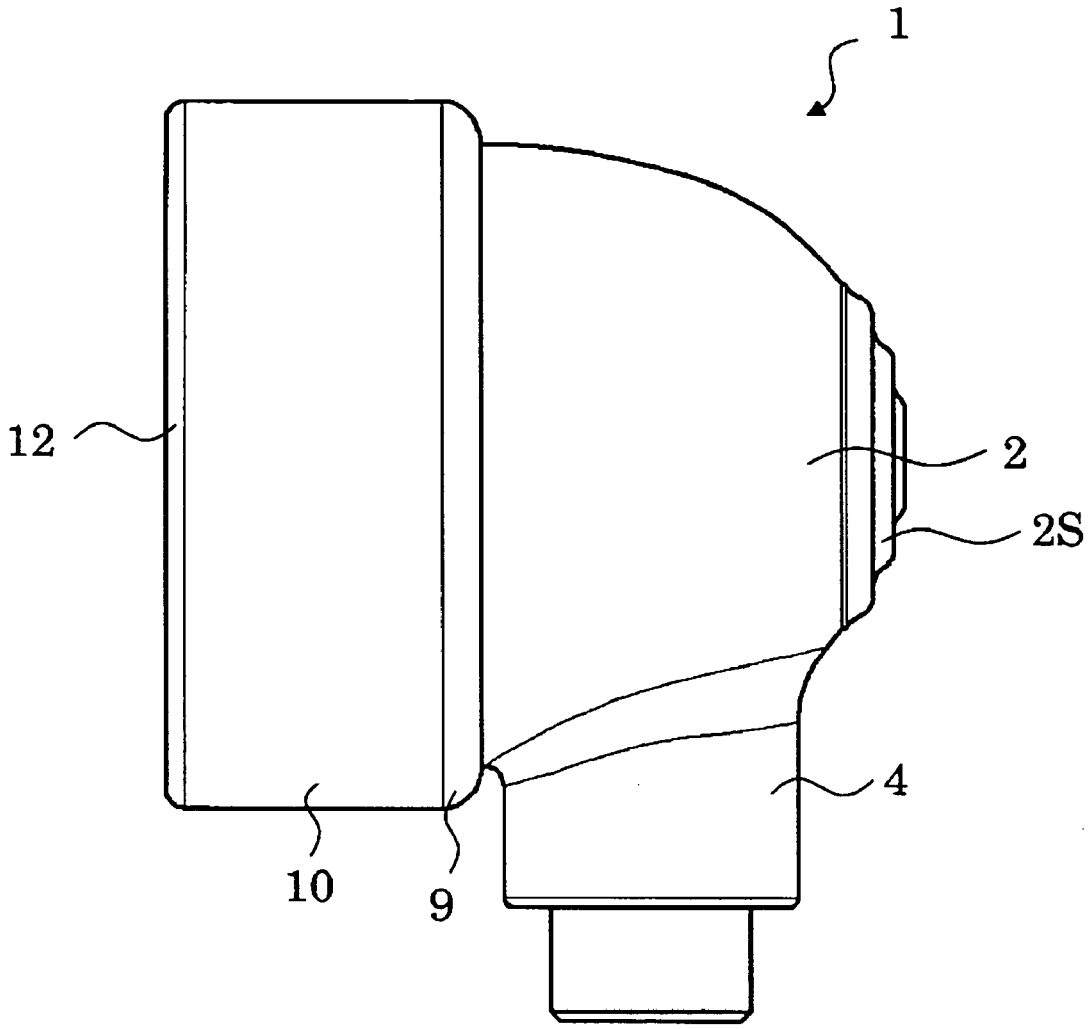
FIG. 96 is a side view showing the massage nozzle of the sample 2.
Figure 97:
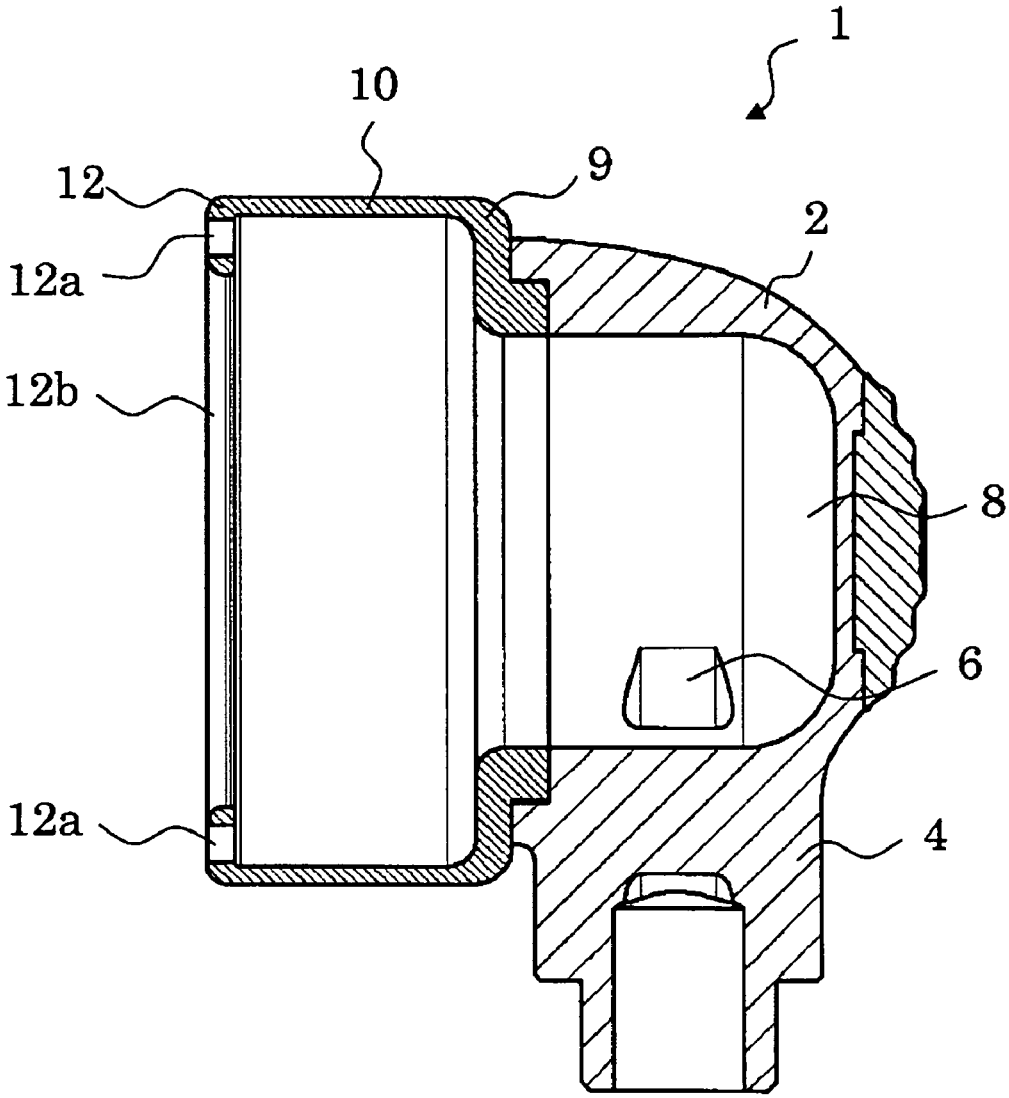
FIG. 97 is an A-A line sectional view of FIG. 94.

FIG. 93 is a perspective view showing the massage nozzle 1 of the sample 2, FIG. 94 is a front view, FIG. 95 is a top view, FIG. 96 is a side view and FIG. 97 is an A-A line sectional view of FIG. 94. In these drawings, as to the same elements as described above in FIGS. 1 to 87, detailed description by attaching the same numerals is omitted.

The massage nozzle 1 of the sample 1 shown in FIGS. 88 to 92 has the water-spray plate 12 and movable member 20, and the massage nozzle 1 of the sample 2 shown in FIGS. 93 to 97 has the water-spray plate 12 but does not have the movable member.

In these massage nozzles of the sample 1 and 2, the nozzle main body i.e., the vortex section 2 and the connection 4 are formed in an integrated condition with an opaque resin. In addition, the flange 9, guide section 10 and the water-spray plate 12 are formed in an integrated condition with a transparent resin, which are adhered to the main body (vortex section 2) with adhesive.

Meanwhile, the movable member 20 of the massage nozzle of the sample 1 is formed by a rubber. As the size of each component is shown in FIG. 92, the outside dimension of the stopper 20*c* of the movable member is 64 mm while the inside diameter of the opening 12*b* of the water-spray plate 12 is 58 mm. Using rubber for this movable member 20 makes it easy to be flexibly deformed and possible to insert into the guide section 10 and take out of the guide section 10 via the opening 12*b*.

In addition, as described below while referring to FIG. 101, the water intake section 6 is formed as the width (11.8 mm) in the parallel direction with the rotation axis than the width (3.8 mm) in the vertical direction to the rotation axis of the vortical flow CF viewing from the opposed position to the water-intake direction. Employing an oblong shape like this enables the vortical flow CF to be generated efficiently. In addition, since a rubber-made stopper 2S is adhered on the back side of the vortex section 2, it is formed as easy-to-hold for a user and suitable for their hands.

Meanwhile, 40 pieces of water-spray holes 12*a* having 4 mm of diameter are provided in the water-spray plate 12. The diameter of the circle (pitch circle diameter: P. C. D.) of the center of the water-spray holes 12*a* forms is 66 mm. As can be seen in FIG. 92, when the movable member 20 is located in the center of the opening 12*b* of the water-spray plate 12, the stopper 20*c* of the movable member overlaps the water-spray holes 12*a* by about 1 mm.

In the massage nozzle of the sample 1 as above configured, the spouting condition was checked, as a result, it was found that a favorable shower spouting was performed. That is, even if the stopper 20*c* of the movable member is slightly overlapped with the water-spray holes 12*a*, it was found that the water-spray holes 12*a* are not virtually blocked. Forming the stopper 20*c* of the movable member in a larger size enable the movable member 20 to be readily pushed forward due to the water flow of the vortical flow CF in a condition where the massage nozzle 1 is spouted in the atmosphere (in an opened spouting condition).

In addition, even in the condition where the central axis of the movable member 20 is misaligned with the rotation axis, it is unlikely that a "clearance" is produced between the stopper 20*c* and the opening 12*b* of the water-spray plate 12. That is, it ensures the effect of the "dam" due to the stopper 20*c*. As a result, the flow-adjustment effect by discharging from the water-spray holes 12*a* can be readily obtained.

In addition, since the movable member receives the force moving toward the front of the nozzle, the vibration stimulation can be provided to the site on the person's skin subject to treatment.

In addition, if the stopper 20*c* is formed in a larger size, it is easier that some part affects the vortical flow CF. That is, the motion of the movable member 20 changes the direction of the vortical flow CF and also enables the suction region to be changed dynamically. That is, with the motion of the movable member 20, the distribution of the negative region (suction region) is changed and accompanying the vibration effect and twisting effect promote the massage effect furthermore.

The suction pressure of these massage nozzles was measured by the inventor of the present invention.

Figure 98:
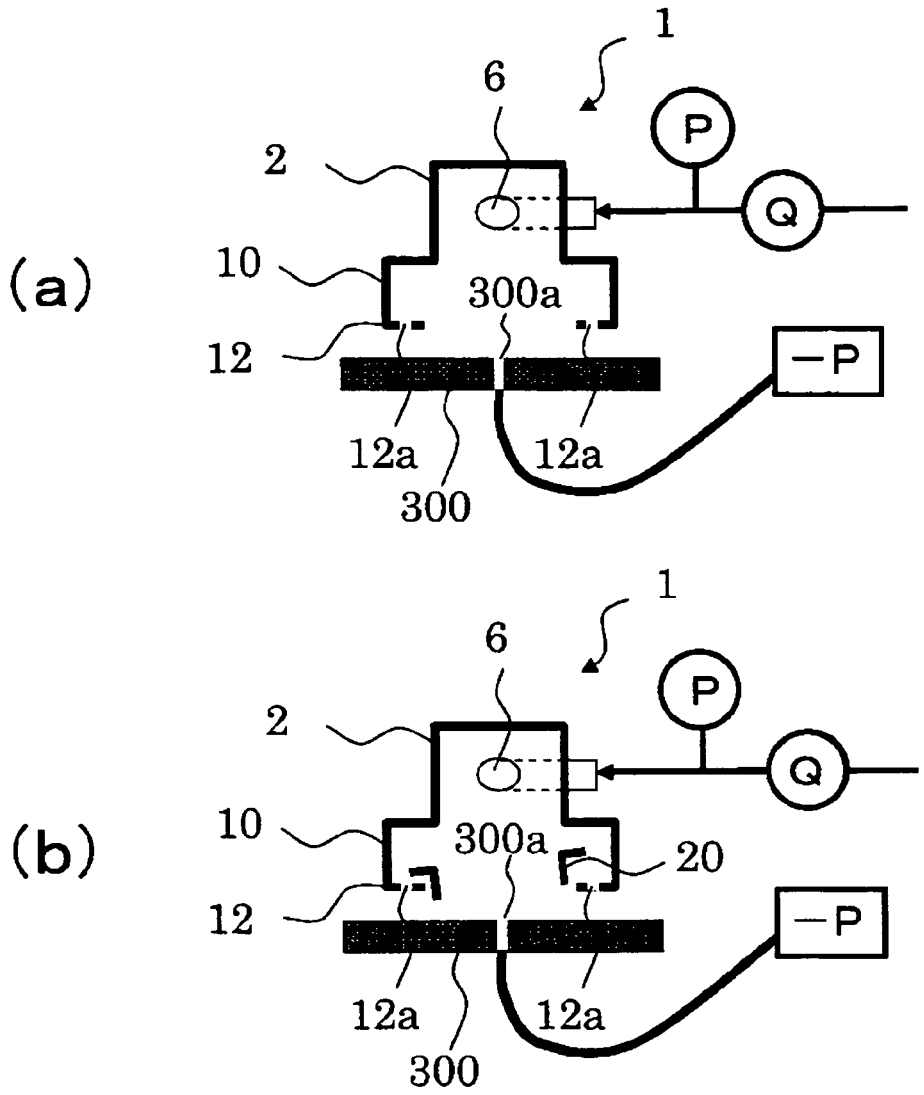
FIG. 98 is a schematic view showing a measurement method performed by the inventor of the present invention.

FIG. 98 is a schematic view showing a measurement method performed by the inventor of the present invention.

That is, a pressure-reception plate 300 having a small hole 300*a* was provided in the font of the massage nozzle 1 to measure the pressure—P at this small hole using a manometer. In addition, measurement was performed with the massage nozzle 1 immersed into the water and the interval between the front side of the water-spray plate 12 and the pressure-reception plate 300 was set to 7 mm in both the samples 1 and 2. In addition, 90 mm square material was used for the pressure-reception plate 300 and the small hole 300*a* was set to 2 mm as a diameter. In addition, in this measurement, the movable member 20 was rotated within the guide section 10 as shown in FIG. 98(*b*).

In addition, the small 300*a* is provided in the center of the pressure-reception plate 300 and is placed to comply with the central axis of the massage nozzle 1. Also in this measurement, the flow rate Q and pressure P supplied to the massage nozzle 1 were measured.

Figure 99:
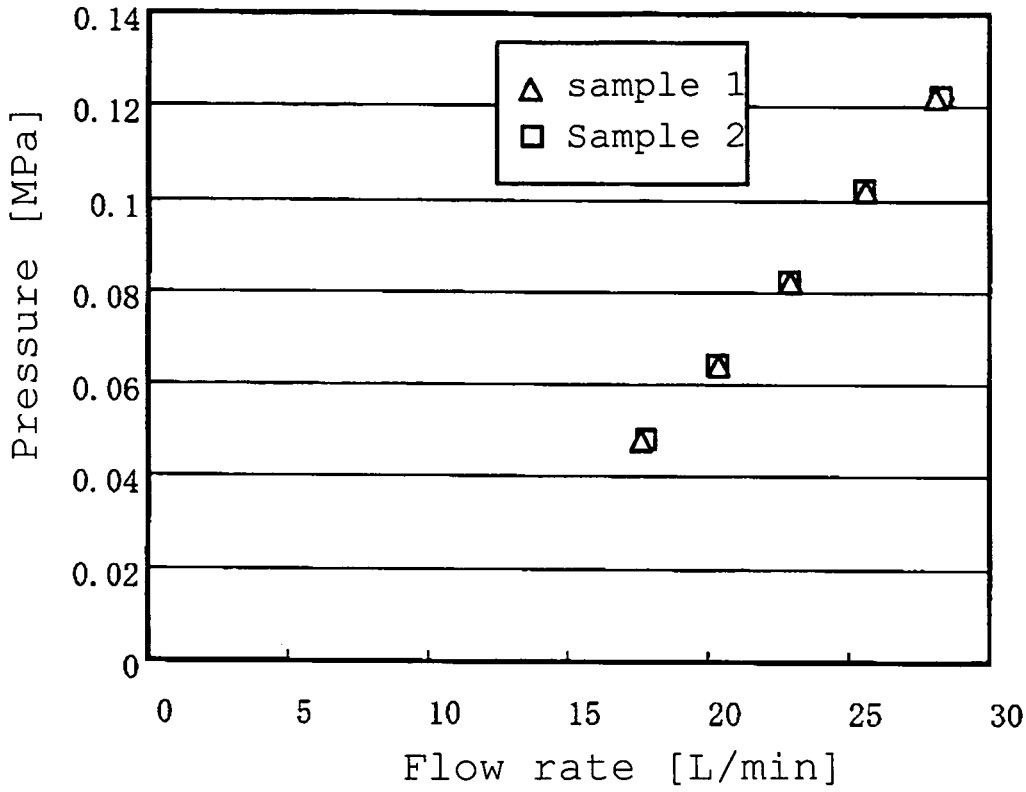
FIG. 99 is a graphical representation showing a pressure loss on each sample.

FIG. 99 is a P-Q graphical representation showing a relationship between the flow rate Q and the pressure P supplied to each sample. At this time, even after the water-spray plate 12 was removed to let the guide section 10 exposed and even after the guide 10 and the flange 9 were removed to let the spouting port 7 exposed, almost the same P-Q graphical representation was obtained.

That is, even if adding the flange 9, guide 10, water-spray plate 12, movable member 20 and the like, it was found that the pressure loss hardly increases. This shows that the pressure loss in the massage nozzle 1 is caused mainly by the forming of the vortical flow CF in the vortex chamber 8 and the decrease in efficiency by providing the water-spray plate 12 and the movable member 20 is greatly low.

Figure 100:
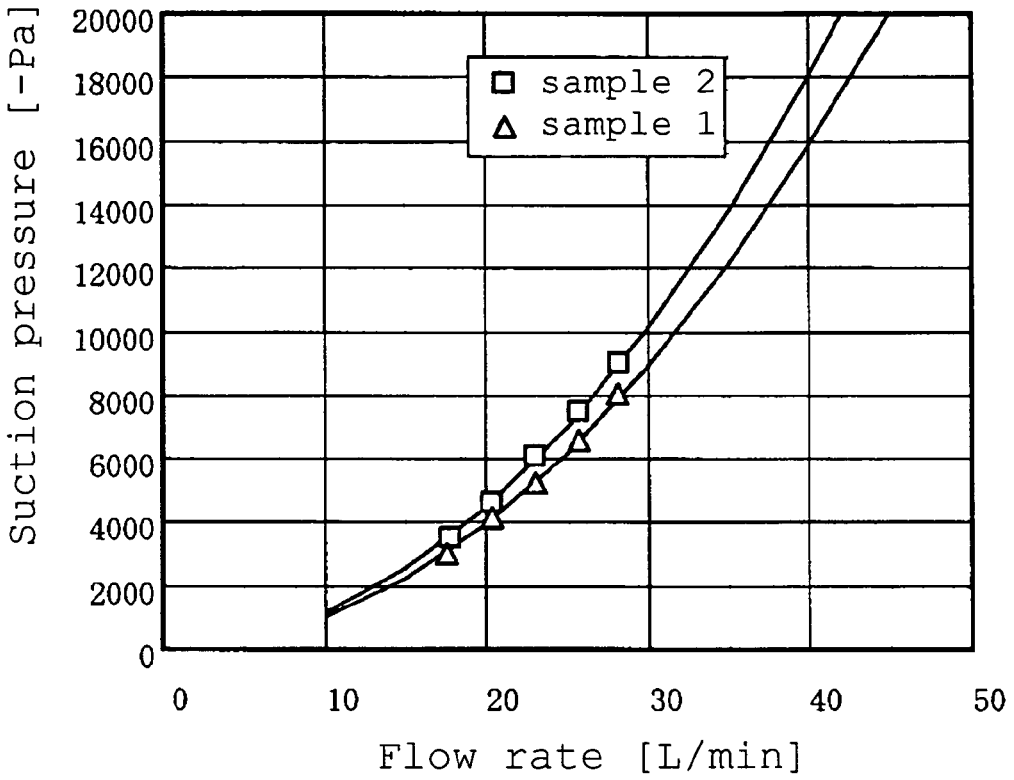
FIG. 100 is a graphical representation showing suction pressure measured at a small hole 300*a* of a pressure-reception plate 300.

FIG. 100 is a graphical representation showing a suction pressure measured at the small hole 300*a* of the pressure-reception plate 300. In this graphical representation, triangle and square plots show the actually-measured values of the sample and a curved line is presented based on the quadratic curve approximation.

In case of the massage nozzles 1 of the samples 1 and 2, with the flow rate in the range from 17 to 28 liters, the suction pressure from 3000 to 9000 Pascals was obtained to achieve a favorable suction feeling.

As a result of sensory evaluations conducted by a plurality of subjects at the same time, it was found that the movable member 20 tends to move but not provide stimulation sufficiently when the flow rate is less than 10 liters per minute, meanwhile, the movable member 20 tends to move vigorously and provide a strong stimulation due to shear stress of rotation when the flow rate is 43 liters or more per minute. From the synthetic judgment of sensory evaluations by many subjects, many opinions say that an excessive stimulation was obtained when the flow rate is set to 15 liters or more per minute. In addition, a water-supply pump having 50 to 200 watts or the like is used often in a normal household. From these standpoints, the upper limit of the flow rate is about 30 liters per minute.

The water-supply pump with high output power generates a somewhat noisy sound; therefore, it is not suitable for household use. However, it can be used for commercial use at aesthetic salon, medical use and the like, making it possible to provide a highly-effective massage effect and bioeffect, and strong feeling of stimulation due to larger amount of flow rate.

Fourth Embodiment

Next, as a fourth embodiment of the present invention, other characteristics to be added to the massage nozzle of the first to third embodiments are hereinafter described.

First, the shape of the water intake section 6 of the massage nozzle 1 of the embodiments 1 to 3 is described. That is, in order to obtain a strong suction force, it is important to efficiently generate a vortical flow CF along the circumferential wall 8W in the vortex chamber 8. For this purpose, the method to form the opening of the water intake section 6 in an oblong fashion is effective.

Figure 101:
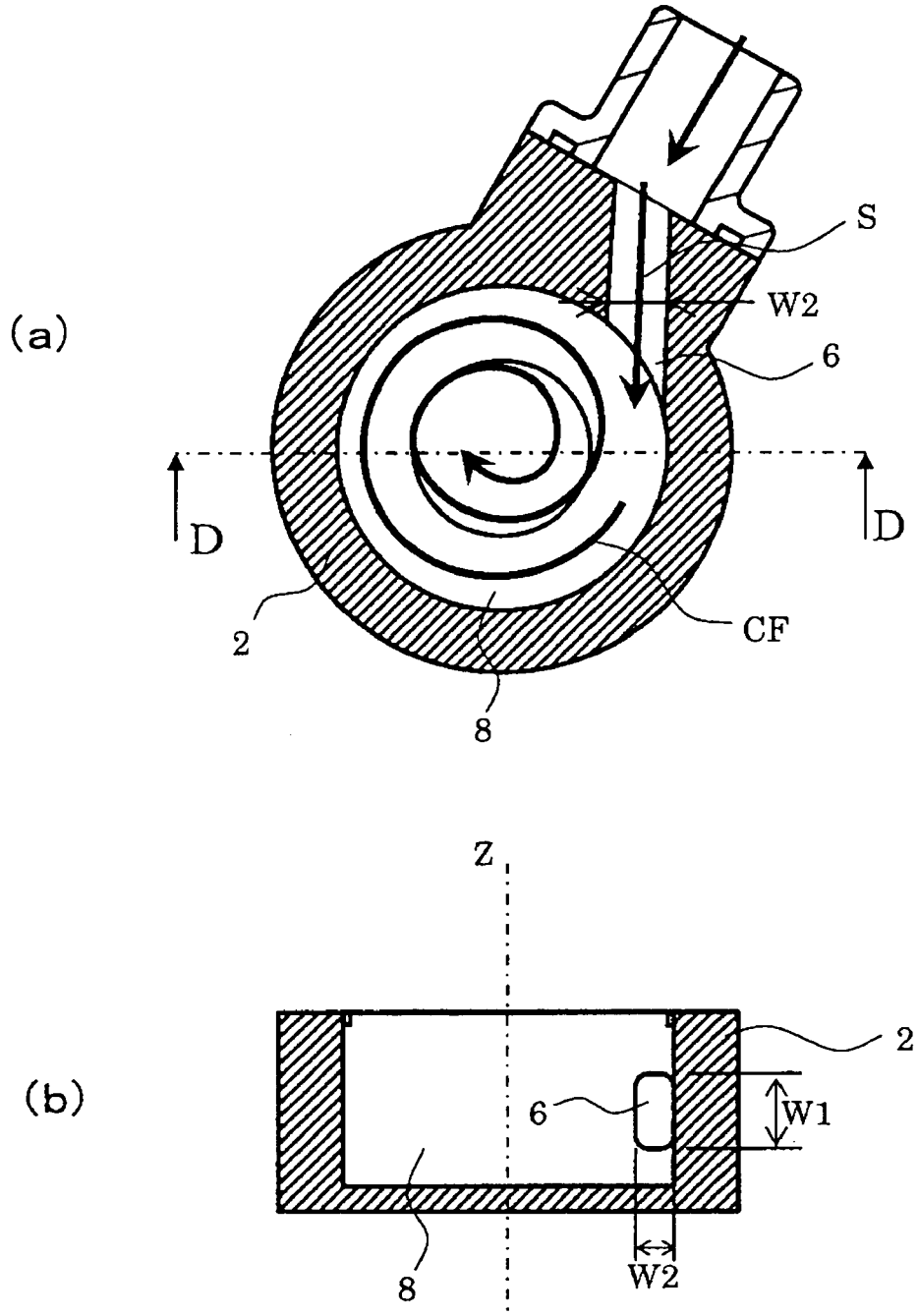
FIG. 101 is a schematic view showing the massage nozzle 1 in which an opening of the water intake section 6 is formed in an oblong fashion.

FIG. 101 is a schematic view showing the massage nozzle 1 formed by this method.

That is, FIG. 101(*a*) is the same sectional view as shown in FIG. 4 and FIG. 101(*b*) is a D-D line sectional view.

As shown in FIG. 101, this massage nozzle is formed as the width W1 in parallel with the rotation axis Z is larger than the width W2 in a vertical direction to the rotation axis Z of the vortical flow CF, when viewing from the opposed direction to the water-entry direction (arrow mark S) into the vortex chamber 8. In other words, this massage nozzle is formed as the width W1 of the water intake section 6 which is vertical against the water-entry direction (arrow mark S) to the vortex chamber 8 and is located along the direction in parallel with the rotation axis Z of the vortical flow is larger than the width W2 of the water intake section 6 which is vertical against the water-entry direction (arrow mark S) and is located along the direction vertical against the rotation axis Z of the vortical flow CF. Providing the water intake section 6 as described above enables the vortical flow to be efficiently developed in the vortex chamber 8. As a result, forming a uniform and strong vortical flow CF from the circumferential wall 8W through the inner-circumference wall 10W of the guide section and discharging from the water-spray holes 12*a* can prevent the spouting water from splashing and can obtain strong suction force. In addition, forming a uniform and strong vortical flow CF along the inner-circumference wall 10W to produce strong suction force and in addition, expanding the movement range of the movable member 20 to generate the "precession movement" and the similar movements can obtain a highly-effective massage due to the collisional stimulation and vibration-like stimulation. Furthermore, the vortical flow CF further closely along the circumferential wall is formed and the spouted water from the opening 12*b* of the water-spray plate and the opening of the movable member 20 is reduced to improve the water-adjustment effect.

However, it is unnecessary to maintain the above-described relationship between the width W1 and W2 entirely in the water intake section 6. Only in some part, the above-described relationship between the width W1 and W2 has to be achieved. For example, from the standpoints of effect extent to the vortical flow, it is preferable that the above-described relationship between the width W1 and W2 is achieved at the water intake opening 6B or in the vicinity of that and the water intake route 6A is smoothly connected to the water intake opening 6B from the introduction route 5 to reduce the pressure loss.

Next, the shape of the vortex chamber 8 of the massage nozzle 1 is hereinafter described. The vortex chamber 8 may have a single semi-cylindrical space opening straight toward the spouting port 7. That is, the massage nozzles 1 illustrated in FIG. 3 and FIG. 101 are almost the same in the inside diameter of the vortex chamber 8 and the opening diameter of the spouting port 7 and the "narrowing section" whose inside diameter becomes smaller in the vicinity of the spouting port 7 is not provided. As the embodiment of the vortex chamber 8, if a single semi-cylindrical type as above described is employed, pressure loss in water flow can be reduced and flow rate to be obtained to the water-supply pressure can be increased in comparison with the case where the "narrowing section" is provided in the vicinity of the spouting port 7. As a result, the flow rate of the vortical flow CF can be increased and a strong suction depressing effect can be obtained.

Furthermore, it is very easy to manufacture a single cylindrical vortex chamber as described above, enabling us to decrease the cost. In addition, if the suction massage nozzle 1 of the present example is molded using a resin injection mold technique, a "taper" is added to the shape of the vortex chamber 8 in some cases. That is, in order to mold a resin in a cast and thereafter smoothly pull out a cast protrusion section to form an inside space of the vortex chamber 8, it is preferable that the inside diameter of the vortex chamber 8 is not uniform and the inside diameter is expanded toward the spouting port 7. The present prevention also includes a taper-shaped vortex chamber 8 as described above.

Meanwhile, some part or whole of the vortex chamber 8 may be conical. For example, the "narrowing section" whose inside diameter becomes smaller gradually can be provided.

Figure 102:
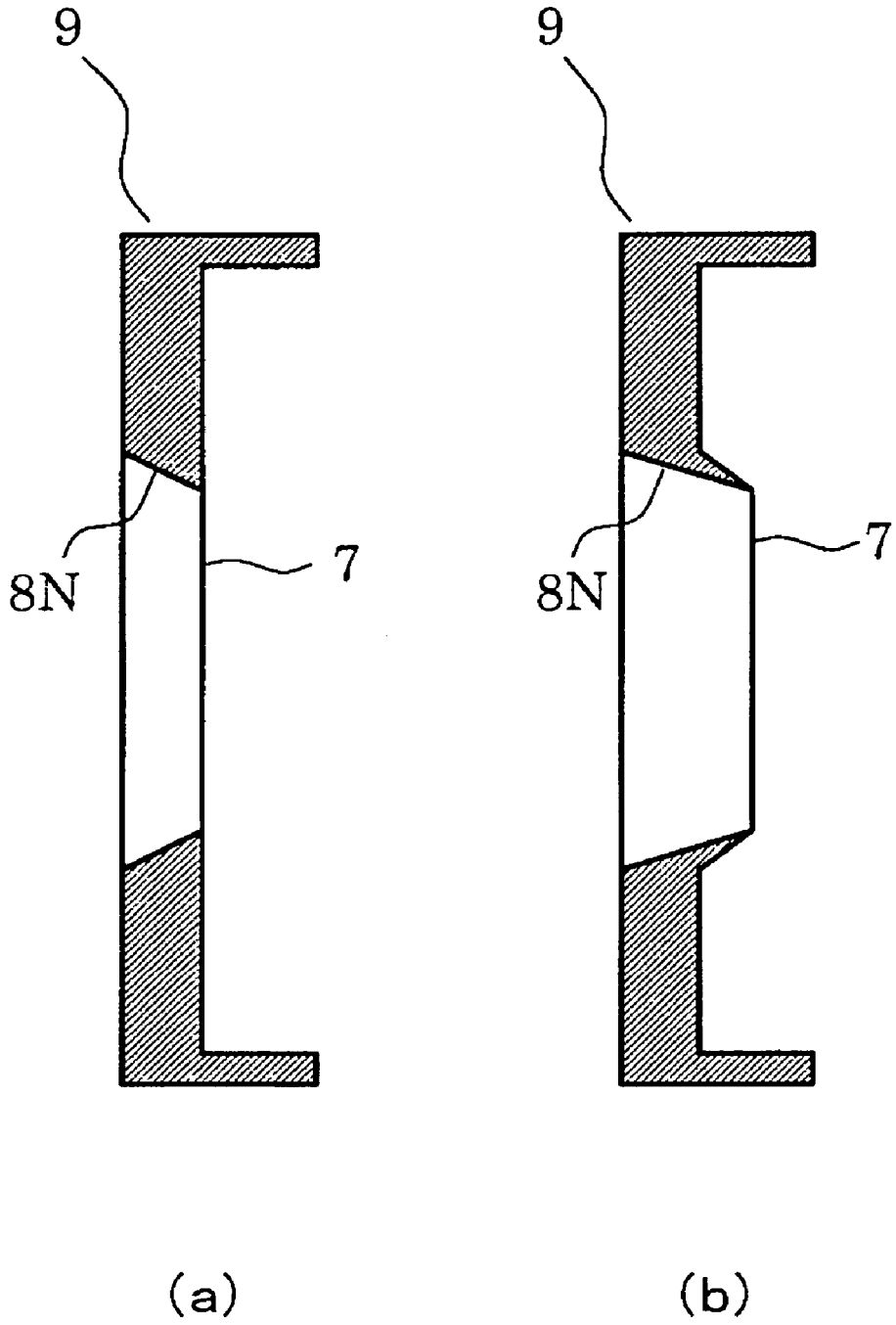
FIG. 102 is a schematic view showing a specific example in which a narrowing section is provided in a flange 9.

FIG. 102 is a schematic view showing a specific example in which a "narrowing section" is provided in a flange 9.

In case of the specific example shown in FIG. 102(*a*), the narrowing section 8N whose inside diameter becomes smaller gradually toward the spouting port is provided with the flange 9.

Meanwhile, in case of the specific example shown in FIG. 102(*b*), the narrowing section 8N is formed in a longer manner than the thickness of the flange 9.

Next, a variation of the water intake section 6 of the massage nozzle 1 is hereinafter described.

Figure 103:
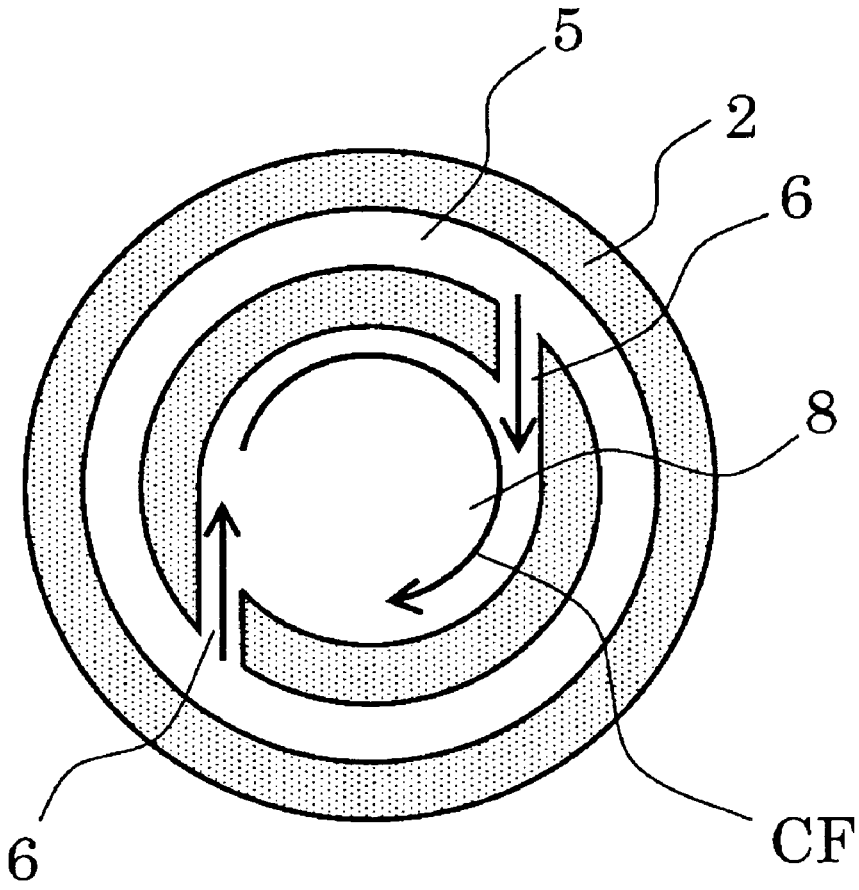
FIG. 103 is a schematic sectional view showing a variation of the water intake section 6 of the massage nozzle of the present invention.

FIG. 103 is a schematic sectional view showing a variation of the water intake section 6 of the massage nozzle. That is, the same drawing is a section view showing the water intake section 6 of the massage nozzle. According to the massage nozzle of the present example, a pair of the water intake sections 6 is provided. Each of these water intake sections 6 introduces water from the introduction route 5 formed circularly outside the vortex chamber 8 into the semi-tangential direction of the circumferential wall 8W. Even if the total water-intake area is the same, providing a plurality of water intake sections 6 as described above enables the central position of the opening of the water intake section 6 to be placed as being located eccentrically away from the rotation axis Z of the vortical flow CF. Thus, the vortical flow CF can be efficiently formed. In addition, placing a plurality of water intake sections 6 uniformly on the circumferential wall 8W enables the rotation axis of the vortical flow CF to be aligned with the central axis. Therefore, the vortical flow CF further located eccentrically to the circumferential wall is formed and the water to be spouted from the opening of the movable member 20 of the 12*b* of the water-spray plate 12 is reduced, in addition, the distribution of the vortical flow CF becomes more uniform and the water to be spouted from the water-spray holes 12*a* becomes more uniform to increase the flow-adjustment effect. In addition, the vortical flow CF further along the circumferential wall to let the distribution of the vortical flow CF more uniform enables the precession movement and the similar movements of the movable member 20 more smoothly.

The massage nozzle is described above while referring to the FIG. 1 to FIG. 103. Either of these massage nozzles may be formed at least partially using a transparent material.

That is, at least either of the guide section 10, vortex section 2, flange 9, water-spray plate 12 and movable member 20 may be formed using a transparent material. In addition, the entire of either element is not formed using a transparent material but only some part may be formed using a transparent material.

For example, forming some part of the guide section 10 using a transparent material enable a user to readily check the site on the person's skin subject to treatment 210 visually.

Figure 104:
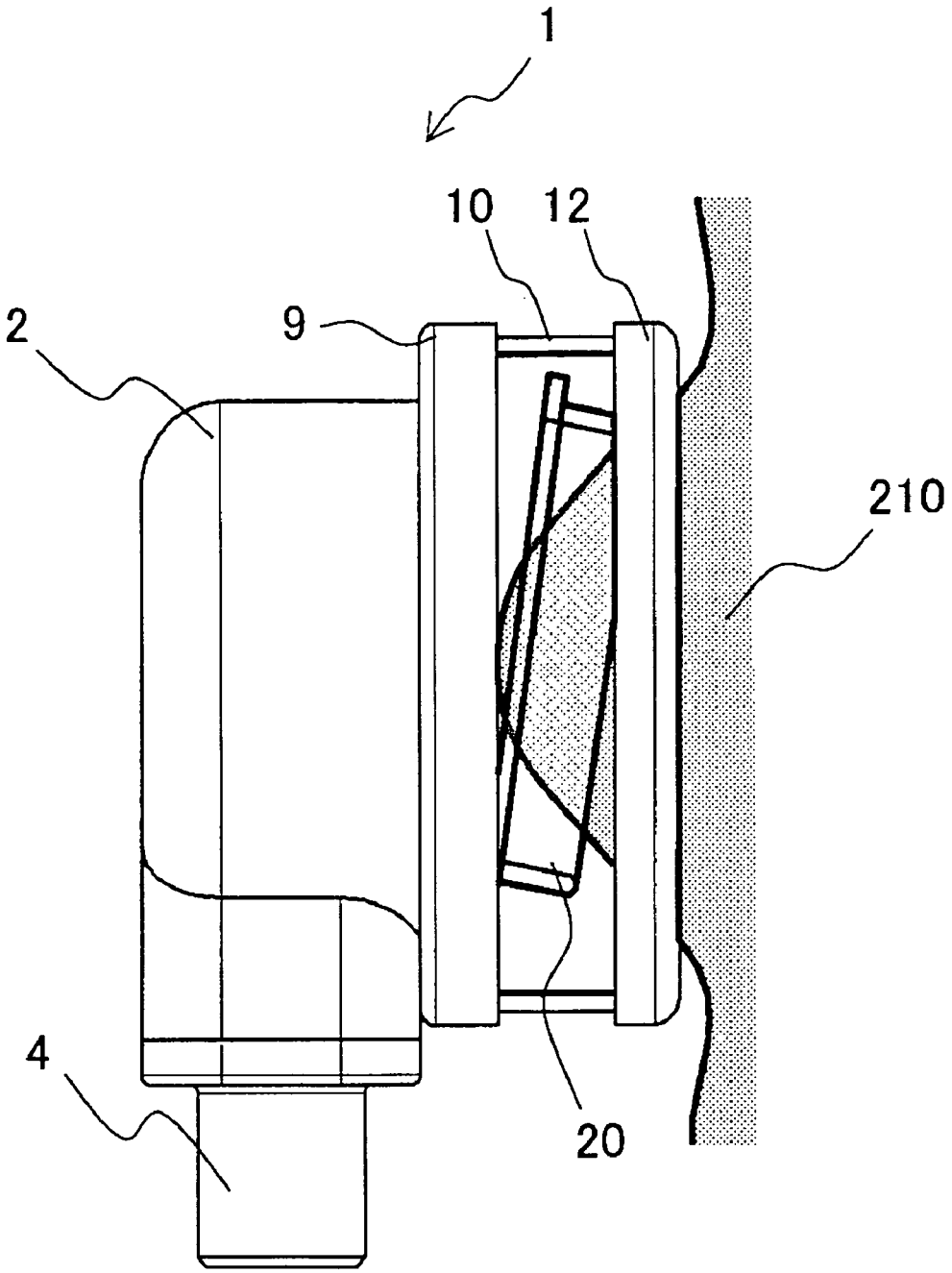
FIG. 104 is a schematic view showing the massage nozzle in which the guide section 10 and the movable member 20 to be provided in the guide section 10 are made of transparent materials.

FIG. 104 is a schematic view showing the massage nozzle in which the guide section 10 and the movable member 20 to be provided in the guide section 10 are made of transparent materials. According to the present specific example, the end of the site on the person's skin subject to treatment 210 to be sucked into the guide section 10 and the movable member 20 can be visually observed from the outside.

According to the prototype study by the inventor of the present invention, if the guide section 10 is made of a transparent material, many subjects were surprised to visually confirm that a greatly larger displacement was obtained than the feeling by receiving from the skin. That is, when the suction massage is performed using the massage nozzle, the actual displacement to be observed visually is greatly larger than the feeling to be received from the skin in many cases. In addition, checking this displacement visually can obtain an expectation feeling, reliability feeling and security feeling to this effect to enable a massage effect and other various bio-effects to increase.

In addition, motion of the movable member 20 can be visually checked to also check the movement conditions, obtain the expectation feeling, reliability feeling and security feeling and promote the massage effect and other various bioeffects.

Also in this case, since the deformation conditions of the site on the person's skin subject to treatment has only to be visually checked, it is unnecessary to form the guide section 10 entirely using a transparent material. In addition, it is unnecessary to use a transparent and colorless material as a component material but may be even transparent and colored or semi-transparent if possible to identify the inside visually. Meanwhile, using transparent materials for the flange 9 and the water-spray plate 12 as well as the guide section 10 increases the checking ability as described above.

In addition, only some part of the vortex section 2 (for example, side or bottom) has only to be formed using a transparent material. This makes it possible to visually check the skin conditions to be sucked into the vortex chamber from the spouting port. In addition, it is possible to visually check the skin deformed conditions at a slant or from the front as well as a transverse direction, increasing the above-described checking effect.

Fifth Embodiment

Next, as a fifth embodiment of the present invention, the massage device using the massage nozzles of the 1st to 4th embodiments are hereinafter described.

That is, combing the massage nozzles as described above in FIGS. 1 to 104 with the water-supply means can provide a massage device to enable suction massage.

Figure 105:
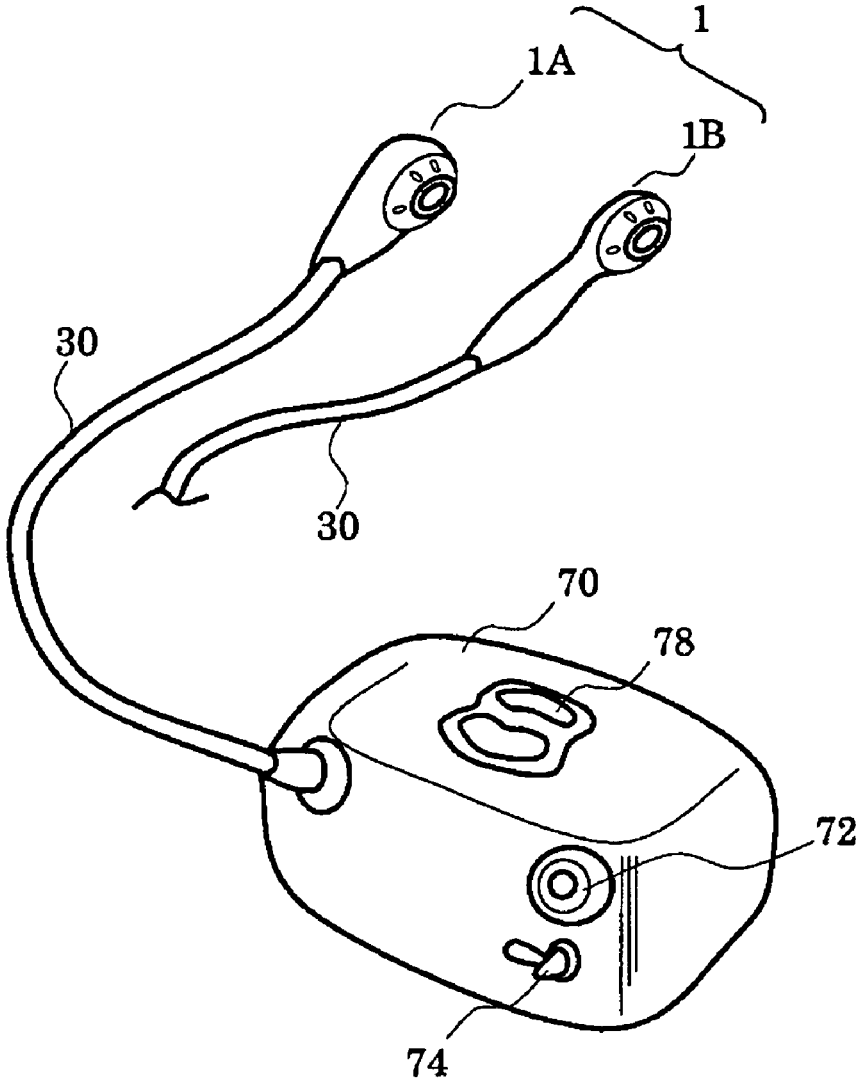
FIG. 105 is a schematic view showing a first example of the massage device of the present invention viewing from the front side at an angle.
Figure 106:
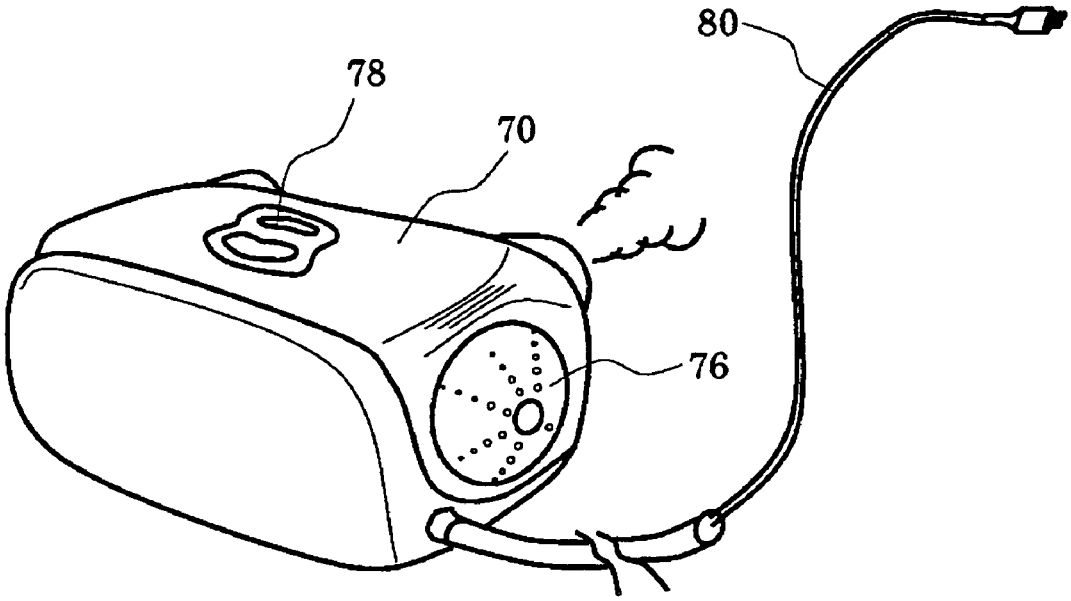
FIG. 106 is a schematic showing the first example of the massage device of the present invention viewing from the rear side at an angle.

FIG. 105 and FIG. 106 are schematic views showing the first example of the massage device viewing from the front side and rear side.

Figure 107:
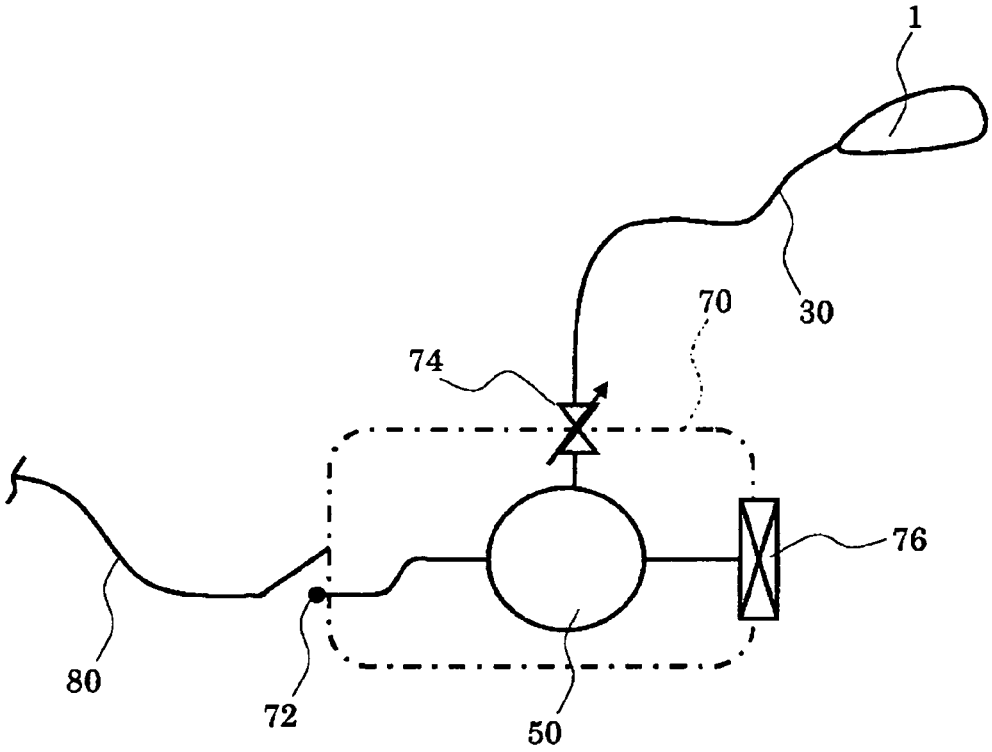
FIG. 107 is a block diagram showing a component configuration of the massage device of a first example.

In addition, FIG. 107 is a block diagram showing a component configuration of the massage device of the present example.

That is, as an appearance, the massage device has a housing 70, a flexible hose 30 leading from the front and a massage nozzle 1 provided at the end. The housing 70 is provided with a power switch 72, a flow rate adjustment valve 74, a water-intake port 76, a pick-up hole 78 and a power cord 80 appropriately. A water-supply means 50 is included in the housing 70. The water-supply means 50, for example, incorporates a water-resistant power-operated water-supply pump and feeds water (hot water) spouted from the water-intake port 76 to the massage nozzle 1 via the flexible hose 30. The water-supply pump may be supplied from AC or DC power outside the housing 70 or may be supplied from a rechargeable battery incorporated in the housing 70. In either case, a predetermined water-resistant treatment has been appropriately taken.

Meanwhile, the massage nozzle 1 has the appearance similar to a showerhead as illustrated in FIG. 105. The massage nozzle 1A illustrated in the same drawing has a shape suitable for using when "grabbing" the section around the end. In addition, the massage nozzle 1B has a shape suitable for using when holding the root section as using a general showerhead.

In these massage nozzles 1 (1A, 1B), as described above in the first embodiment, providing the water-spray plate 12 enables the water flow bundled in a shower-like manner to be spouted from the water-spray holes 12*a* in an opened status and prevents the spouted water from splashing. In addition, as described above in the second example, providing the movable member 20 can obtain a highly-effective massage due to collisional stimulation and vibration-like stimulation.

Figure 108:
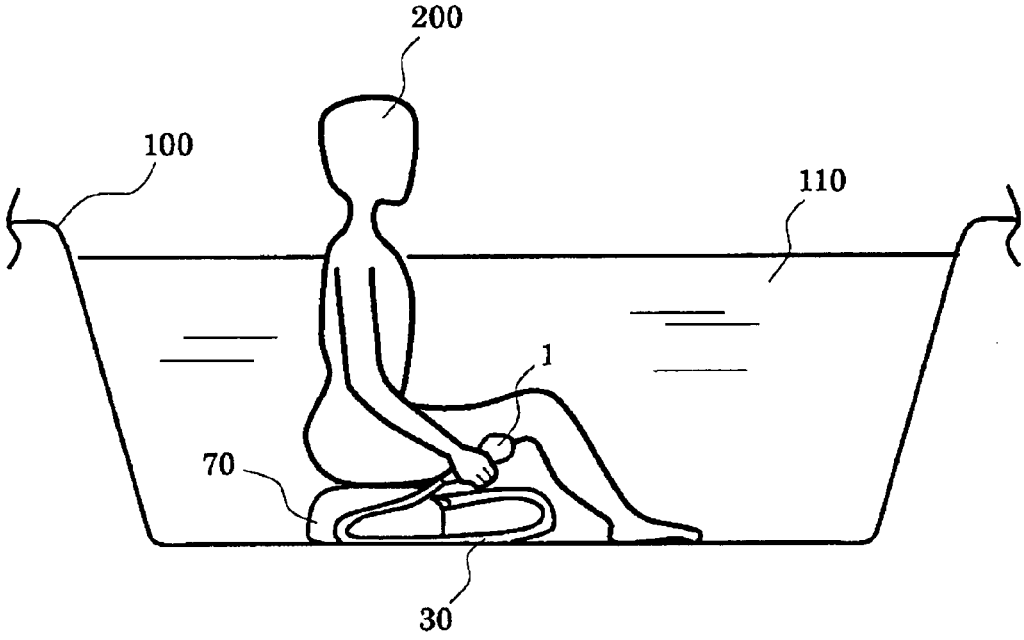
FIG. 108 is a schematic view showing use conditions of the massage device of the first example.

FIG. 108 is a schematic view showing use conditions of the massage device of the present example. That is, a user 200 can install the massage device in the bathtub 100 filled with hot water 110 and operate the massage nozzle 1 while sitting on the housing 70. At this time, as described above in the first example, providing the water-spray plate 12 enables the front face to the water-spray plate 12 or the end of the movable member 20 to be covered with the water film formed by the water flow A1 and B1. As a result, the site on the person's skin subject to treatment 210 of a human body is always protected by a uniform water film. In addition, as described above in the second example while referring to FIG. 31, the water film formed by the water flow A1 covers the spouting port 7, the end of the movable member 20 or the guide section 10, which always protects the surface of the site on the person's skin subject to treatment 210 of a human body. For this reason, a human body does not receive an excessive friction resistance from the massage nozzle 1 or uncomfortable stimulation, feels user-friendly. Using the device with the device immersed in water (hot water) of the bath tub prevents an air hole (void) to deteriorate a suction force from forming in the vortex chamber 8 and enable the user to use it more effectively. In addition, since the hot water 110 in the bathtub 100 is circulated, a high water-saving effect can be obtained.

According to the massage device of the present example, as described above in the first embodiment, providing the water-spray plate 12 enables spouted water bundled in a shower-like manner in an opened status to be formed. Accordingly, during suction massage in the hot water 110 as shown in FIG. 108, even if letting the massage nozzle 1 expose to the atmosphere carelessly, spouted water does not splash in all directions, but enabling an effective suction massage by eliminating uncomfortable feeling. In addition, the massage nozzle 1 can be used as a general showerhead, enabling the user to use it very conveniently.

In addition, according to the massage device of the present example, as described above in the second embodiment, providing the movable member 20 causes the movable member 20 to perform the "precession movement" and the similar movements in an eccentric manner, providing a shaking-like vibration to the site on the person's skin subject to treatment in addition to the suction effect. As a result, a further effective massage can be provided to enhance various bioeffects such as beautification, improved blood circulation and the like.

In addition, according to the present example, since the massage nozzle 1 is connected to the housing 70 via the flexible hose 30, the massage nozzle 1 can be applied to a site on the person's skin subject to treatment 210 of any part of a user's human body flexibly or arbitrarily.

In addition, according to the present example, the user 200 can operate the massage nozzle 1 while sitting on the compact-sized housing 70. As a result, the user 200 can always perform suction massage in a relaxed manner. In addition, an upper body, for example, if the underarm to the upper arm undergoes suction massage, the user can perform with the massage nozzle 1 immersed into the hot water 110 of the bath tub. In addition, even for the hip or the back side of the upper thigh which doe not undergo treatment easily, sitting on the housing causes a human body to be floated away from the bottom of the bath tub and provides a treatment space, enabling a lower body, for example, a hip or back side of the upper thigh to undergo suction massage uniformly. Accordingly, kneading "cellulite (metabolic decomposition product and fat mass) can promote the metabolic decomposition product to be exhausted and improve the cellulite into a normal fat. As a result, "tightening effect" of human body can be obtained.

Figure 109:
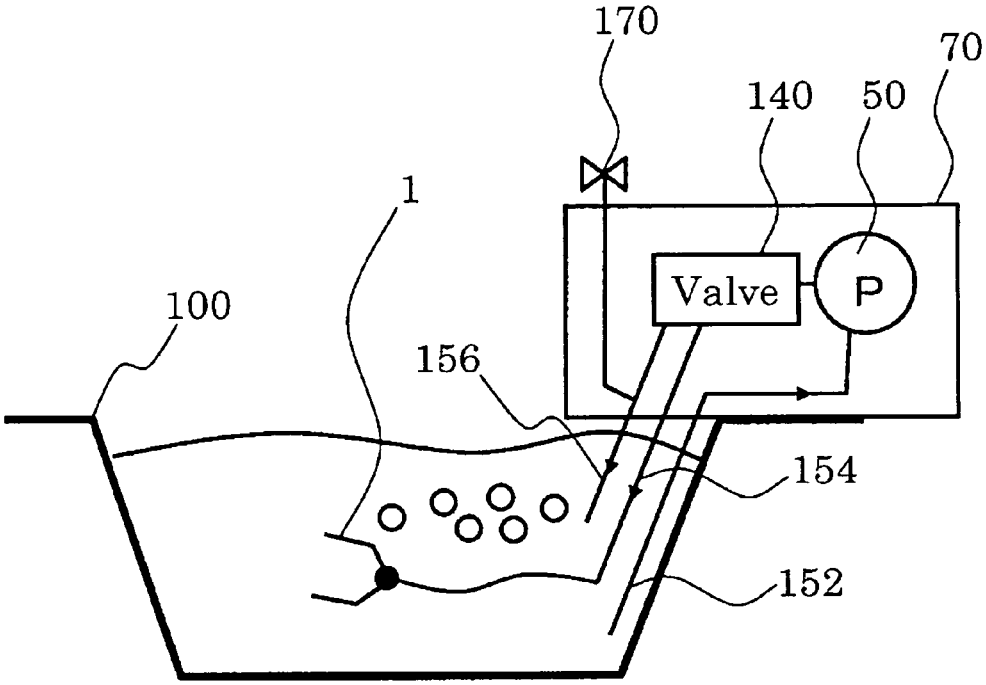
FIG. 109 is a schematic view showing a second example of the massage device of present invention.

FIG. 109 is a schematic view showing the second example of the massage device. In the drawing, as to the same elements as described above in FIGS. 1 and 108, detailed description by attaching the same numerals is omitted. Since the massage device of the present example is stored in the housing 70, it can be used with it installed in the rim of the bathtub 100, that is, an apron and the like. That is, the water-supply means 50 such as a pump is incorporated inside of the housing 70 to pump up the water (hot water) inside the bath tub via the water-intake piping 152 and feed the water (hot water) to the change-over valve 140. The change-over valve 140 is designed to change over the water-supply route of either nozzle piping 154 or blow flow exhaust piping 156. The water supplied to the nozzle piping 154 is fed to the massage nozzle 1, enabling the suction massage. Meanwhile, if the water is supplied to the blow flow exhaust piping 156, air is mixed via the air-intake opening/closing cock 170, enabling a blow bath.

Employing the configuration as described above enable the user to perform the blow bath and suction massage at the same time within the capacity range of the water-supply means 50 to increase the conformability. In addition, changing over the water supply to the blow flow exhaust piping 156 and the massage nozzle 1 can switch the blow bath and suction massage arbitrarily by the user's desire.

In addition, as described above in the first embodiment, providing the water-spray plate 12 enables spouted water bundled in a shower-like manner in an opened status to be formed. Accordingly, during suction massage in the hot water (water) with which the bathtub 100 was filled, even if letting the massage nozzle 1 expose to the atmosphere carelessly, spouted water does not splash in all directions, but enabling an effective suction massage by eliminating uncomfortable feeling. In addition, the massage nozzle 1 can be used as a general showerhead, enabling the user to use it very conveniently.

In addition, as described above in the second embodiment, providing the movable member 20 causes the movable member 20 to perform the "precession movement" and the similar movements in an eccentric manner, providing a shaking-like vibration to the site on the person's skin subject to treatment in addition to the suction effect. As a result, a further effective massage can be provided to enhance various bioeffects such as beautification, blood circulation and the like.

Figure 110:
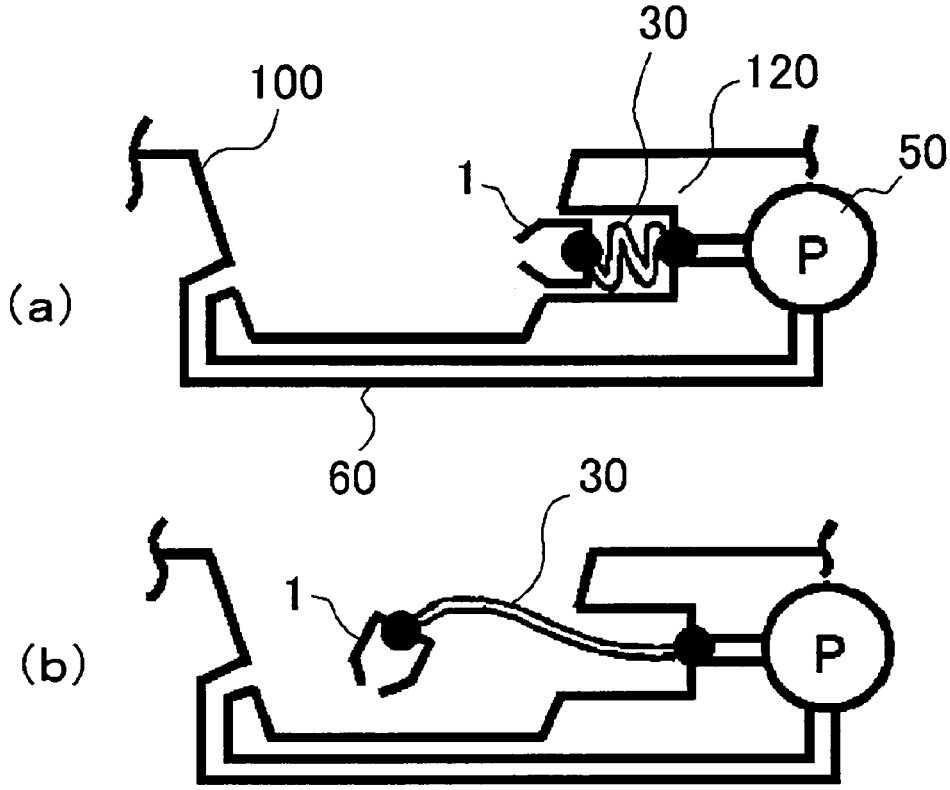
FIG. 110 is a schematic view showing a third example of the massage device of present invention.

FIG. 110 is a schematic view showing the third example of the massage device. That is, the same drawing shows the massage device in combination with the bathtub 100.

According to the present example, the inside of the bathtub 100 is provided with the nozzle storage section 120 and the massage nozzles 1, which were described above in FIGS. 1 to 104, are designed to be stored in this nozzle storage section 120. In addition, the water-supply means 50 pumps up the water (hot water) in the bathtub 100 via the water piping 60 and supplies the water (hot water) to the massage nozzle 1 via the flexible hose 30.

According to the present example, as shown in FIG. 110 (*a*), a user can undergo suction and depressing massage with letting the massage nozzle 1 applied to the site on the person's skin subject to treatment while taking bath in the bathtub 100. At this time, the massage nozzle 1 may be immersed into the hot water (water) or may be exposed to the atmosphere. However, immersing the massage nozzle 1 into the hot water (water) will prevent air from entering the vortex chamber 8, thus can undergo stronger suction massage.

Meanwhile, as shown in FIG. 110(*b*), the massage device can be used with the massage nozzle 1 removed from the nozzle storage section 120. According to the present example, since the massage nozzle 1 is connected via the flexible hose 30, a user can move the massage nozzle 1 freely and use with it applied to the site on the person's skin subject to treatment.

In addition, also according to this example, the hot water (water) in the bathtub 100 is supplied to the massage nozzle 1 via the water-supply means 50. That is, since the hot water in the bathtub 100 is circulated, a high water-saving effect can be obtained.

According to the massage nozzle 1, as described above in the first embodiment, providing the water-spray plate 12 enables spouted water bundled in a shower-like manner in an opened status to be formed. Accordingly, during suction massage in the hot water of the bathtub 100, even if letting the massage nozzle 1 expose to the atmosphere carelessly, spouted water does not splash in all directions, but enabling an effective suction massage by eliminating uncomfortable feeling. In addition, the massage nozzle 1 can be used as a general showerhead, enabling the user to use it very conveniently.

In addition, as described above in the second embodiment, providing the movable member 20 causes the movable member 20 to perform the "precession movement" and the similar movements in an eccentric manner, providing a shaking-like vibration to the site on the person's skin subject to treatment in addition to the suction effect. As a result, a further effective massage can be provided to enhance various bioeffects such as beautification, blood circulation and the like.

Figure 111:
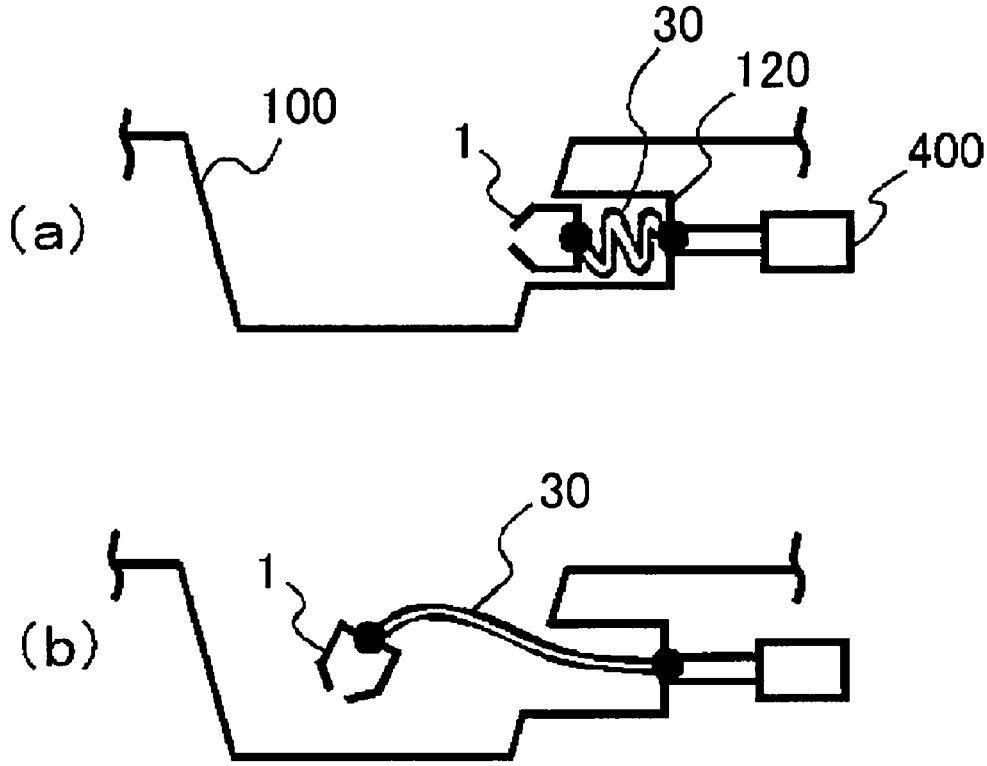
FIG. 111 is a schematic view showing a fourth example of the massage device of present invention.

FIG. 111 is a schematic view showing a fourth example of the massage device. In this drawing, as to the same elements as described above in FIGS. 1 to 110, detailed description by attaching the same numerals is omitted.

According to the present example, a hot water (or water) supply section 400 is provided instead of the water-supply means to circulate the hot water in the bathtub 100. The supply section 400 can serve as a water heater. Or a water tap may substitute the supply section 400.

According to the present example, providing the supply section 400 enable the user to undergo suction and depressing massage using the massage nozzle 1 even if there is no water in the bathtub 100. Movable members to say, also in a condition where the bathtub 100 is filled with hot water, suction and depressing massage can be performed at the same time.

In addition, as shown in FIG. 111(*b*), extending the flexible hose 30 enables the massage nozzle 1 to be removed and used toward the predetermined site on the person's skin subject to treatment. Also according to the present example, it is unnecessary to provide the water-supply means 50 and water piping 60 for circulation as described in FIG. 110, enabling the configuration of the massage device to be simplified and to be provided at lower cost.

According to the massage nozzle 1, as described above in the first embodiment, providing the water-spray plate 12 enables spouted water bundled in a shower-like manner in an opened status to be formed. Accordingly, during suction massage in the hot water of the bathtub 100, even if letting the massage nozzle 1 expose to the atmosphere carelessly, spouted water does not splash in all directions, but enabling an effective suction massage by eliminating uncomfortable feeling. In addition, the massage nozzle 1 can be used as a general showerhead, enabling the user to use it very conveniently.

In addition, as described above in the second embodiment, providing the movable member 20 causes the movable member 20 to perform the "precession movement" and the similar movements in an eccentric manner, providing a shaking-like vibration to the site on the person's skin subject to treatment in addition to the suction effect. As a result, a further effective massage can be provided to enhance various bioeffects such as beautification, blood circulation and the like.

Figure 112:
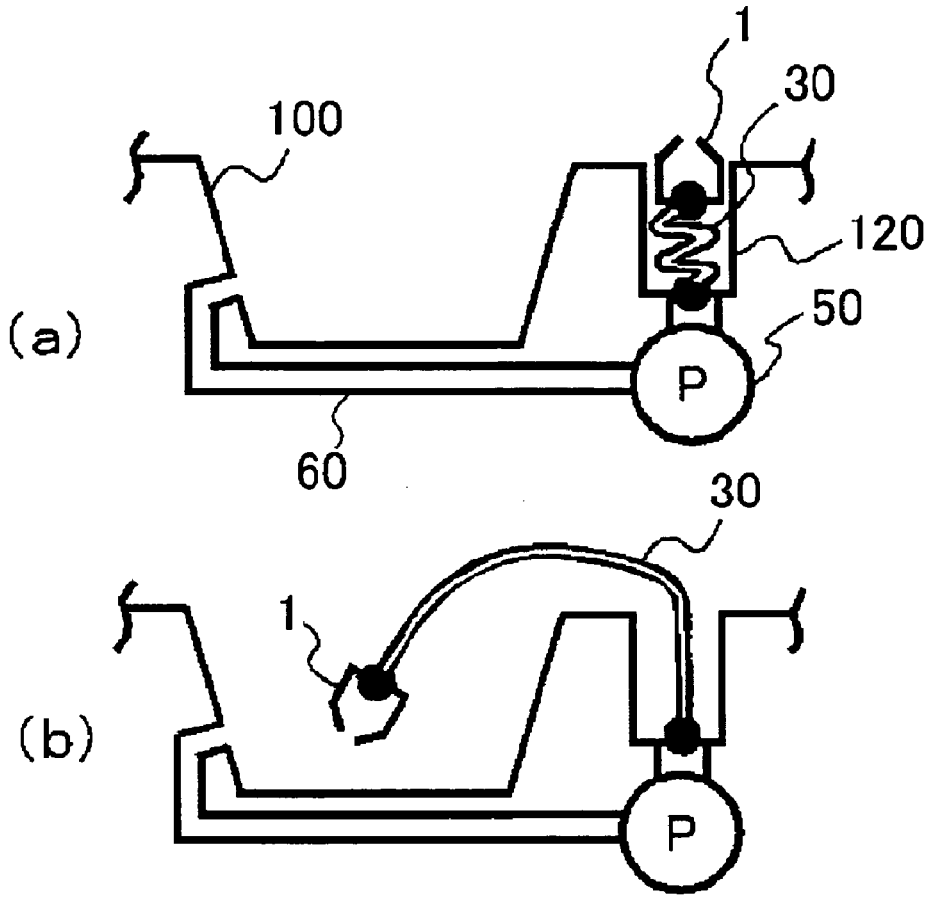
FIG. 112 is a schematic view showing a fifth example of the massage device of present invention.

FIG. 112 is a schematic view showing a fifth example of the massage device. In this drawing, as to the same elements as described above in FIGS. 1 to 111, detailed description by attaching the same numerals is omitted.

According to the present example, the nozzle storage section 120 is provided in the rim of the bathtub 100, so-called "apron" section. During suction and depressing massage, the massage nozzle 1 can be easily removed and easily applied to each site of a user. Providing the nozzle storage section 120 in the apron of the bathtub 100 enables the user to remove the massage nozzle 1 much more easily. In addition, it is unlikely that the massage nozzle 1 becomes an obstacle while taking bath in the bathtub 100.

In addition, connecting the nozzle storage section 120 to the massage nozzle 1 enables the user to treat the massage nozzle 1 freely.

Also according to the present example, since the hot water in the bathtub 100 is circulated, a high water-saving effect can be obtained. In addition, as described above in the first embodiment, providing the water-spray plate 12 enables spouted water bundled in a shower-like manner in an opened status to be formed. Accordingly, during suction massage in the hot water with which the bathtub 100 was filled, even if letting the massage nozzle 1 expose to the atmosphere carelessly, spouted water does not splash in all directions, but enabling an effective suction massage by eliminating uncomfortable feeling. In addition, the massage nozzle 1 can be used as a general showerhead, enabling the user to use it very conveniently.

In addition, according to the massage nozzle, as described above in the first embodiment, providing the water-spray plate 12 enables spouted water bundled in a shower-like manner in an opened status to be formed. Accordingly, during suction massage in the hot water with which the bathtub 100 was filled, even if letting the massage nozzle 1 expose to the atmosphere carelessly, spouted water does not splash in all directions, but enabling an effective suction massage by eliminating uncomfortable feeling. In addition, the massage nozzle 1 can be used as a general showerhead, enabling the user to use it very conveniently.

In addition, as described above in the second embodiment, providing the movable member 20 causes the movable member 20 to perform the "precession movement" and the similar movements in an eccentric manner, providing a shaking-like vibration to the site on the person's skin subject to treatment in addition to the suction effect. As a result, a further effective massage can be provided to enhance various bioeffects such as beautification, blood circulation and the like.

Figure 113:
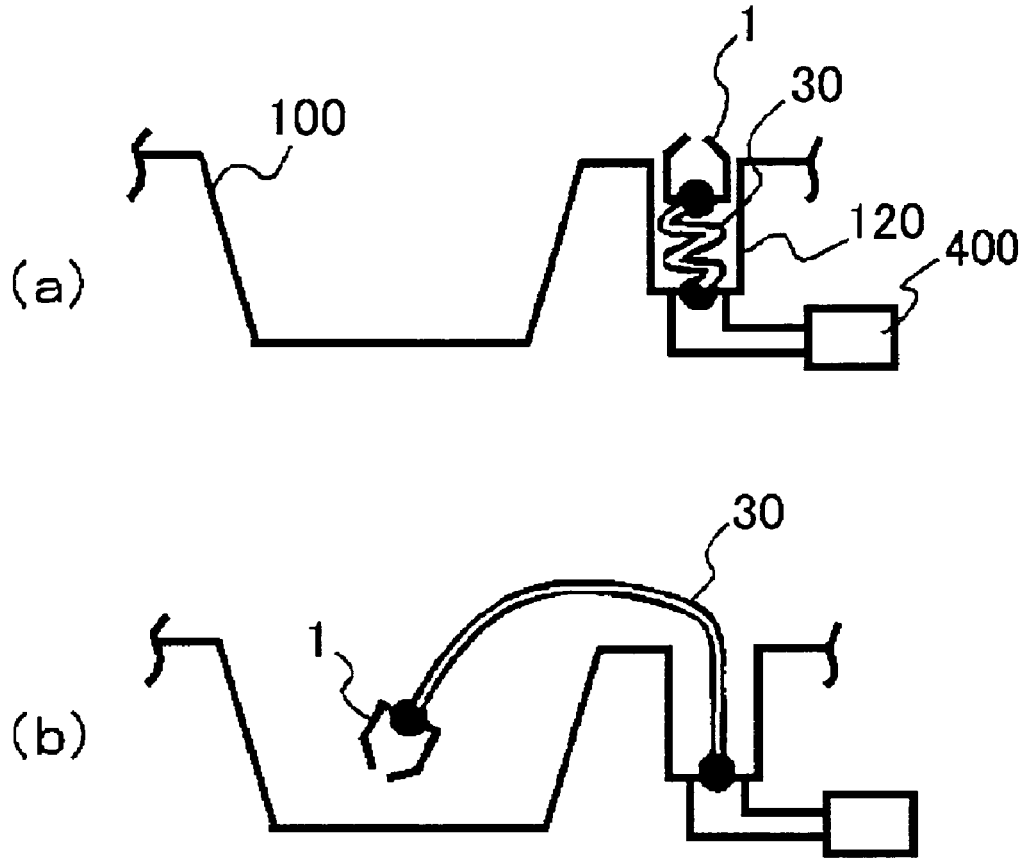
FIG. 113 is a schematic view showing a sixth example of the massage device of present invention.

FIG. 113 is a schematic view showing a sixth example of the massage device. In this drawing, as to the same elements as described above in FIGS. 1 to 112, detailed description by attaching the same numerals is omitted.

Also according to the present example, the nozzle storage section 120 is provided in the rim "apron" section" of the bathtub 100. Thanks to the above installation, the massage nozzle 1 can be easily removed. In addition, it is unlikely that the massage nozzle 1 becomes an obstacle while taking bath in the bathtub 100.

In addition, according to the present example, connecting the nozzle storage section 120 to the massage nozzle 1 enables the user to treat the massage nozzle 1 freely. In addition, it is unnecessary to provide the water-supply means 50 and water piping 60 for circulation as described in FIG. 110, enabling the configuration of the massage device to be simplified and to be provided at lower cost. As described above in the first embodiment, providing the water-spray plate 12 enables spouted water bundled in a shower-like manner in an opened status to be formed. Accordingly, during suction massage in the hot water of the bathtub 100, even if letting the massage nozzle 1 expose to the atmosphere carelessly, spouted water does not splash in all directions, but enabling an effective suction massage by eliminating uncomfortable feeling. In addition, the massage nozzle 1 can be used as a general showerhead, enabling the user to use it very conveniently.

In addition, as described above in the second embodiment, providing the movable member 20 causes the movable member 20 to perform the "precession movement" and the similar movements in an eccentric manner, providing a shaking-like vibration to the site on the person's skin subject to treatment in addition to the suction effect. As a result, a further effective massage can be provided to enhance various bioeffects such as beautification, blood circulation and the like.

Figure 114:
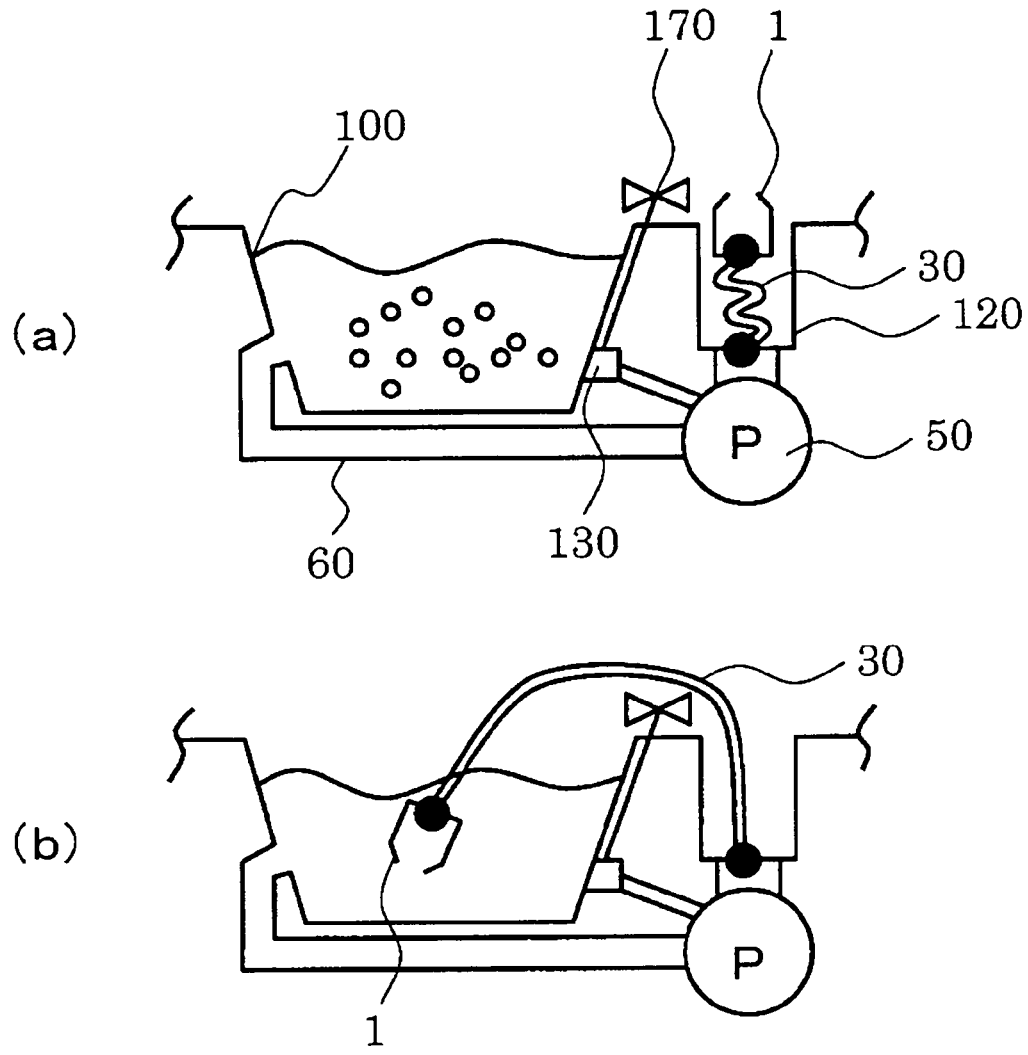
FIG. 114 is a schematic view showing a seventh example of the massage device of present invention.

FIG. 112 is a schematic view showing a seventh example of the massage device. In this drawing, as to the same elements as described above in FIGS. 1 to 113, detailed description by attaching the same numerals is omitted. According to the present example, a blow flow exhaust port 130 is provided in the bathtub 100. The blow flow exhaust port 130 is connected to the air-intake opening/closing cock 170 and injects a blow flow in the bathtub by supplying the effect of the water-supply means 50. As a result, as shown in FIG. 114(*a*), blow bath can be performed.

In addition, according to the present example, in the same manner as the fifth example, the nozzle storage section 120 is provided in the rim of the bathtub 100, so-called "apron" section. As shown in FIG. 114(*b*), a user can remove the massage nozzle 1 to perform suction massage. Employing the configuration as described above enables the user to perform the blow bath and suction massage at the same time within the capacity range of the water-supply means 50 to increase the conformability. In addition, changing over the water supply to the blow flow exhaust port 130 and the massage nozzle 1 can switch the blow bath and suction massage arbitrarily by the user's desire.

As described above in the first embodiment, providing the water-spray plate 12 enables spouted water bundled in a shower-like manner in an opened status to be formed. Accordingly, during suction massage in the hot water of the bathtub 100, even if letting the massage nozzle 1 expose to the atmosphere carelessly, spouted water does not splash in all directions, but enabling an effective suction massage by eliminating uncomfortable feeling. In addition, the massage nozzle 1 can be used as a general showerhead, enabling the user to use it very conveniently.

In addition, as described above in the second embodiment, providing the movable member 20 causes the movable member 20 to perform the "precession movement" and the similar movements in an eccentric manner, providing a shaking-like vibration to the site on the person's skin subject to treatment in addition to the suction effect. As a result, a further effective massage can be provided to enhance various bioeffects such as beautification, blood circulation and the like.

The embodiments of the present invention are described above while referring to the specific examples. However, the present embodiment is not limited to these specific examples.

That is, even if a design change is added to either element which includes the massage nozzle and massage device of one or more aspects of the present invention by a person with an ordinary skill in the art, if a device has the gist of the present invention, it is included in the present invention.

For example, regarding the appearance of the massage nozzle, a number of water-spray holes on the water-spray plate or shape or position, rate of size to the spouting port or position relationship of the water entry section, if the above configurations can provide a vortical flow and as a result, they are within the range where a negative pressure is produced, they are included in the present invention.

FIELD OF INDUSTRIAL APPLICATION

As described above in detail, according to the present invention, even if using the device in an open environment, suction with a large area can be performed without splashing in all directions, even if moving the device with it applied to the skin. Further, the device can be moved smoothly. Furthermore, it is possible to provide a massage nozzle which can be used also as a normal showerhead or a massage device using this massage nozzle.

In addition, according to the present invention, it is possible to provide a massage nozzle and a massage device using this massage nozzle to synergistically generate a massage effect due to physical vibration in addition to a suction effect.

What is claimed is:

1. A massage nozzle comprising:

a vortex chamber having a water intake section provided to form a vortical flow therein and a spouting port provided to spout the vortical flow to form a negative pressure region; and a water-spray plate provided at a distal end of the spouting port, the water-spray plate having an opening at a center thereof and a plurality of water-spray holes around the opening, wherein the vortical flow reaching the water-spray plate is spouted forward from the water-spray holes, wherein a movable member is movably provided in the vortex chamber, the movable member comprising a stopper in a semi-discoid-shaped shape having an opening at a center and a ring section in a semi-cylindrical shape protruding from the circumference of the opening substantially vertically with respect to the stopper.

2. A massage nozzle according to claim 1, wherein the water-spray plate further has a circumferential protrusion section protruding from the circumference of the opening of the water-spray plate to the vortex chamber.

3. A massage nozzle comprising:

a vortex chamber having a water intake section provided to form a vortical flow therein and a spouting port provided to spout the vortical flow to form a negative pressure region;

a guide section having a semi-cylindrical shape and located externally with respect to the spouting port; and a water-spray plate provided at a distal end of the guide section, the water-spray plate having an opening at a center thereof and a plurality of water-spray holes around the opening, wherein the vortical flow reaching the water-spray plate is spouted forward from the water-spray holes, wherein a movable member is movably provided in the guide section, the movable member comprising a stopper in a semi-discoid-shaped shape having an opening at a center and a ring section in a semi-cylindrical shape protruding from the circumference of the opening substantially vertically with respect to the stopper.

4. A massage nozzle according to claim 3, wherein the opening is larger than the spouting port.

5. A massage nozzle according to claim 3, which further comprises a baffle plate provided at a plane of the water-spray plate opposite to the spouting port or at an inner circumference wall of the guide section.

6. A massage nozzle according to claim 3, wherein the guide section is formed to protrude such that a distance to the water-spray plate with respect to the spouting port is not less than L1 times tan θ where L1 represents a half of a difference between diameters of the spouting port and the opening and θ represents an angle at which spouted water from the spouting port flows with a plane including the spouting port.

7. A massage nozzle according to claim 3, wherein the guide section is formed to protrude such that a distance to the stopper with respect to the spouting port in an open spouting condition is not less than L1 times tan θ where L2 represents a half of a difference between diameters of the spouting port and the opening of the stopper, and θ represents an angle at which spouted water from the spouting port flows with a plane including the spouting port.

8. A massage nozzle according to claim 3, wherein a maximum outside dimension of the stopper is larger than the opening of the water-spray plate.

9. A massage nozzle according to claim 3, wherein the ring section is provided to be able to protrude from the opening of the water-spray plate.

10. A massage nozzle comprising:

a vortex chamber having a water intake section provided to form vortical flow therein and a spouting port provided to spout the vortical flow to form a negative pressure region; and a movable member having an opening, at least some part of which is inserted into the vortex chamber, the opening being provided to effect the negative pressure region externally, the at least some part including a first portion which has a larger outside dimension than the spouting port, the moveable member being moved by effect due to the vortical flow.

11. A massage nozzle according to claim 10, wherein the movable member has a section externally protruding from the spouting port in a condition that the first portion abuts on an inner wall of the vortex chamber in the vicinity of the spouting port.

12. A massage nozzle according to claim 11, the section externally protruding has a second portion which has a larger outside dimension than the spouting port.

13. A massage nozzle according to claim 10, wherein the movable member has a ring section having the opening inside and having a semi-cylindrical shape, and a stopper protruding from an outer circumferential wall of the ring section.

14. A massage nozzle comprising:

a vortex chamber having a water intake section provided to form vortical flow therein and a spouting port provided to spout the vortical flow to form a negative pressure region;

a guide section in a semi-cylindrical shape externally with respect to the spouting port and having an inner diameter larger than that of the spouting port;

a protrusion section protruding from an inner wall of the guide section toward a rotation axis of the vortical flow; and a movable member having an opening, at least some part of which is inserted into the guide section, the opening being provided to effect the negative pressure region externally, the at least some part having a stopper capable of abutting on the protrusion section, the moveable member being moved by effect due to the vortical flow.

15. A massage nozzle according to claim 14, wherein the protrusion section is formed in a substantially annular fashion and having a plurality of water-spray holes, and a central axis of the movable member is inclinable to a central axis of the vortex chamber.

16. A massage nozzle according to claim 14, wherein the movable member has a section protruding outside the guide section in the condition that the stopper abuts on the protrusion section.

17. A massage nozzle comprising:

a vortex chamber having a water intake section provided to form a vortical flow therein and a spouting port provided to spout the vortical flow to form a negative pressure region;

a plurality of protrusions provided around the spouting port and protruding from the spouting port;

a protrusion section protruding from each of the protrusions toward a rotation axis of the vortical flow; and a movable member having an opening, at least some part of the movable member being inserted into between the plurality of protrusions and the spouting port, the opening being provided to effect the negative pressure region externally, the at least some part having a stopper capable of abutting on the protrusion section.

18. A massage nozzle according to claim 17, wherein the movable member has a section protruding further with respect to a plurality of the protrusions in a condition that the stopper abuts on the protrusion section.

19. A massage device comprising:

a water supply means; and a massage nozzle according to claim 1, wherein water is supplied from the water supply means to the vortex chamber through the water intake section so that a suction massage can be practiced by a user utilizing a negative pressure region formed in the spouting port of the massage nozzle.

* * * * *